US009546442B2

(12) United States Patent
Underly et al.

(10) Patent No.: US 9,546,442 B2
(45) **Date of Patent: *Jan. 17, 2017**

(54) MODULAR LAUNDRY SYSTEM AND LAUNDRY MODULE

(71) Applicant: WHIRLPOOL CORPORATION, Benton Harbor, MI (US)

(72) Inventors: Kristina K. Underly, Berrien Springs, MI (US); Donald M. Tomasi, Stevensville, MI (US); Daniel C. Conrad, Newburgh, IN (US); Richard A. Sunshine, Granger, IN (US); James W. Kendall, Mt. Prospect, IL (US); Ameresh B. Viswanathan, Saint Joseph, MI (US); Lorraine L. Achterberg, Saint Joseph, MI (US); Colleen M. Doyle, Ann Arbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/725,261

(22) Filed: May 29, 2015

(65) Prior Publication Data

US 2015/0259844 A1 Sep. 17, 2015

Related U.S. Application Data

(63) Continuation of application No. 12/497,034, filed on Jul. 2, 2009, now Pat. No. 9,187,855, which is a (Continued)

(51) Int. Cl.

| | |
|---|---|
| ***D06F 37/00*** | (2006.01) |
| ***D06F 29/00*** | (2006.01) |
| ***D06F 39/12*** | (2006.01) |
| ***D06F 29/02*** | (2006.01) |
| ***D06F 39/00*** | (2006.01) |

(52) U.S. Cl.

CPC ..... *D06F 29/00* (2013.01); *D06F 29/005* (2013.01); *D06F 29/02* (2013.01); *D06F 39/005* (2013.01); *D06F 39/12* (2013.01); *D06F 39/125* (2013.01)

(58) Field of Classification Search

CPC ..... D06F 29/00

See application file for complete search history.

(56) References Cited

U.S. PATENT DOCUMENTS

| | | | |
|---|---|---|---|
| D88,281 | S | 3/1869 | Montigny |
| 315,725 | A | 4/1885 | Caughy |

(Continued)

FOREIGN PATENT DOCUMENTS

| | | |
|---|---|---|
| BE | 1013066 | 8/2001 |
| CA | 2330236 | 11/2001 |

(Continued)

OTHER PUBLICATIONS

NPL: Better Lifestyle Products; Rolling Mobile Laundry Ironing Center; Jul. 28, 2005; http://www.betterlifestyleproducts.com/mobile-laundry-center.html.

(Continued)

*Primary Examiner* — Jason Ko

(57) ABSTRACT

A laundry module performs a washing function to wash laundry and has a height that is less than the height of a laundry appliance. The laundry module can be part of a modular laundry system including the laundry appliance. The laundry module can be vertically arranged with the laundry appliance, such as by supporting the laundry appliance thereupon.

26 Claims, 132 Drawing Sheets

Related U.S. Application Data continuation of application No. 11/323,220, filed on Dec. 30, 2005, now abandoned, and a continuation-in-part of application No. 11/323,221, filed on Dec. 30, 2005, now Pat. No. 7,624,600, which is a continuation-in-part of application No. 10/971,671, filed on Oct. 22, 2004, now Pat. No. 7,513,132, application No. 14/725,261, which is a continuation of application No. 12/489,710, filed on Jun. 23, 2009, which is a continuation of application No. 11/322,740, filed on Dec. 30, 2005, now abandoned, and a continuation of application No. 11/323,221, which is a continuation-in-part of application No. 10/971,671, said application No. 12/489,710 is a continuation of application No. 11/323,125, filed on Dec. 30, 2005, now Pat. No. 7,628,043, which is a continuation-in-part of application No. 10/971,671.

(56) References Cited

U.S. PATENT DOCUMENTS 380,949 A 4/1888 Shannon
496,655 A 5/1893 Hilton
502,237 A 7/1893 Proctor
602,494 A 4/1898 Briggs
699,922 A 5/1902 Hyson et al.
707,409 A 8/1902 Guitar
870,805 A 11/1907 Trager
900,347 A 10/1908 Berry
916,849 A 3/1909 Darrow
970,174 A 9/1910 Booton
1,000,933 A 8/1911 North
1,078,882 A 11/1913 Scott
1,203,752 A 11/1916 Le Claire
1,255,399 A 2/1918 Ferren
1,278,072 A 9/1918 Dssry
1,317,829 A 10/1919 Shroyer
1,369,933 A 3/1921 Nelson
1,482,742 A 2/1924 Gilchrist
1,485,991 A 3/1924 Mulley
1,532,973 A 4/1925 Adelson
1,590,390 A 6/1926 Miller
1,665,118 A 4/1928 Thompson et al.
1,691,042 A 11/1928 Bell
1,720,165 A 7/1929 Bloom et a1.
1,728,458 A 9/1929 Verduce
1,752,797 A 4/1930 Hutchinson, Jr.
1,767,157 A 6/1930 Steele
1,900,793 A 11/1931 Broughton
1,994,044 A 3/1935 Michelet
2,060,065 A 11/1936 Gill et al.
2,102,449 A 12/1937 Zimmerman
2,140,961 A 12/1938 Lendle
2,287,646 A 12/1938 Steele
D113,031 S 1/1939 Baer et al.
2,202,811 A 6/1940 Carney et al.
2,230,793 A 2/1941 Borah
2,256,425 A 9/1941 Damiano
2,279,984 A 4/1942 Goodwin
2,284,572 A 5/1942 Holder
D132,963 S 7/1942 Salomon
2,295,378 A 9/1942 Barnsteiner
2,295,718 A 9/1942 Dahlberg
2,312,220 A 2/1943 Snyder
2,326,062 A 8/1943 Parker
2,339,495 A 1/1944 McMann
2,346,133 A 4/1944 Hayes
2,355,835 A 8/1944 Whalen
2,369,366 A 2/1945 O'Neill
2,402,477 A 6/1946 Williams
2,412,270 A 12/1946 Johnston
2,419,319 A 4/1947 Lankton
2,422,825 A 6/1947 Davis, Jr.
2,434,404 A 1/1948 Goodwin
2,434,886 A 1/1948 Pugh
2,624,137 A 1/1948 Gysin
2,435,439 A 2/1948 Goodwin et al.
2,447,480 A 8/1948 Stubbs
2,463,218 A 3/1949 Travis
2,475,106 A 7/1949 Mohr et al.
2,478,531 A 8/1949 Harris et al.
2,482,412 A 9/1949 Gershon
2,486,058 A 10/1949 Patterson et al.
2,499,078 A 2/1950 Shaw
2,641,072 A 2/1950 Maher
2,499,455 A 3/1950 Brochu
2,526,030 A 10/1950 Kagan
2,543,579 A 2/1951 Kauffmann, II
2,547,238 A 4/1951 Tremblay
2,547,382 A 4/1951 Freeman
2,548,437 A 4/1951 Mantagas
2,556,943 A 6/1951 Reisman
2,566,488 A 9/1951 Gould
2,570,529 A 10/1951 Dolan
2,576,067 A 11/1951 Chandler
2,587,111 A 2/1952 Cashen, Jr.
2,602,315 A 7/1952 Shoop et al.
2,637,192 A 5/1953 Richterkessing
2,645,863 A 7/1953 Morrison
2,650,442 A 9/1953 Johnson
D170,556 S 10/1953 Sterling
2,654,386 A 10/1953 Woking
2,657,566 A 11/1953 Richterkessing
2,664,646 A 1/1954 Boumer
2,665,183 A 1/1954 Battles
2,668,091 A 2/1954 Clark
2,687,566 A 8/1954 Hall
2,707,837 A 5/1955 Robinson et al.
2,707,874 A 5/1955 Glover, Jr.
2,719,422 A 10/1955 Golden
2,728,481 A 12/1955 Robinson et al.
2,731,316 A 1/1956 Cohen
2,732,700 A 1/1956 Dunn
2,737,573 A 3/1956 Olthuis
2,742,708 A 4/1956 McCormick
2,742,710 A 4/1956 Richterkessing
2,758,387 A 8/1956 Stann
2,759,277 A 8/1956 Malnick
2,813,534 A 11/1956 Low
2,773,373 A 12/1956 Corson
2,919,340 A 12/1956 Jacobs
D179,475 S 1/1957 Emile et al.
2,778,705 A 1/1957 Barker
2,786,730 A 3/1957 Thurston
2,787,849 A 4/1957 Lacey
2,903,711 A 4/1957 Kesling
2,799,948 A 7/1957 Morrison
2,807,503 A 9/1957 Buterbaugh
2,813,353 A 11/1957 McMillan
2,817,157 A 12/1957 McCormick
2,817,501 A 12/1957 Schubert
2,843,945 A 7/1958 Whyte
2,861,355 A 11/1958 Douglas
3,001,844 A 5/1959 Spring
2,893,807 A 7/1959 Earle
2,895,618 A 7/1959 Nathan
2,895,782 A 7/1959 Fragale
2,933,360 A 4/1960 Sitler
2,960,780 A 11/1960 Stilwell, Jr.
2,967,670 A 1/1961 McRoberts
2,979,932 A 4/1961 Hughes
2,983,050 A 5/1961 Alaback
2,985,967 A 5/1961 Pataillot et al.
3,000,108 A 9/1961 Jones et al.
3,022,589 A 2/1962 Kleinman
3,026,699 A 3/1962 Rhodes
3,030,792 A 4/1962 Bader
3,031,871 A 5/1962 Bailey
3,059,632 A 10/1962 Rogers
3,059,653 A 10/1962 Ingolia
3,061,942 A 11/1962 Scofield
3,086,657 A 4/1963 Myers et al.
D195,518 S 6/1963 Bullock et al.

3,170,417 A 2/1965 Avidiya
3,173,730 A 3/1965 Collins
3,197,886 A 8/1965 Brameh
3,209,560 A 10/1965 Shelton
3,220,230 A 11/1965 Jacobs et al.
3,220,790 A 11/1965 White
3,230,961 A 1/1966 Benkert et al.
3,245,161 A 4/1966 Adiletta et al.
3,256,616 A 6/1966 McGoldrick
3,316,659 A 5/1967 Lauck
3,320,780 A 5/1967 Frahm
3,331,226 A 7/1967 Fink
3,344,532 A 10/1967 Bigler
3,356,841 A 12/1967 Horan
3,399,783 A 9/1968 Injeski
3,402,477 A 9/1968 Hubbard
3,406,645 A 10/1968 Monroe
3,417,481 A 12/1968 Rumsey, Jr.
3,418,665 A 12/1968 Long
3,427,831 A 2/1969 Frauendorf
3,432,939 A 3/1969 Eichholz
3,469,603 A 9/1969 Nagel
3,490,254 A 1/1970 Mason
3,500,666 A 3/1970 Leslie
3,506,321 A 4/1970 Hampel
3,512,379 A 5/1970 Buckley et al.
3,513,786 A 5/1970 Kellogg
3,522,817 A 8/1970 Raymond
3,527,352 A 9/1970 Lapa
3,537,110 A 11/1970 Horie
3,550,284 A 12/1970 Lambert
3,555,701 A 1/1971 Hubbard
3,559,427 A 2/1971 Baker
3,563,624 A 2/1971 Stice
3,579,851 A 5/1971 Elmy
3,606,506 A 9/1971 Ungaro
3,619,830 A 11/1971 Harris et al.
3,670,425 A 6/1972 Benjamin et al.
3,688,706 A 9/1972 Merryweather
3,717,173 A 2/1973 Nyberg et al.
3,724,095 A 4/1973 Laue et al.
3,739,496 A 6/1973 Buckley et al.
3,743,372 A 7/1973 Ruggerone
3,744,402 A 7/1973 Piegza et al.
3,744,435 A 7/1973 Tracy et al.
3,745,676 A 7/1973 Dikoff
3,764,793 A 10/1973 Binzer
3,774,742 A 11/1973 Magnanelli
3,793,744 A 2/1974 Saita
3,811,198 A 5/1974 Baltes
3,840,998 A 10/1974 Marcussen
3,866,336 A 2/1975 Bereza
3,926,315 A 12/1975 Bernard
3,958,586 A 5/1976 Schnelle
3,981,404 A 9/1976 Goeke
3,983,583 A 10/1976 Herman et al.
4,002,383 A 1/1977 Holloway, Jr.
4,086,709 A 5/1978 Jackson
4,091,155 A 5/1978 Behr
4,094,414 A 6/1978 Thiot et al.
4,109,397 A 8/1978 Daily
4,120,180 A 10/1978 Jedora
D251,165 S 2/1979 Moody
4,171,545 A 10/1979 Kann
4,180,919 A 1/1980 Baltes
4,221,441 A 9/1980 Bain
4,242,197 A 12/1980 Voelskow et al.
4,243,197 A 1/1981 Wright
D258,293 S 2/1981 Macowski
4,254,873 A 3/1981 Cook, III et al.
4,262,605 A 4/1981 Sokol
4,510,778 A 4/1985 Cotton
4,557,058 A 12/1985 Ozawa et al.
D283,474 S 4/1986 Appel
4,602,446 A 7/1986 Guion
4,617,743 A 10/1986 Barnard
4,621,003 A 11/1986 O'Kane
D286,958 S 12/1986 Gualtieri
4,625,432 A 12/1986 Baltes
4,637,321 A 1/1987 Hasler et al.
4,653,200 A 3/1987 Werner
4,663,538 A 5/1987 Cotton et al.
4,682,424 A 7/1987 Irving
4,713,949 A 12/1987 Wilcox
4,723,583 A 2/1988 Lowe et al.
4,734,826 A 3/1988 Wilson et al.
4,760,929 A 8/1988 Fedorchak
4,799,743 A 1/1989 Kikuchi et al.
4,819,341 A 4/1989 Gayso
4,856,206 A 8/1989 Klein
4,857,703 A 8/1989 Wilkins
4,863,222 A 9/1989 Posso
4,894,935 A 1/1990 Kretz
D306,240 S 2/1990 Newhouse
4,901,871 A 2/1990 Ohm et al.
4,908,957 A 3/1990 Acosta, Sr. et al.
4,919,368 A 4/1990 Garrett
4,926,514 A 5/1990 Leuenberger
4,980,981 A 1/1991 Naidoo
4,995,681 A 2/1991 Parnell
D315,068 S 3/1991 Miller
5,018,628 A 5/1991 Schenck et al.
5,019,126 A 5/1991 Post
5,046,844 A 9/1991 Milton
5,058,403 A 10/1991 Barnes
5,062,219 A 11/1991 Harris et al.
5,121,698 A 6/1992 Kelley
D328,171 S 7/1992 Hikawa
5,136,792 A 8/1992 Janecke
5,147,090 A 9/1992 Mandell et al.
5,152,077 A 10/1992 Liang
D331,257 S 11/1992 Breen et al.
5,165,181 A 11/1992 Acosta, Sr. et al.
5,181,685 A 1/1993 Ostapowicz
5,203,044 A 4/1993 Jung, Jr.
D336,706 S 6/1993 Lechman et al.
5,241,766 A 9/1993 Walz et al.
5,253,378 A 10/1993 Jung, Jr.
5,253,493 A 10/1993 Ohashi
5,253,932 A 10/1993 Nesovic
5,279,047 A 1/1994 Janecke
5,290,998 A 3/1994 Couch et al.
5,294,009 A 3/1994 Maurer et al.
5,301,376 A 4/1994 Herbert
5,305,484 A 4/1994 Fitzpatrick et al.
5,315,726 A 5/1994 Borenstein
5,315,773 A 5/1994 Iwami et al.
5,331,945 A 7/1994 Somerton
5,337,905 A 8/1994 Gast
D350,646 S 9/1994 Bescher et al.
5,369,892 A 12/1994 Dhaemers
5,381,574 A 1/1995 VonPless
5,402,657 A 4/1995 Henry, Jr.
5,411,164 A 5/1995 Smith et al.
5,452,531 A 9/1995 Graville et al.
5,461,887 A 10/1995 VonPless
5,466,058 A 11/1995 Chan
D365,224 S 12/1995 Pohlman
5,486,041 A 1/1996 Sykes
5,518,309 A 5/1996 St-Pierre
5,528,912 A 6/1996 Weber
5,546,678 A 8/1996 Dhaemers
5,555,640 A 9/1996 Ou
D374,954 S 10/1996 Katz et al.
5,568,691 A 10/1996 Rubin
5,570,598 A 11/1996 Haven
5,595,427 A 1/1997 Peters et al.
5,609,047 A 3/1997 Hellman, Jr. et al.
5,653,221 A 8/1997 Luken et al.
5,664,339 A 9/1997 Swanson et al.
5,666,743 A 9/1997 Dawson
5,702,010 A 12/1997 Liang
5,706,678 A 1/1998 Sasaki
5,733,022 A 3/1998 Whetstone
5,743,025 A 4/1998 Jordan, Jr.
5,755,040 A 5/1998 Ou
D395,639 S 6/1998 Ham et al.
5,778,573 A 7/1998 Nottingham et al.

5,787,615 A 8/1998 Hensel et al.
D398,906 S 9/1998 Fynn et al.
5,806,207 A 9/1998 Merrigan
5,815,961 A 10/1998 Estes et al.
5,836,486 A 11/1998 Ohsugi
D401,782 S 12/1998 Mitchell
5,848,828 A 12/1998 MacLellan
5,858,521 A 1/1999 Okuda et al.
5,900,258 A 5/1999 Engler
D410,351 S 6/1999 Magnusson et al.
5,951,127 A 9/1999 Smith
5,957,557 A 9/1999 Langer et al.
5,967,342 A 10/1999 Steffine
5,974,980 A 11/1999 Kent
5,983,808 A 11/1999 Weil
5,987,773 A 11/1999 Lipscy
D417,701 S 12/1999 Jack
5,996,983 A 12/1999 Laurenzi
6,000,158 A 12/1999 Zoellner
6,016,610 A 1/2000 Sears
6,036,150 A 3/2000 Lehrman
6,082,841 A 7/2000 Smith et al.
6,101,741 A 8/2000 Sears
D431,130 S 9/2000 Thompson et al.
D431,934 S 10/2000 Chininis
6,131,929 A 10/2000 Haley
6,134,806 A 10/2000 Dhaemers
6,135,583 A 10/2000 Simon et al.
6,138,979 A 10/2000 Morman
D433,248 S 11/2000 Hellwig et al.
6,151,795 A 11/2000 Hoffman et al.
D435,741 S 1/2001 Schlereth
D436,952 S 1/2001 Goto
D438,047 S 2/2001 Chavez
6,189,346 B1 2/2001 Chen et al.
6,189,551 B1 2/2001 Sargeant et al.
6,219,876 B1 4/2001 Blum
6,253,472 B1 7/2001 Gast
6,263,591 B1 7/2001 La Porte
6,263,708 B1 7/2001 Yarmosky
6,263,869 B1 7/2001 Abernethy
6,267,462 B1 7/2001 Krause et al.
D446,891 S 8/2001 Kim
6,279,876 B1 8/2001 Massie
6,311,945 B1 11/2001 D'Angelo
6,334,340 B1 1/2002 Kegler et al.
6,352,038 B1 3/2002 Nelson et al.
6,353,954 B1 3/2002 Dunsbergen et al.
6,374,644 B1 4/2002 Rhode et al.
6,375,686 B1 4/2002 Kim
D457,749 S 5/2002 Doane
D457,991 S 5/2002 Baldwin et al.
D457,992 S 5/2002 Baldwin et al.
6,384,380 B1 5/2002 Faries, Jr. et al.
6,386,378 B1 5/2002 Scharing
6,397,502 B1 6/2002 Chen
D459,844 S 7/2002 Baldwin et al.
6,427,259 B1 8/2002 Cawthon
D463,631 S 9/2002 Baldwin et al.
6,448,306 B1 9/2002 Lever et al.
D465,308 S 11/2002 Resuello et al.
6,475,594 B2 11/2002 Johnston et al.
6,482,242 B2 11/2002 Yarmosky
6,484,645 B2 11/2002 Allen
6,502,570 B2 1/2003 Grady
6,510,280 B1 1/2003 Chen
D474,566 S 5/2003 Baldwin et al.
6,572,208 B2 6/2003 Albaizar et al.
6,585,225 B1 7/2003 Lake
6,588,238 B1 7/2003 Reason
6,604,473 B2 8/2003 Felsenthal
6,611,972 B2 9/2003 Underbrink et al.
6,618,887 B2 9/2003 Kim et al.
D489,496 S 5/2004 Sneddon
6,732,552 B2 5/2004 Kim et al.
D492,073 S 6/2004 Sneddon
6,745,496 B2 6/2004 Cassella
D492,507 S 7/2004 Moon et al.
D495,453 S 8/2004 Baldwin et al.
6,793,991 B2 9/2004 Thuma et al.
6,796,055 B2 9/2004 Baltes
D497,162 S 10/2004 Neal et al.
6,845,569 B1 1/2005 Kim
6,846,871 B2 1/2005 Patel et al.
D501,615 S 2/2005 Chen
D502,577 S 3/2005 Baldwin et al.
6,860,032 B2 3/2005 Meyer
6,866,336 B2 3/2005 De Gaillard
6,868,621 B1 3/2005 Grimm et al.
D504,038 S 4/2005 Perella et al.
6,883,257 B2 4/2005 Couch et al.
6,886,371 B2 5/2005 Arai et al.
6,886,373 B2 5/2005 Carrubba et al.
6,889,399 B2 5/2005 Steiner et al.
6,889,449 B2 5/2005 Silver
D506,090 S 6/2005 Ben-Or
6,910,292 B2 6/2005 Prows
D508,346 S 8/2005 Petruccelli
D519,692 S 4/2006 Jun
7,036,243 B2 5/2006 Doh et al.
7,062,871 B1 6/2006 Smidt
7,065,904 B2 6/2006 Lee et al.
D524,079 S 7/2006 Grosfillex
D526,453 S 8/2006 Jun
7,100,316 B2 9/2006 Obileye
D532,455 S 11/2006 Beardslee
D534,215 S 12/2006 Nakata
7,171,761 B1 2/2007 Hunts
7,191,546 B2 3/2007 Maruca
7,207,197 B2 4/2007 North
D541,563 S 5/2007 LaBonia, Jr. et al.
7,213,792 B2 5/2007 Choi
7,251,905 B2 8/2007 Doh et al.
7,313,932 B2 1/2008 Ryohke et al.
7,513,132 B2 4/2009 Wright et al.
2002/0017117 A1 2/2002 Sunshine et al.
2002/0043604 A1 4/2002 Cooper et al.
2002/0056163 A1 5/2002 Estes et al.
2002/0137631 A1 9/2002 Falder et al.
2003/0019798 A1 1/2003 Capps et al.
2003/0062810 A1 4/2003 Westwinkel
2003/0074105 A1 4/2003 Capps et al.
2003/0196460 A1 10/2003 Lyu et al.
2003/0222085 A1 12/2003 Kaczmarek
2004/0022405 A1 2/2004 Caron et al.
2004/0034924 A1 2/2004 Underbrink et al.
2004/0040084 A1 3/2004 Underbrink et al.
2004/0040476 A1 3/2004 Diers
2004/0134087 A1 7/2004 Meyer
2004/0134237 A1 7/2004 Sunshine et al.
2004/0139555 A1 7/2004 Conrad et al.
2004/0144140 A1 7/2004 Lee
2004/0154194 A1 8/2004 Prows
2004/0160150 A1 8/2004 Hay et al.
2004/0181979 A1 9/2004 Compeau et al.
2004/0182288 A1 9/2004 Goldberg et al.
2004/0194339 A1 10/2004 Johnson et al.
2004/0221411 A1 11/2004 Blum et al.
2004/0221624 A1 11/2004 Fumagalli
2004/0226320 A1 11/2004 Bongini
2004/0245899 A1 12/2004 Cho
2004/0263032 A1 12/2004 Cho
2005/0017605 A1 1/2005 Bauer
2005/0035076 A1 2/2005 Schober et al.
2005/0040070 A1 2/2005 Adams
2005/0040184 A1 2/2005 Noyes et al.
2005/0056059 A1 3/2005 Usherovich et al.
2005/0072194 A1 4/2005 Ryohke et al.
2005/0120585 A1 6/2005 Lee et al.
2005/0120757 A1 6/2005 Jackson
2005/0126035 A1 6/2005 Lee et al.
2005/0132593 A1 6/2005 Doh et al.
2005/0132594 A1 6/2005 Doh et al.
2005/0132604 A1 6/2005 Hong et al.
2005/0155393 A1 7/2005 Wright et al.
2005/0172678 A1* 8/2005 Ki ..... A47B 91/005
68/3 R
2005/0275325 A1 12/2005 Yang

| | | | | |
|---|---|---|---|---|
| 2005/0284867 | A1 | 12/2005 | Sander et al. | |
| 2007/0028479 | A1 | 2/2007 | Hunts | |
| 2007/0051864 | A1 | 3/2007 | Bartell et al. | |
| 2007/0113419 | A1 | 5/2007 | Belgard | |
| 2009/0126421 | A1 | 5/2009 | Kim et al. | |
| 2010/0018259 | A1* | 1/2010 | Jeong | D06F 31/00 68/17 R |
| 2010/0101282 | A1* | 4/2010 | Jeong | D06F 31/00 68/139 |

FOREIGN PATENT DOCUMENTS

| | | | |
|---|---|---|---|
| DE | 662984 | | 7/1938 |
| DE | 945683 | | 7/1956 |
| DE | 2402065 | | 7/1975 |
| DE | 2552697 | A1 | 6/1977 |
| DE | 8033429 | | 5/1982 |
| DE | 3131532 | A1 | 3/1983 |
| DE | 3211316 | | 9/1983 |
| DE | 3213420 | | 10/1983 |
| DE | 3409972 | | 9/1985 |
| DE | 3417481 | | 11/1985 |
| DE | 3904423 | | 8/1990 |
| DE | 9104422 | | 7/1991 |
| DE | 4105112 | | 8/1992 |
| DE | 4228469 | | 5/1993 |
| DE | 9419048 | | 3/1995 |
| DE | 4343488 | A1 | 6/1995 |
| DE | 19514821 | | 11/1995 |
| DE | 29606946 | | 8/1996 |
| DE | 19604370 | | 6/1997 |
| DE | 29704672 | | 7/1997 |
| DE | 19716825 | | 4/1998 |
| DE | 19750946 | | 10/1998 |
| DE | 19832675 | | 1/2000 |
| DE | 19838630 | | 3/2000 |
| DE | 19922647 | | 11/2000 |
| DE | 20101254 | | 4/2001 |
| DE | 10055918 | | 5/2002 |
| DE | 20302572 | | 4/2003 |
| DE | 10223539 | | 12/2003 |
| EP | 0050395 | | 4/1982 |
| EP | 0265704 | | 5/1988 |
| EP | 355701 | | 2/1990 |
| EP | 0362738 | A2 | 4/1990 |
| EP | 0449060 | | 10/1991 |
| EP | 1146161 | | 10/2001 |
| EP | 1175853 | A1 | 1/2002 |
| EP | 1205129 | | 5/2002 |
| EP | 1227182 | | 7/2002 |
| EP | 1288367 | | 3/2003 |
| EP | 1371307 | | 12/2003 |
| EP | 1431442 | | 6/2004 |
| EP | 1444922 | | 8/2004 |
| EP | 1467015 | | 10/2004 |
| EP | 1495697 | | 1/2005 |
| EP | 1731654 | | 12/2006 |
| FR | 1116286 | | 5/1956 |
| FR | 2510881 | | 2/1983 |
| FR | 2595937 | | 9/1987 |
| FR | 2604196 | | 3/1988 |
| FR | 2626016 | | 7/1989 |
| FR | 2646674 | | 11/1990 |
| FR | 2760761 | | 9/1998 |
| GB | 326511 | | 3/1930 |
| GB | 336679 | | 10/1930 |
| GB | 384352 | | 12/1932 |
| GB | 442615 | | 2/1936 |
| GB | 582959 | | 12/1946 |
| GB | 617965 | | 2/1949 |
| GB | 618803 | | 2/1949 |
| GB | 855965 | | 12/1960 |
| GB | 1355656 | | 6/1974 |
| GB | 1399827 | | 7/1975 |
| GB | 2164552 | | 3/1986 |
| GB | 2221970 | | 2/1990 |
| GB | 2297982 | | 8/1996 |
| GB | 2407860 | | 5/2005 |
| JP | 5781381 | A | 5/1982 |
| JP | 64009000 | | 1/1989 |
| JP | 01223998 | | 9/1989 |
| JP | 02307414 | | 12/1990 |
| JP | 03012196 | | 1/1991 |
| JP | 03275099 | | 12/1991 |
| JP | 426455 | | 1/1992 |
| JP | 456484 | U | 5/1992 |
| JP | 04187194 | | 7/1992 |
| JP | 04220210 | | 8/1992 |
| JP | 04220211 | | 8/1992 |
| JP | 04220212 | | 8/1992 |
| JP | 04220213 | | 8/1992 |
| JP | 04220214 | | 8/1992 |
| JP | 04237000 | | 8/1992 |
| JP | 05277298 | | 10/1993 |
| JP | 671100 | | 3/1994 |
| JP | 0691100 | A | 4/1994 |
| JP | 06343794 | | 12/1994 |
| JP | 07116395 | | 5/1995 |
| JP | 07194661 | | 8/1995 |
| JP | 07213792 | | 8/1995 |
| JP | 07227495 | | 8/1995 |
| JP | 08047599 | | 2/1996 |
| JP | 8191998 | | 7/1996 |
| JP | 8192000 | | 7/1996 |
| JP | 08299070 | | 11/1996 |
| JP | 09010492 | | 1/1997 |
| JP | 09149826 | | 6/1997 |
| JP | 10057699 | | 3/1998 |
| JP | 11146995 | | 6/1999 |
| JP | 2000218095 | | 8/2000 |
| JP | 2000225299 | | 8/2000 |
| JP | 2002218093 | | 8/2000 |
| JP | 2001157800 | | 6/2001 |
| JP | 2002000997 | | 1/2002 |
| JP | 2002126395 | | 5/2002 |
| JP | 2002136799 | | 5/2002 |
| JP | 200233693 | | 8/2002 |
| JP | 2002322702 | | 11/2002 |
| JP | 2003019382 | | 1/2003 |
| JP | 2003114611 | | 4/2003 |
| JP | 2003311097 | | 11/2003 |
| KR | 200201898 | | 11/2000 |
| KR | 1020040009401 | | 1/2004 |
| KR | 2005115968 | A | 12/2005 |
| WO | 8803579 | | 5/1988 |
| WO | 9317601 | | 9/1993 |
| WO | 9627309 | | 9/1996 |
| WO | 9629458 | | 9/1996 |
| WO | 9829595 | | 7/1998 |
| WO | 0026463 | | 5/2000 |
| WO | 03035961 | | 5/2003 |
| WO | 2004063452 | | 7/2004 |
| WO | 2004099308 | | 11/2004 |
| WO | 2004109021 | | 12/2004 |
| WO | 2004110214 | | 12/2004 |
| WO | 2005001191 | | 1/2005 |
| WO | 2005045121 | | 5/2005 |
| WO | 2006073885 | | 7/2006 |

OTHER PUBLICATIONS

NPL: Bosch; Bosch Laundry Vertical Stacking Kit with Pull-Out Tray; Jul. 26, 2006; http://www.bosch.appliances.com/customer_care/1492_423.asp.

NPL: Thor Appliance Company; Washing Machine—Apex by Thor; Jul. 26, 2005 http://thorappliances.com/apex/index.php, http://thorappliances.com/apex/images/apexzoom2.jpg, http://thorappliances.com/apex/apexAnatomy.php.

* cited by examiner

MODULAR LAUNDRY SYSTEM AND LAUNDRY MODULE

CROSS-REFERENCE TO RELATED APPLICATIONS

This application is a continuation of U.S. patent application Ser. No. 12/497,034, filed Jul. 2, 2009, now U.S. Pat. No. 9,187,855, issued Nov. 17, 2015, which is a continuation of U.S. patent application Ser. No. 11/323,220, filed Dec. 30, 2005, now abandoned, and a continuation-in-part of U.S. patent application Ser. No. 11/323,221, filed Dec. 30, 2005, now U.S. Pat. No. 7,624,600, issued Dec. 1, 2009, which is a continuation-in-part of U.S. patent application Ser. No. 10/971,671, filed Oct. 22, 2004, now U.S. Pat. No. 7,513,132, issued Apr. 7, 2009, all of which are incorporated herein by reference in their entirety.

This application is also a continuation of U.S. patent application Ser. No. 12/489,710, filed Jun. 23, 2009, which is a continuation of U.S. patent application Ser. No. 11/322,740, filed Dec. 30, 2005, now abandoned, a continuation of U.S. patent application Ser. No. 11/323,125, filed Dec. 30, 2005, now U.S. Pat. No. 7,628,043, issued Dec. 8, 2009, and continuation of U.S. patent application Ser. No. 11/323,221, filed Dec. 30, 2005, now U.S. Pat. No. 7,624,600, issued Dec. 1, 2009, of which U.S. patent application Ser. Nos. 11/323,125 and 11/323,221 are a continuation-in-part of U.S. patent application Ser. No. 10/971,671, filed Oct. 22, 2004, now U.S. Pat. No. 7,513,132, issued Apr. 7, 2009, all of which are incorporated herein by reference in their entirety.

BACKGROUND OF THE INVENTION

Field of the Invention

The invention relates to a laundry module that can be configured to spatially and functionally optimize a household laundry area.

Description of the Related Art

Most homeowners utilize laundry appliances, such as a washer and a dryer, to clean clothing and other fabric items. The laundry appliances are located in a household laundry area that can be a dedicated laundry room, a laundry closet, or part of another room or hallway of the home. A common complaint of homeowners is that the laundry area tends to be an afterthought when the home is designed. Many feel that the laundry area is small, poorly arranged, and inefficient.

Regardless of size, the laundry area is not optimized for performing functions other than the conventional washing and drying done in the washer and dryer, such as flat drying, hang drying, ironing, hand steaming, spot pre-treatment, stain removal, and the like. Laundry areas contain, at most, the washer and dryer and possibly a built-in sink and storage cabinets. This configuration meets the basic needs of doing laundry but neither provides facilities for performing other functions nor optimizes the process of doing laundry. Examples of functional deficiencies of the laundry area follow.

For example, different types of clothing require different care; some items need to be washed in a delicate cycle while others are intended for the normal cycle or the heavy duty cycle. With only the washing machine and the dryer, only one clothes load can be run at a time, and if the cycles for the clothes loads are different, i.e., delicate and heavy duty, then the loads must be washed one after another, thereby lengthening the laundry process.

For example, some clothes need to be hung or laid flat to dry after washing, but there is usually no dedicated space for these items. Consequently, some people hang clothes along the top of doors, on door knobs, on hooks attached to the washer, and in other creative locations. Furthermore, to touch up a wrinkled clothing item, people have to set up the ironing board and the iron, usually outside the laundry room, and then let the iron cool and return the ironing board and the iron to its storage location after ironing. This process is extremely inconvenient and time consuming, especially if only one garment needs to be touched up. In addition, storage is a common shortcoming in laundry areas; detergents, fabric softeners, stain pre-treatment aids, delicate garment bags, and the like are often stored in locations distant from where they are actually used.

Additionally, the laundry area typically does not provide flat surfaces that can be employed for, for example, applying stain pre-treatments, flat drying clothing items, or for folding clothes after they have been dried. Conventional laundry appliances provide a flat surface, but the surface is not particularly suited for some of these tasks. Further, the space between horizontally arranged laundry appliances can be annoying if such tasks are conducted on top of the laundry appliances, and clothing items can fall in the space between the laundry appliances. These examples are only a few of the many deficiencies of the laundry area.

To address some of these problems, a hodgepodge of different gadgets, such as sweater racks, accordion hanging racks, rolling shelves, and rolling laundry carts that store ironing boards and the like, have been made commercially available. However, these solutions are not ideal; some are inconvenient to store when not in use, others are not dimensioned to optimize the space of the laundry area, and all are not aesthetically coherent with the laundry appliances.

SUMMARY OF THE INVENTION

A modular laundry system according to one aspect of the invention includes first and second laundry appliances in a horizontal arrangement, each laundry appliance defining a single width, a first single width horizontal module vertically arranged with the first laundry appliance and having a height less than the first laundry appliance, and a second single width horizontal module vertically arranged with the second laundry appliance and having a height less than the second laundry appliance, wherein at least one of the first and second single width horizontal modules comprises a functional element that performs a washing function to wash laundry, and the laundry appliances and the horizontal modules are arranged in contiguous relationship to form a coherent modular system.

A horizontal laundry module according to another aspect of the invention includes a cabinet capable of supporting a washing machine thereupon and having an open face, the cabinet having a width and a height which is less than the width and less than a standard washing machine height, a drawer slidably mounted to the cabinet for movement between an opened and closed position relative to the open face, an imperforate tub provided within the drawer, and a wash chamber provided within the imperforate tub.

BRIEF DESCRIPTION OF THE DRAWINGS

In the drawings:

FIG. 83B is a schematic view illustrating construction of a customized configuration D formed from the core configuration B of FIG. 75.

FIG. 84A is a schematic view illustrating construction of a customized configuration E formed from the core configuration C of FIG. 77A.

FIG. 84B is a schematic view illustrating construction of a customized configuration F formed from the core configuration D of FIG. 77B.

FIG. 84C is a schematic view illustrating construction of a customized configuration G formed from the core configuration E of FIG. 77C.

FIG. 85A is a schematic view illustrating construction of a customized configuration H formed from the core configuration F of FIG. 12A.

FIG. 85B is a schematic view illustrating construction of a customized configuration I formed from the core configuration G of FIG. 12B.

FIG. 85C is a schematic view illustrating construction of a customized configuration J formed from the core configuration H of FIG. 78C.

FIG. 85D is a schematic view illustrating construction of a customized configuration K formed from the core configuration I of FIG. 78D.

FIG. 86A is a schematic view illustrating construction of a customized configuration L formed from the core configuration J of FIG. 79A.

FIG. 86B is a schematic view illustrating construction of a customized configuration M formed from the core configuration K of FIG. 79B.

FIG. 87A is a schematic view illustrating construction of a customized configuration N formed from the core configuration L of FIG. 80A.

FIG. 87B is a schematic view illustrating construction of a customized configuration O formed from the core configuration M of FIG. 80B.

Figure 80A:
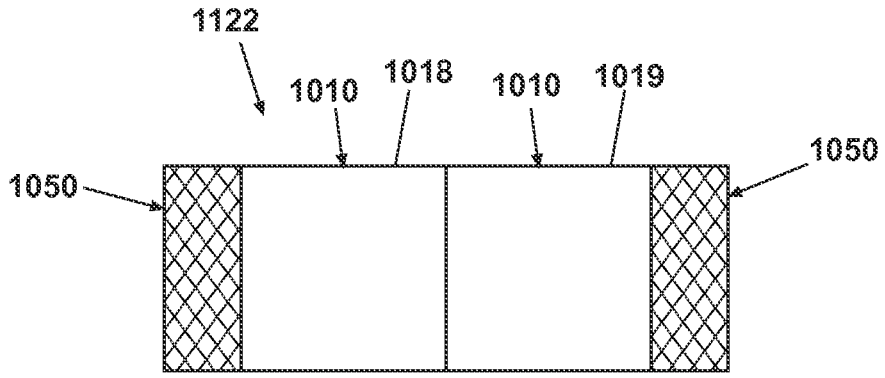
FIG. 80A is a schematic view of a core configuration L formed by two of the laundry appliances of FIG. 67A in a horizontal arrangement and two of the single height vertical modules of FIG. 69A positioned adjacent to the laundry appliances.
Figure 80B:
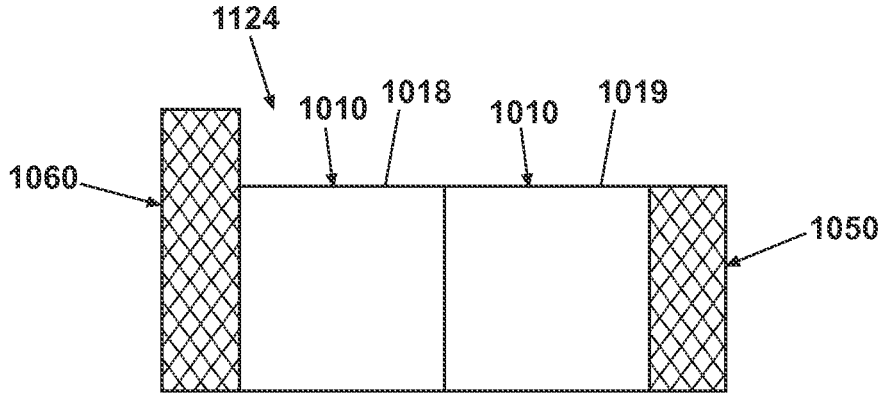
FIG. 80B is a schematic view of a core configuration M formed by two of the laundry appliances of FIG. 67A in a horizontal arrangement and one each of the single height vertical module of FIG. 69A and the intermediate height vertical module of FIG. 69C positioned adjacent to the laundry appliances.
Figure 80C:
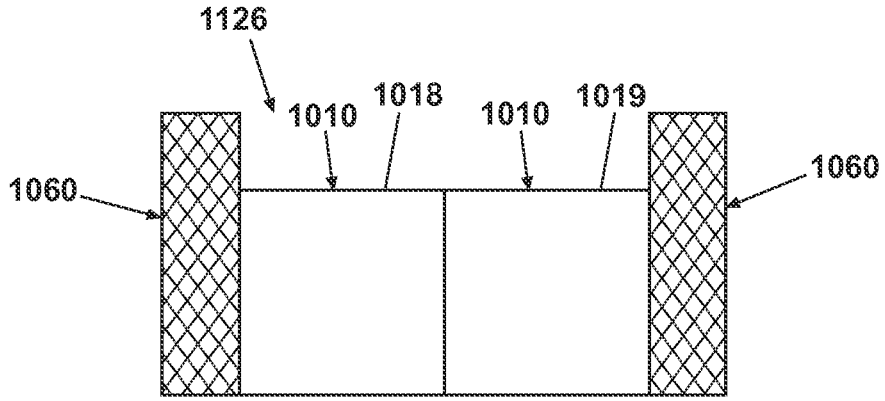
FIG. 80C is a schematic view of a core configuration N formed by two of the laundry appliances of FIG. 67A in a horizontal arrangement and two of the intermediate height vertical modules of FIG. 69C positioned adjacent to the laundry appliances.
Figure 87A:
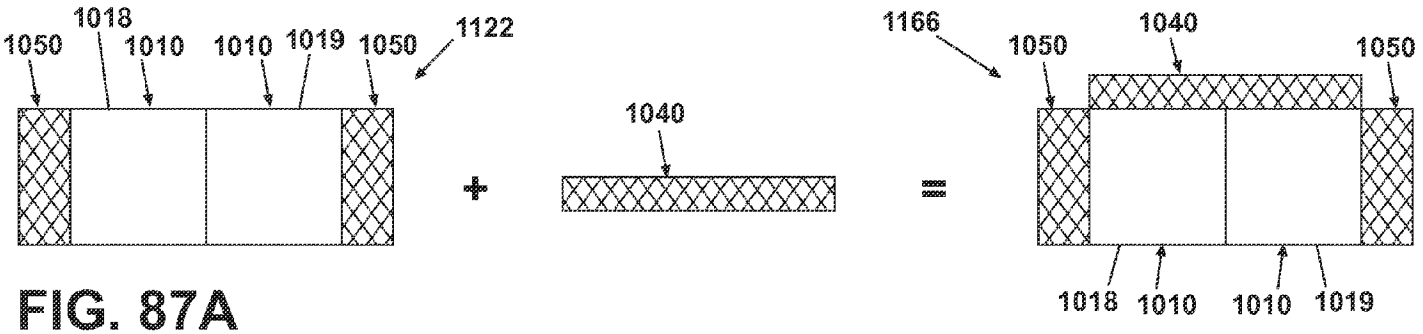
Figure 87B:
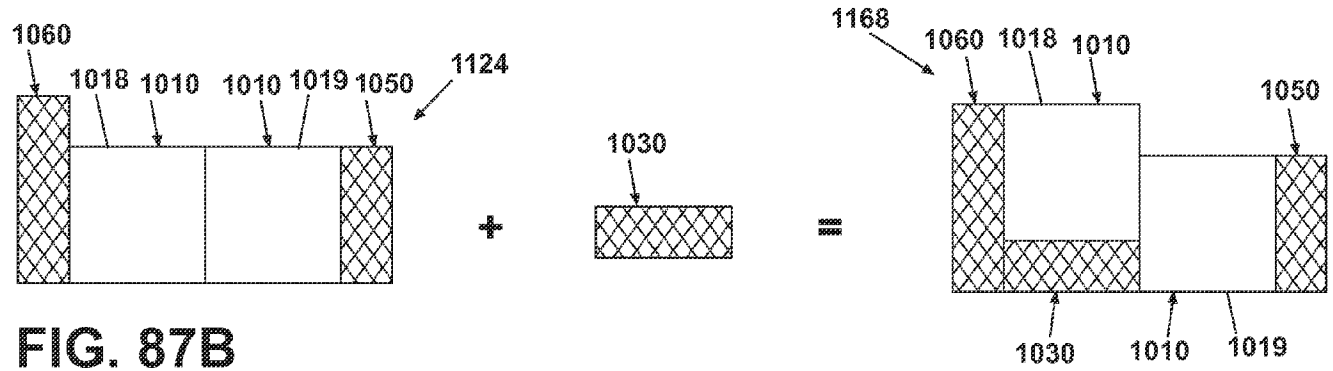
Figure 87C:
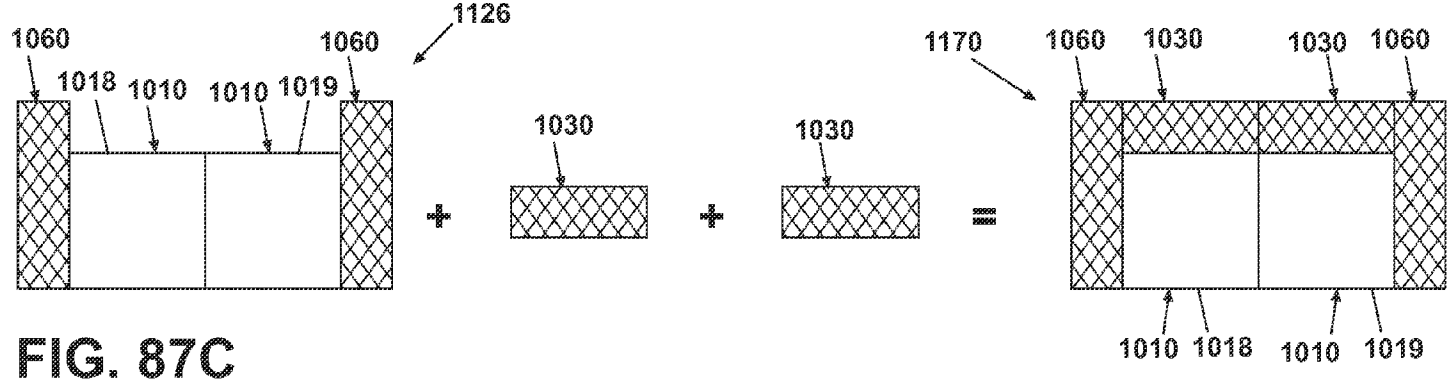

FIG. 87C is a schematic view illustrating construction of a customized configuration P formed from the core configuration N of FIG. 80C.

Figure 81A:
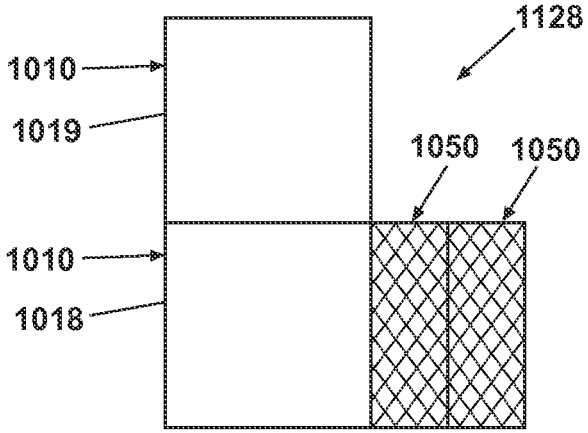
FIG. 81A is a schematic view of a core configuration O formed by two of the laundry appliances of FIG. 67A in a vertical arrangement and two of the single height vertical modules of FIG. 69A positioned adjacent to the laundry appliances.
Figure 88A:
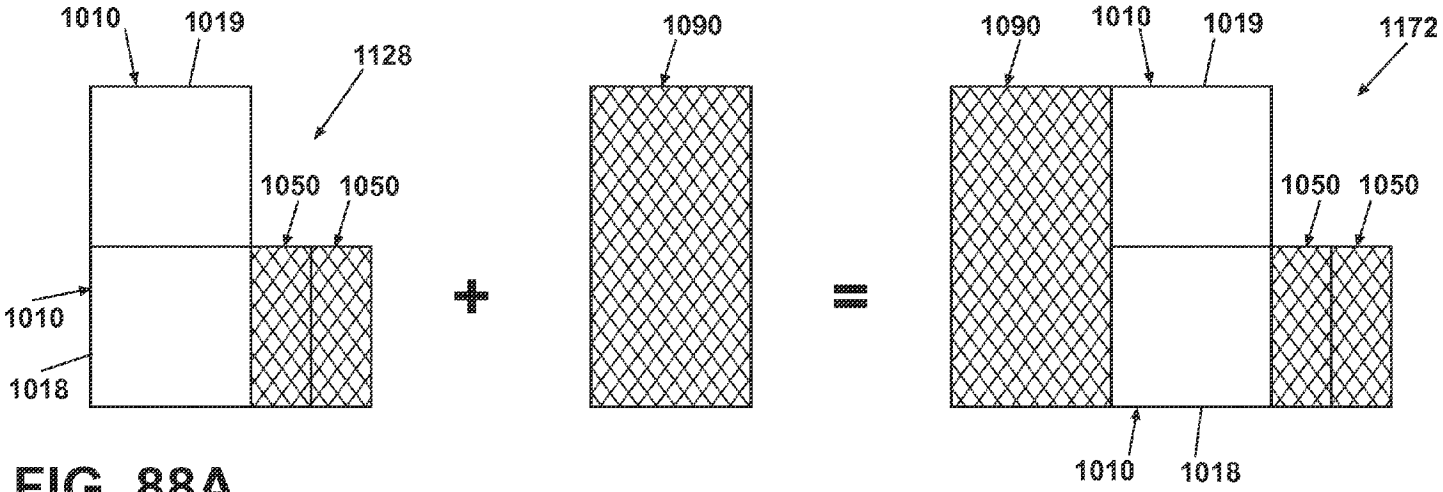

FIG. 88A is a schematic view illustrating construction of a customized configuration Q formed from the core configuration O of FIG. 81A.

Figure 81B:
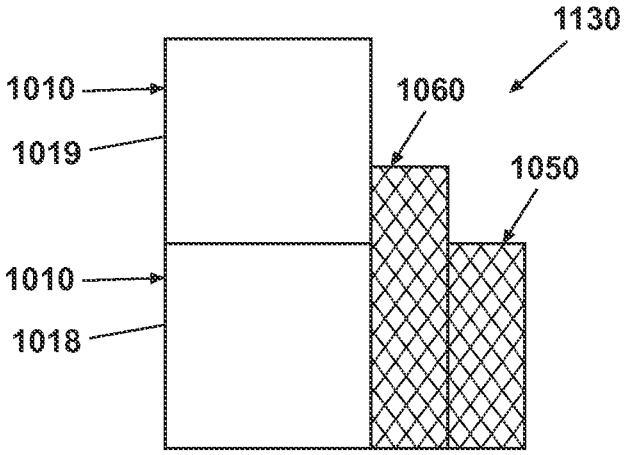
FIG. 81B is a schematic view of a core configuration P formed by two of the laundry appliances of FIG. 67A in a vertical arrangement and one each of the single height vertical module of FIG. 69A and the intermediate height vertical module of FIG. 69C positioned adjacent to the laundry appliances.
Figure 88B:
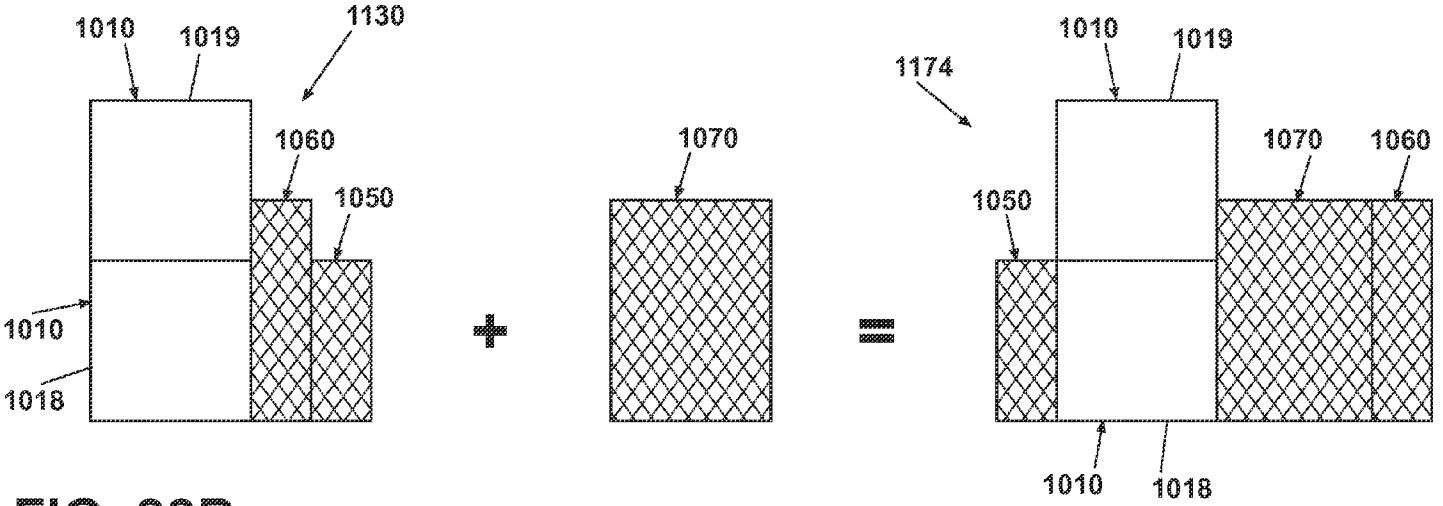

FIG. 88B is a schematic view illustrating construction of a customized configuration R formed from the core configuration P of FIG. 81B.

Figure 81C:
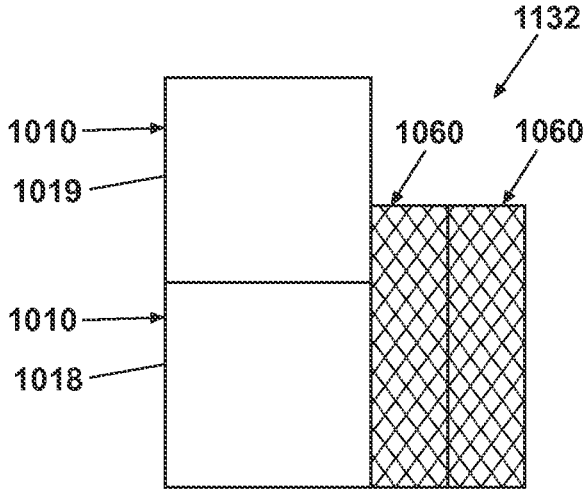
FIG. 81C is a schematic view of a core configuration Q formed by two of the laundry appliances of FIG. 67A in a vertical arrangement and two of the intermediate height vertical modules of FIG. 69C positioned adjacent to the laundry appliances.
Figure 88C:
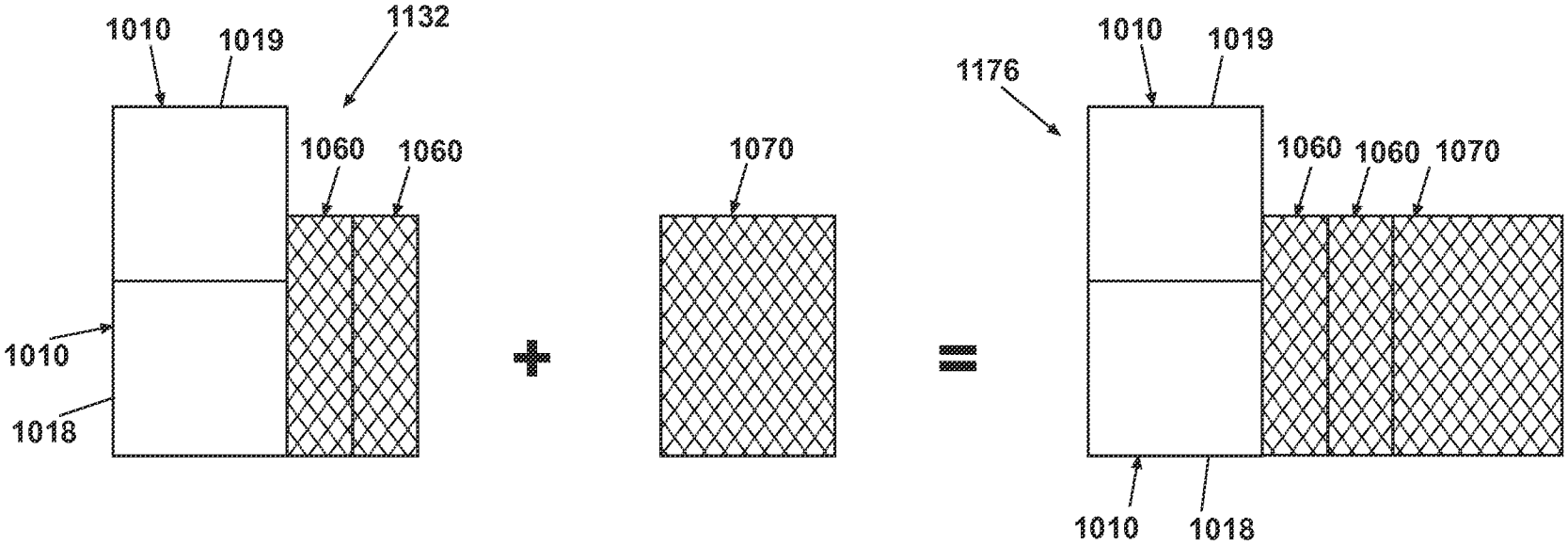

FIG. 88C is a schematic view illustrating construction of a customized configuration S formed from the core configuration Q of FIG. 81C.

Figure 68A:
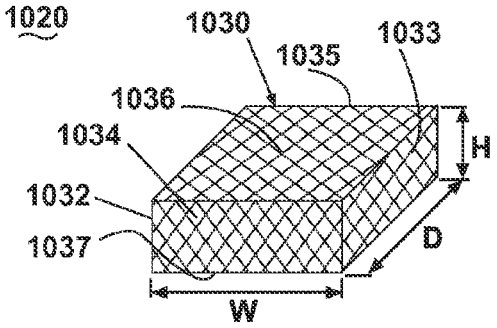
FIG. 68A is a schematic view of a single width horizontal module according to one embodiment of the invention.
Figure 71A:
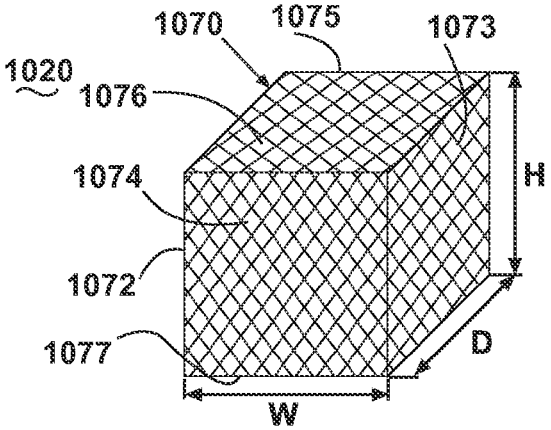
FIG. 71A is a schematic view of a single height cabinet module according to one embodiment of the invention.
Figure 71B:
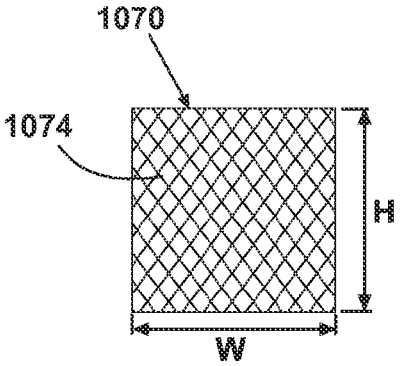
FIG. 71B is a view of a symbol representative of the single height cabinet module of FIG. 71A.
Figure 71C:
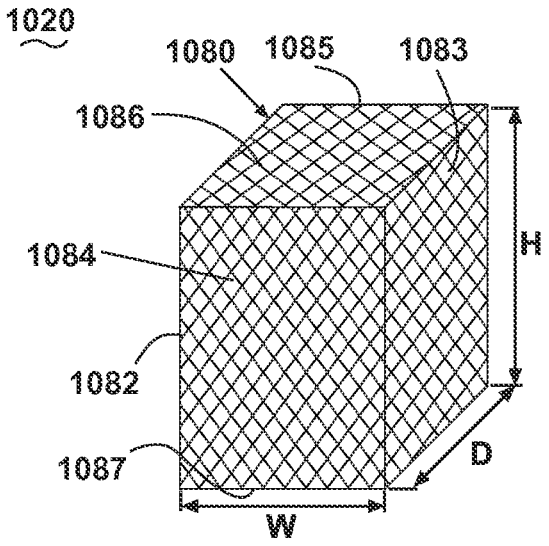
FIG. 71C is a schematic view of an intermediate height cabinet module according to one embodiment of the invention.
Figure 71D:
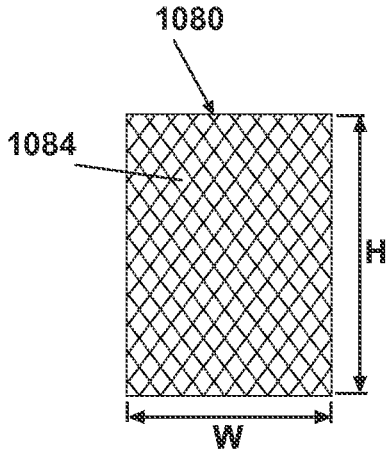
FIG. 71D is a view of a symbol representative of the intermediate height cabinet module of FIG. 71C.
Figure 71E:
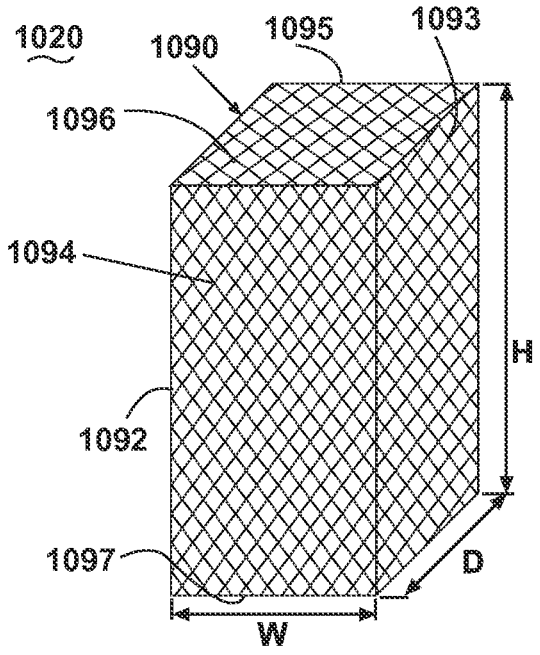
FIG. 71E is a schematic view of a double height cabinet module according to one embodiment of the invention.
Figure 71F:
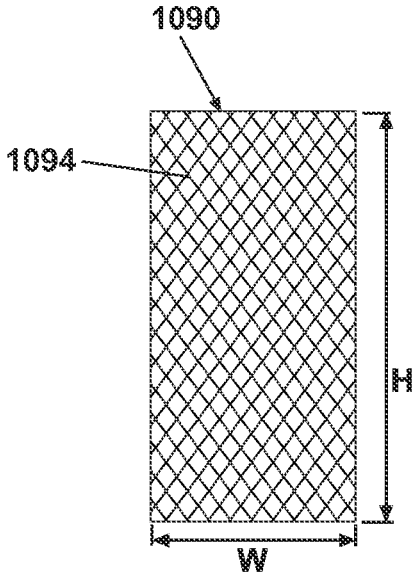
FIG. 71F is a view of a symbol representative of the double height cabinet module of FIG. 71E.
Figure 89:
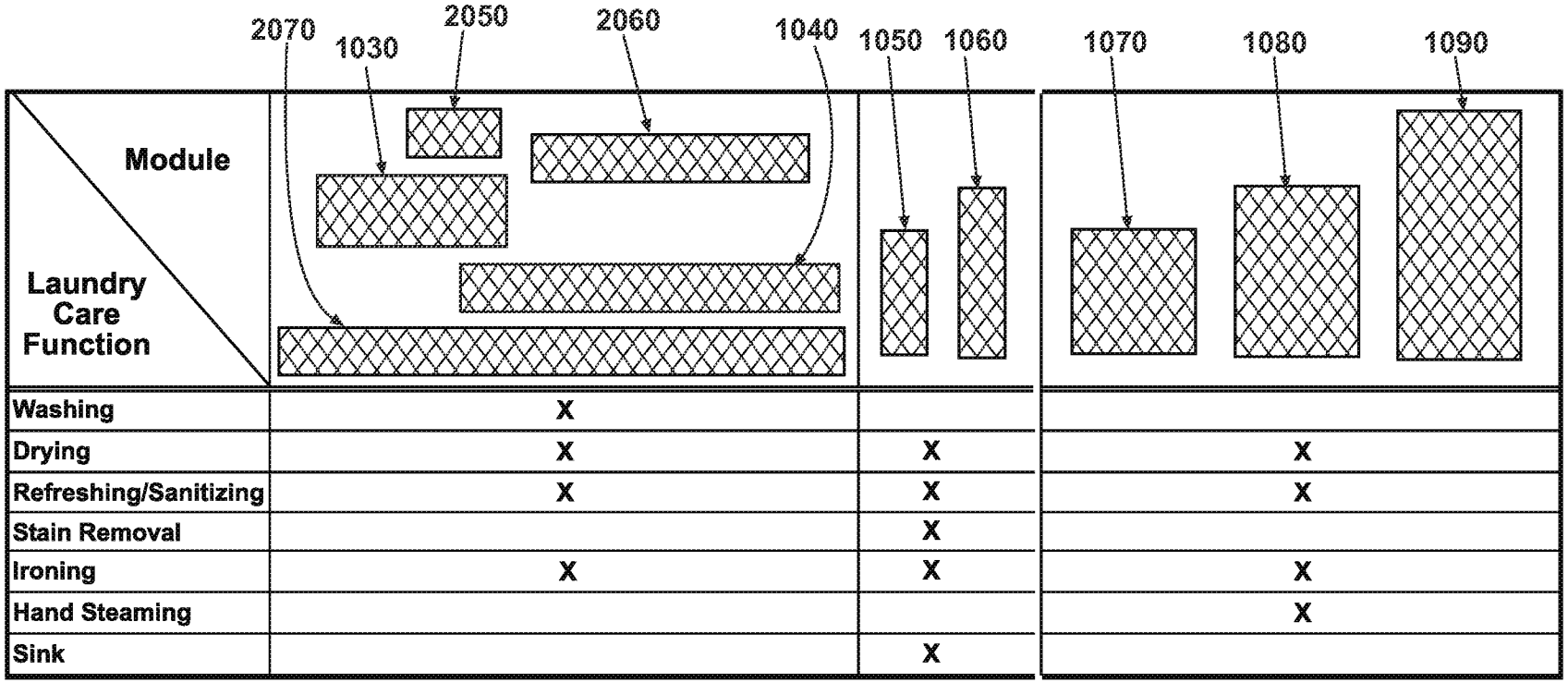

FIG. 89 is a table of exemplary laundry care functions for the modules shown in FIGS. 68A71F.

Figure 90A:
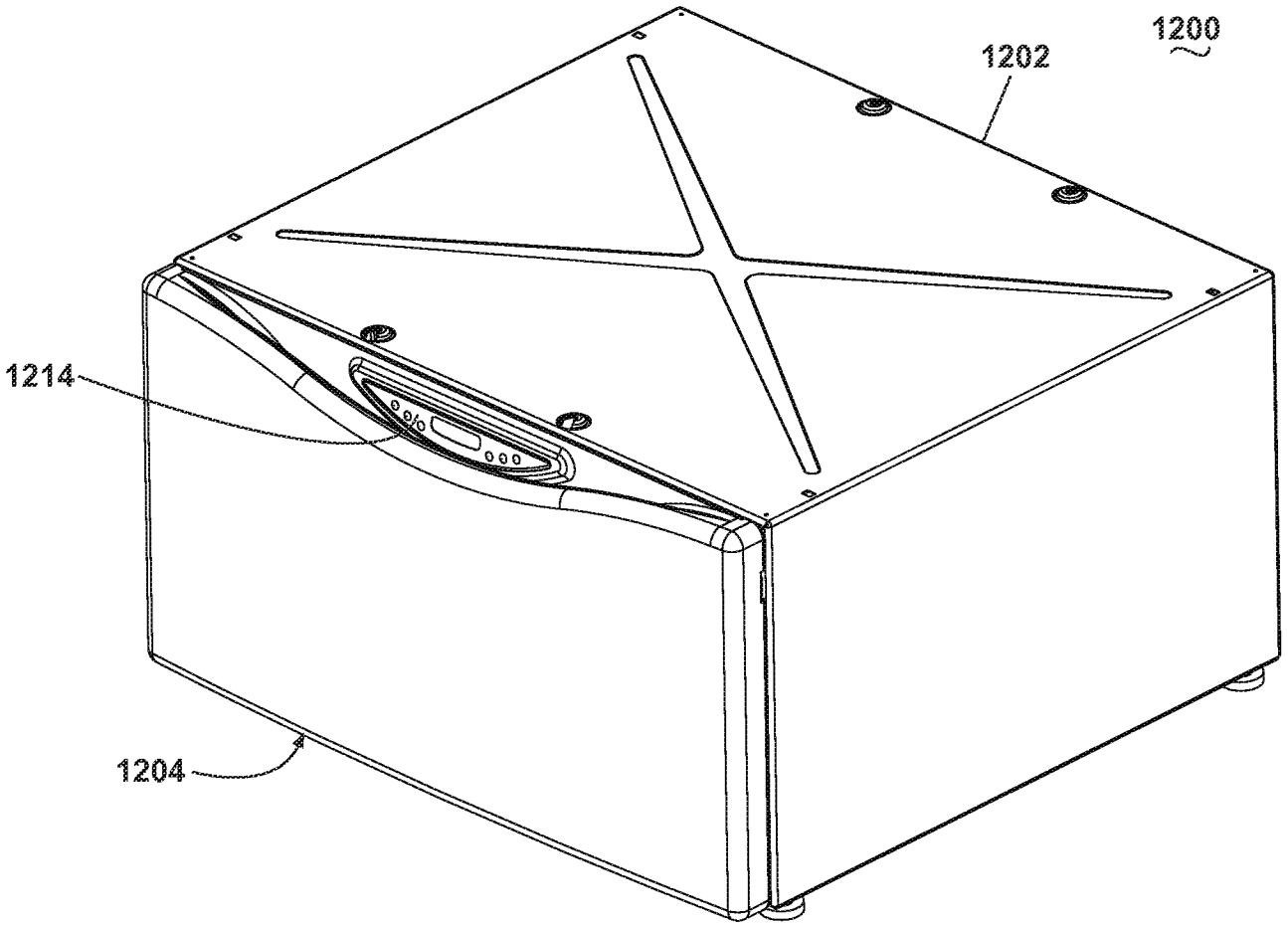

FIG. 90A is a perspective view of the single width horizontal module of FIG. 68A having a washing function and shown with a wash drawer in a closed position.

Figure 90B:
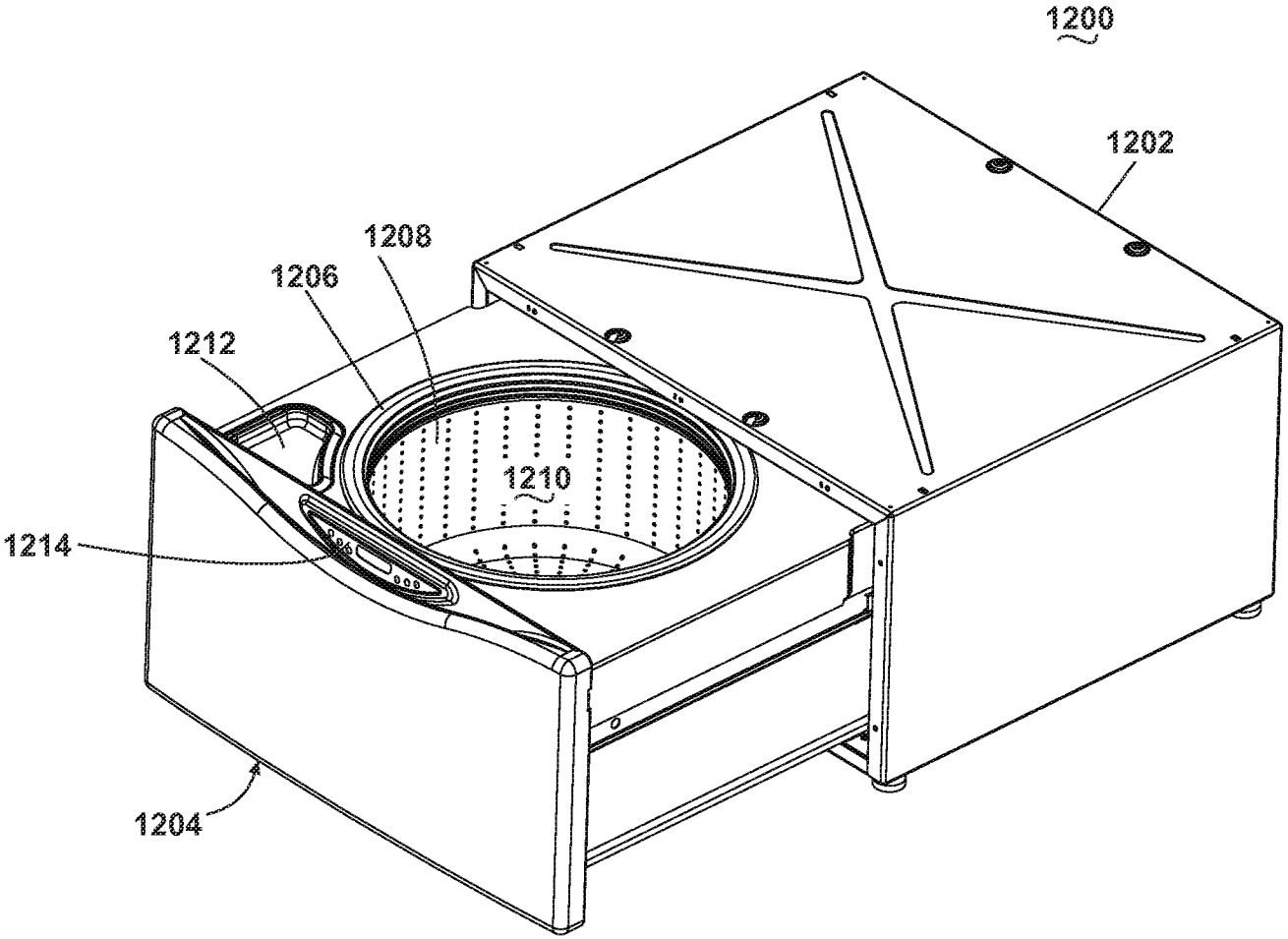

FIG. 90B is a perspective view of the washing function single width horizontal module of FIG. 90A with the wash drawer in an opened position.

Figure 91A:
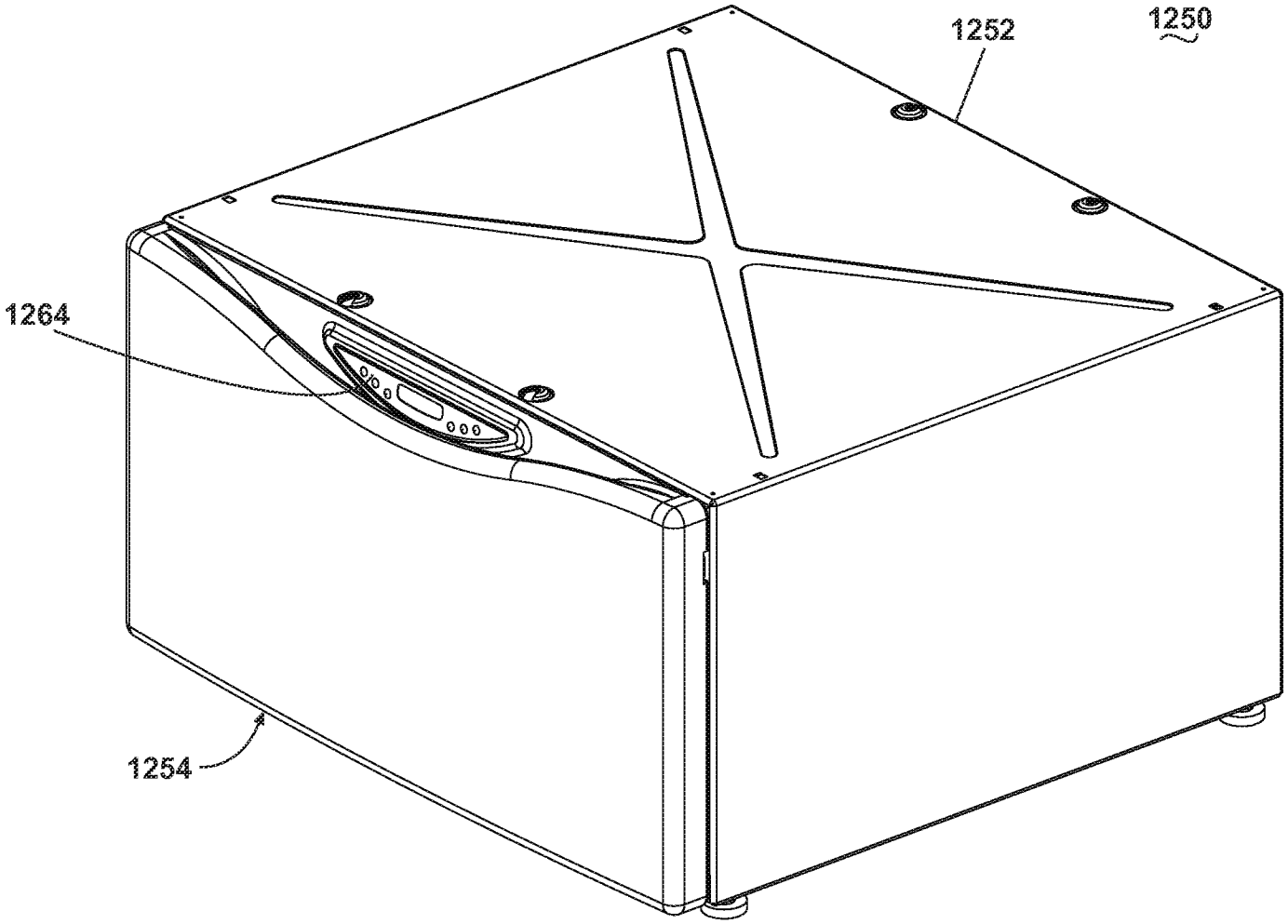

FIG. 91A is a perspective view of the single width horizontal module of FIG. 68A having a drying function and shown with a dryer drawer in a closed position.

Figure 91B:
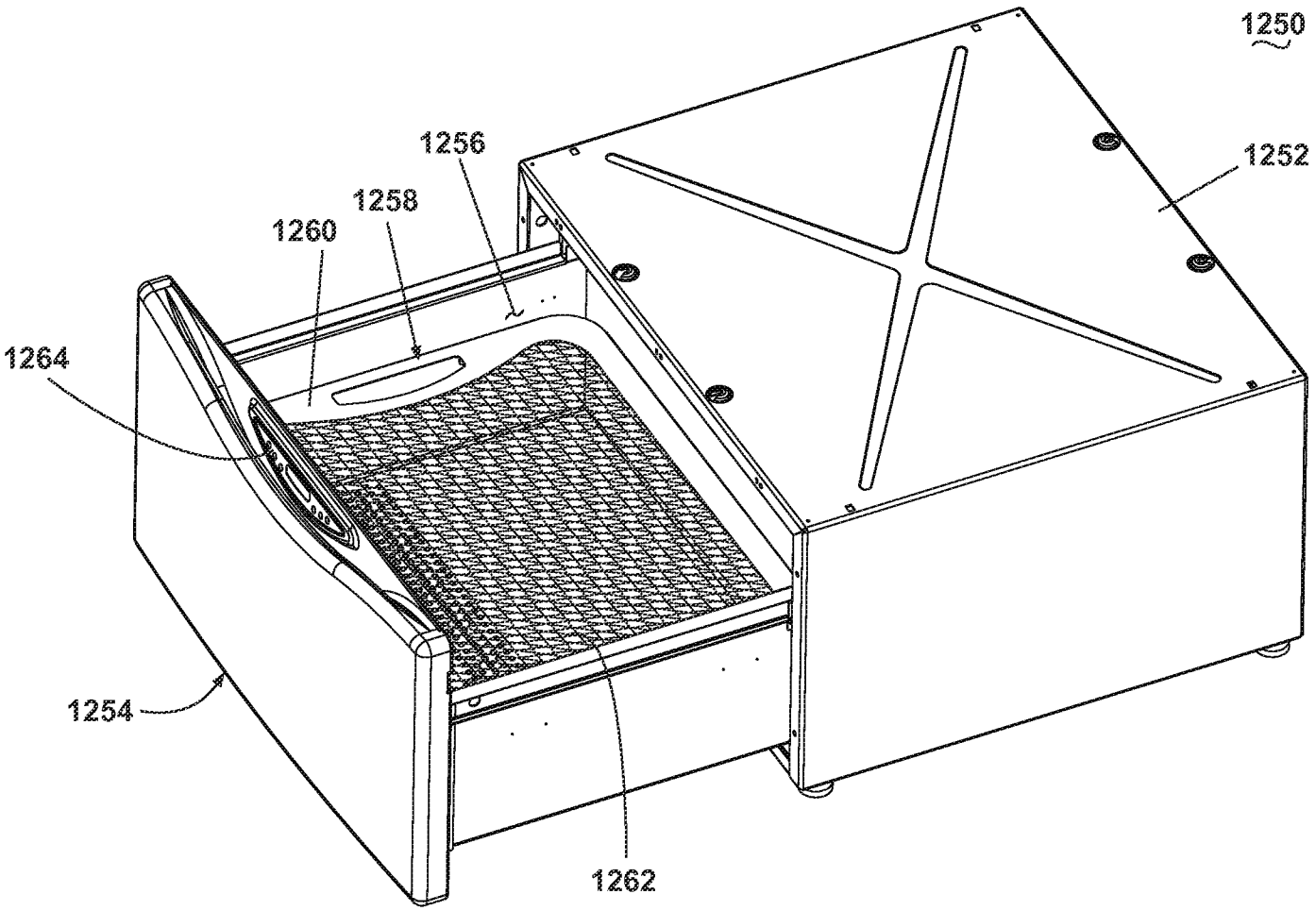

FIG. 91B is a perspective view of the drying function single width horizontal module of FIG. 91A with the drying drawer in an opened position.

Figure 68B:
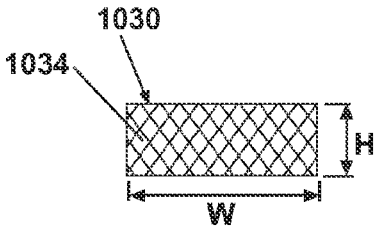
FIG. 68B is a view of a symbol representative of the single width horizontal module of FIG. 68A.
Figure 68C:
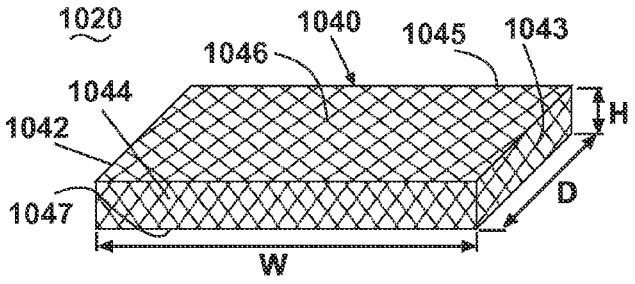
FIG. 68C is a schematic view of a double width horizontal module according to one embodiment of the invention.
Figure 92A:
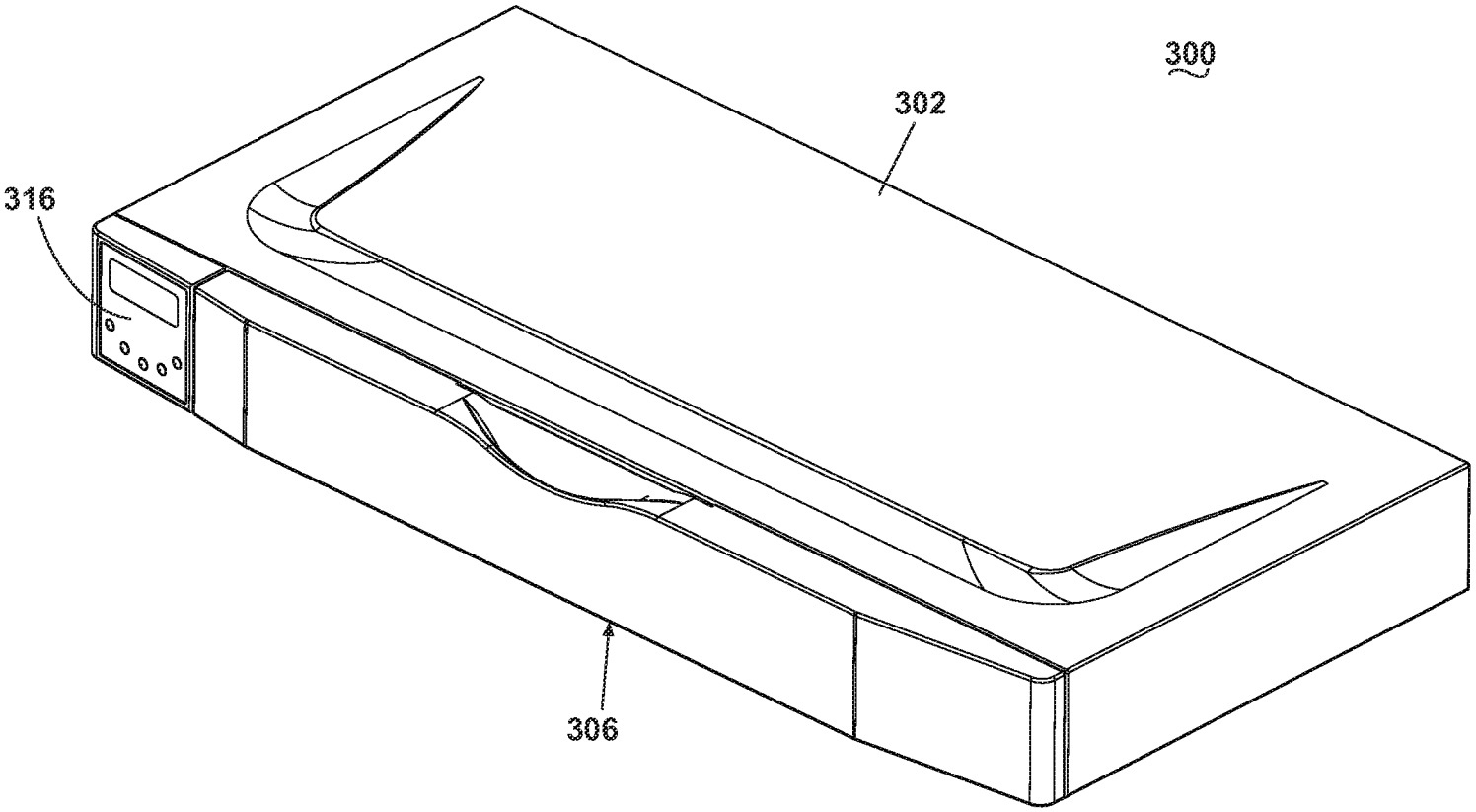

FIG. 92A is a perspective view of the double width horizontal module of FIG. 68C having a drying function and shown with a dryer drawer in a closed position.

Figure 92B:
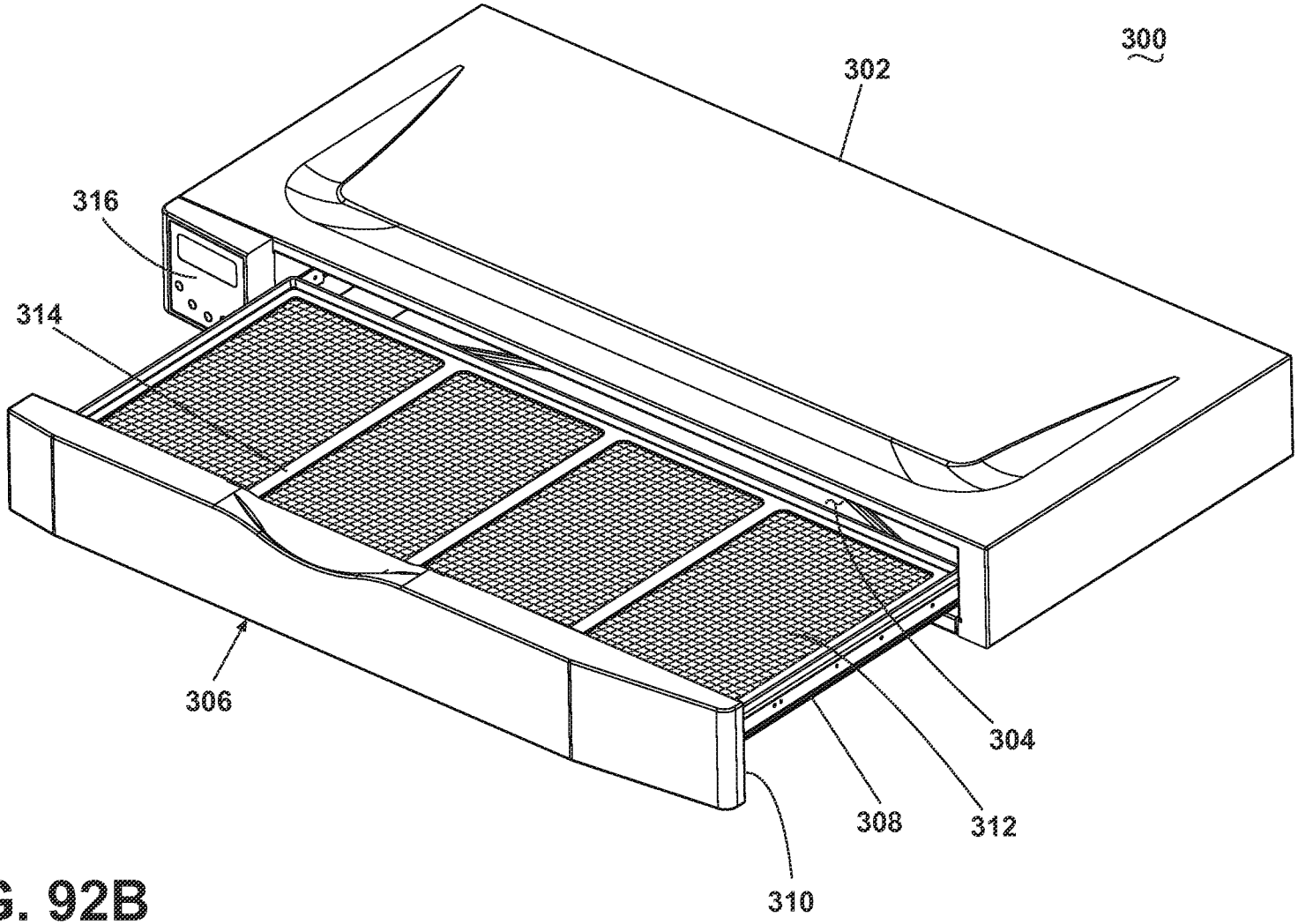

FIG. 92B is a perspective view of the drying function double width horizontal module of FIG. 92A with the drying drawer in an opened position.

Figure 69A:
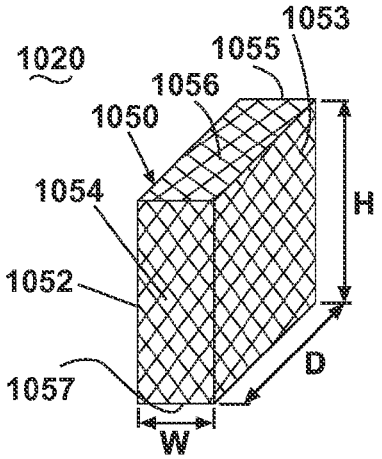
FIG. 69A is a schematic view of a single height vertical module according to one embodiment of the invention.
Figure 69B:
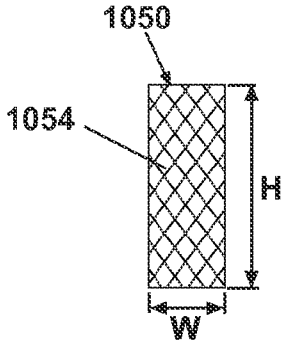
FIG. 69B is a view of a symbol representative of the single height vertical module of FIG. 69A.
Figure 69C:
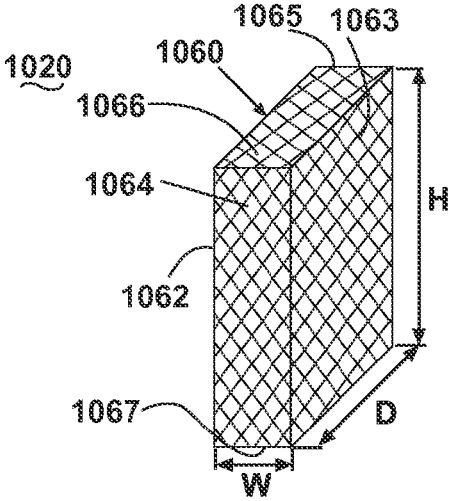
FIG. 69C is a schematic view of an intermediate height vertical module according to one embodiment of the invention.
Figure 93A:
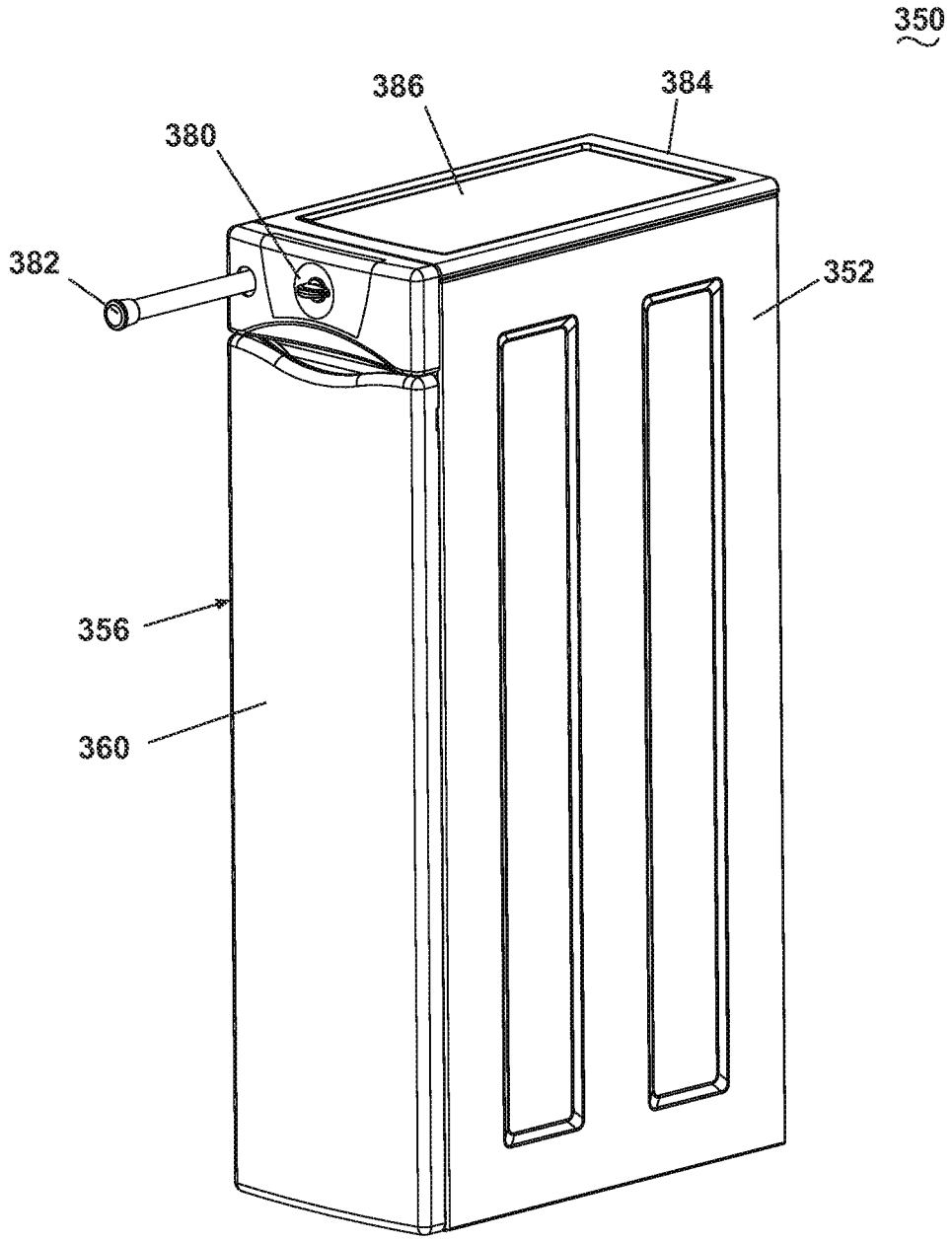

FIG. 93A is a perspective view of the intermediate height vertical module of FIG. 69C having a drying function and shown with a dryer drawer in a closed position and a hanging rod in an extended position.

Figure 93B:
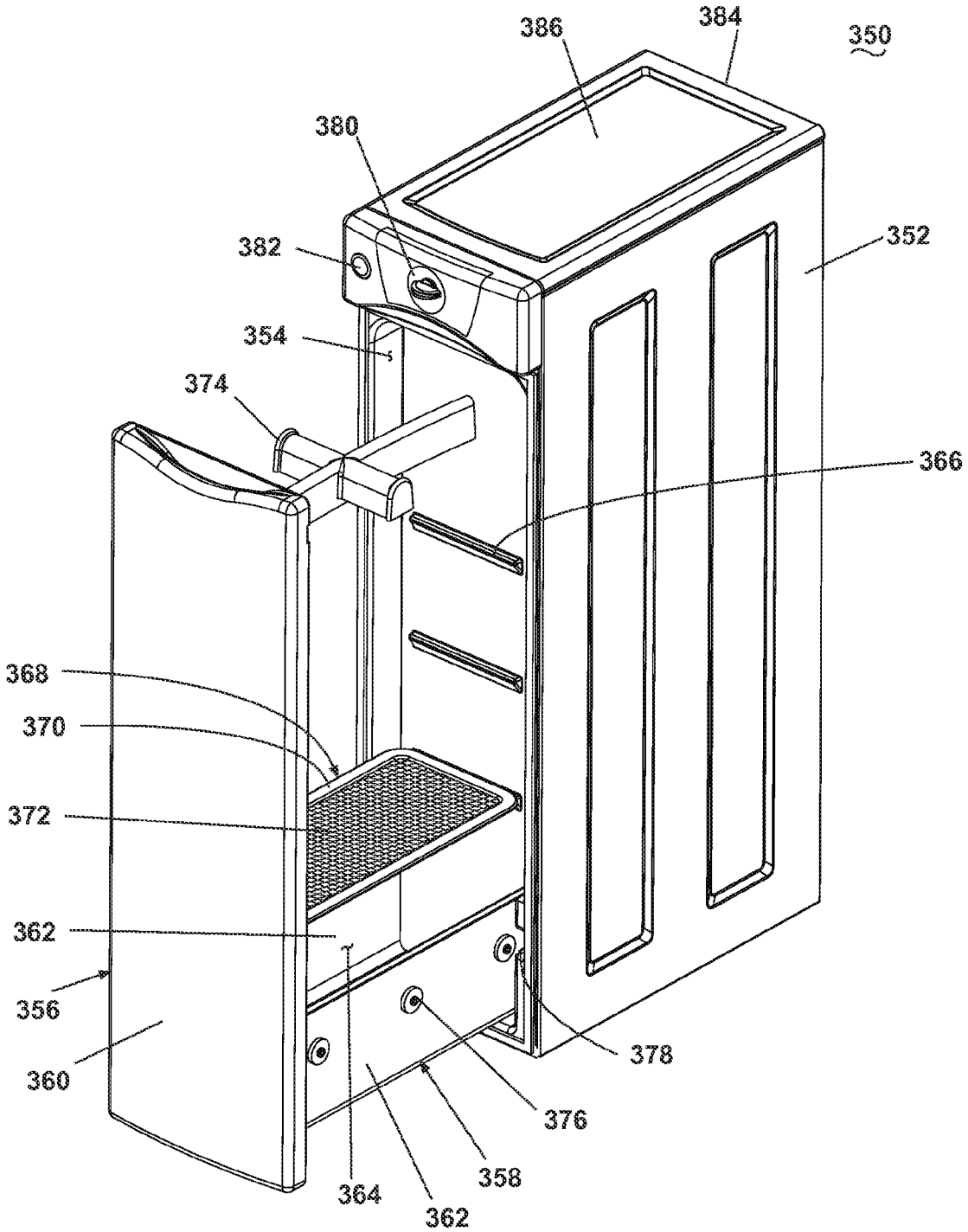

FIG. 93B is a perspective view of the drying function intermediate height vertical module of FIG. 93A with the drying drawer in an opened position and the hanging rod in a retracted position.

Figure 94A:
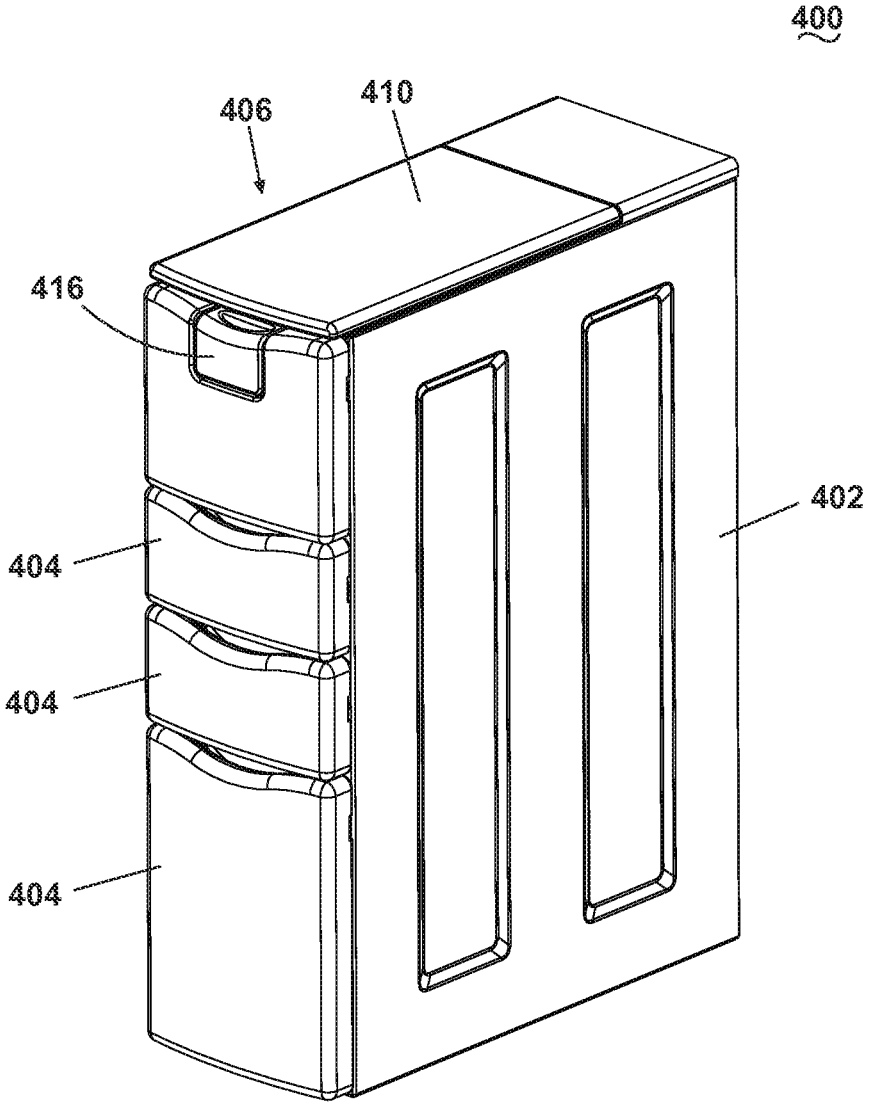

FIG. 94A is a perspective view of the single height vertical module of FIG. 69A having a stain removal function and shown with a stain removal assembly in a storage position.

Figure 94B:
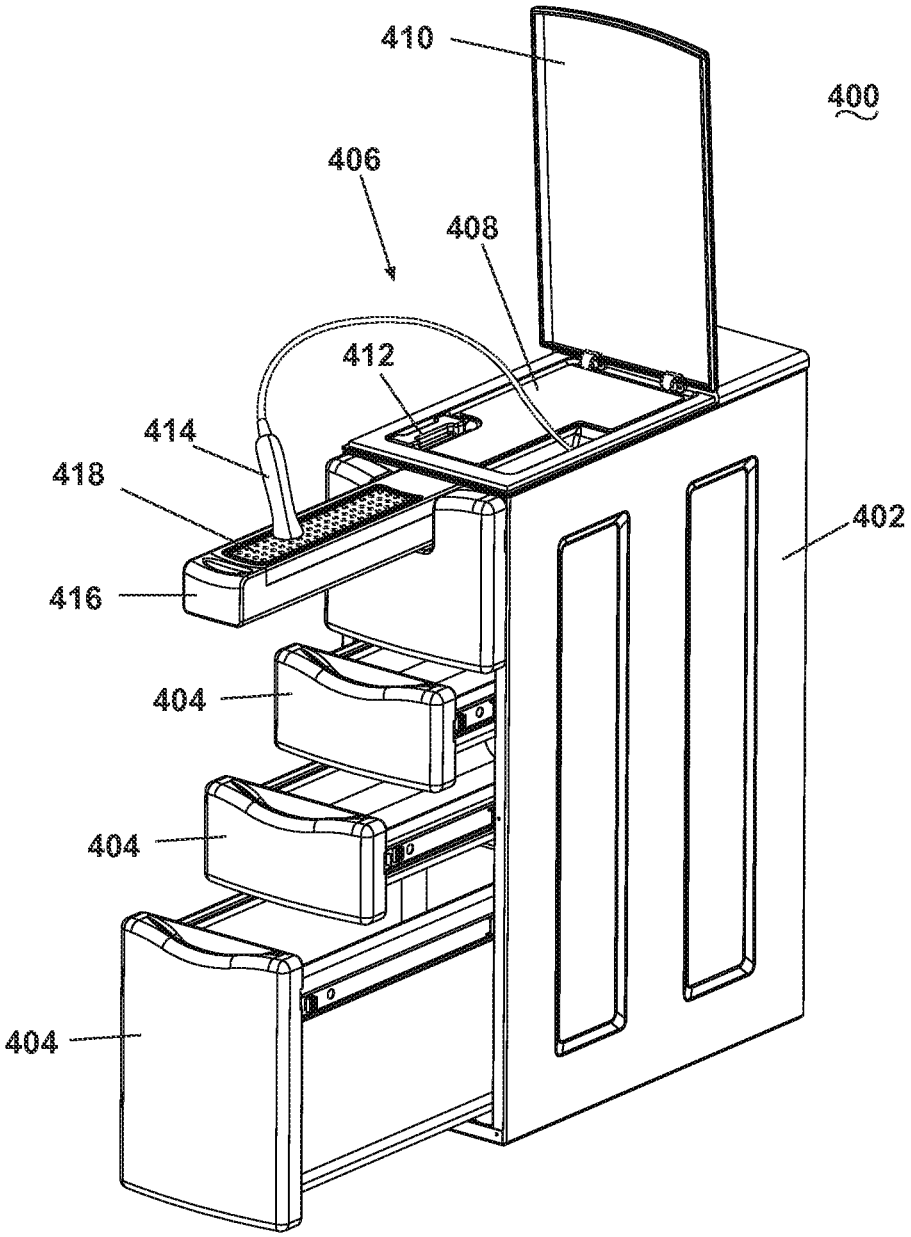

FIG. 94B is a perspective view of the stain removal function single height vertical module of FIG. 94A with the stain removal assembly in a use position.

Figure 95A:
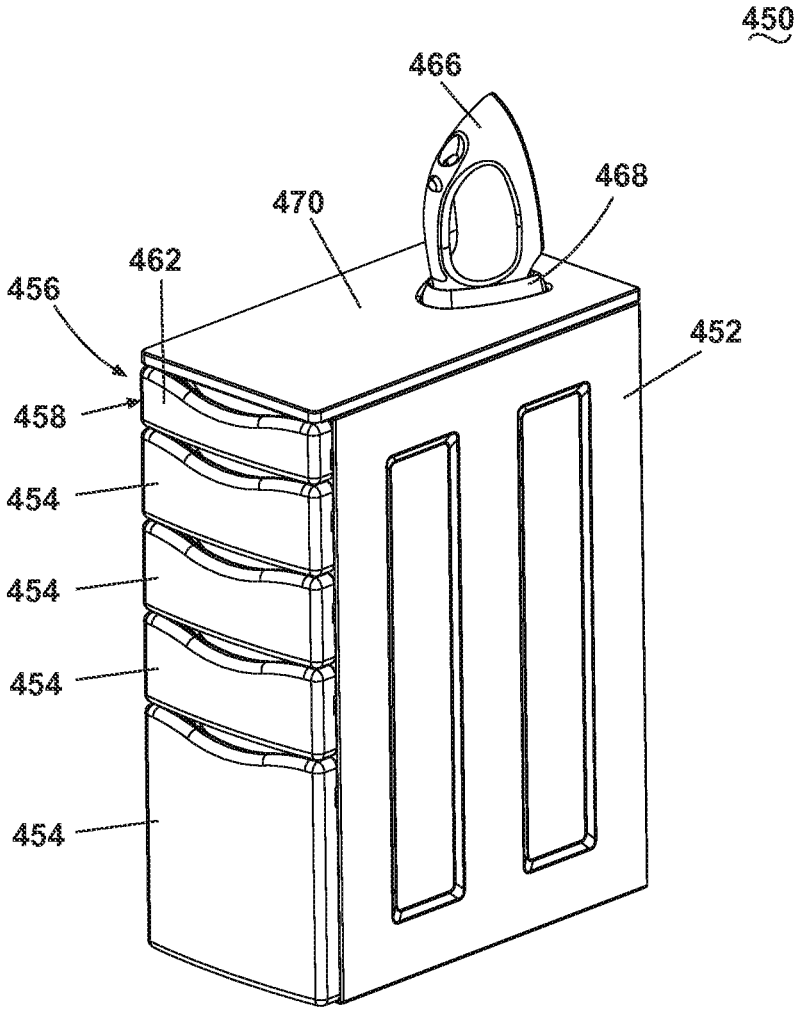

FIG. 95A is a perspective view of the single height vertical module of FIG. 69A having an ironing function and shown with an ironing board support in a closed position.

Figure 95B:
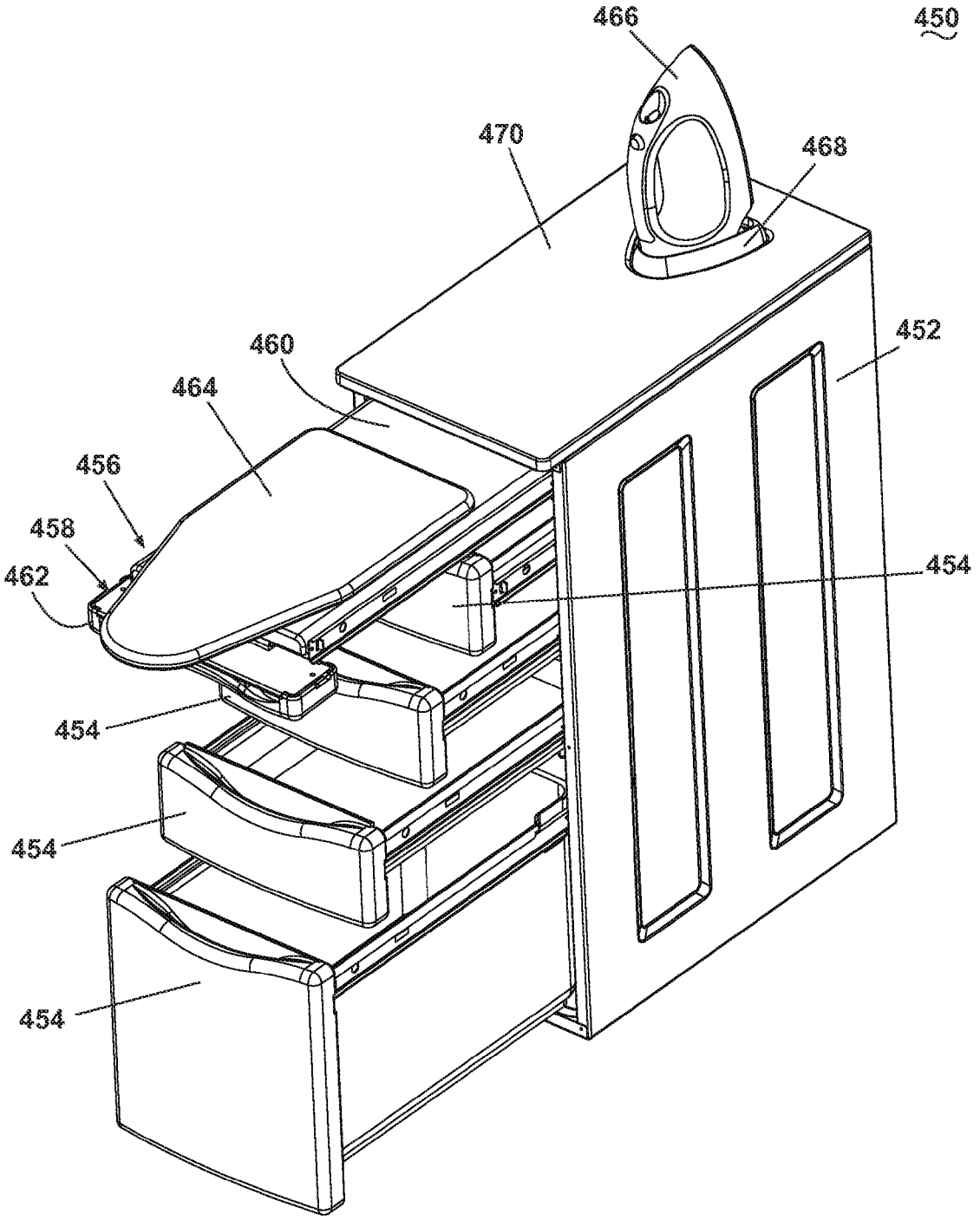

FIG. 95B is a perspective view of the ironing function single height vertical module of FIG. 95A with the ironing board support in an opened position.

Figure 96A:
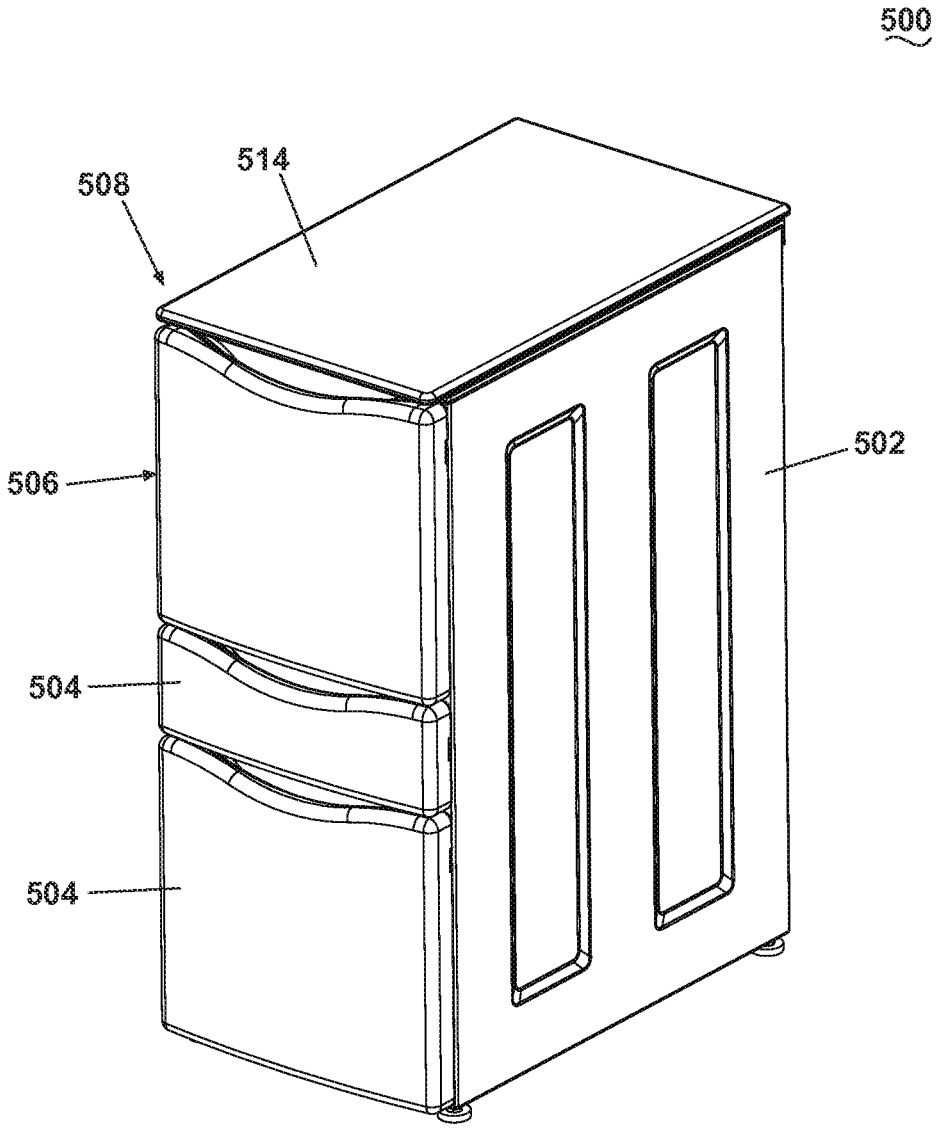

FIG. 96A is a perspective view of the single height vertical module of FIG. 69A having a sink function and shown with a sink assembly in a storage position.

Figure 96B:
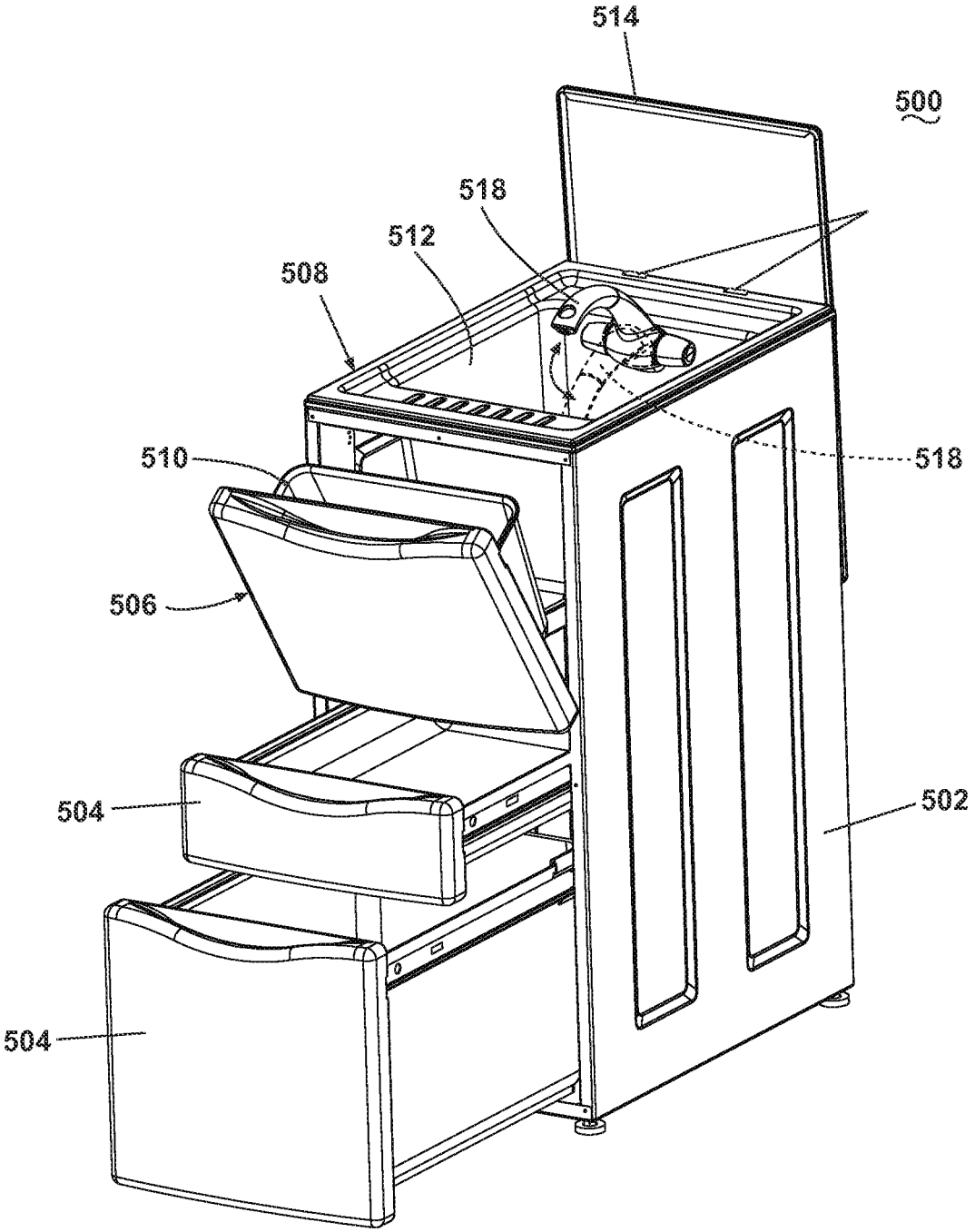

FIG. 96B is a perspective view of the sink function single height vertical module of FIG. 96A with the sink assembly in a use position.

Figure 97A:
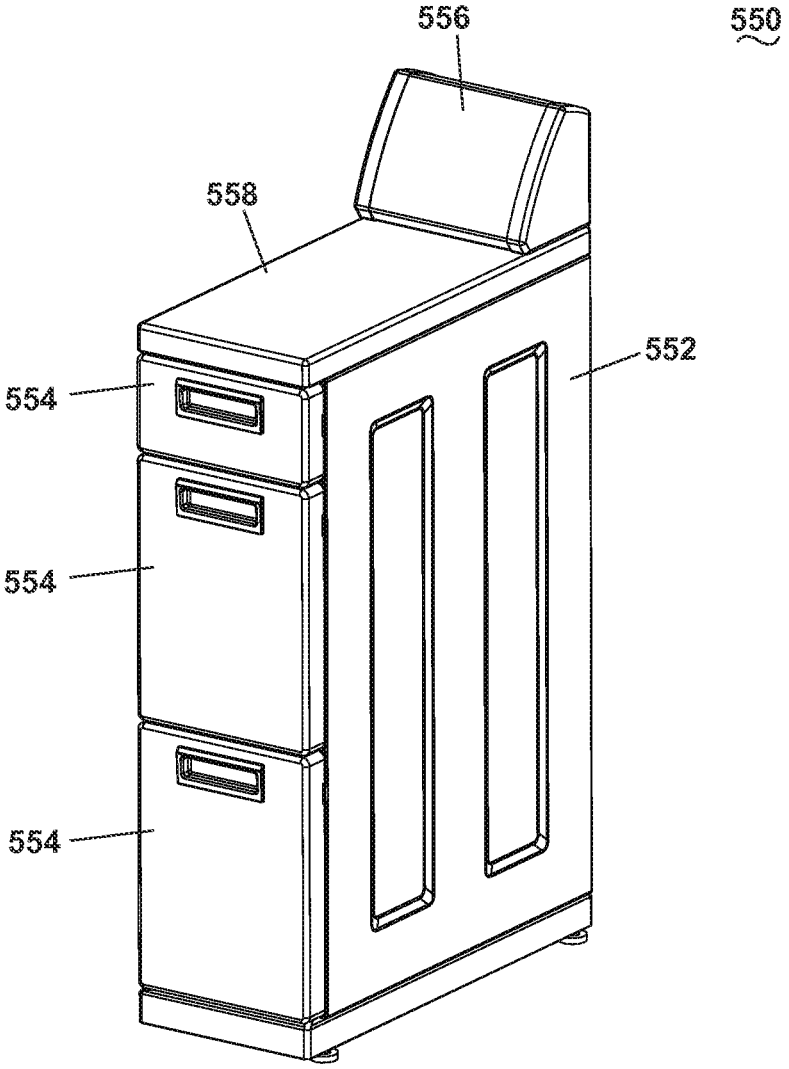

FIG. 97A is a perspective view of the single height vertical module of FIG. 69A having a storage function and shown with a plurality of storage drawers in a closed position.

Figure 97B:
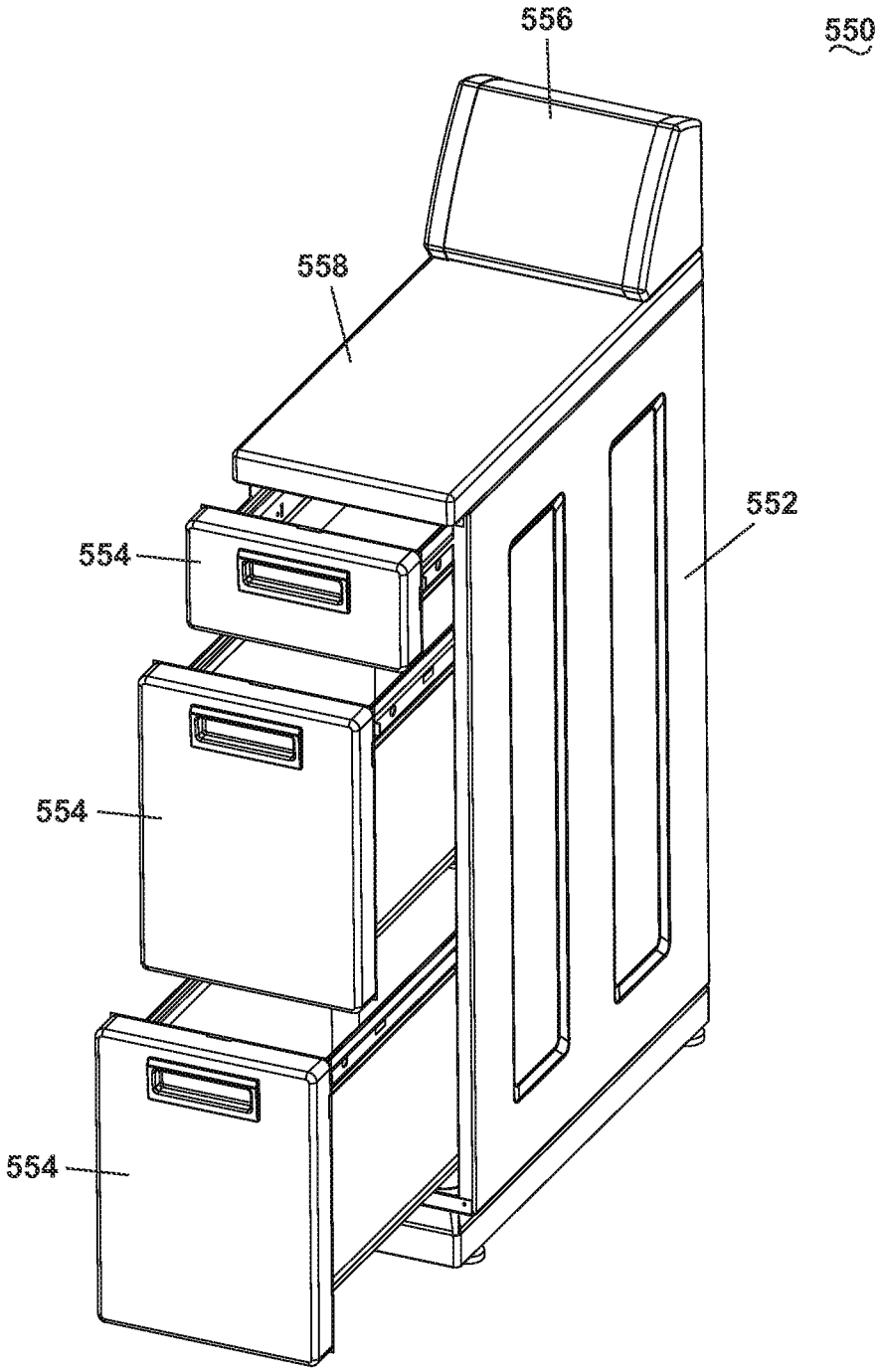

FIG. 97B is a perspective view of the storage function single height vertical module of FIG. 97A with the storage drawers in an opened position.

Figure 98A:
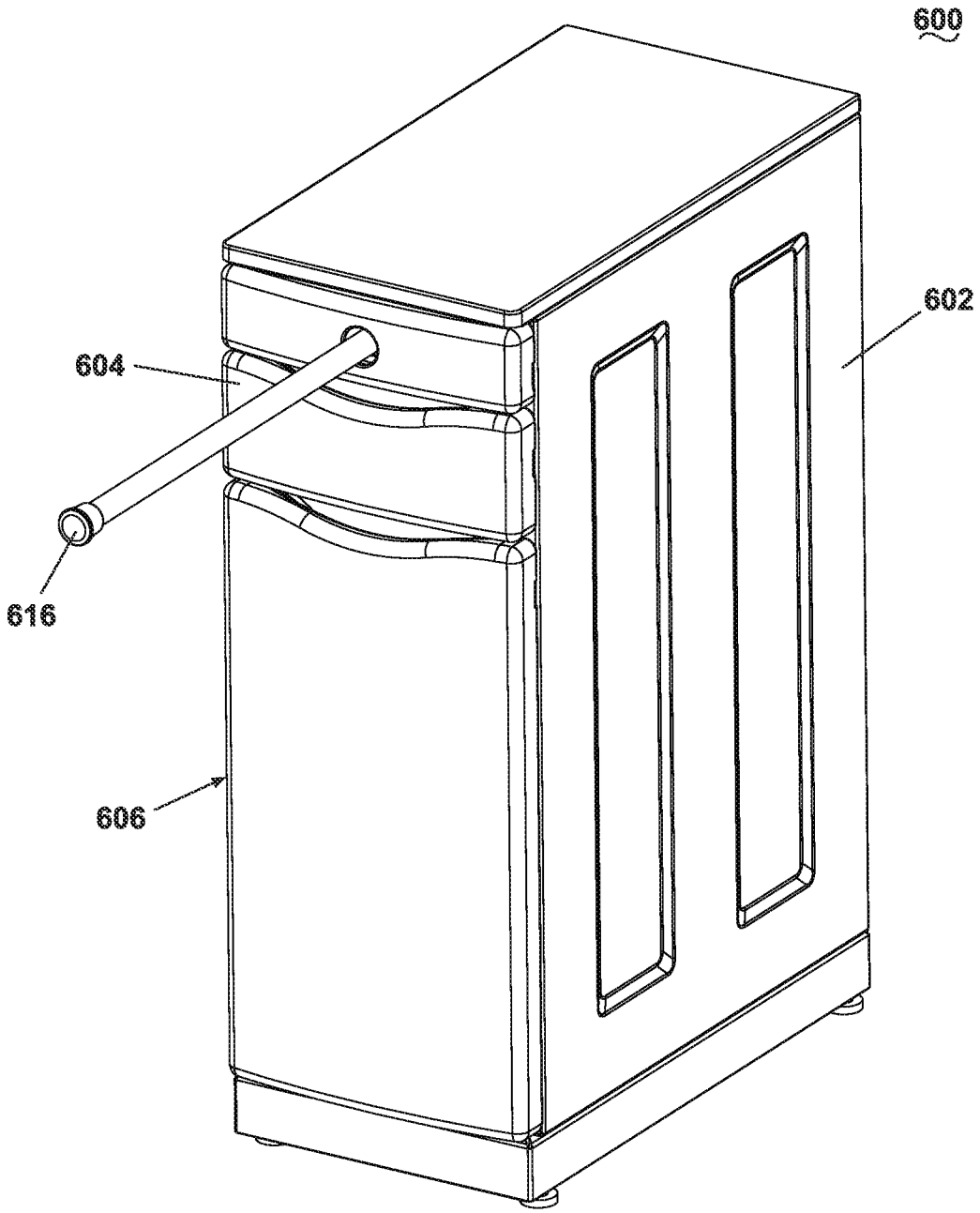

FIG. 98A is a perspective view of the single height vertical module of FIG. 69A having a storage function and shown with a plurality of storage drawers in a closed position and a hanging rod in an extended position.

Figure 98B:
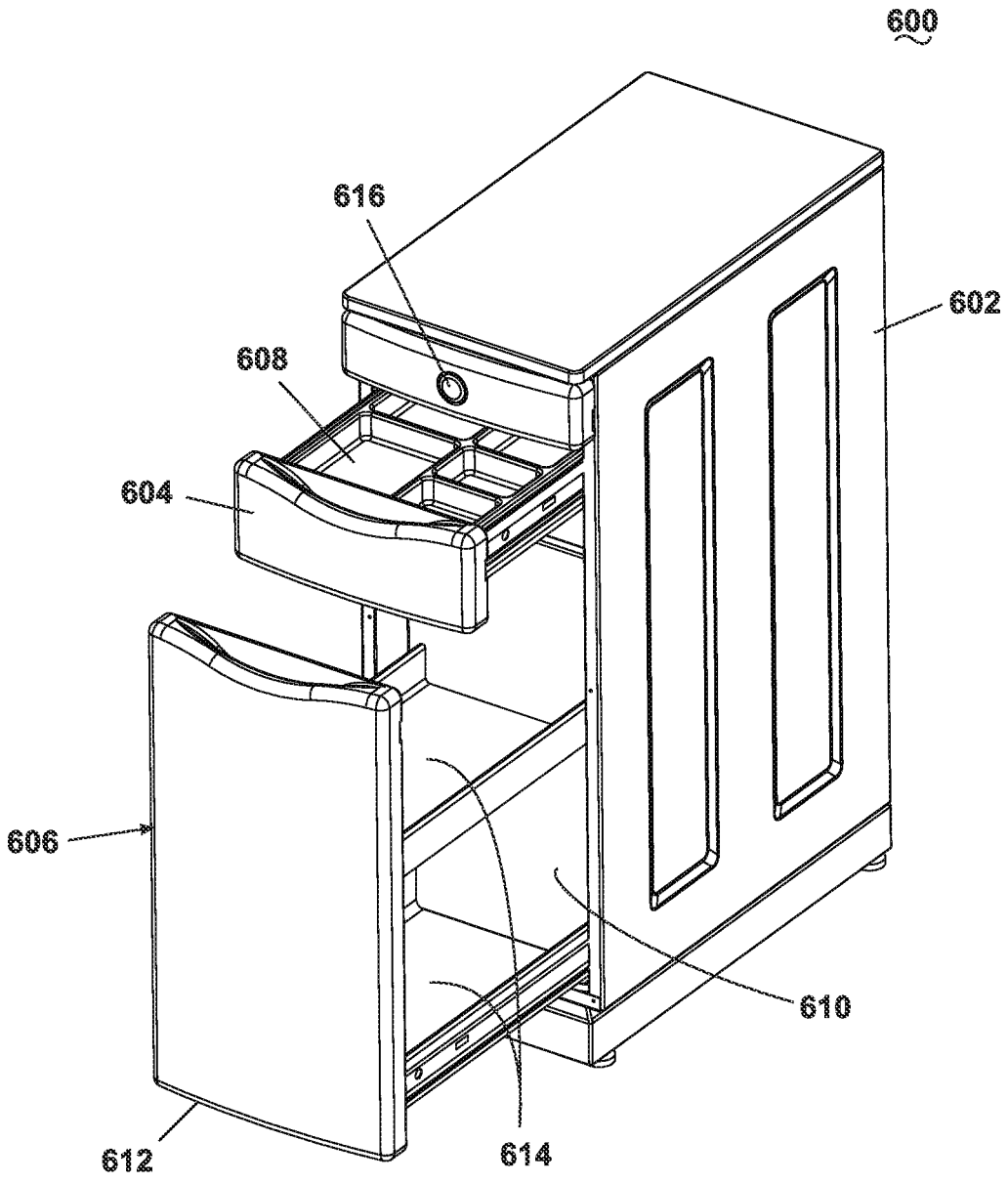

FIG. 98B is a perspective view of the storage function single height vertical module of FIG. 98A with the storage drawers in an opened position and the hanging rod in a retracted position.

Figure 99A:
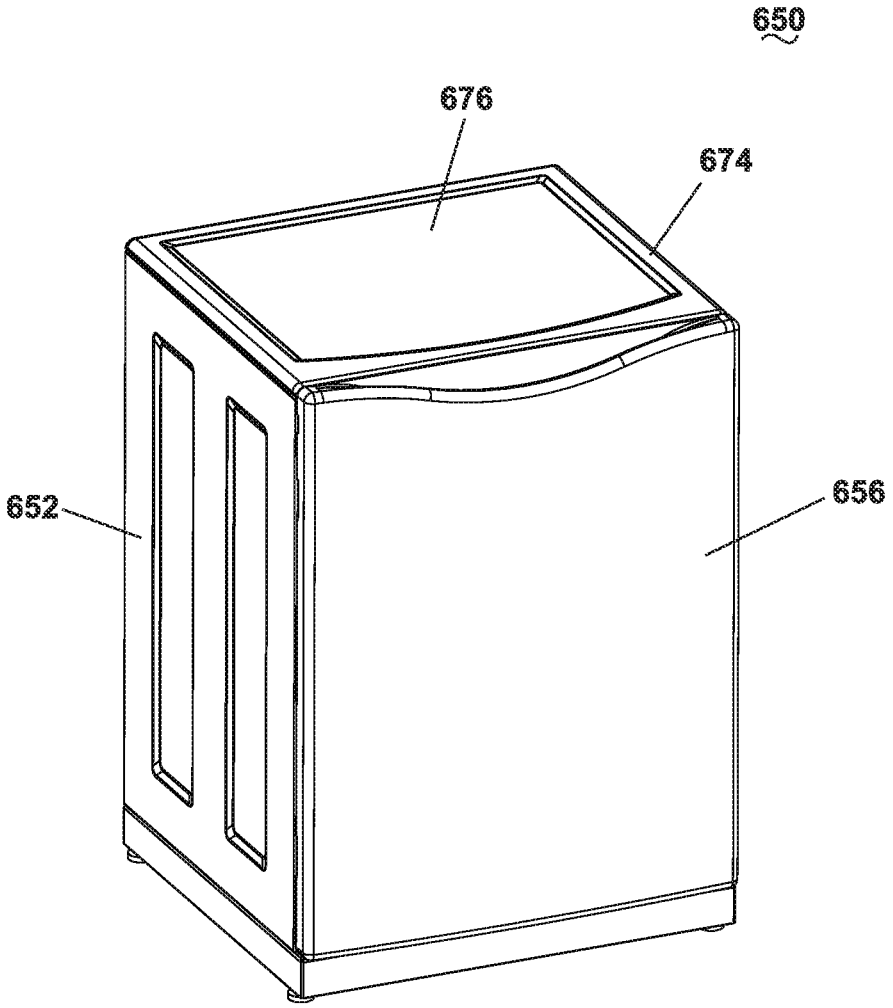

FIG. 99A is a perspective view of the single height cabinet module of FIG. 71A having a storage function and shown with a door in a closed position.

Figure 99B:
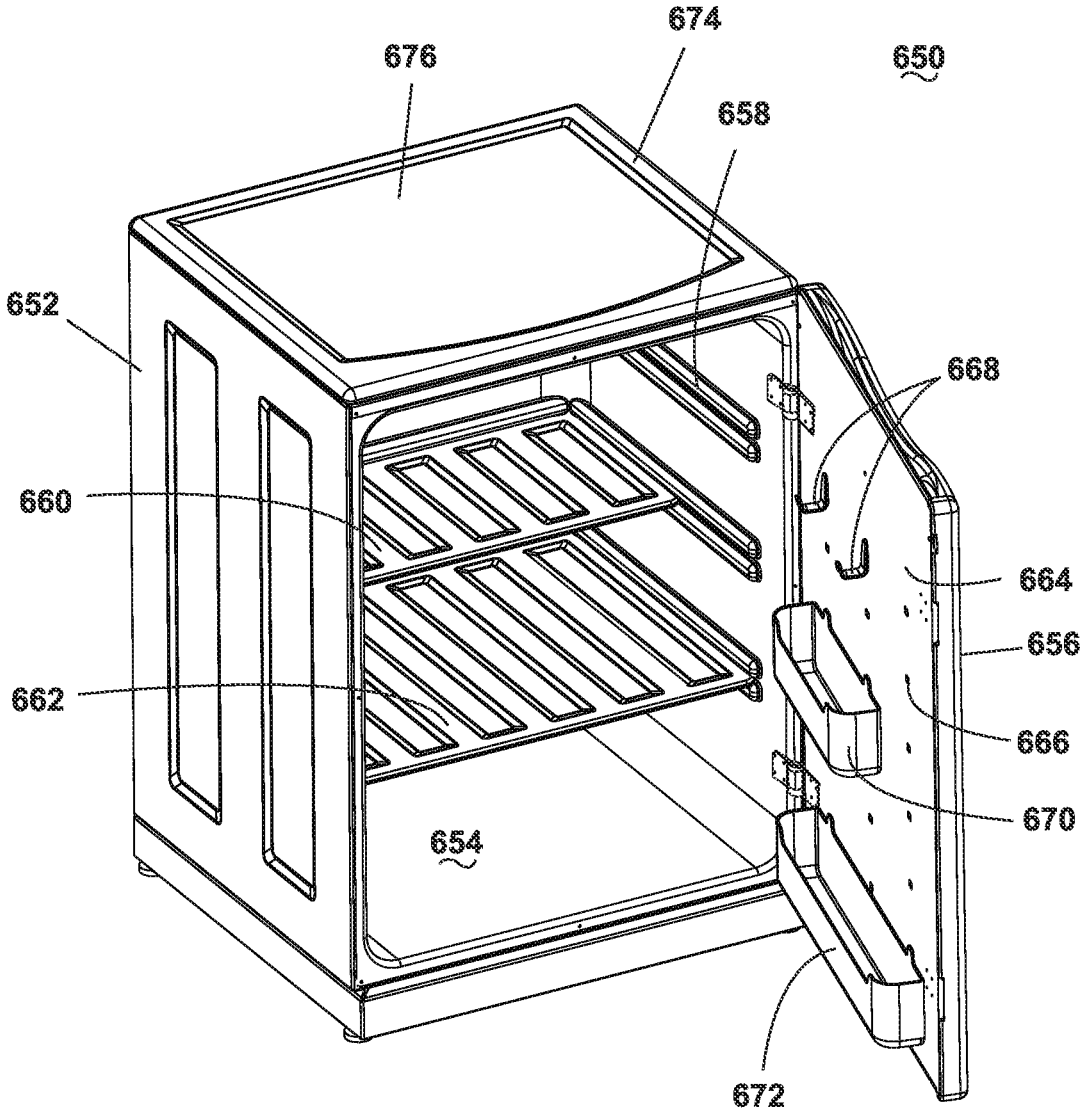

FIG. 99B is a perspective view of the storage function single height cabinet module of FIG. 99A with the door in an opened position.

Figure 100A:
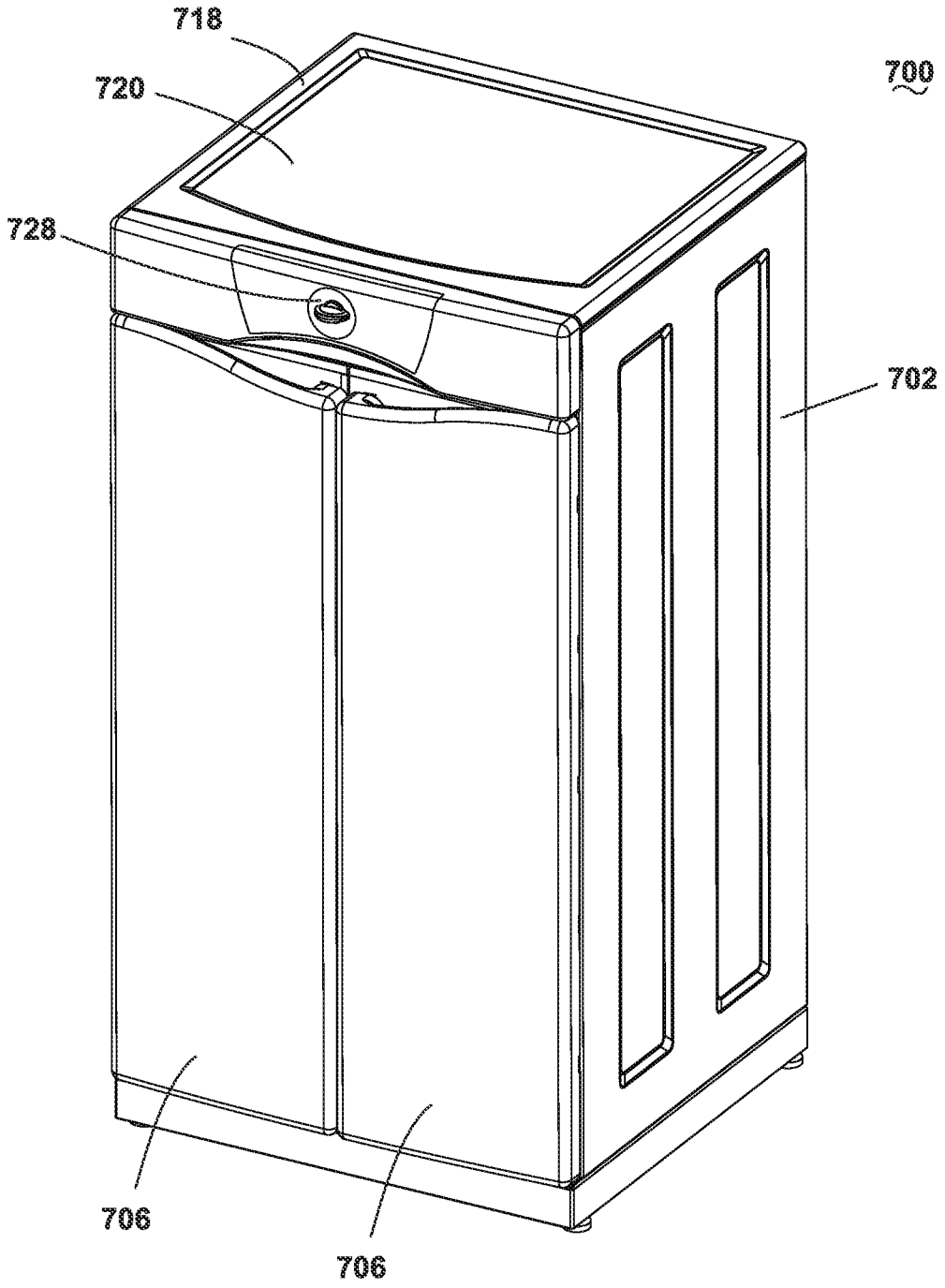

FIG. 100A is a perspective view of the intermediate height cabinet module of FIG. 71C having a drying function and shown with a pair of doors in a closed position.

Figure 100B:
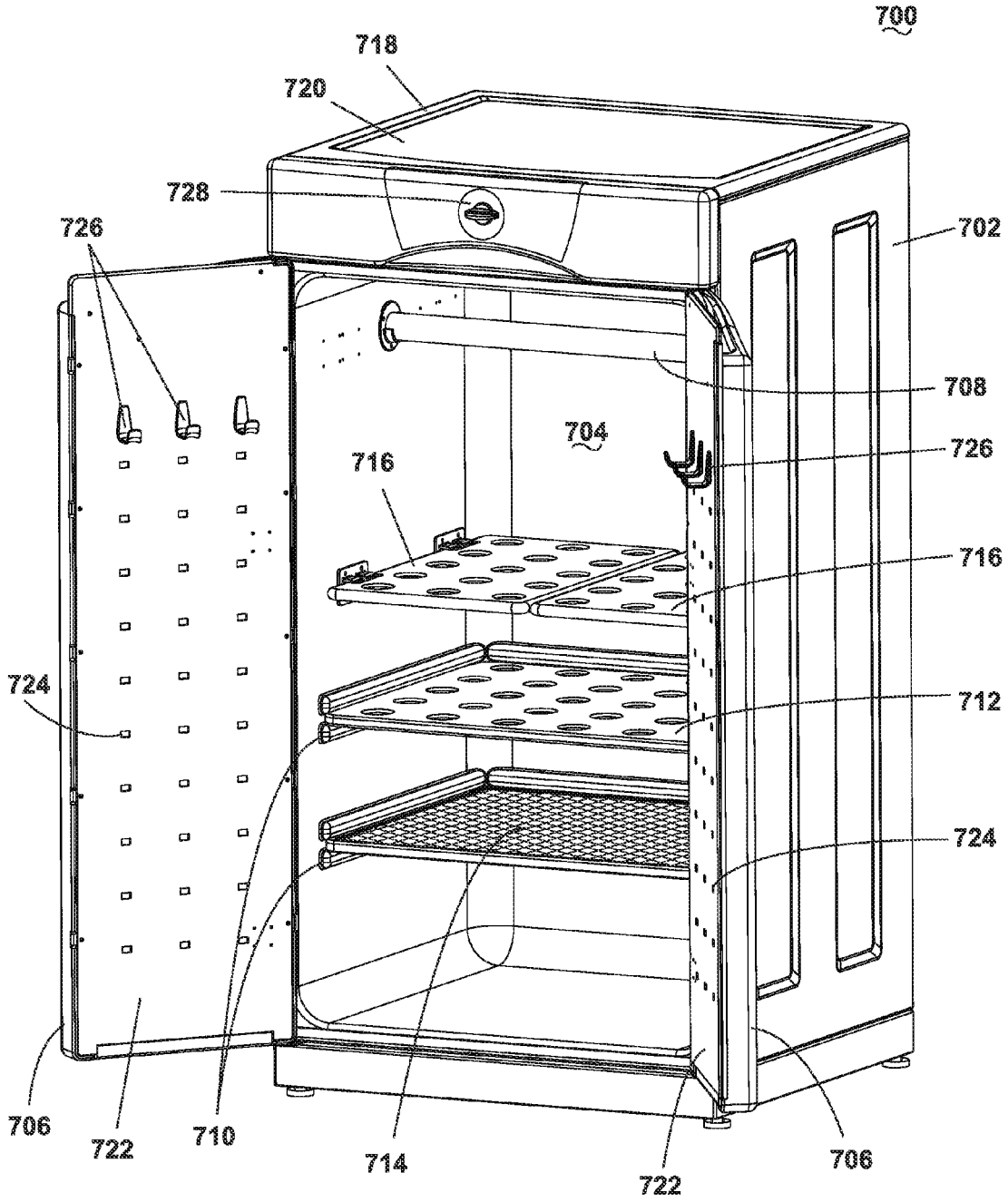

FIG. 100B is a perspective view of the drying function intermediate height cabinet module of FIG. 100A with the pair of doors in an opened position.

Figure 101A:
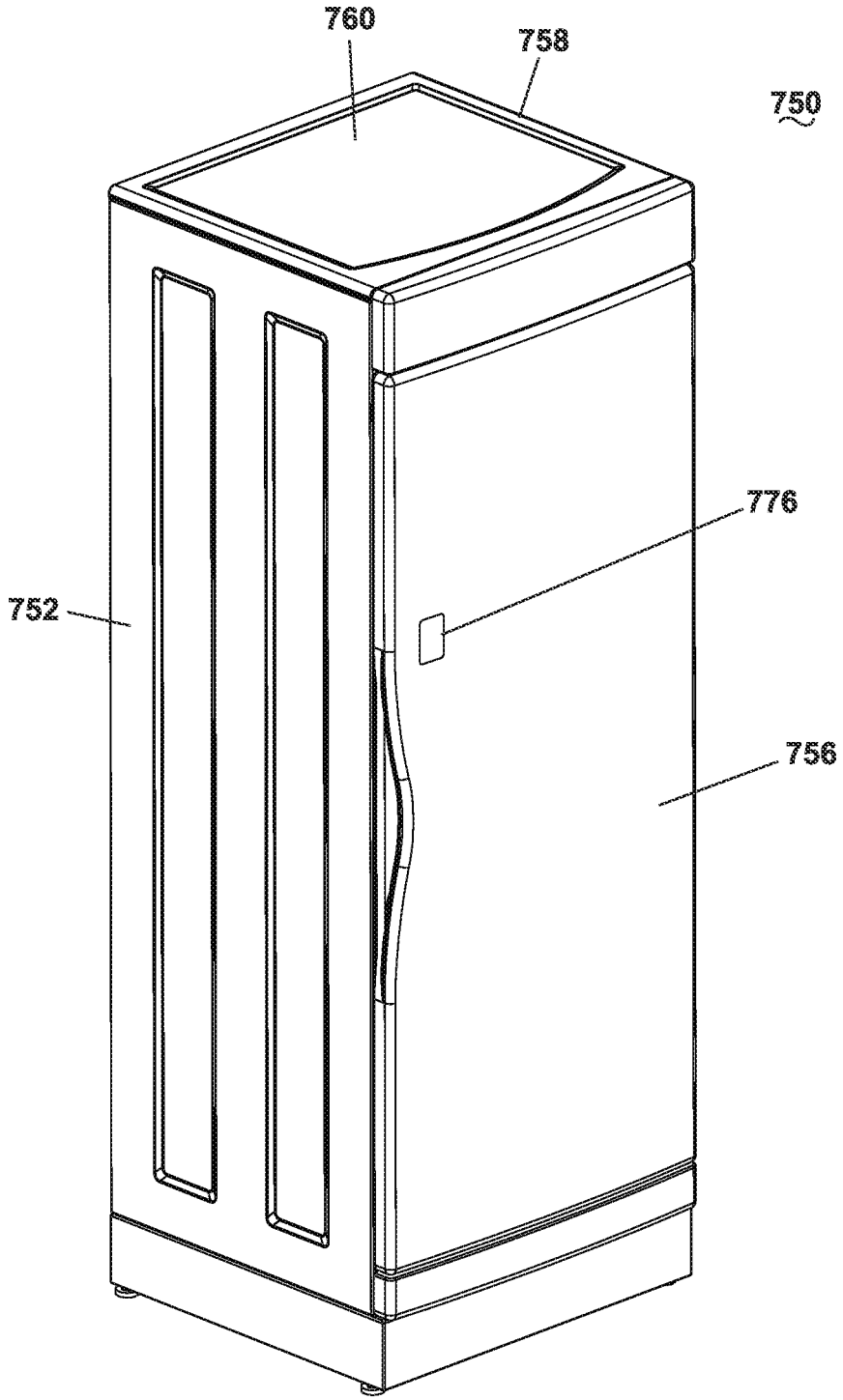

FIG. 101A is a perspective view of the double height cabinet module of FIG. 71E having a drying function and shown with a door in a closed position.

Figure 101B:
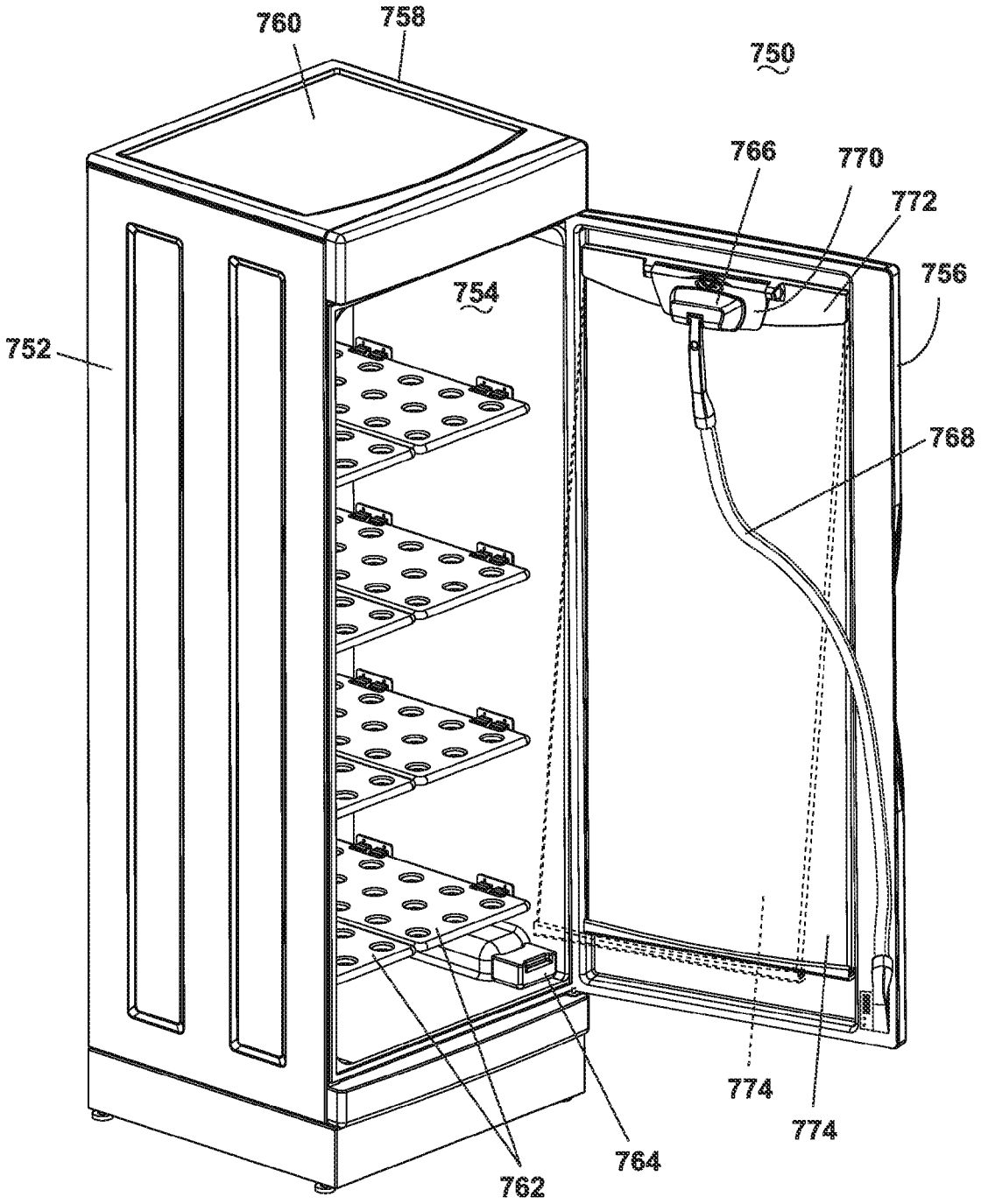

FIG. 101B is a perspective view of the drying function double height cabinet module of FIG. 101A with the door in an opened position.

Figure 102A:
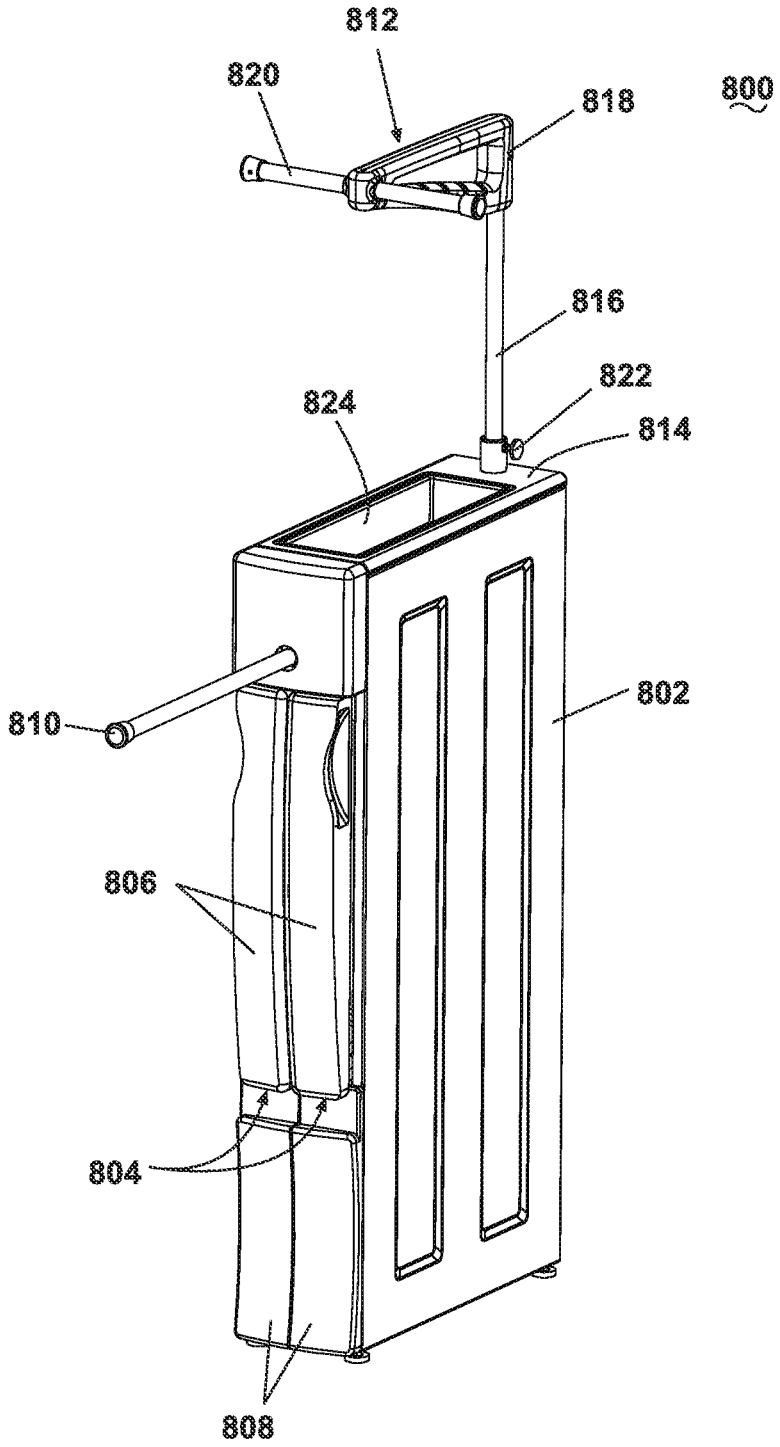

FIG. 102A is a perspective view of the intermediate height vertical module of FIG. 69A having a shelving function and shown with a pair of shelves in a retracted position.

Figure 102B:
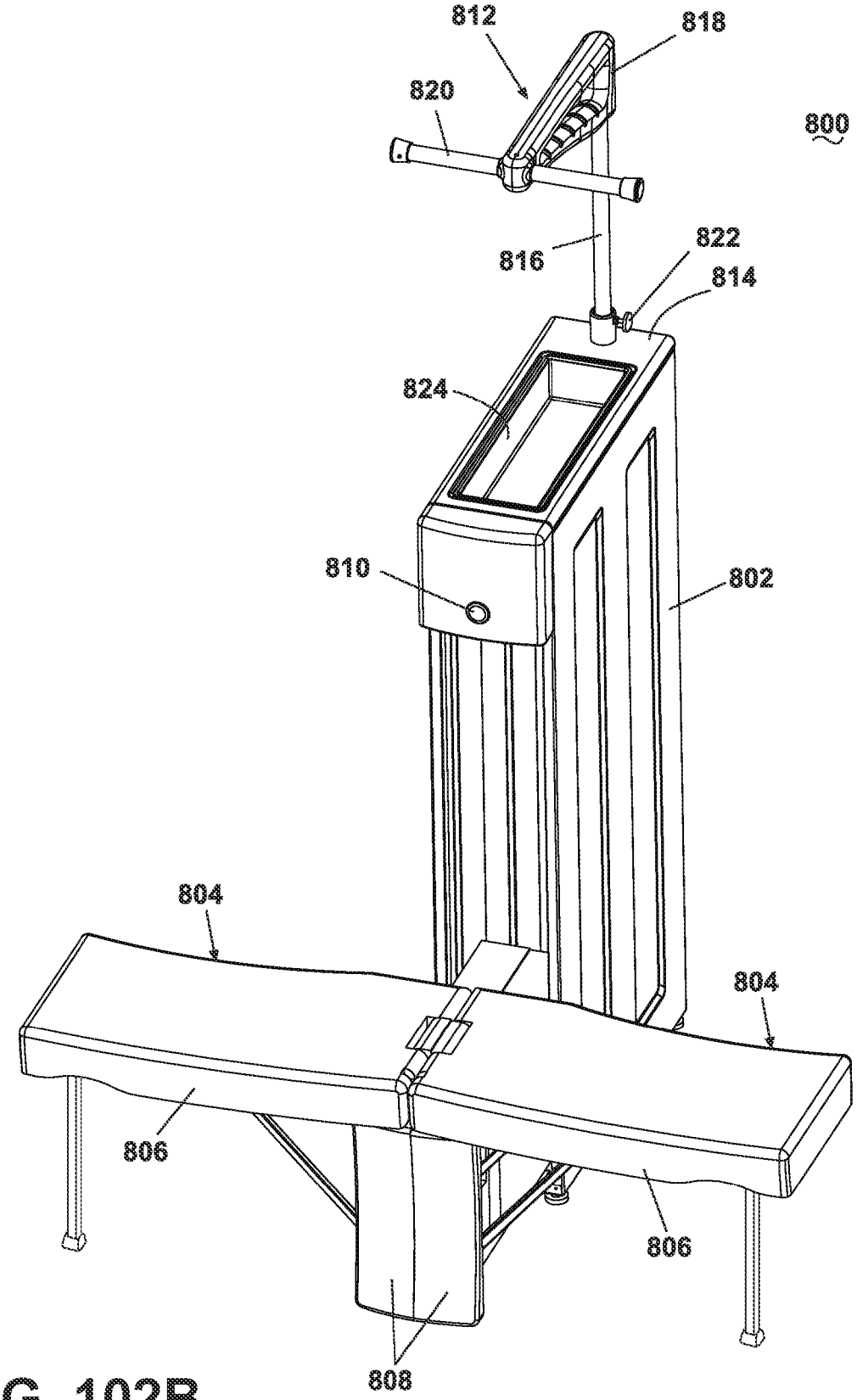

FIG. 102B is a perspective view of the shelving function intermediate height vertical module of FIG. 102A with the pair of shelves in an extended position.

Figure 103A:
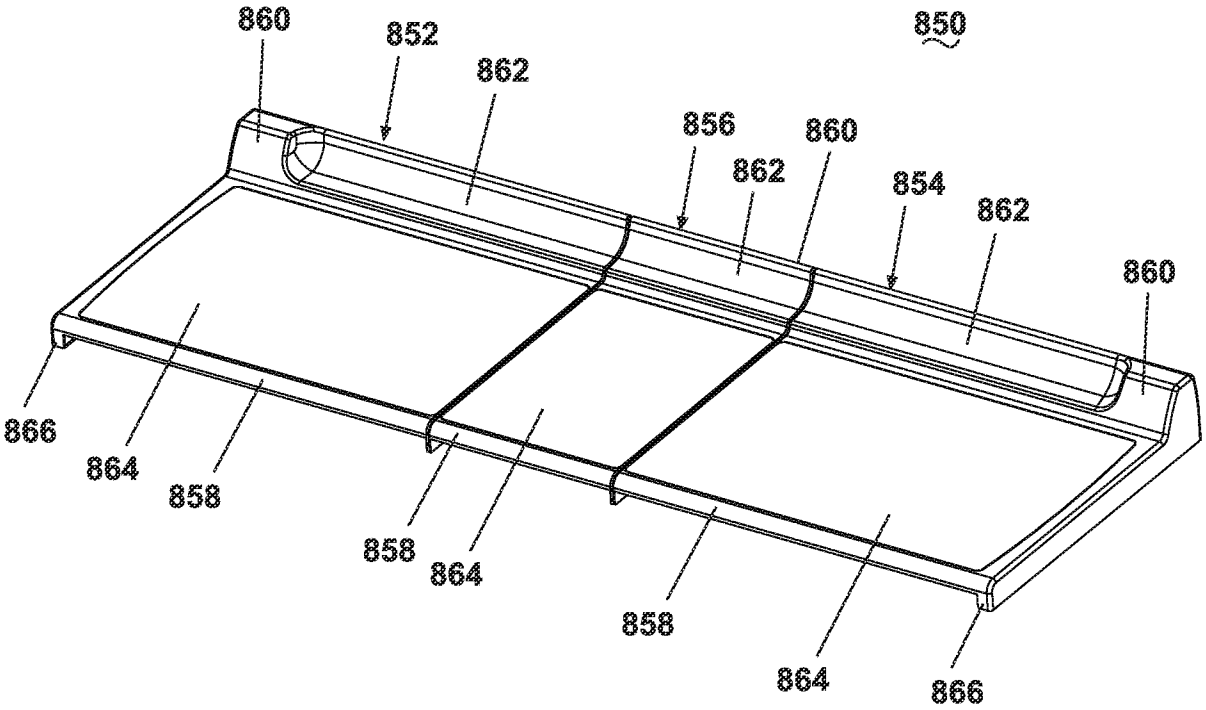

FIG. 103A is a perspective view of a segmented work surface in an assembled condition.

Figure 103B:
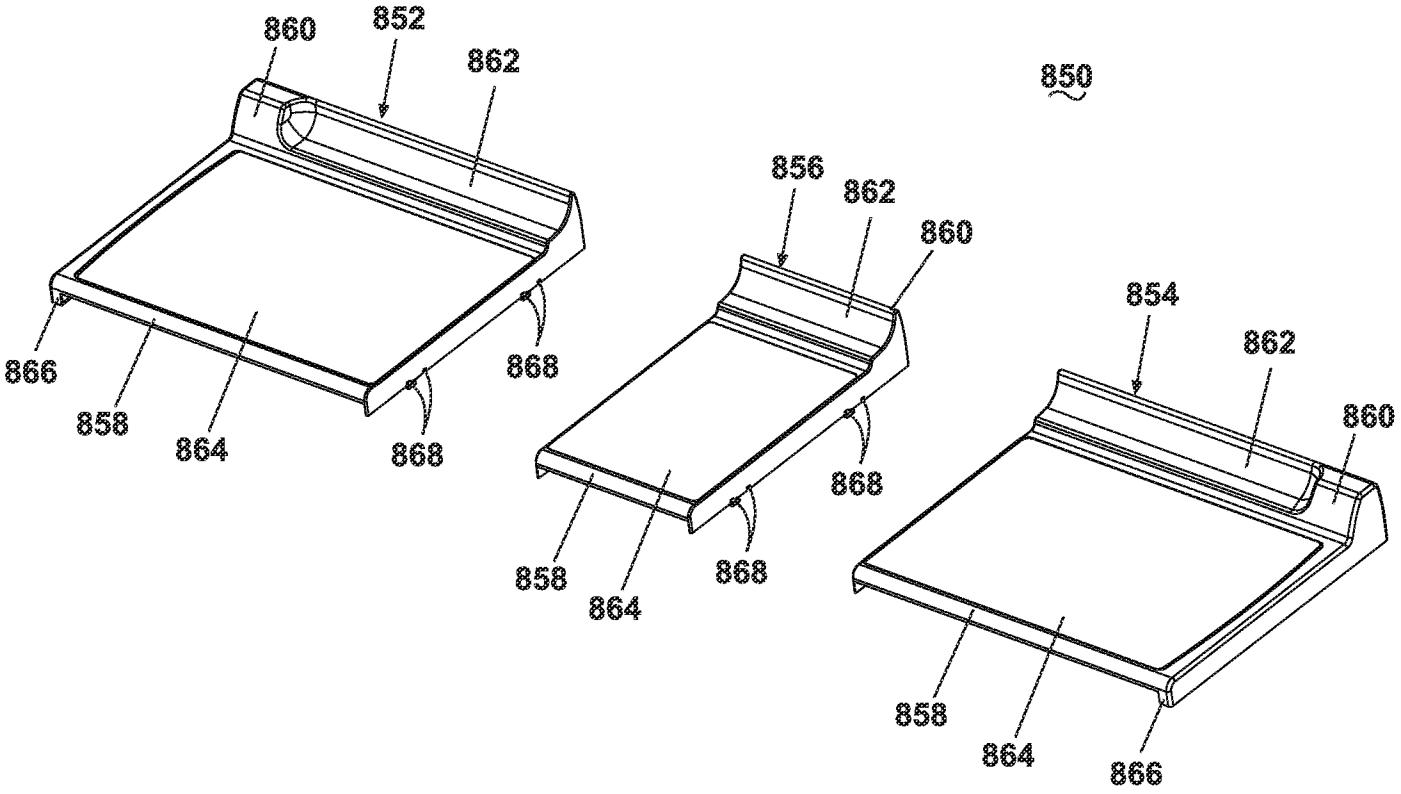

FIG. 103B is a perspective view the segmented work surface of FIG. 103A in a disassembled condition.

Figure 104:
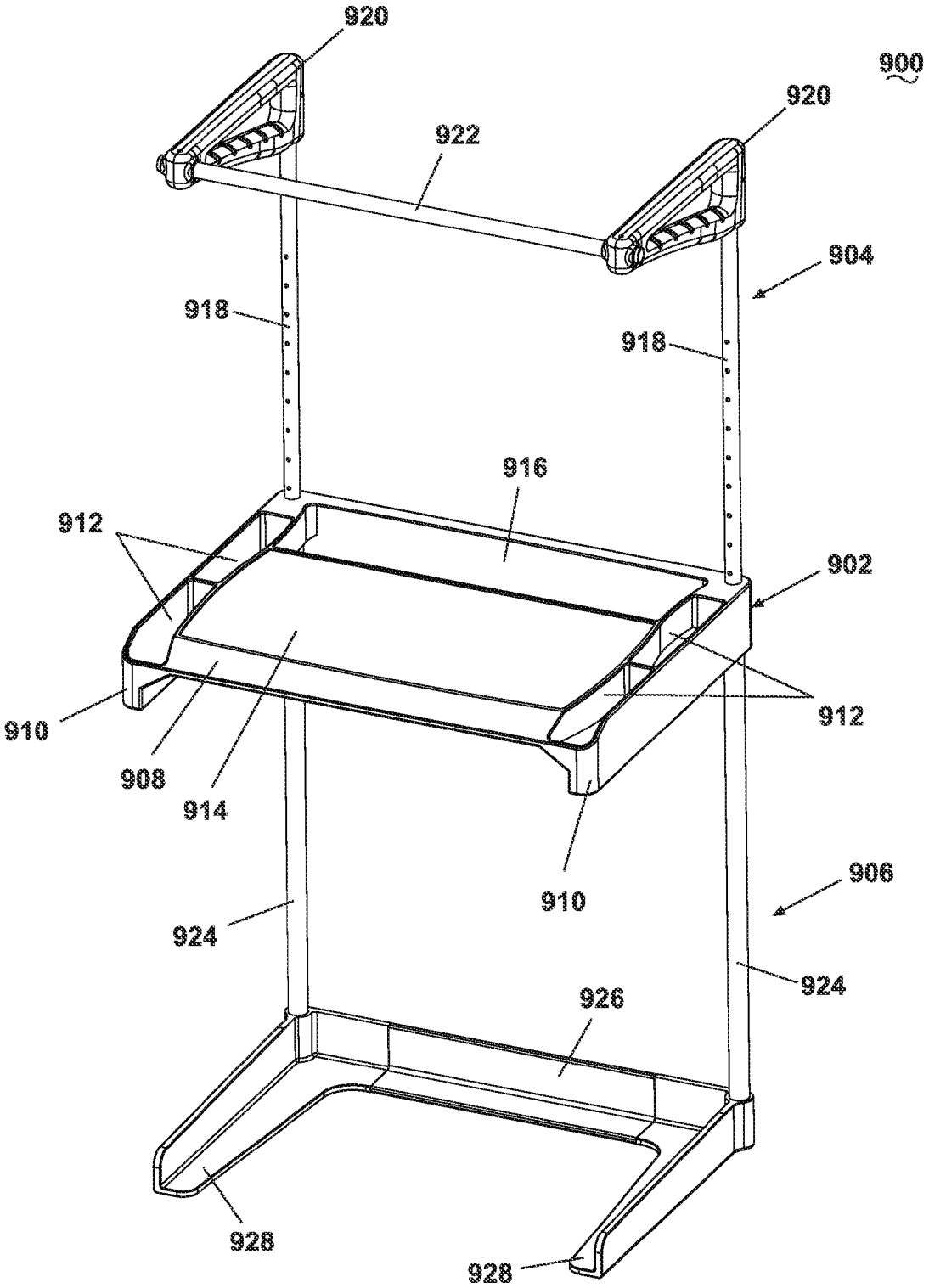

FIG. 104 is a perspective view of a single laundry appliance work surface.

Figure 105A:
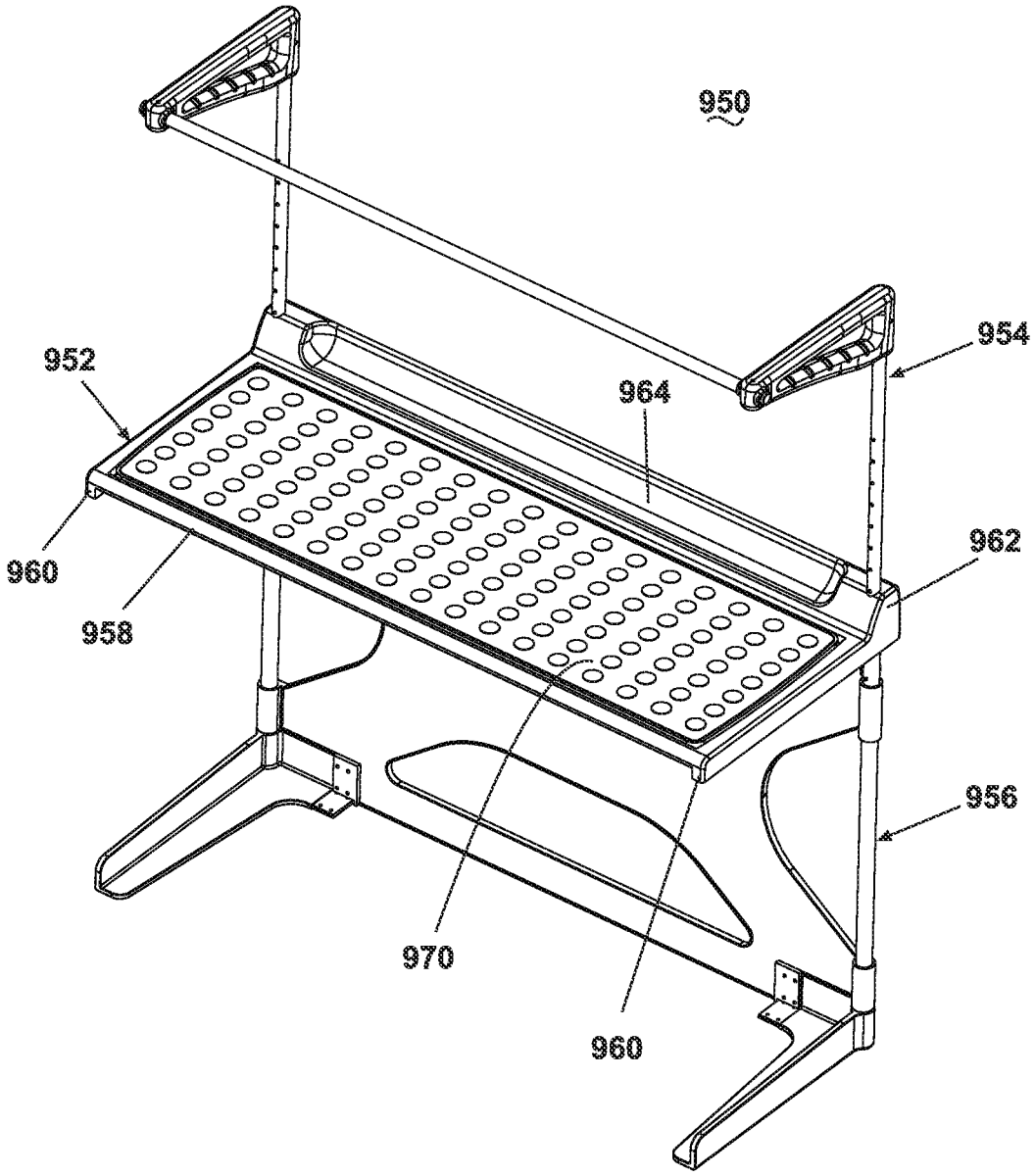

FIG. 105A is perspective view of a double laundry appliance work surface having a removable work surface shown with a first side facing upwards.

Figure 105B:
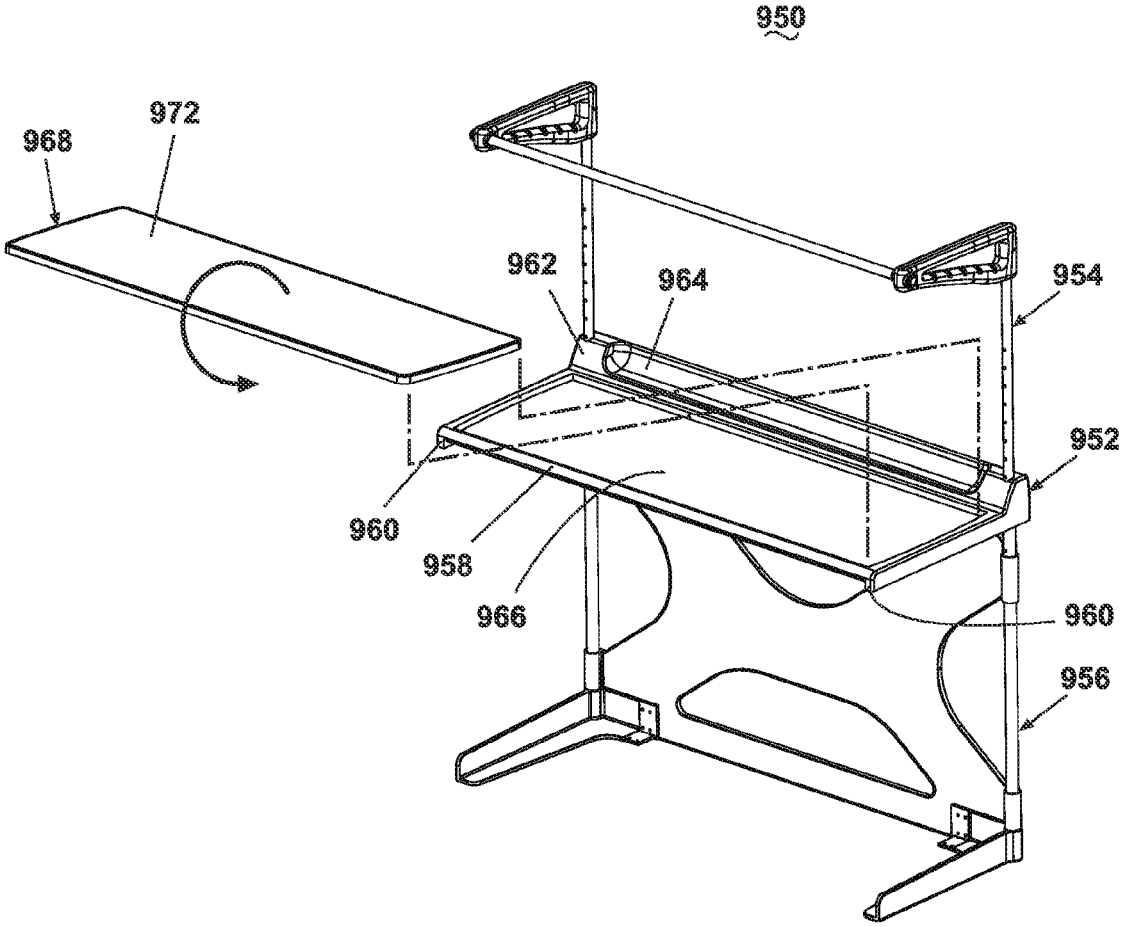

FIG. 105B is a perspective view of the double laundry appliance work surface of FIG. 105A with the removable work surface being flipped over so that a second side is facing upwards.

Figure 106A:
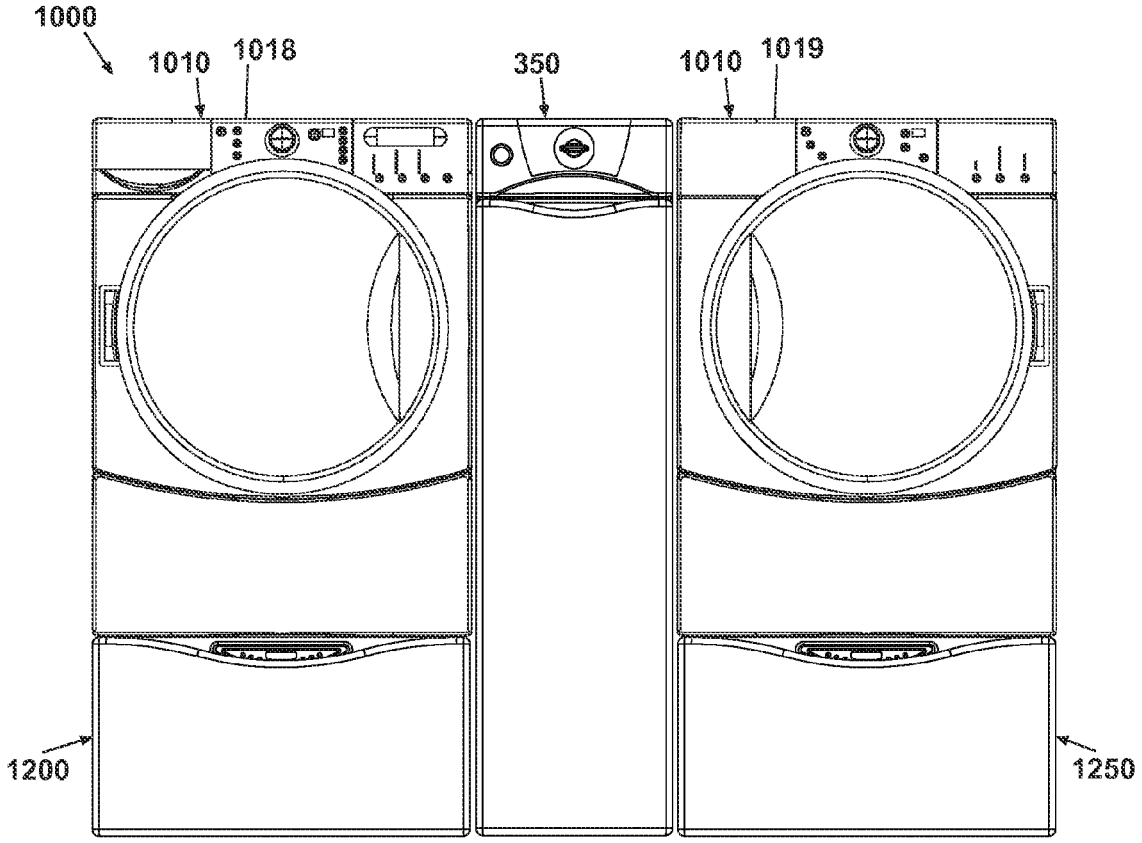

FIG. 106A is a front view of an implementation A of the modular laundry system.

Figure 86A:
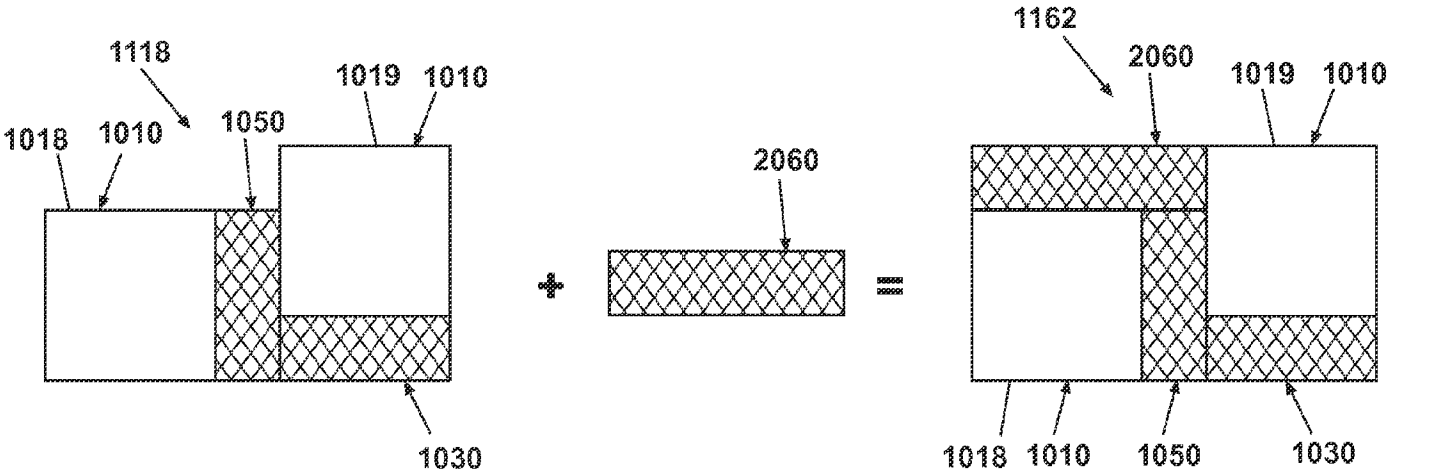
Figure 86B:
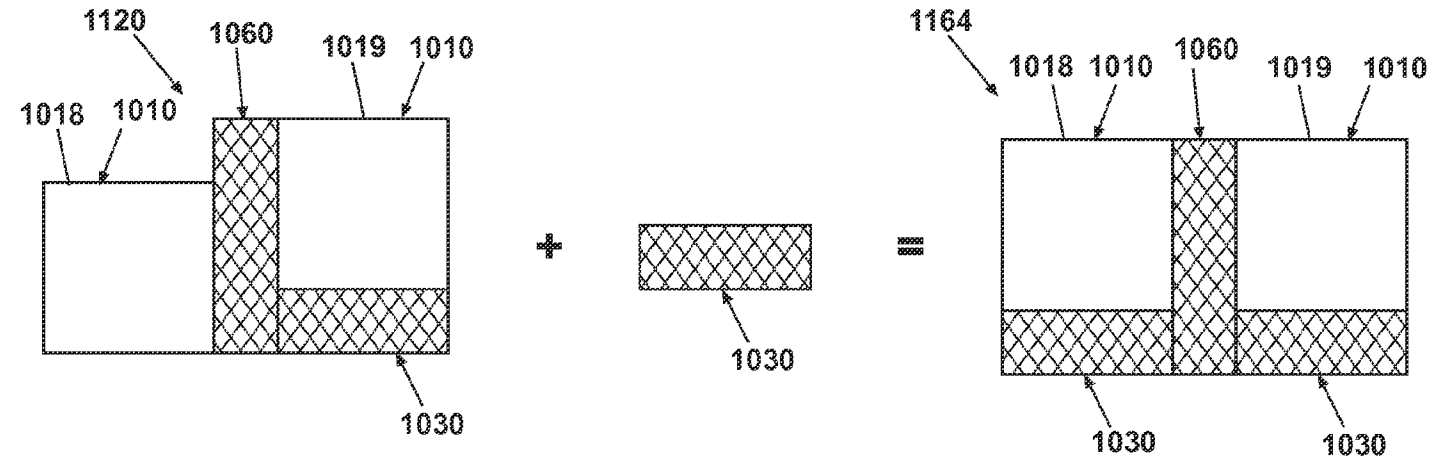
Figure 106B:
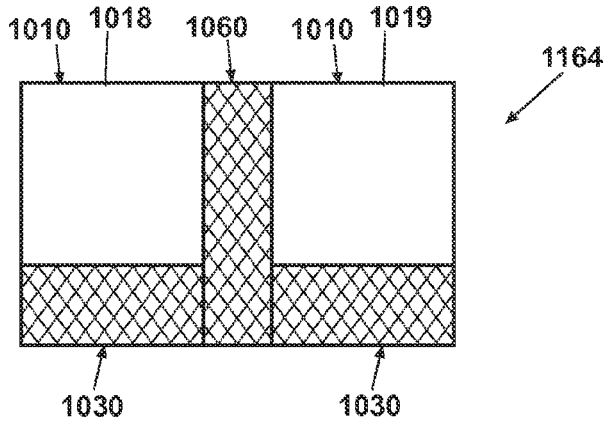

FIG. 106B is a schematic view of the customized configuration M of FIG. 86B, which corresponds to the implementation A of FIG. 106A.

Figure 106C:
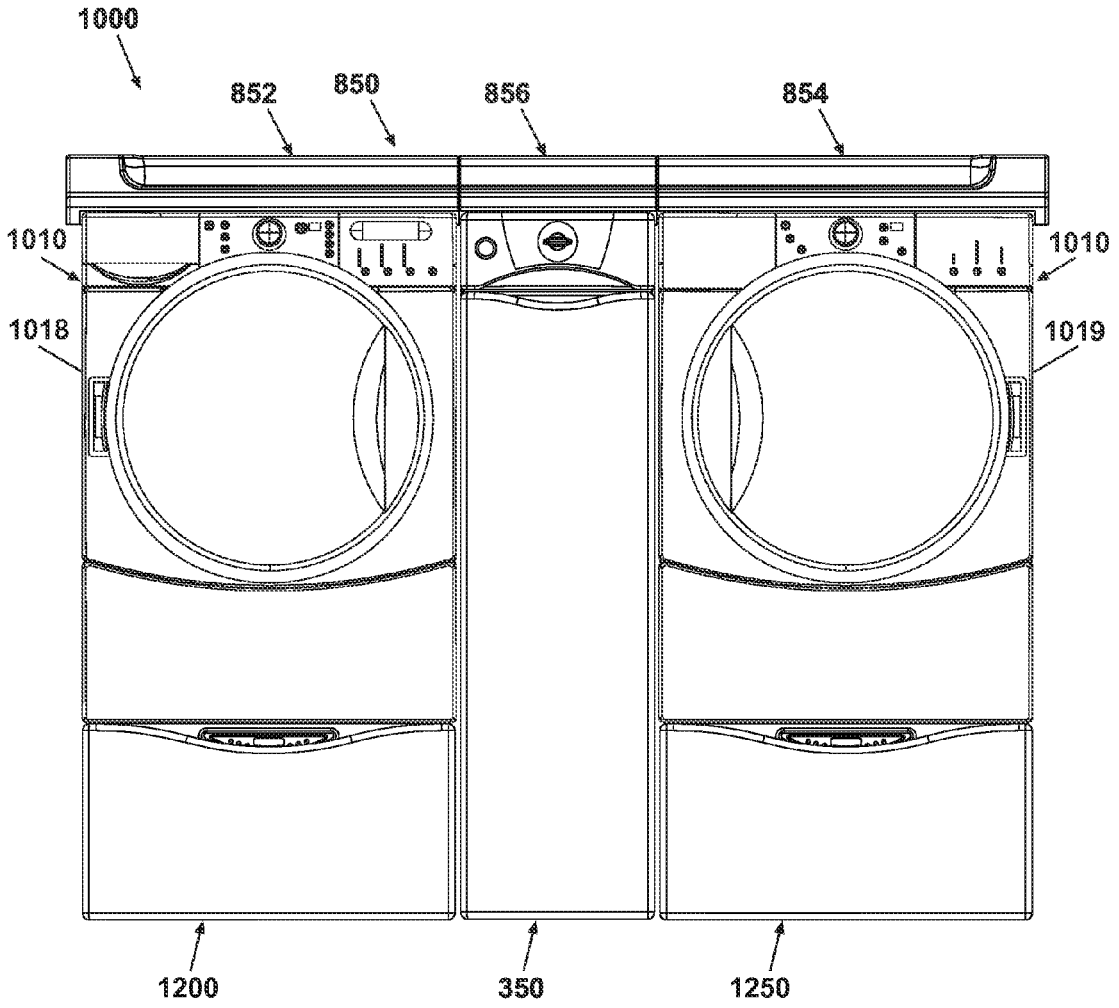

FIG. 106C is a front view of the implementation A of FIG. 106A incorporating the segmented work surface of FIG. 103A.

Figure 107A:
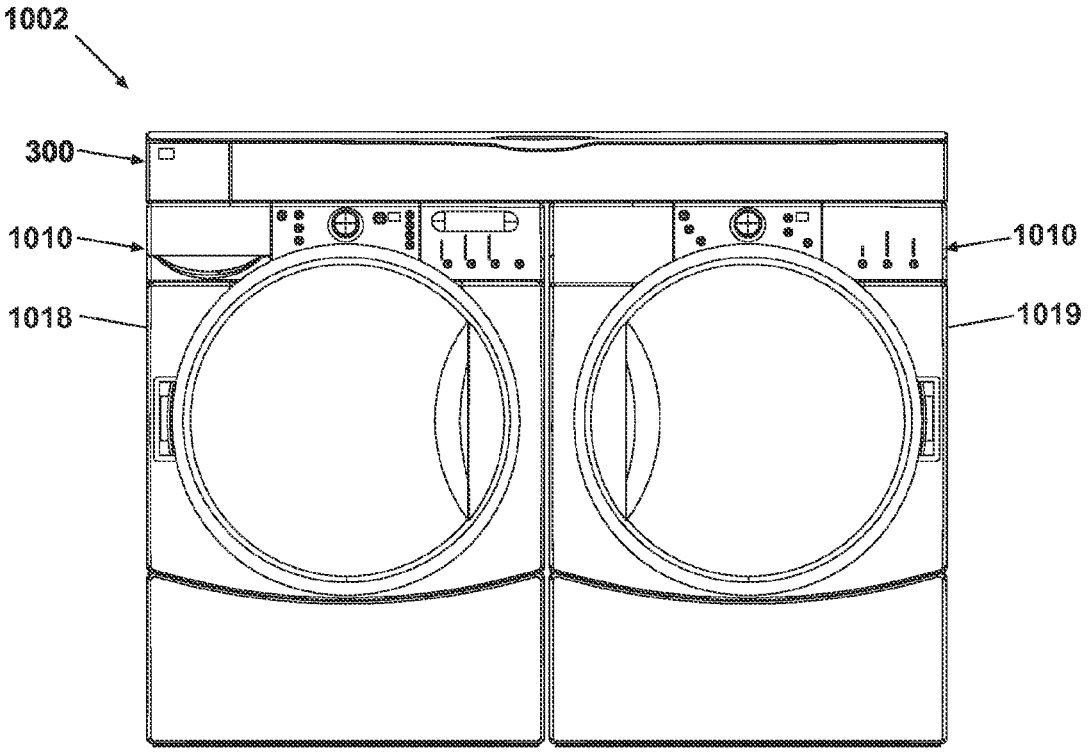

FIG. 107A is a front view of an implementation B of the modular laundry system.

Figure 76:
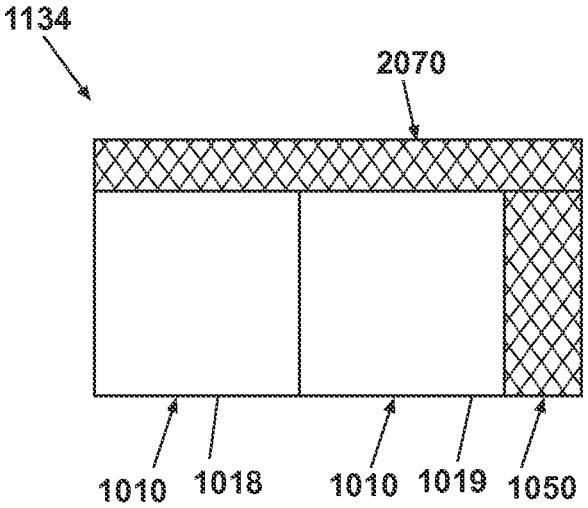
FIG. 76 is a schematic view of a core configuration R formed by two of the laundry appliances of FIG. 67A and one of the single height vertical modules of FIG. 69A in a horizontal arrangement and the greater than double width horizontal module of FIG. 70E vertically stacked with the laundry appliances and the single height vertical module.
Figure 107B:
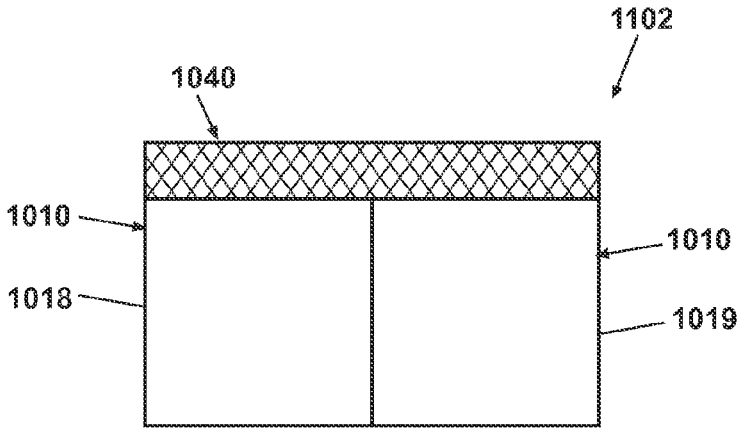

FIG. 107B is a schematic view identical to FIG. 76 of the core configuration B, which corresponds to the implementation B of FIG. 107A.

Figure 107C:
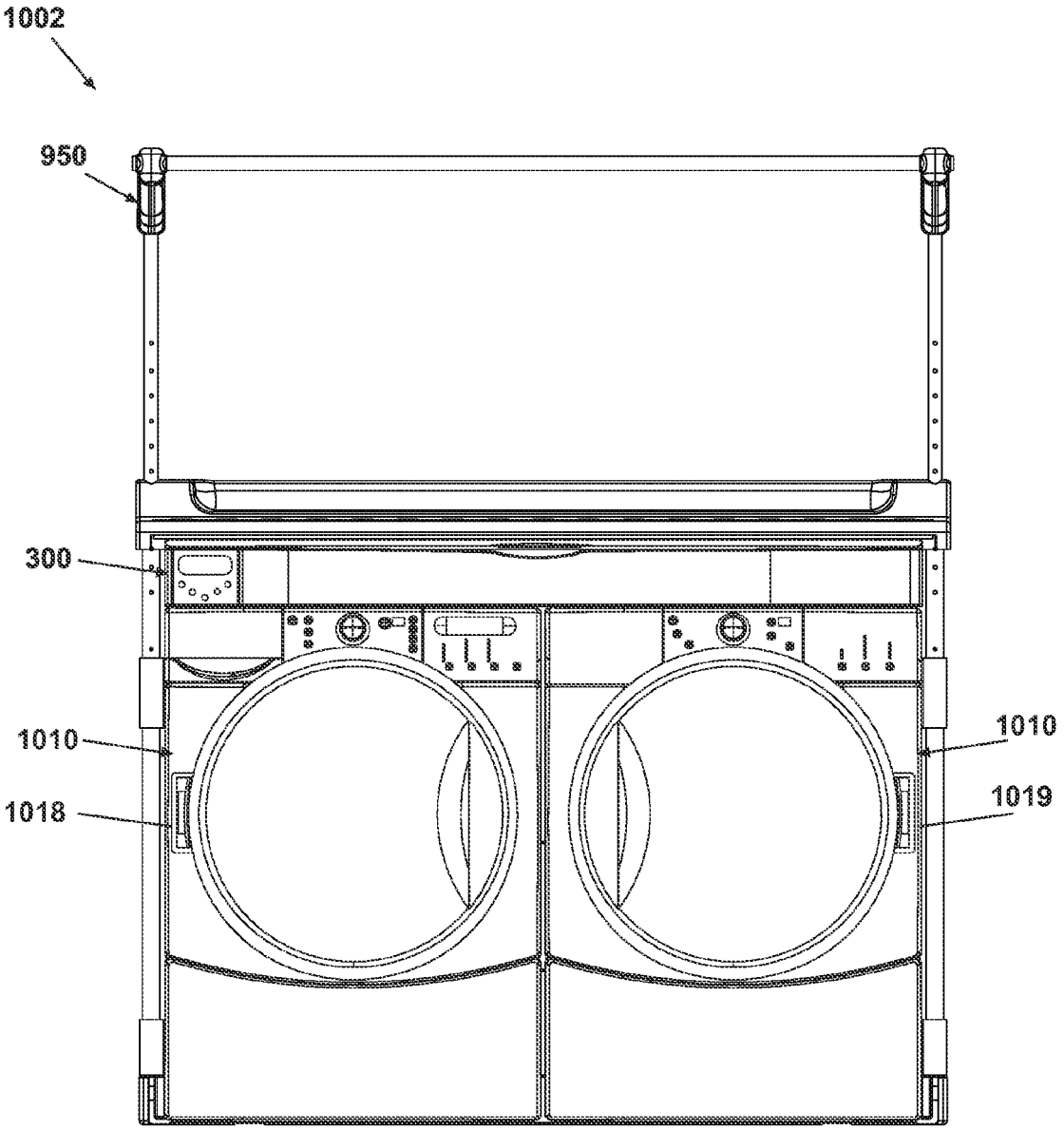

FIG. 107C is a front view of the implementation B of FIG. 107A incorporating the double laundry appliance work surface of FIG. 105A.

Figure 108A:
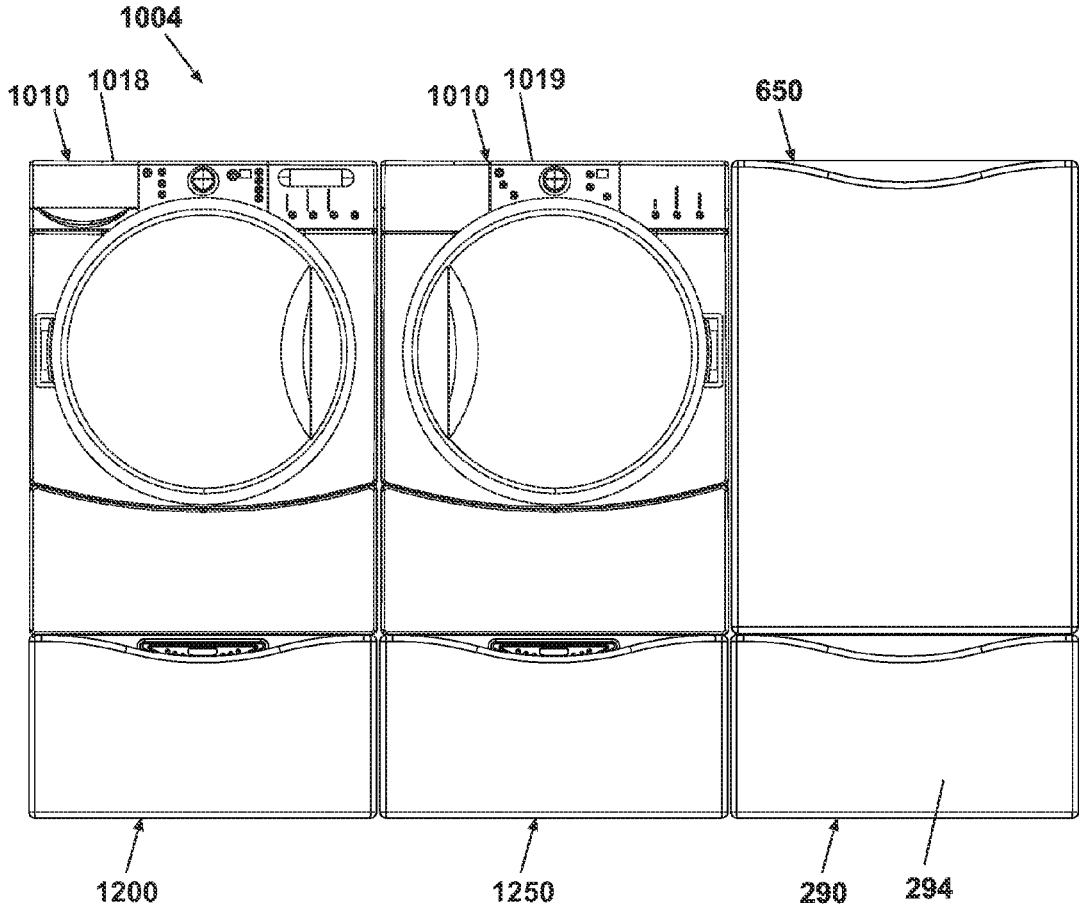

FIG. 108A is a front view of an implementation C of the modular laundry system.

Figure 82A:
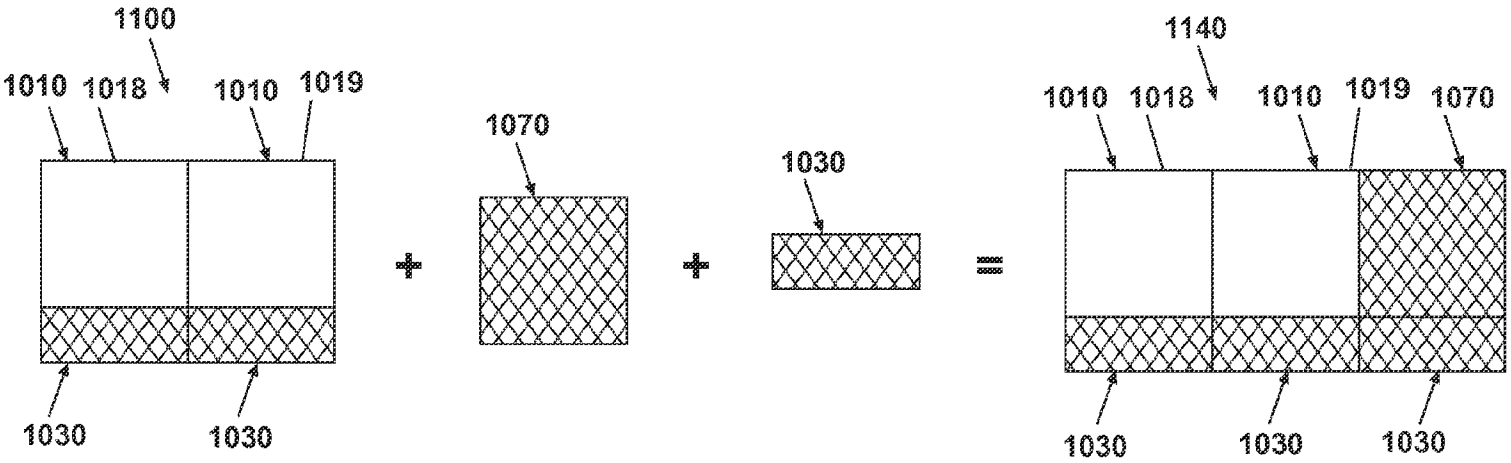
FIG. 82A is a schematic view illustrating construction of a customized configuration A formed from the core configuration A of FIG. 74A.
Figure 108B:
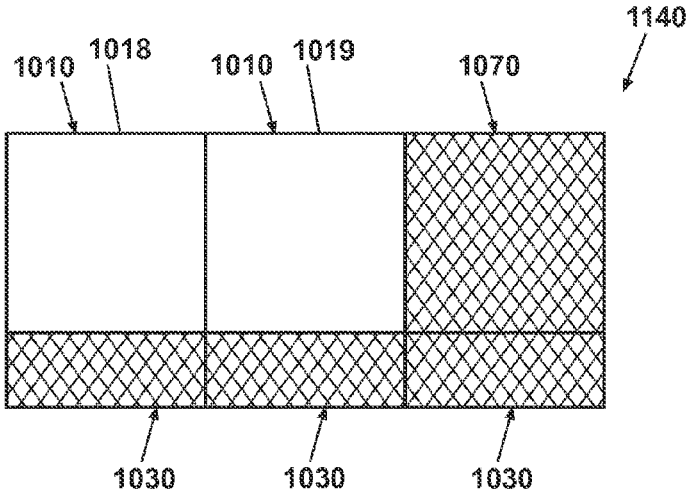

FIG. 108B is a schematic view of the customized configuration A of FIG. 82A, which corresponds to the implementation C of FIG. 108A.

Figure 38:
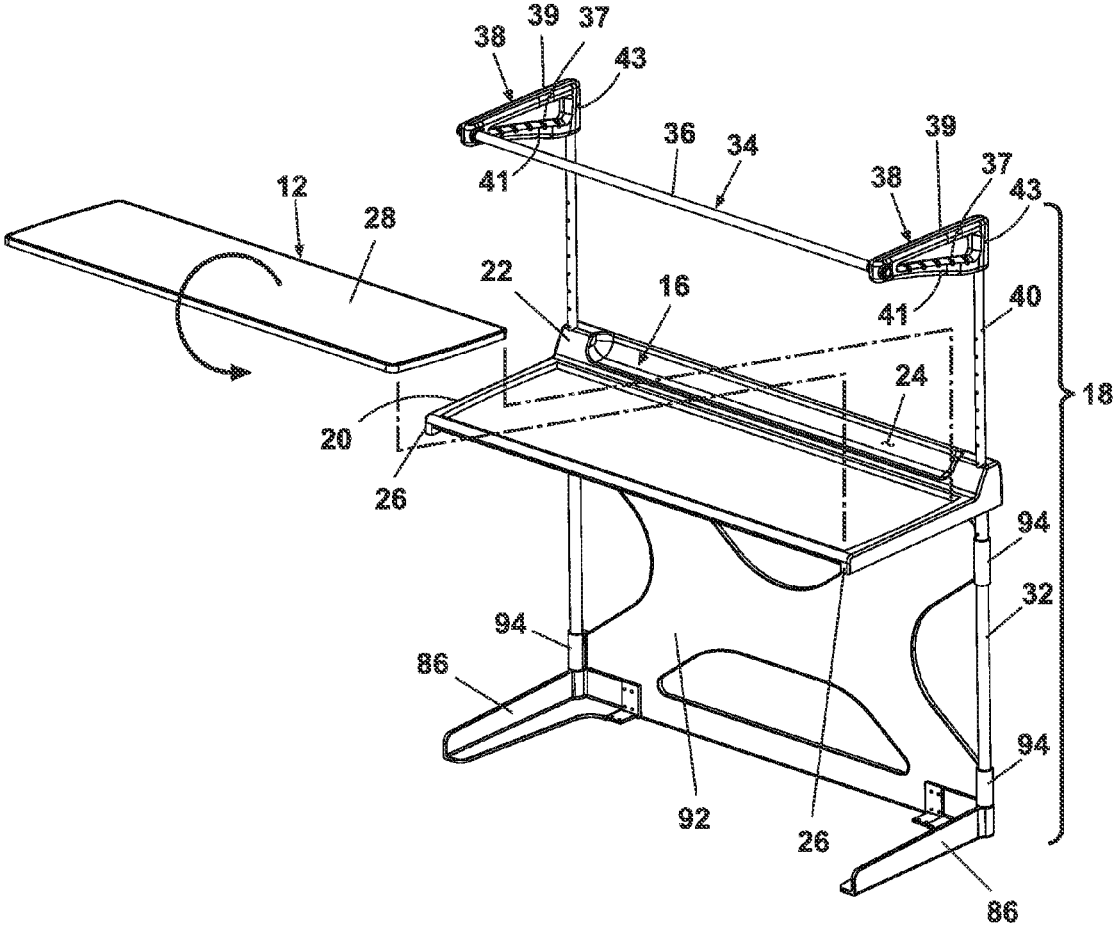
FIG. 38 is a perspective view of the worksurface from the embodiment of the modular laundry system shown in FIG. 37A in which the worksurface and hanging area are provided on a floor standing stand and at an insert of the worksurface is reversible to provide for a plurality of laundry-related functions to be performed on the worksurface depending upon which side of the insert is exposed.
Figure 108C:
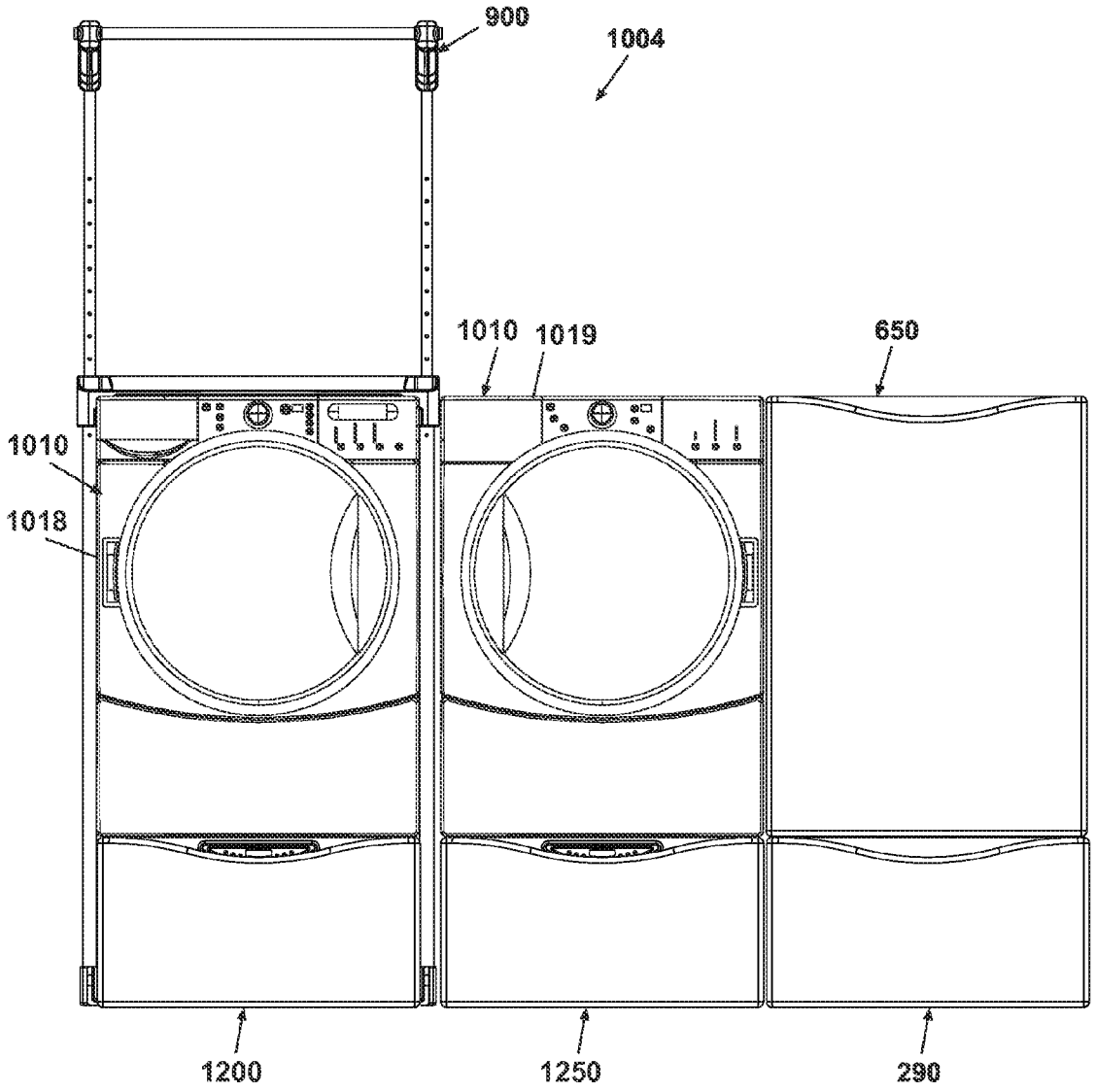

FIG. 108C is a front view of the implementation C of FIG. 108A incorporating the single laundry appliance work surface of FIG. 38.

Figure 109A:
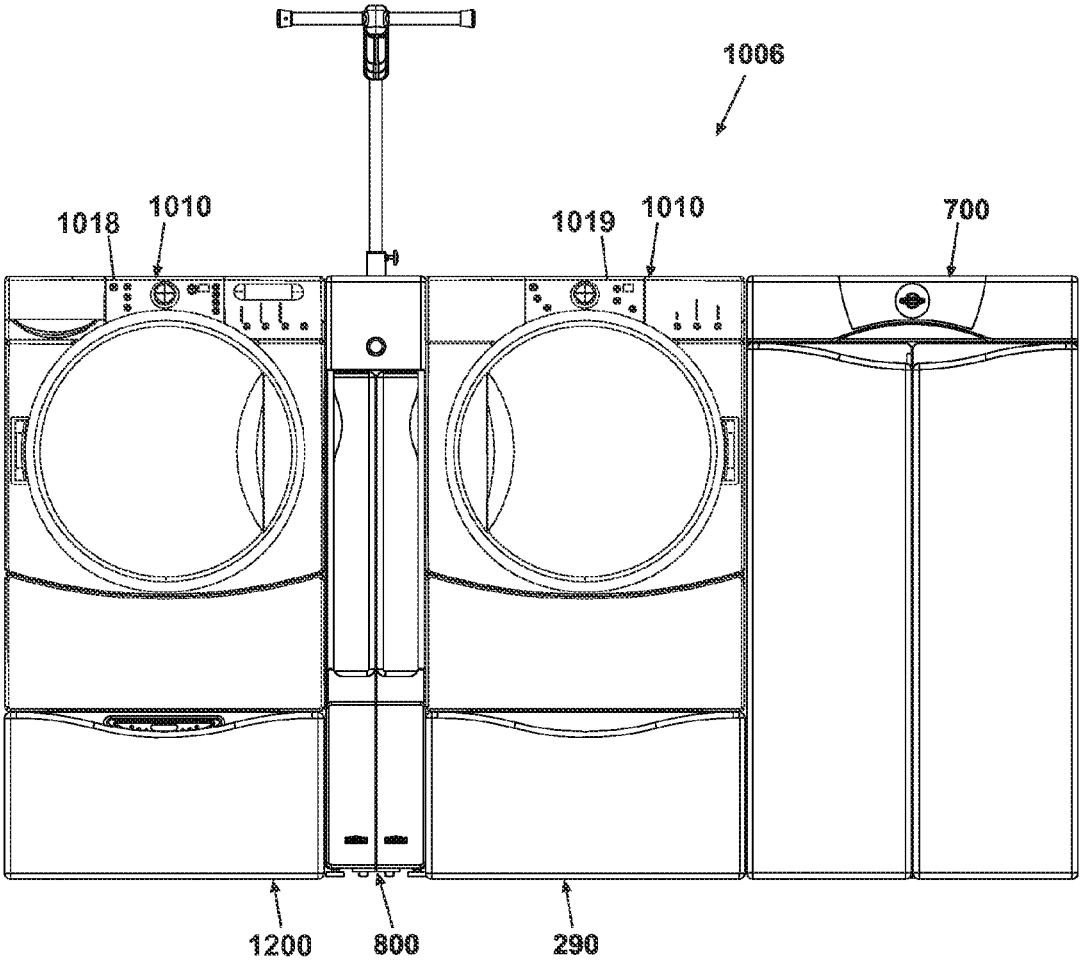

FIG. 109A is a front view of an implementation D of the modular laundry system.

Figures 84A, 84B, 84C:
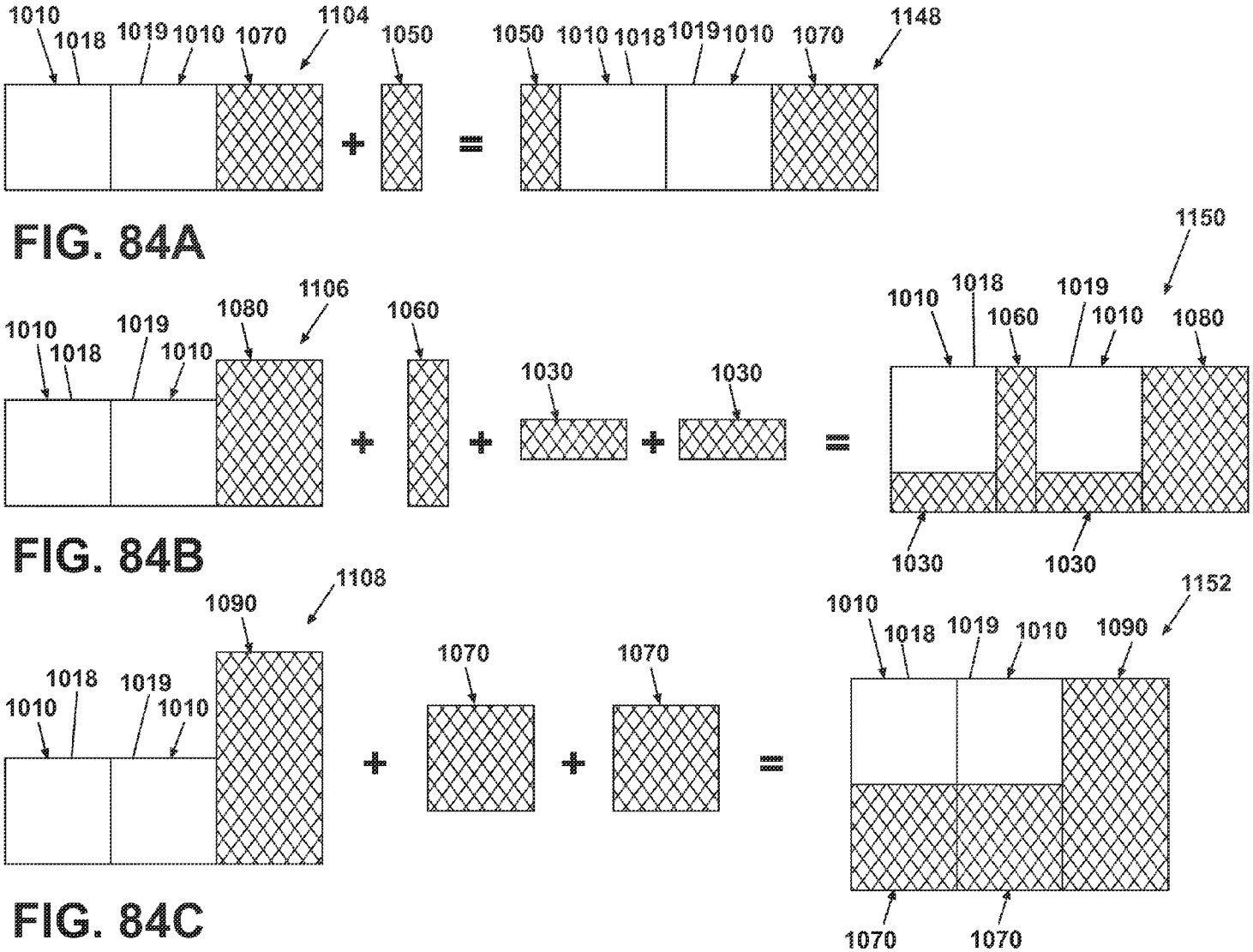
Figure 109B:
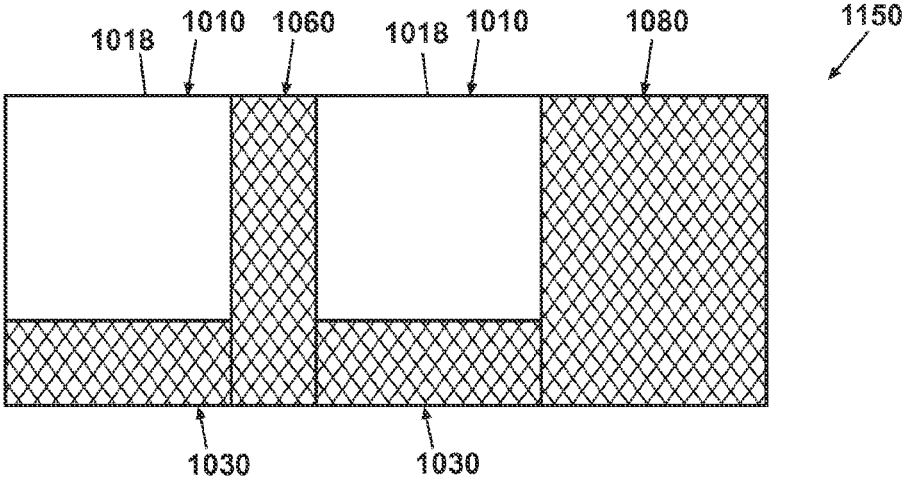

FIG. 109B is a schematic view of the customized configuration F of FIG. 84B, which corresponds to the implementation D of FIG. 109A.

Figure 110A:
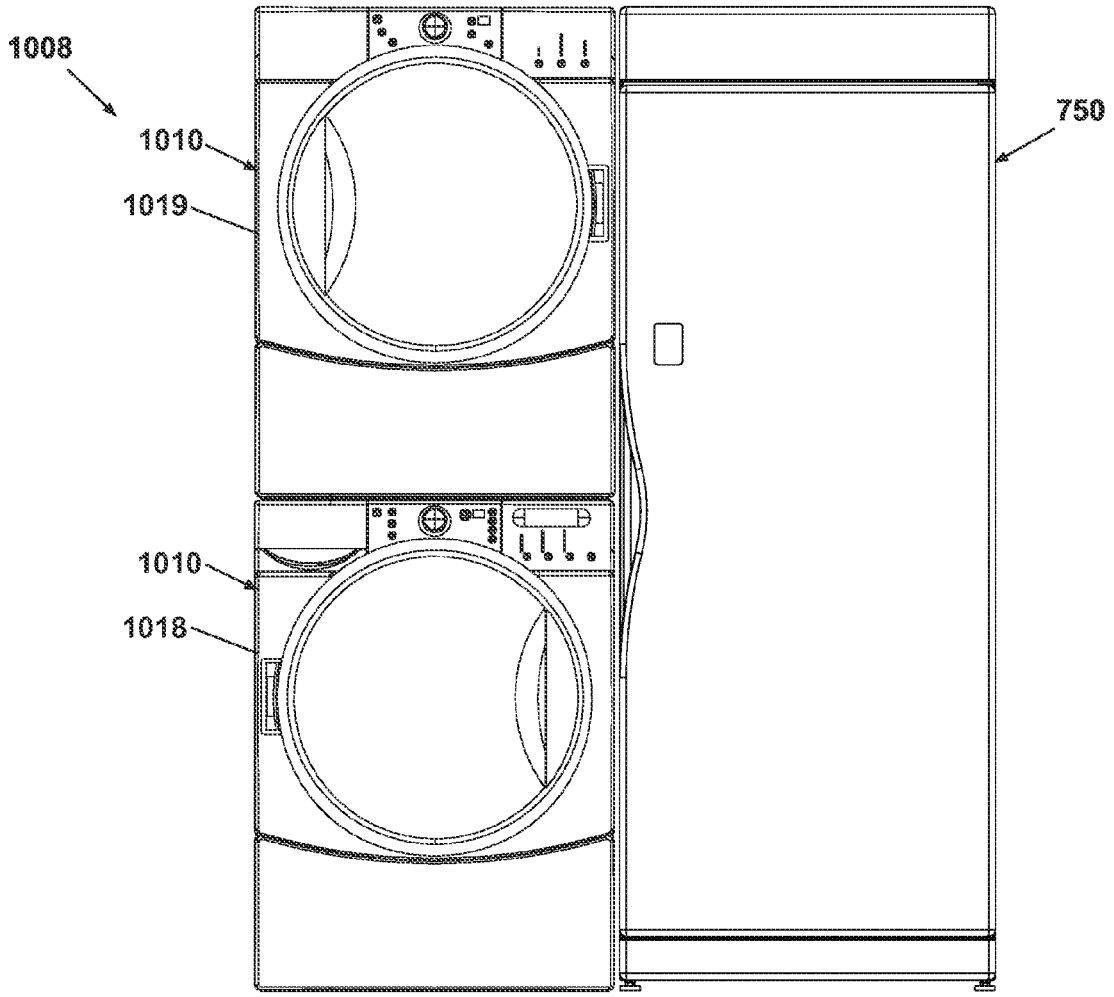

FIG. 110A is a front view of an implementation E of the modular laundry system.

Figure 78A:
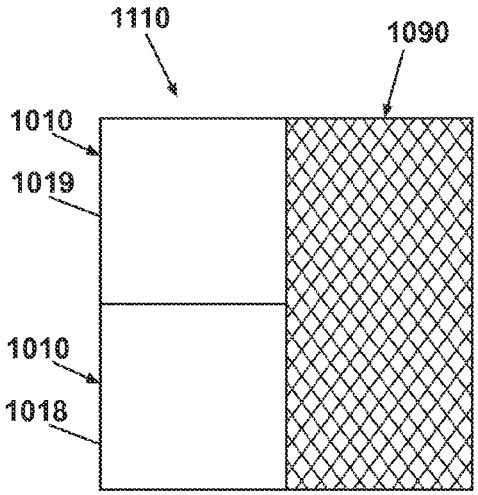
FIG. 78A is a schematic view of a core configuration F formed by two of the laundry appliances of FIG. 67A in a vertical arrangement and the double height cabinet module of FIG. 71E positioned adjacent to the laundry appliances.
Figure 78B:
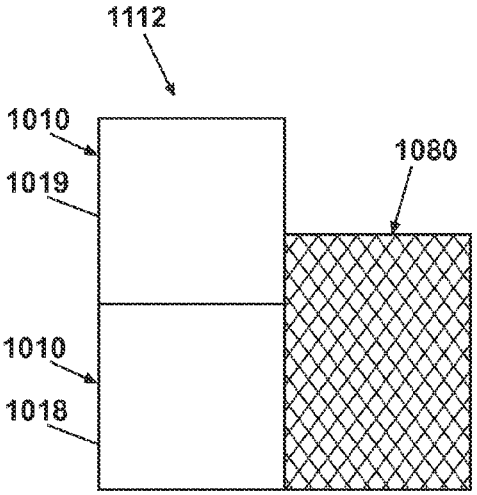
FIG. 78B is a schematic view of a core configuration G formed by two of the laundry appliances of FIG. 67A in a vertical arrangement and the intermediate height cabinet module of FIG. 71C positioned adjacent to the laundry appliances.
Figure 110B:
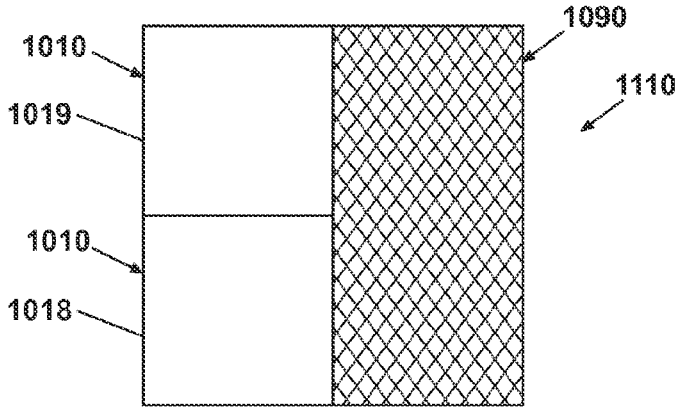

FIG. 110B is a schematic view identical to FIG. 78A of the core configuration F, which corresponds to the implementation E of FIG. 110A.

Figure 111A:
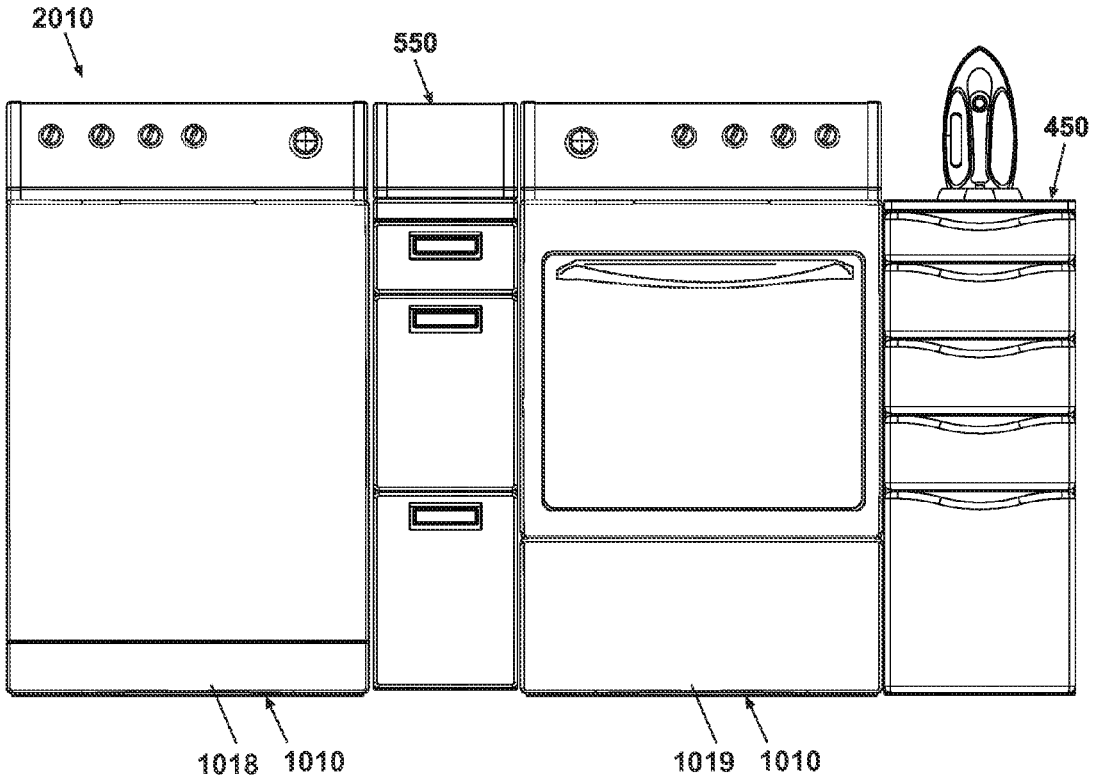

FIG. 111A is a front view of an implementation F of the modular laundry system.

Figure 111B:
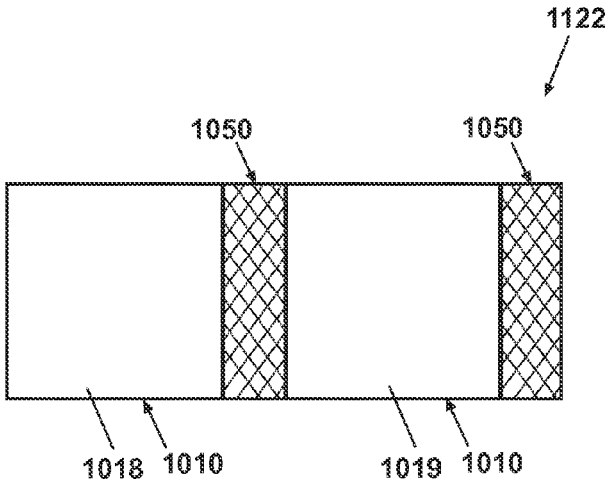

FIG. 111B is a schematic view of the core configuration L of FIG. 80A, which corresponds to the implementation F of FIG. 111A.

Figure 111C:
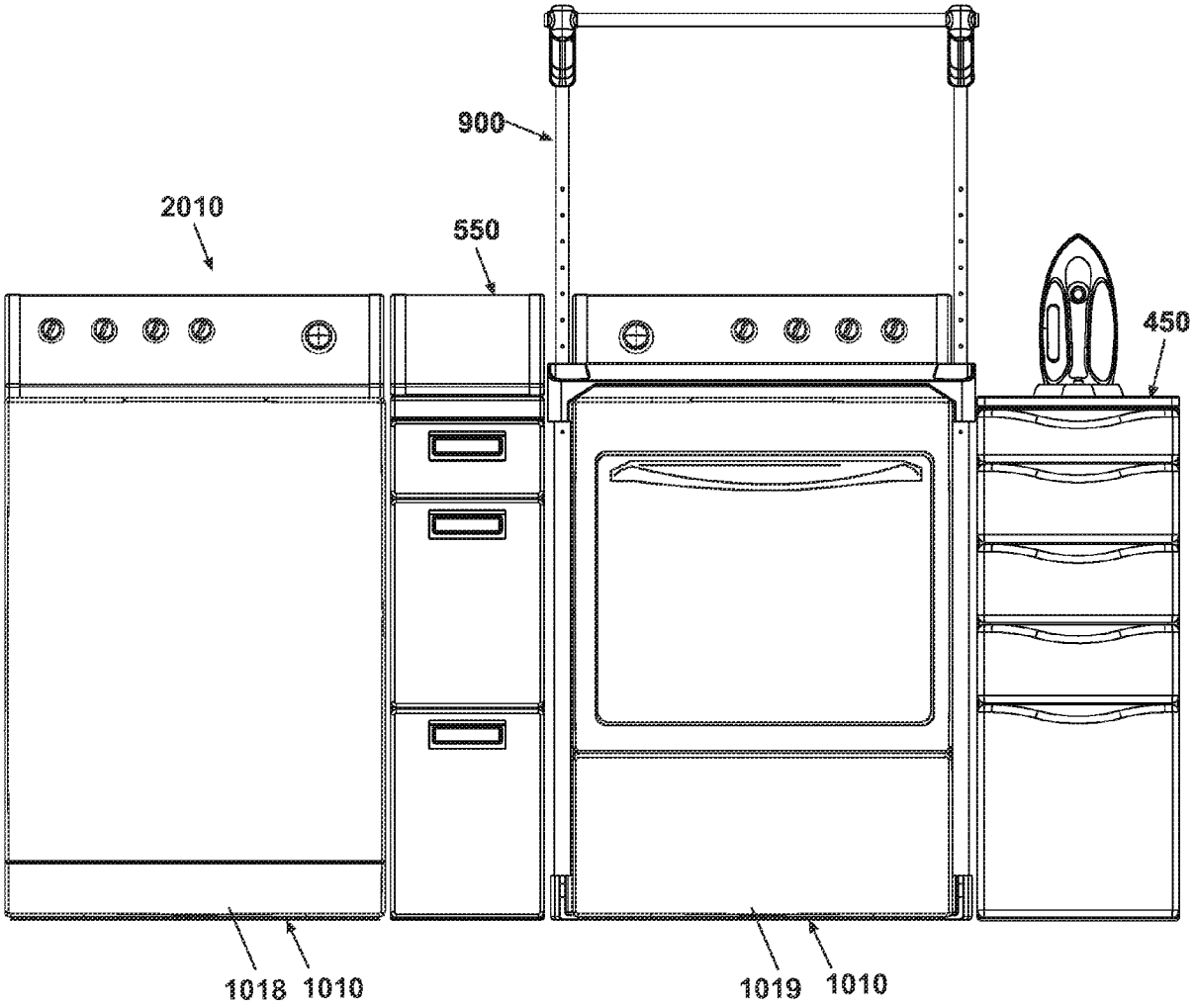

FIG. 111C is a front view of the implementation F of FIG. 111A incorporating the single laundry appliance work surface of FIG. 38.

Figure 112A:
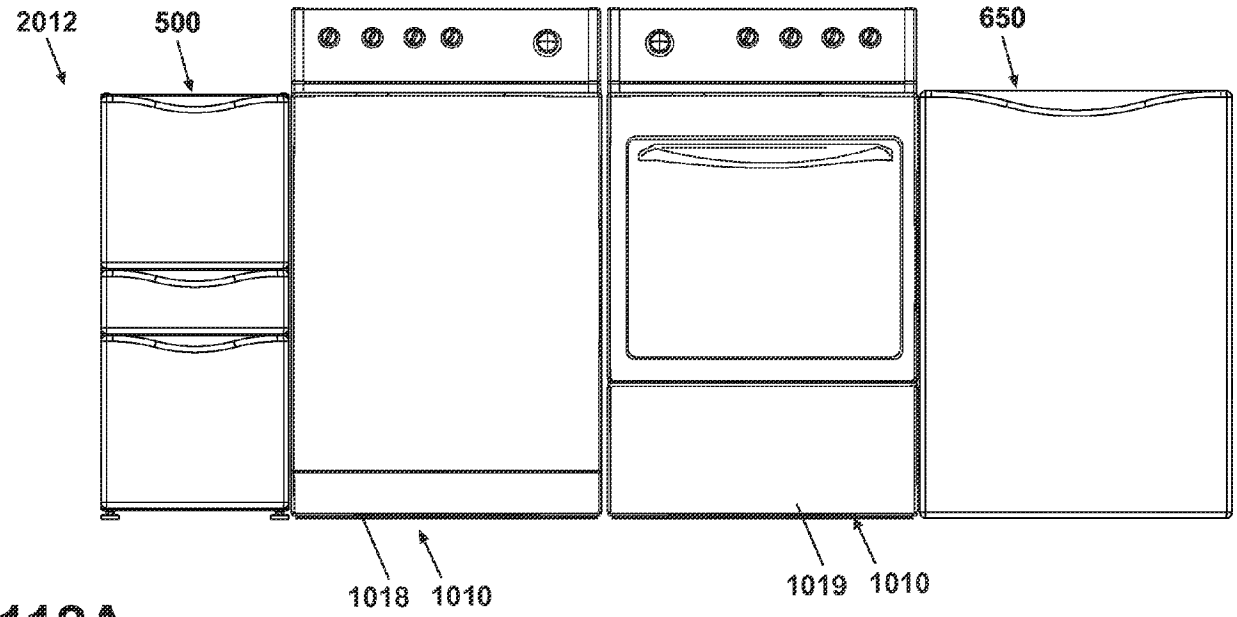

FIG. 112A is a front view of an implementation G of the modular laundry system.

Figure 112B:
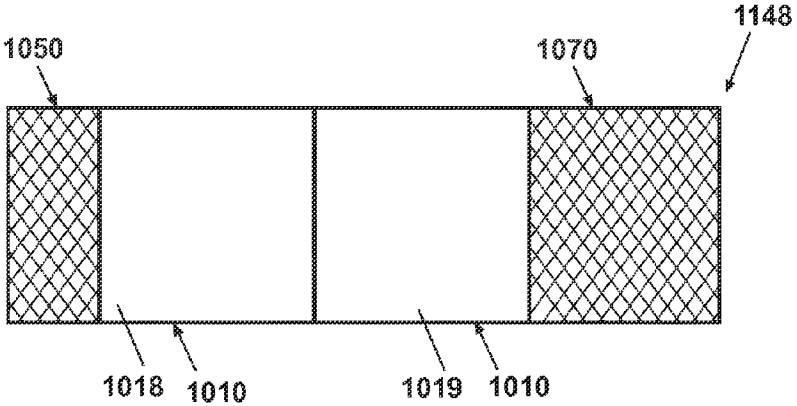

FIG. 112B is a schematic view of the customized configuration E of FIG. 84A, which corresponds to the implementation G of FIG. 112A.

Figure 77A:
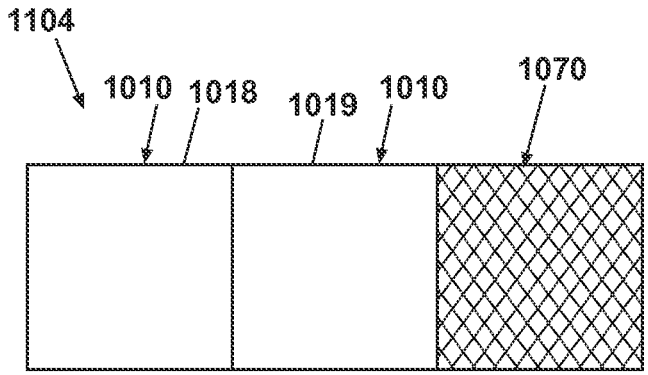
FIG. 77A is a schematic view of a core configuration C formed by two of the laundry appliances of FIG. 67A in a horizontal arrangement and the single height cabinet module of FIG. 71A positioned adjacent to the laundry appliances.
Figure 113:
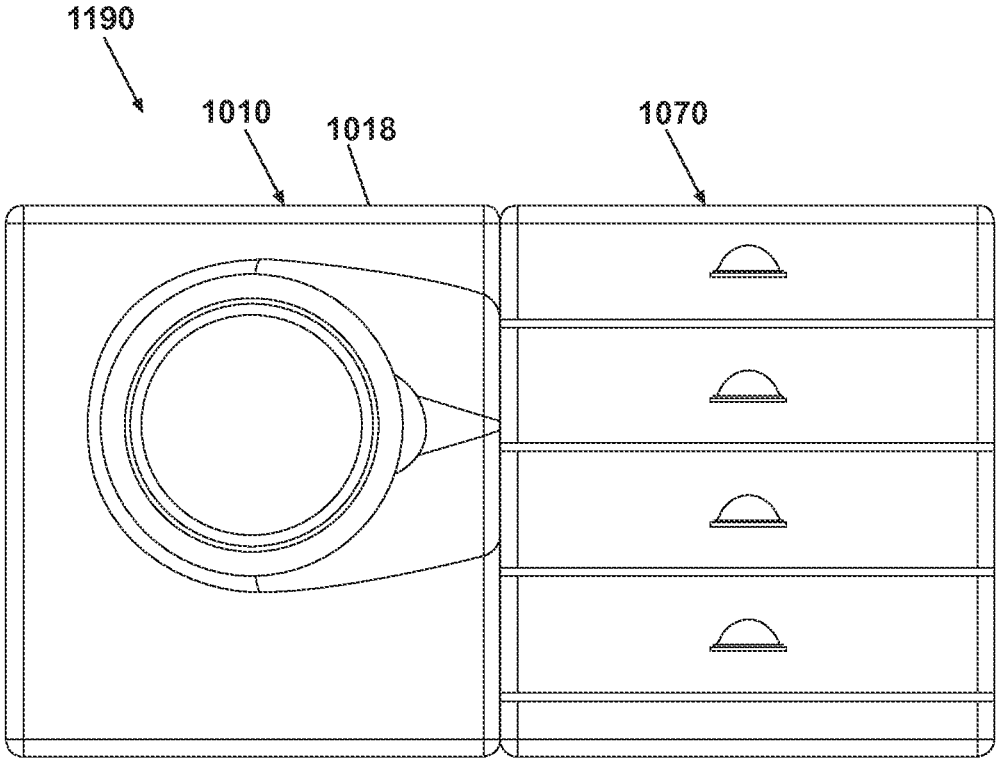

FIG. 113 is a schematic view of a modified core configuration C based on the core configuration C of FIG. 77A.

Figure 75:
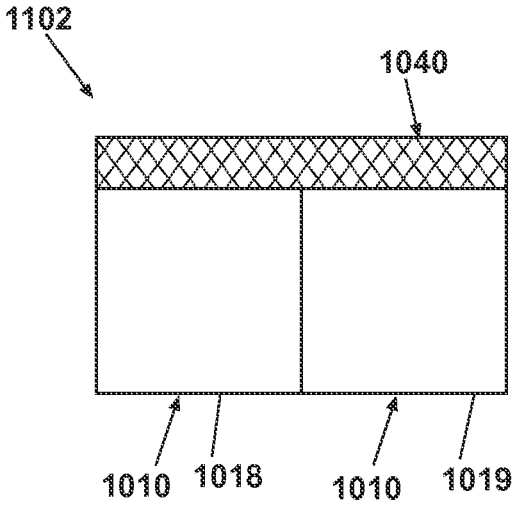
FIG. 75 is a schematic view of a core configuration B formed by two of the laundry appliances of FIG. 67A in a horizontal arrangement and the double width horizontal module of FIG. 68C vertically stacked with the laundry appliances.
Figure 114:
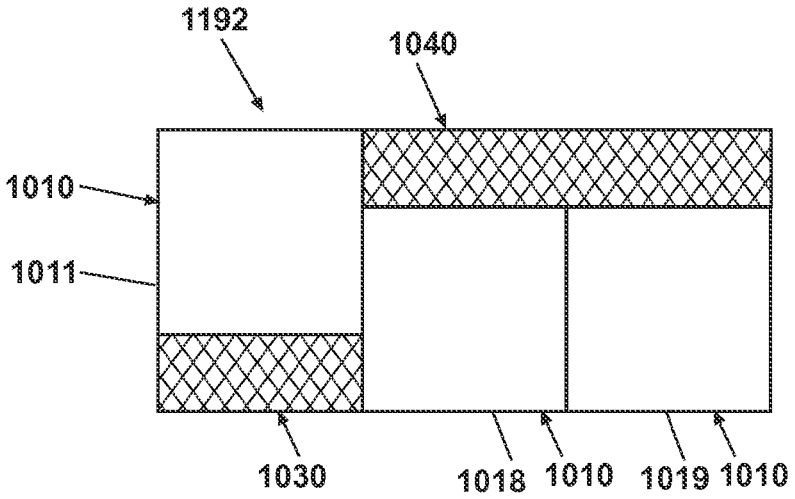

FIG. 114 is a schematic view of a modified core configuration B based on the core configuration B of FIG. 75.

Figure 67A:
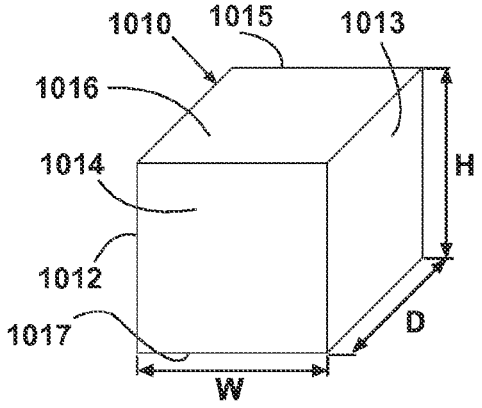
FIG. 67A is a schematic view of a laundry appliance.
Figure 70A:
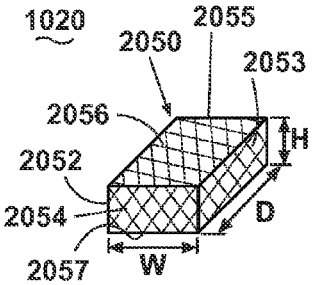
FIG. 70A is a schematic view of a less than single width horizontal module according to one embodiment of the invention.
Figure 70B:
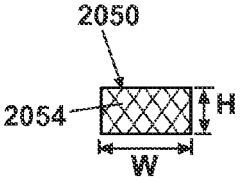
FIG. 70B is view of a symbol representative of the less than single width horizontal module of FIG. 70A.
Figure 70C:
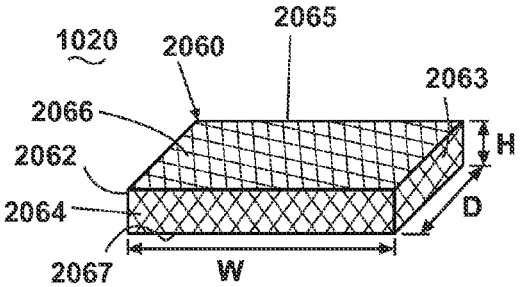
FIG. 70C is a schematic view of an intermediate width horizontal module according to one embodiment of the invention.
Figure 115:
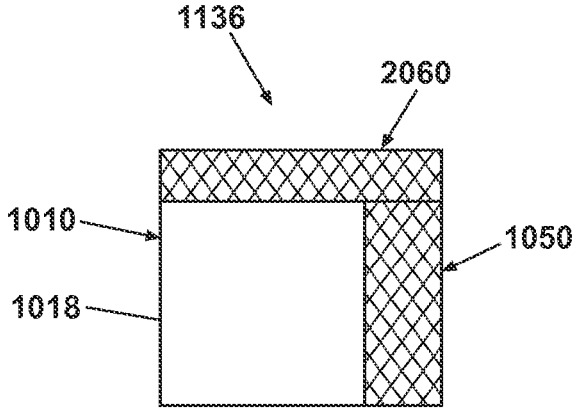

FIG. 115 is a schematic view of a core configuration S formed by one of the laundry appliances of FIG. 67A and one of the single height vertical modules of FIG. 69A in a horizontal arrangement and one of the intermediate width horizontal modules of FIG. 70C stacked with the laundry appliance and the single height vertical module.

Figure 70D:
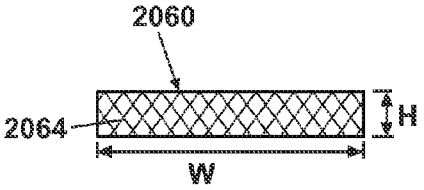
FIG. 70D is view of a symbol representative of the intermediate width horizontal module of FIG. 70C.
Figure 70E:
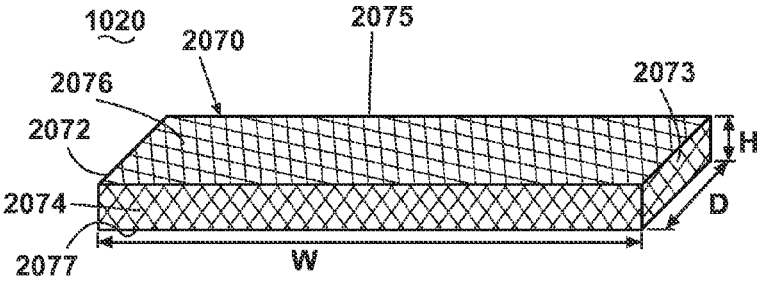
FIG. 70E is a schematic view of a greater than double width horizontal module according to one embodiment of the invention.
Figure 116:
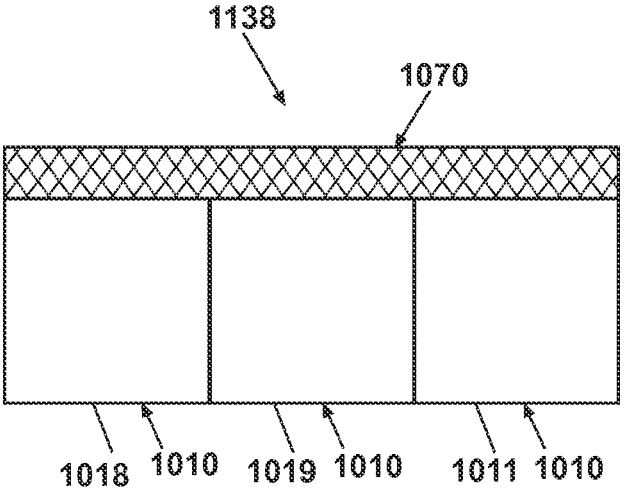

FIG. 116 is a schematic view of a core configuration T formed by three of the laundry appliances of FIG. 67A in a horizontal arrangement and one of the greater than double width horizontal modules of FIG. 70E stacked with the laundry appliances.

Figure 74A:
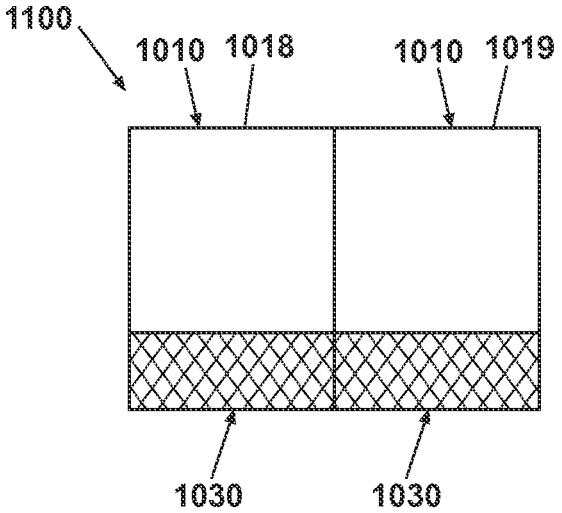
FIG. 74A is a schematic view of a core configuration A formed by two of the laundry appliances of FIG. 67A in a horizontal arrangement and two of the single width horizontal modules of FIG. 68A vertically stacked with the laundry appliances.
Figure 117:
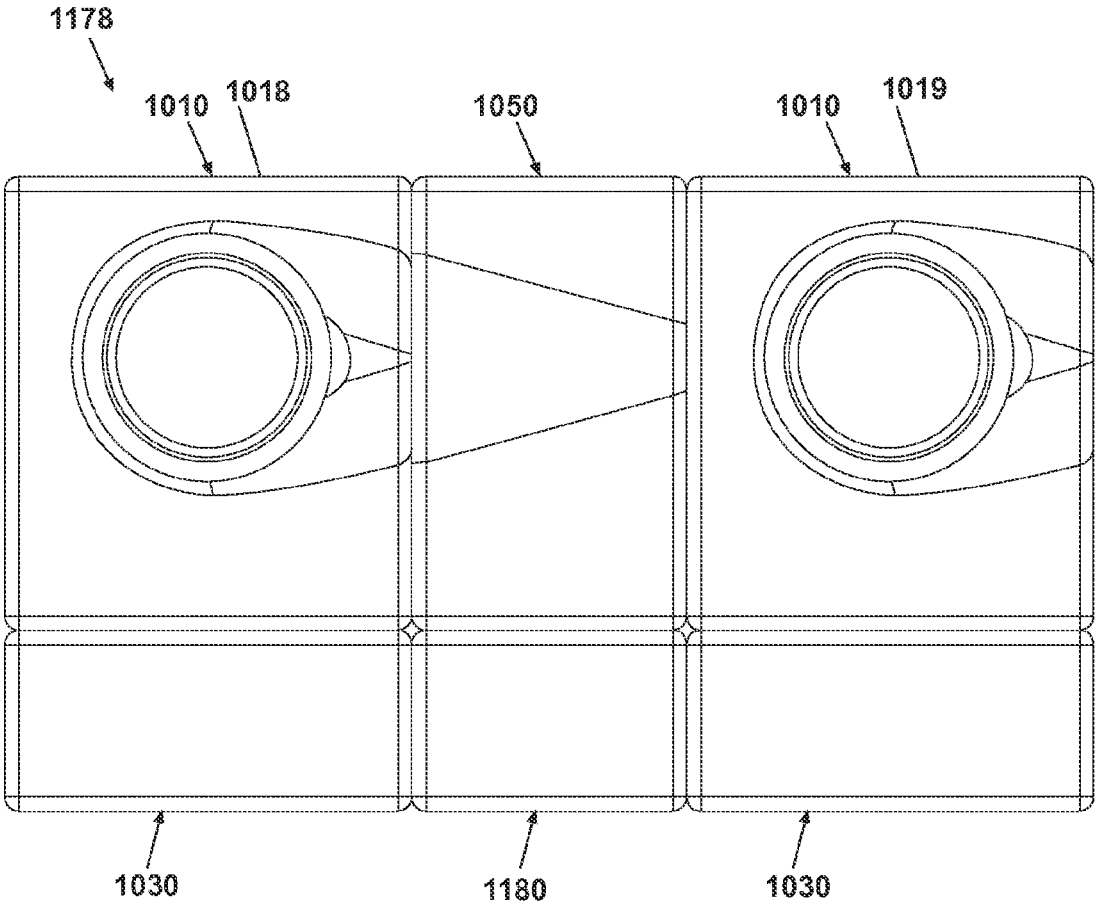

FIG. 117 is a schematic view of a customized configuration T formed from the core configuration A of FIG. 74A.

DESCRIPTION OF EMBODIMENTS OF THE INVENTION

A modular laundry system according to one embodiment of the invention comprises at least one laundry appliance 10 and a worksurface 12. The modular laundry system can optionally comprise a shelf module 14 in addition to the worksurface 12 or instead of the worksurface 12. Each of the worksurface 12 and the shelf module 14 can optionally have at least one of a storage/staging area 16 and a hanging area 18. The worksurface 12 can further include a shelving area 19, which is inherent in the shelf module 14. According to one embodiment of the invention, the modular laundry system comprises two laundry appliances 10 and at least one of the worksurface 12 and the shelf module 14, which can be selected and configured to provide desired laundry care functionality within a given laundry area. The laundry area is a space of a home in which the laundry appliance 10 conventionally resides. The laundry area can be, for example, a dedicated laundry room, a shared room, such as a combined laundry and utility room or a combined laundry room and garage, a closet, or part of another room or hallway of the home.

The laundry appliance 10 is a conventional appliance for washing and drying fabric items, such as clothes and linens. Examples of the laundry appliance 10 include, but are not limited to, a washing machine, including top-loading, front-loading, vertical axis, and horizontal axis washing machines, a dryer, such as a tumble dryer, including top-loading dryers and front-loading dryers, a combination washing machine and dryer, a tumbling refreshing machine, an extractor, a combination washer and dryer, and a non-aqueous washing apparatus. An exemplary non-aqueous washing apparatus is disclosed in U.S. Patent Application Publication No. 2005/0155393, which is incorporated herein by reference in its entirety. The non-aqueous washing apparatus of the incorporated application publication comprises a wash unit and a reclamation unit, and the laundry appliance 10 can be the wash unit. When the laundry system comprises two of the laundry appliances 10, a first laundry appliance and a second laundry appliance, the first and second laundry appliances 10 can be the same type of laundry appliance, such as two washing machines, or different types of laundry appliances, such as a washing machine and a dryer.

The worksurface 12 is generally a horizontally-disposed element having an upper surface upon which various laundry-related tasks or functions can be performed including, but not limited to, sorting clothes, loading and unloading of clothes into a laundry appliance 10, folding clothes, ironing, spot cleaning, scrubbing, and the like. The worksurface 12 can also be used for performing non-laundry-related tasks or functions. The worksurface 12 is disposed above a top of at least one of the laundry appliances 10 and/or at least one other module of a modular laundry system. For example, the worksurface 12 can be disposed on top of a single laundry appliance 10, two laundry appliances 10 and a module, or three laundry appliances 10. When the worksurface 12 is provided on more than one supporting structure, i.e., more than one laundry appliance 10, more than one shelf module 14, more than one other module, or combinations of the laundry appliance 10, the shelf module 14, and the other module, the worksurface 12 preferably forms a generally continuous surface above the supporting structures. The generally continuous surface extends across interfaces between the supporting structures to effectively form a unitary surface for performing functions or tasks. The continuous surface can include seams, such as those inherently present when the worksurface 12 is formed by multiple interconnected pieces, as will be described in more detail below. The worksurface 12 can have any suitable longitudinal length (i.e. width), such as the longitudinal length of one or more laundry appliances 10 alone or in conjunction with the shelf module 14 and/or another module or structure.

Exemplary modules of the modular laundry system are disclosed in application Ser. No. 11/323,125, filed Dec. 30, 2005, and titled "Modular Laundry System with Horizontal Modules," now U.S. Pat. No. 7,628,043, issued Dec. 8, 2009, application Ser. No. 11/322,715, filed Dec. 30, 2005, and titled "Modular Laundry System with Horizontal Module Spanning Two Laundry Appliances," now abandoned, application Ser. No. 11/323,221, filed Ser. No. 11/323,221, and titled "Modular Laundry System with Horizontally Arranged Cabinet Module," now U.S. Pat. No. 7,624,600, issued Dec. 1, 2009, application Ser. No. 11/322,739, filed Dec. 30, 2005, and titled "Modular Laundry System with Horizontal and Vertical Modules," now abandoned, application Ser. No. 11/323,075, filed Dec. 30, 2005, and titled "Modular Laundry System with Vertical Module," now abandoned, application Ser. No. 11/323,147, filed Dec. 30, 2005, and titled "Modular Laundry System with Cabinet Module," now U.S. Pat. No. 7,617,702, issued Nov. 17, 2009, and application Ser. No. 11/322,742, filed Dec. 30, 2005, and titled "Laundry Module for Modular Laundry System," now abandoned, which are incorporated herein by reference in their entirety. Other exemplary modules are disclosed in application Ser. No. 11/323,867, filed Dec. 30, 2005, and titled "Vertical Laundry Module," now abandoned, application Ser. No. 11/322,943, filed Dec. 30, 2005, and titled "Vertical Laundry Module with Backsplash," now U.S. Pat. No. 7,562,543, issued Jul. 21, 2009, application Ser. No. 11/322,502, filed Dec. 30, 2005, and titled "Non-Tumble Clothes Dryer," now U.S. Pat. No. 7,913,419, issued Mar. 29, 2011, application Ser. No. 11/323,270, filed Dec. 30, 2005, and titled "Ironing Station," now U.S. Pat. No. 7,555,856, issued Jul. 7, 2009, and application Ser. No.

11/322,944, filed Dec. 30, 2005, and titled "Sink Station with Cover," now abandoned, which are incorporated herein by reference in their entirety.

The shelf module 14 comprises at least one shelf that can be stowed or retracted into a storage position when not in use and extended to provide a generally horizontally-disposed surface upon which various laundry-related tasks can be performed including, but not limited to, sorting clothes, loading and unloading of clothes into a laundry appliance 10, folding, ironing, spot cleaning, scrubbing, and the like. The shelf of the shelf module 14 can be selectively positionable by a user so that the shelf can be stored and retrieved, respectively, to optimize the space used by the shelf module 14 within the laundry workspace.

The storage/staging area 16 is generally an enclosed (storage) or exposed (staging) region which can store cleaning (e.g., detergent, spot cleaners, etc.), pressing (e.g., starch), and other laundry-related products (e.g., fabric softener). When the storage/staging area 16 is exposed, the products are staged in a visible displayed fashion to make them readily-accessible to a user of the laundry appliance 10. The storage/staging area 16 is preferably associated with the worksurface 12 to store/stage the laundry-related products in a manner easily-accessible by a user adjacent to the worksurface 12 and who is typically performing laundry-related tasks on the worksurface 12, possibly requiring easy and immediate access to the laundry-related products in the storage/staging area 16.

The hanging area 18 is generally a mechanical implement for hanging clothes, whether draped over the hanging area 18 or arranged on a clothes hanger in a manner which would be apparent to one skilled in the art. Examples of the implements employed in the hanging area 18 according to the invention include, but are not limited to, a suspended horizontal rod supported at each end or in a cantilevered fashion by a medial center support. The hanging area 18 can also, according to the invention, be placed on a stand which surrounds at least one laundry appliance 10. The hanging area 18 can also include a vertically-adjustable stand which allows the clothes-hanging implement to be adjusted vertically with respect to ground level, the surrounding area, or an adjacent one or more laundry appliances 10 to allow the hanging area 18 to be extended so that clothing of varying lengths can be hung, or to store the hanging area 18 in a retracted position adjacent one or more laundry appliances 10 so that the hanging area 18 can be stored and selectively extended for use by a user.

The shelving area 19 of the worksurface 12 can comprise at least one shelf that can be stowed or retracted into a storage position when not in use and extended to provide a generally horizontally-disposed surface upon which various laundry-related tasks can be performed including, but not limited to, sorting clothes, loading and unloading of clothes into a laundry appliance 10, folding, ironing, spot cleaning, scrubbing, and the like. When in the stowed or retracted position, the shelf need not be concealed from view; rather, the shelf is positioned in a location different than when in use. Additionally, the shelf can be a static shelf with a fixed position. The shelving area 19 can also be integrated with the hanging area 18.

Figure 1:
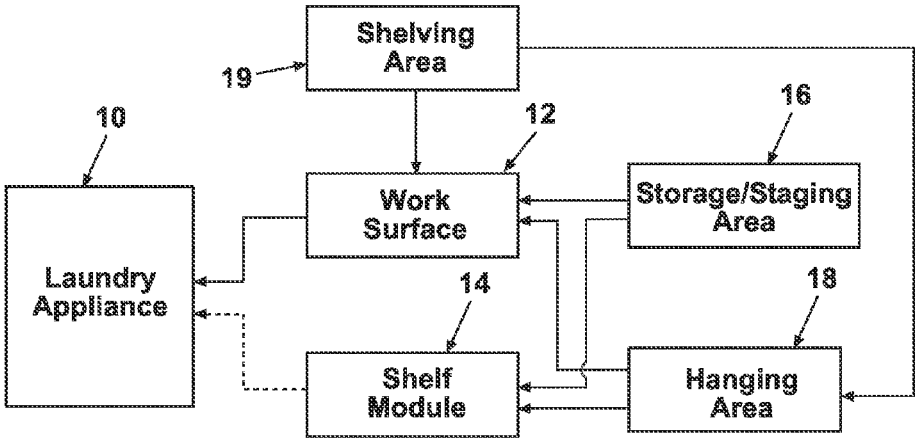
FIG. 1 is a schematic diagram of a modular laundry system including a laundry appliance with at least one of a worksurface and an optional shelf module, each having an optional storage/staging and/or hanging area and the worksurface having an optional shelving area.
Figure 2:
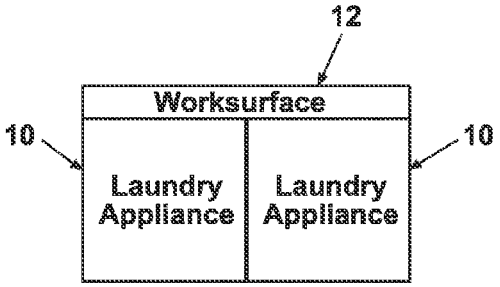
FIG. 2 is a schematic diagram of the modular laundry system shown in FIG. 1 comprising a pair of horizontally-disposed laundry appliances with a worksurface disposed across an upper surface of both appliances.
Figure 4:
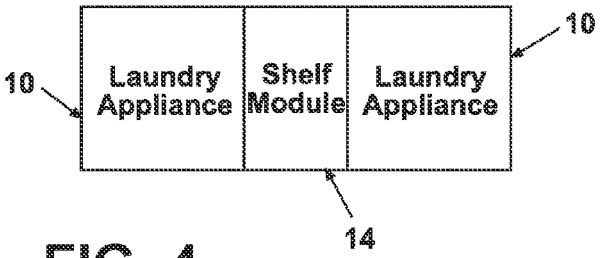
FIG. 4 is a schematic diagram of the modular laundry system shown in FIG. 1 comprising a pair of horizontally-disposed laundry appliances having a shelf module disposed between the laundry appliances.
Figure 3:
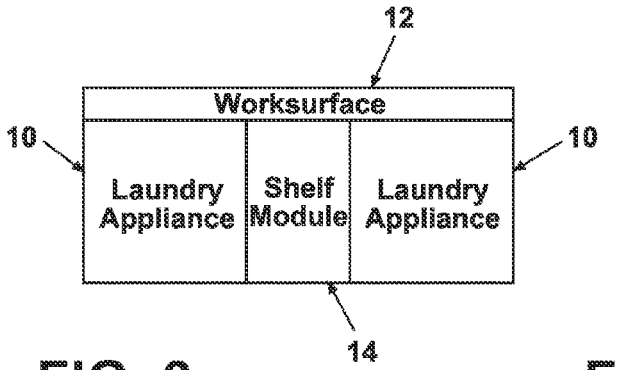
FIG. 3 is a schematic diagram of the modular laundry system shown in FIG. 1 comprising a pair of horizontally-disposed laundry appliances having a shelf module disposed between the laundry appliances and a worksurface disposed across an upper surface of both the laundry appliances and the shelf module.
Figure 5:
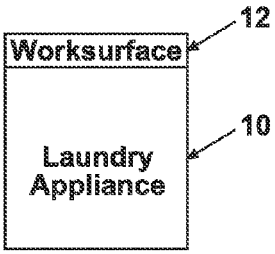
FIG. 5 is a schematic diagram of the modular laundry system shown in FIG. 1 comprising a single laundry appliance with a worksurface disposed horizontally across an upper surface of the laundry appliance.

Turning to the drawings, various configurations of the modular laundry system are shown by example in the schematic of FIG. 1 and the diagrams shown in FIGS. 2-5. FIG. 1 is a schematic diagram of a modular laundry system including a laundry appliance 10 with at least one worksurface 12 and/or an optional shelf module 14, each having an optional storage/staging area 16 and/or hanging area 18. FIG. 2 is a schematic diagram of the modular laundry system shown in FIG. 1 comprising a pair of horizontally-disposed laundry appliances 10 with a worksurface 12 disposed across an upper surface of both appliances 10. FIG. 3 is a schematic diagram of the modular laundry system shown in FIG. 1 comprising a pair of horizontally-disposed laundry appliances 10 having a shelf module 14 disposed between the laundry appliances 10 and a worksurface 12 disposed across an upper surface of both the laundry appliances 10 and the shelf module 14. FIG. 4 is a schematic diagram similar to FIG. 3, except that the modular laundry system of FIG. 4 does not include the worksurface 12. FIG. 5 is a schematic diagram of the modular laundry system shown in FIG. 1 comprising one laundry appliance 10 and a worksurface 12 disposed across the laundry appliance 10. It will be understood that these configurations are for illustrative purposes only, and that other configurations will be contemplated by one skilled in the art, and the particular examples selected for FIGS. 2-5 shall not be interpreted to limit the scope of the invention.

Figure 6:
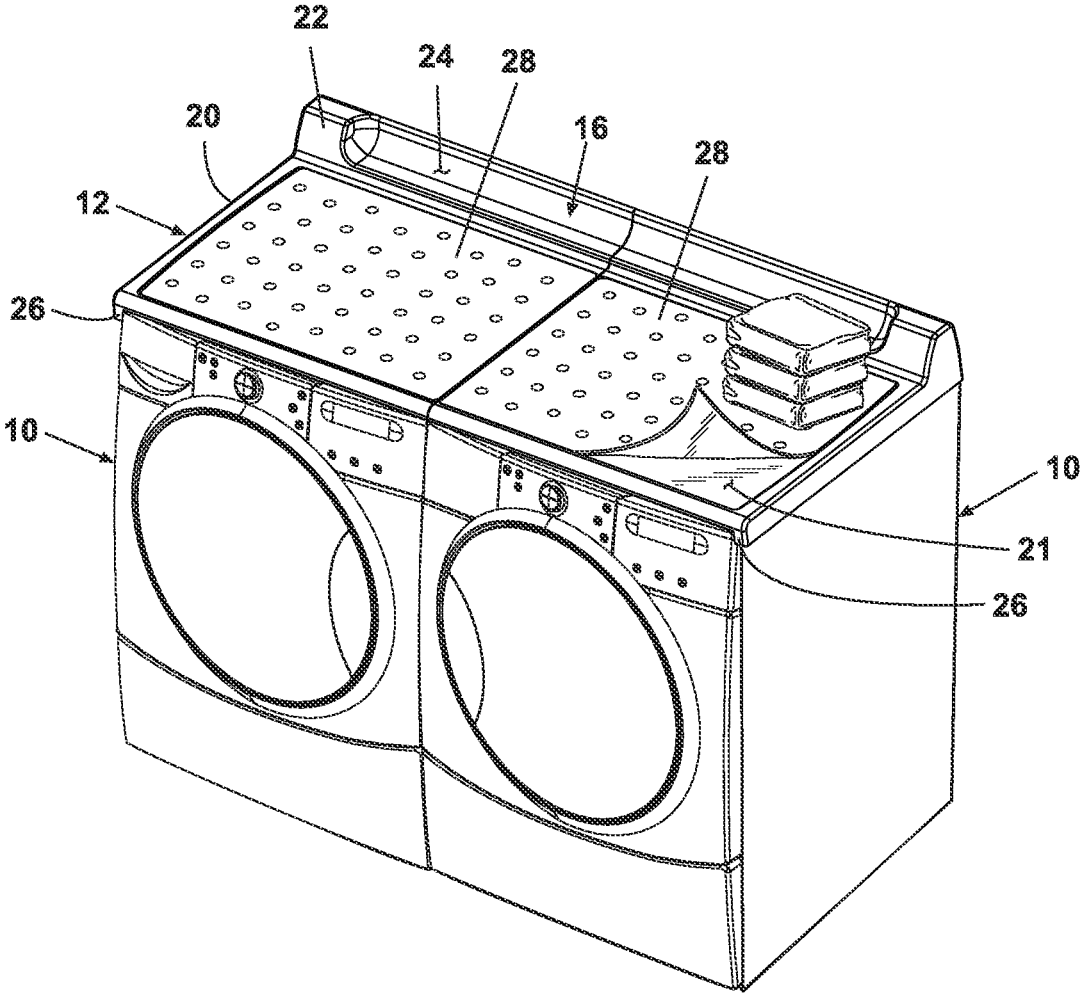
FIG. 6 is a perspective view of the modular laundry system shown in FIG. 1 comprising a pair of horizontally-disposed laundry appliances with a worksurface disposed across an upper surface of both appliances, in a similar configuration to that shown in FIG. 2.

Beginning with FIG. 6, various configurations for the modular laundry system are set forth in the drawings. It will be understood that the various examples of the laundry appliances 10, worksurfaces 12, and shelf modules 14 in one drawing can be interchanged with and substituted for examples of these components shown in other figures so that several additional combinations of these basic components of the invention are contemplated in this invention.

In addition, for simplicity of description and explanation, components of the laundry appliances 10, worksurfaces 12, shelf modules 14, the storage/staging area 16, the hanging area 18, and the shelving area 19 that are common between the various embodiments shown in the Figures herein are referred to with the same reference numerals.

FIG. 6 is a perspective view of the modular laundry system shown in FIG. 1 comprising a pair of horizontally-disposed laundry appliances 10 with a worksurface 12 disposed across an upper surface of both appliances 10, in a similar configuration to that shown in FIG. 2. The laundry appliances 10 in FIG. 6 are front-loading appliances, and while the worksurface 12 can be utilized with any type of laundry appliance 10, the front-loading laundry appliances 10 are ideally suited for use with the worksurface 12 because the worksurface 12, which is disposed on top of the laundry appliance 10, does not interfere with providing access to the interior of the laundry appliance 10. The various functions of the components 12, 14, 16, 18, and 19 are set forth above and will not be repeated embodiment-to-embodiment herein.

The worksurface 12 comprises a generally horizontal body 20 that can be rigid or flexible. For example, when the body 20 is flexible, the body 20 can be made of a flexible polymeric material, such as silicone or a flexible polyvinyl chloride. The body 20 can be made of any suitable material and can optionally comprise, such as by being made of, coated with, or impregnated with, a hygienic material, such as an antimicrobial, antibacterial, antifungal, or similar substance. The horizontal body 20 of the current embodiment has a backsplash 22 extending upwardly from a rear portion thereof. In the example shown in FIG. 6, the backsplash has a depth sufficient for the storage/staging area 16 to be formed therein as a recess 24. The recess 24 preferably extends substantially the width of the worksurface 12 to allow for as many laundry-related items to be stored within the storage/staging area 16 formed by the recess 24. Alternatively, the recess 24 can be broken up into non-contiguous segments or provided with dividers (not shown) to provide for additional organization of the storage/staging area 16 formed by the recess 24.

The worksurface 12 also has a pair of depending flanges 26 located at either longitudinal end of the worksurface 12. The flanges 26 preferably extend the length of each longitudinal end of the worksurface 12 and preferably define a space therebetween having a width into which the abutted laundry appliances 10 can fit. In one embodiment, the worksurface 12 can act as a retainer to hold the pair of laundry appliances 10 (and any items located therebetween) together. As will be described in more detail below, the underside of the worksurface 12 can be provided with a vibration dampener to reduce any noise caused by vibration between the laundry appliances 10 and/or the worksurface 12 during operation of either of the laundry appliances 10 and to prevent transference of vibrations from one of the laundry appliances 10 to the other of the laundry appliances 10 or from one of the laundry appliances 10 to the worksurface 12. In addition, a depending flange (not shown) can also be provided on a rear longitudinal edge of the worksurface 12 to assist in alignment of the rear surfaces of the adjacent (and typically abutted) laundry appliances 10. Similarly, a depending flange (not shown) can also be provided on a front longitudinal edge of the worksurface 12 to assist in alignment of the front surfaces of the adjacent (and typically abutted) laundry appliances 10.

The body 20 of the worksurface 12 can be configured as a unitary body, or as a "leaf-type" structure comprising multiple interconnected pieces allowing for various pieces having a width corresponding to, e.g., a width of a single laundry appliance 10, the width of another worksurface 12, or the width of a shelf module 14, or some other width, to be connected in leaf-type fashion and which is described in greater detail herein with respect to the exemplary embodiments shown in FIGS. 42-45.

An upper surface of the worksurface 12 can be provided with a functional insert 28 (shown as two rectangular components in FIG. 6). The functional insert 28 can be made of any suitable materials, including, but not limited to, polymers, such as rubber, fabrics, and composites of different types of materials. The functional insert 28 can optionally be textured according to the type of function to be performed thereon and can have any of a variety of functional coatings, such as anti-friction or anti-slip coatings. The functional insert 28 can also be entirely made of or impregnated with anti-friction or anti-slip materials. Further, the functional insert 28 can comprise a hygienic material or beneficial substrate, such as an antimicrobial, antibacterial, antifungal, or similar substance embedded therein or coated therewith. The functional insert 28 can be permanently coupled to the worksurface 12 or removable from the worksurface 12, such as for cleaning or replacement. According to one embodiment, the functional insert can be removed and placed in a dishwasher for cleaning. Dishwasher cleaning of the functional insert 28 ensures that the functional insert 28 is completely washed and sanitized. In addition, the functional insert 28 can be reversible with opposing surfaces configured for performing differing functions or tasks to allow for a plurality of different functions or tasks to be performed on the functional insert 28. For example, one side of the functional insert 28 can be provided with a surface suitable for scrubbing or handwashing an item of clothing while the reverse side of the functional insert 28 can be provided with a surface suitable for ironing. The functional insert 28 can also be used, for example, to cut fabric according to sewing patterns. For this task, the functional insert 28 can be adapted to receive pins for pinning the sewing patterns and fabric in place on the functional insert 28. In addition, the worksurface 12 can be provided with additional modular functional inserts 28 which can be substituted onto the worksurface 12 to provide for even greater flexibility in performing laundry-related functions on the worksurface 12. Preferably, the horizontal body 20 of the worksurface 12 comprises an insert recess 21 formed on the upper surface thereof into which the functional insert(s) 28 can be placed to provide for a pleasing appearance to the worksurface 12 with the functional inserts 28 provided thereon. Additionally, the insert recess 21 in the upper surface of the worksurface 12 can position the functional insert(s) 28 on the worksurface 12 and prevent the functional insert(s) 28 from the sliding off of the upper surface of the worksurface 12.

Figure 7:
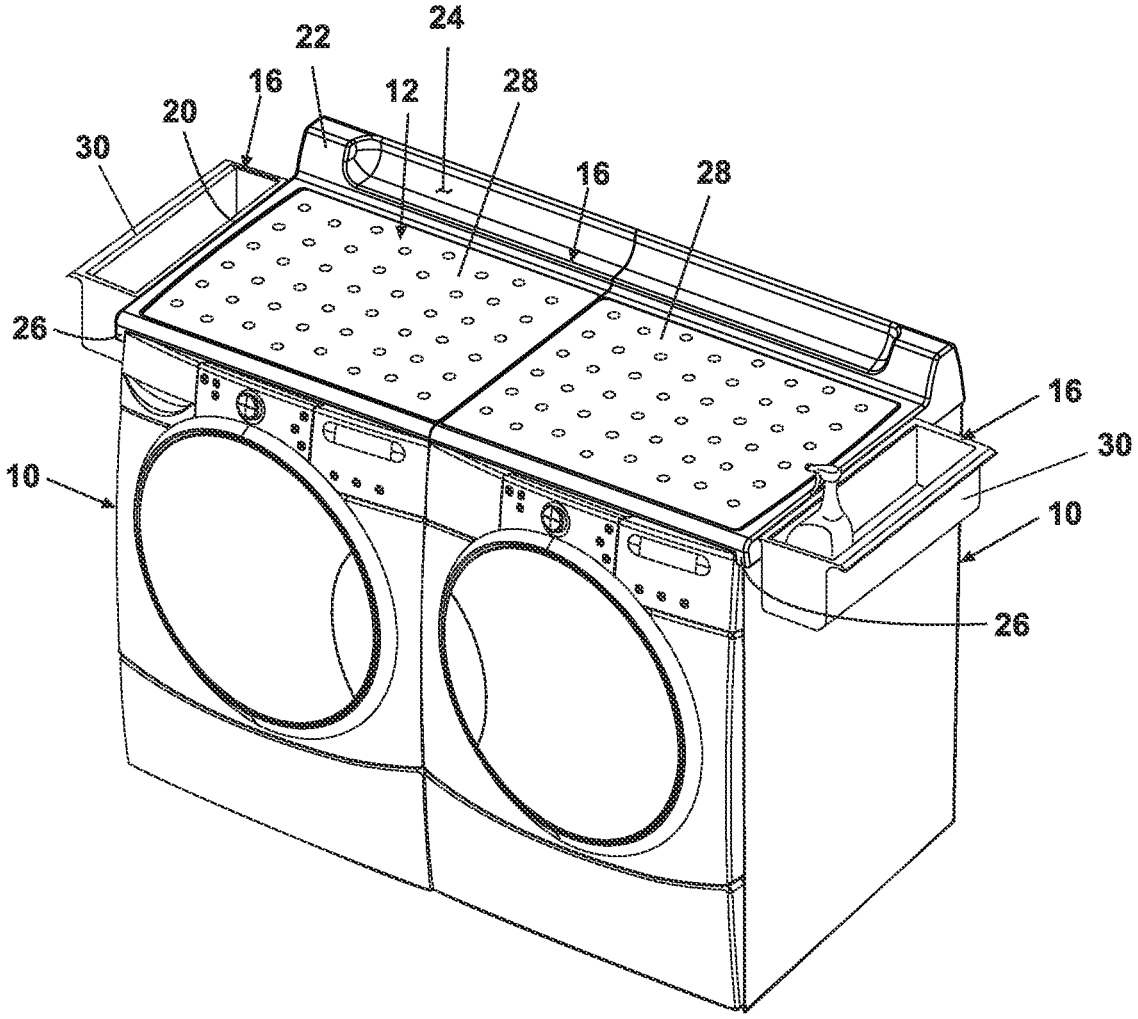
FIG. 7 is a perspective view of another embodiment of the modular laundry system similar to that shown in FIG. 6 whereby the worksurface is provided with a saddle-bag-type staging area.

FIG. 7 is a perspective view of another embodiment of the modular laundry system similar to that shown in FIG. 6 whereby the worksurface 12 is provided with an additional storage/staging area 16 comprising a saddle-bag staging bin 30. The saddle-bag staging bin 30 comprises a well attached to each longitudinal end of the worksurface 12 such that the staging bins 30 are located beyond a combined width of the laundry appliances 10. Laundry-related and non-laundry-related items can be stored in the staging bins 30 for easy access when working adjacent the laundry appliances 10 and/or the worksurface 12. The staging bin 30 can be formed integrally with the horizontal body or removably mounted thereto so that the staging bins 30 can be removed for replacement and/or cleaning. If the staging bin 30 is removably attached to the body 20 of the worksurface 12, the body 20 and the staging bin 30 can be provided with interlocking components, such as a socket and a detent, which would allow the attachment and disassembly of the staging bin 30 to the body 20 without the use of tools or a separate conventional fastener (although separate fasteners could be employed).

Figure 8:
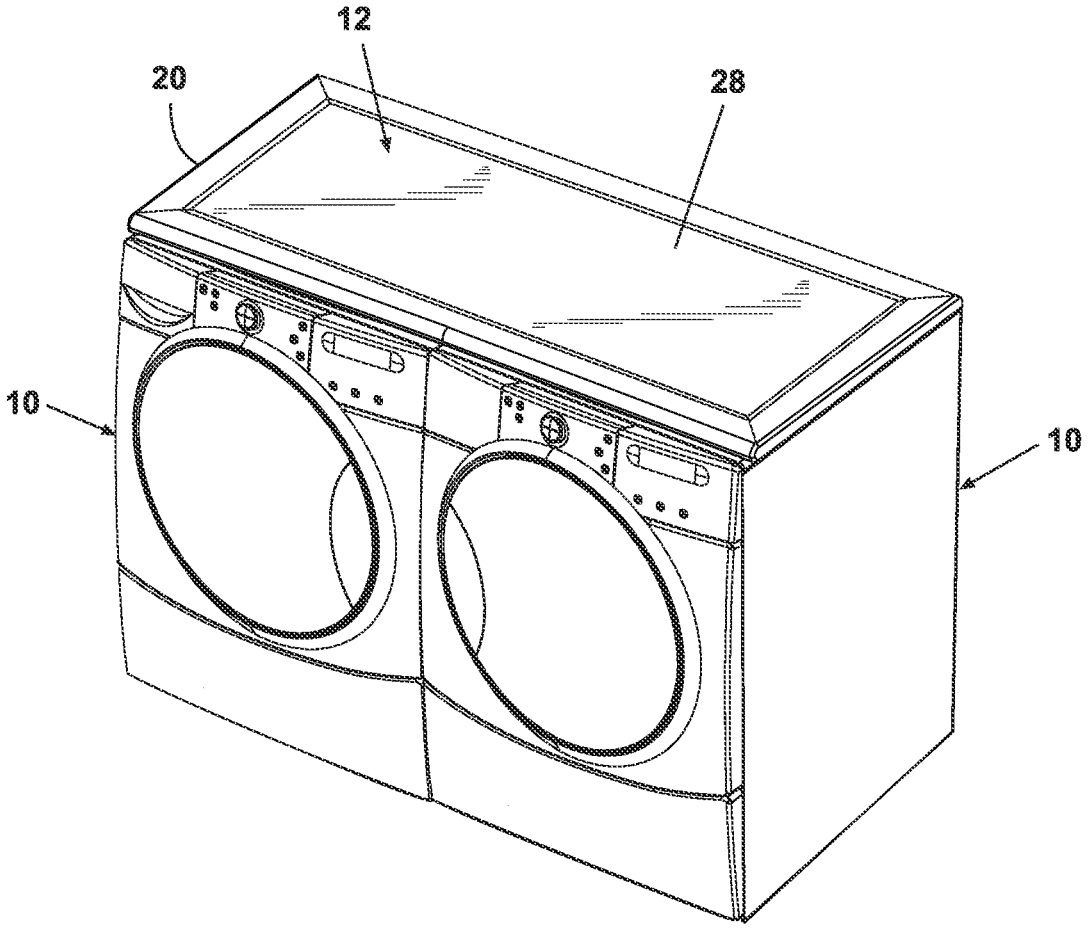
FIG. 8 is a perspective view of another embodiment of the worksurface shown in FIG. 6.
Figure 9:
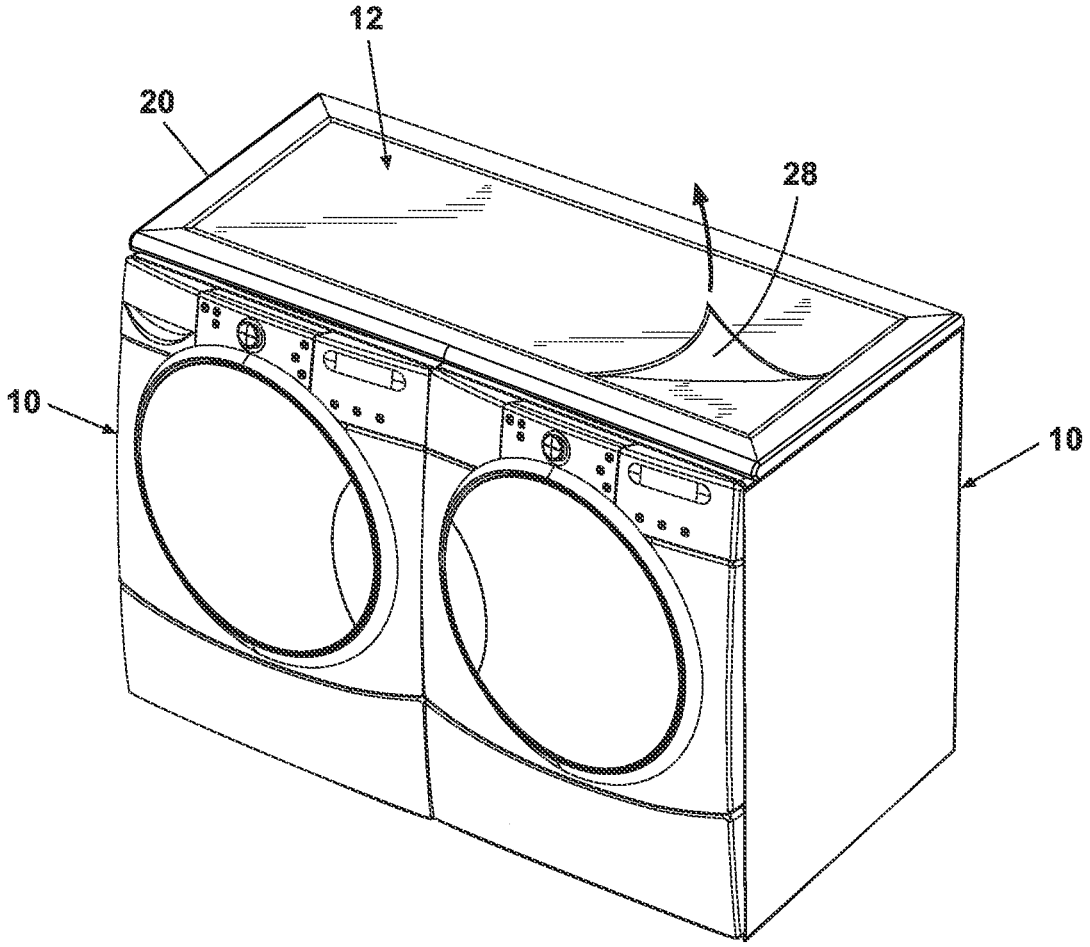
FIG. 9 is a perspective view of FIG. 8 wherein the worksurface is shown having a removable and reversible insert to allow for different types of laundry-related activities to be performed on the worksurface depending upon which side of the insert is exposed.

FIG. 8 is a perspective view of another embodiment of the worksurface 12 shown in FIG. 6. The embodiment of the worksurface shown in FIG. 8 is shown without the backsplash 22. The body 20 of the worksurface 12 is shown with a functional insert 28 provided thereon. FIG. 9 illustrates the removable and reversible nature of the functional insert 28 to allow for different types of laundry-related activities to be performed on the worksurface 12 depending upon which side of the worksurface 12 is exposed.

Figure 10:
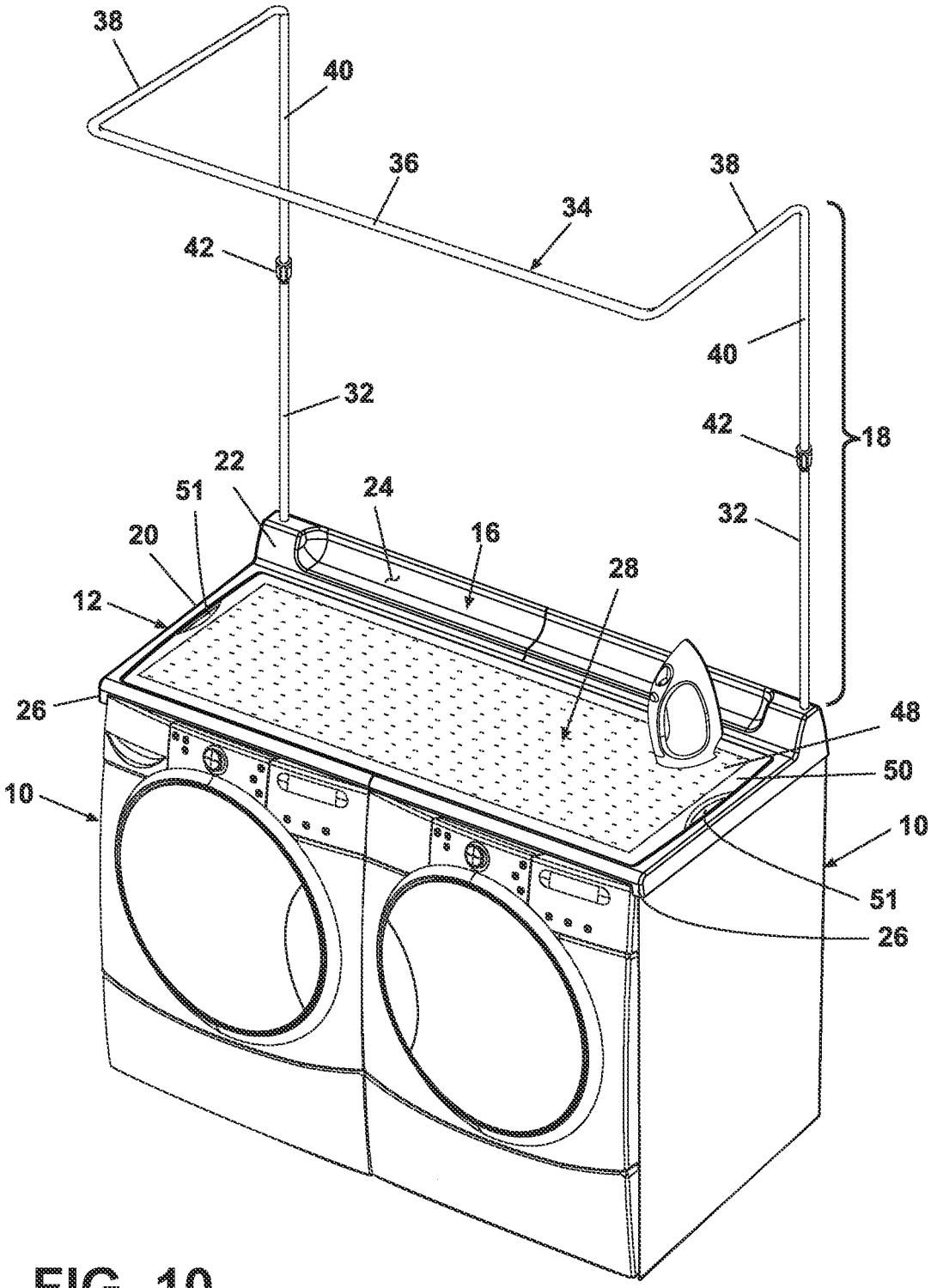
FIG. 10 is a perspective view of another embodiment of the modular laundry system similar to that shown in FIG. 6, wherein the worksurface is shown as including a reversible insert as described with respect to FIGS. 8-9, and the worksurface is provided with a rear staging area and an upwardly-extending hanging area.

FIG. 10 is a perspective view of another embodiment of the modular laundry system similar to that shown in FIG. 6, wherein the worksurface 12 is shown having a reversible functional insert 28 as described with respect to FIGS. 6-9, and the worksurface 12 is provided with a rear storage/staging area 16 and an upwardly-extending hanging area 18. The hanging area 18 comprises a cylindrical rod formed into a functional shape for hanging clothes and other laundry-related items thereon. In the example hanging area 18 shown in FIG. 10, the hanging area 18 comprises a pair of base rods 32, which are mounted to opposing longitudinal rear ends of the worksurface 12, each of which support an opposing end of a hanging rod 34. The hanging rod 34 comprises a U-shaped member formed by an elongated central rod 36 having a spacer rod 38 extending rearwardly therefrom at each longitudinal end thereof. Each spacer rod 38 terminates in a downwardly-extending extension rod 40 which, in turn, is telescopingly received in the base rod 32 by a selectively-adjustable clamp mount 42. Tightening the clamp mount 42, such as by rotation, secures the extension rod 40 at a particular height with respect to the base rod 32. Other variations on the clamp mount 42 would be apparent to one skilled in the art for retaining the extension rod 40 at a particular height with respect to the base rod 32, and the particular embodiment of the clamp rod 42 illustrated herein shall not be limiting on the scope of the invention.

Figure 11:
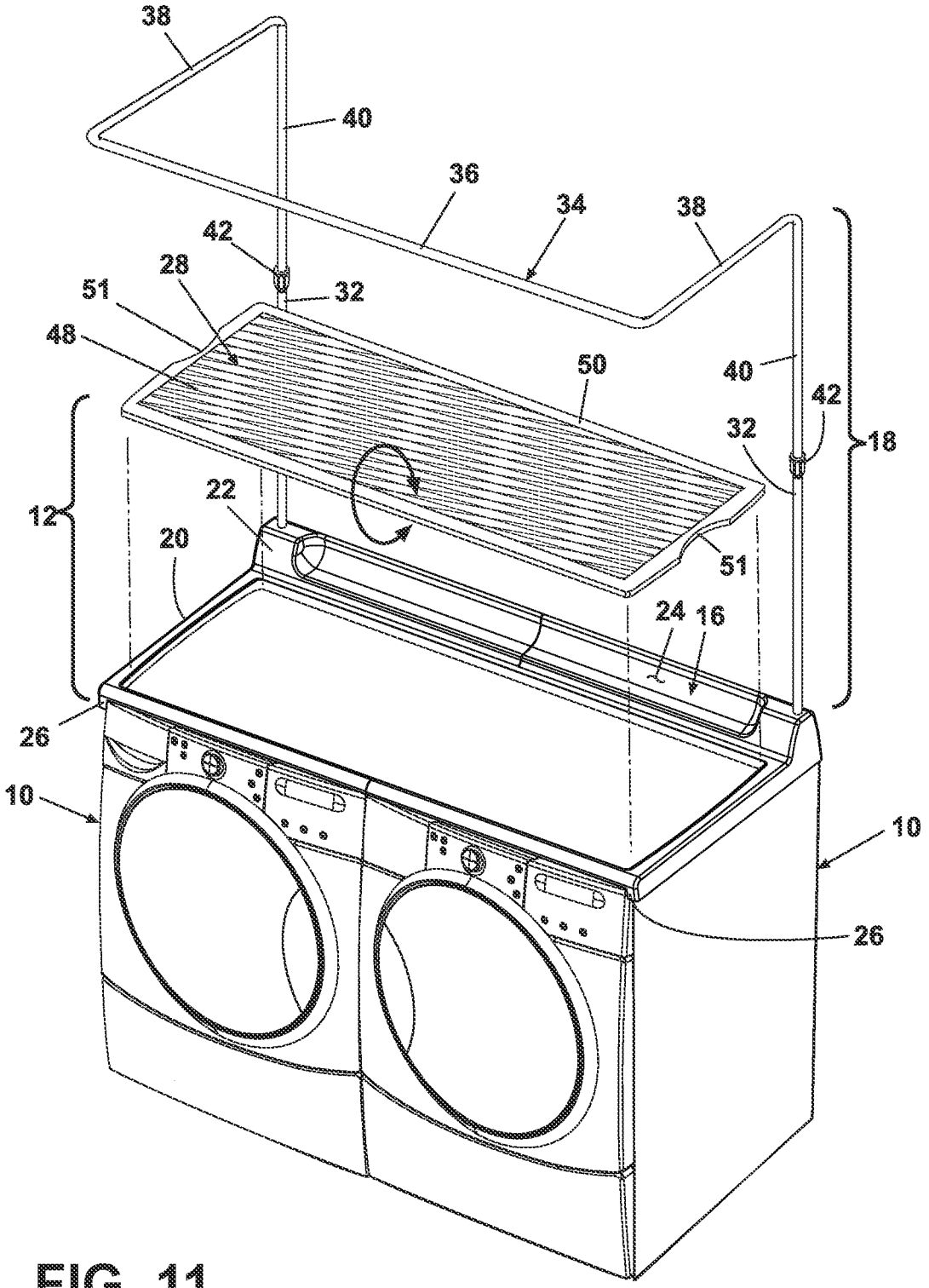
FIG. 11 is a perspective view similar to that shown in FIG. 10 illustrating the reversible nature of the insert.

FIG. 11 is a perspective view of the embodiment shown and described with respect to FIG. 10 illustrating the reversible nature of the functional insert 28 on the worksurface 12 which, in the example embodiment shown in FIGS. 10-11, extends across both horizontally-disposed laundry appliances 10. The functional insert 28 shown in FIGS. 10 and 11 comprises a mat 48 supported by a frame 50 having a pair of user graspable handles 51 that facilitate removal of the functional insert 28 and reversing the functional insert 28.

Figure 12:
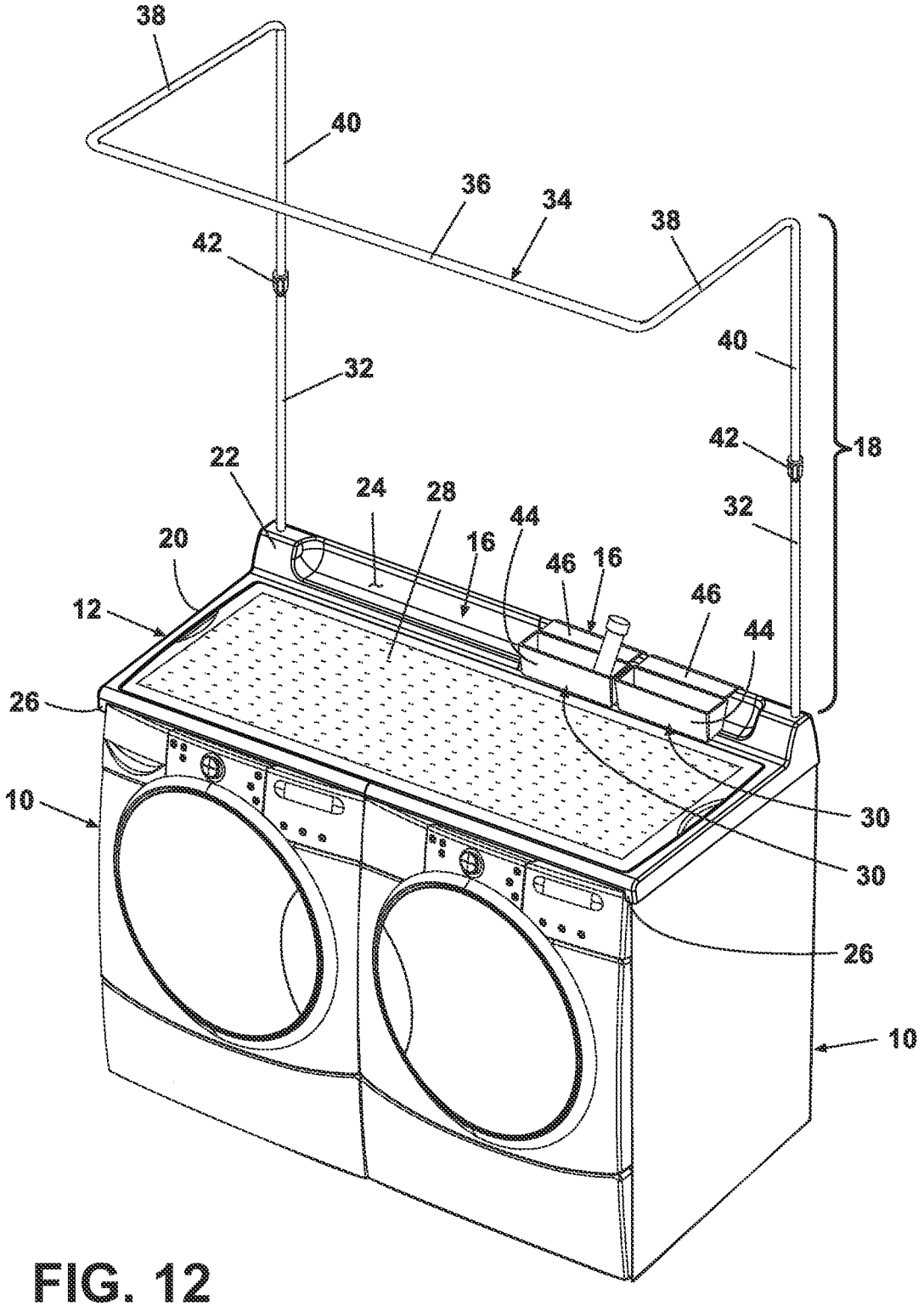
FIG. 12 is a perspective view similar to that shown in FIG. 10 illustrating the use of hanging storage compartments in a storage/staging area on the worksurface.
Figure 13:
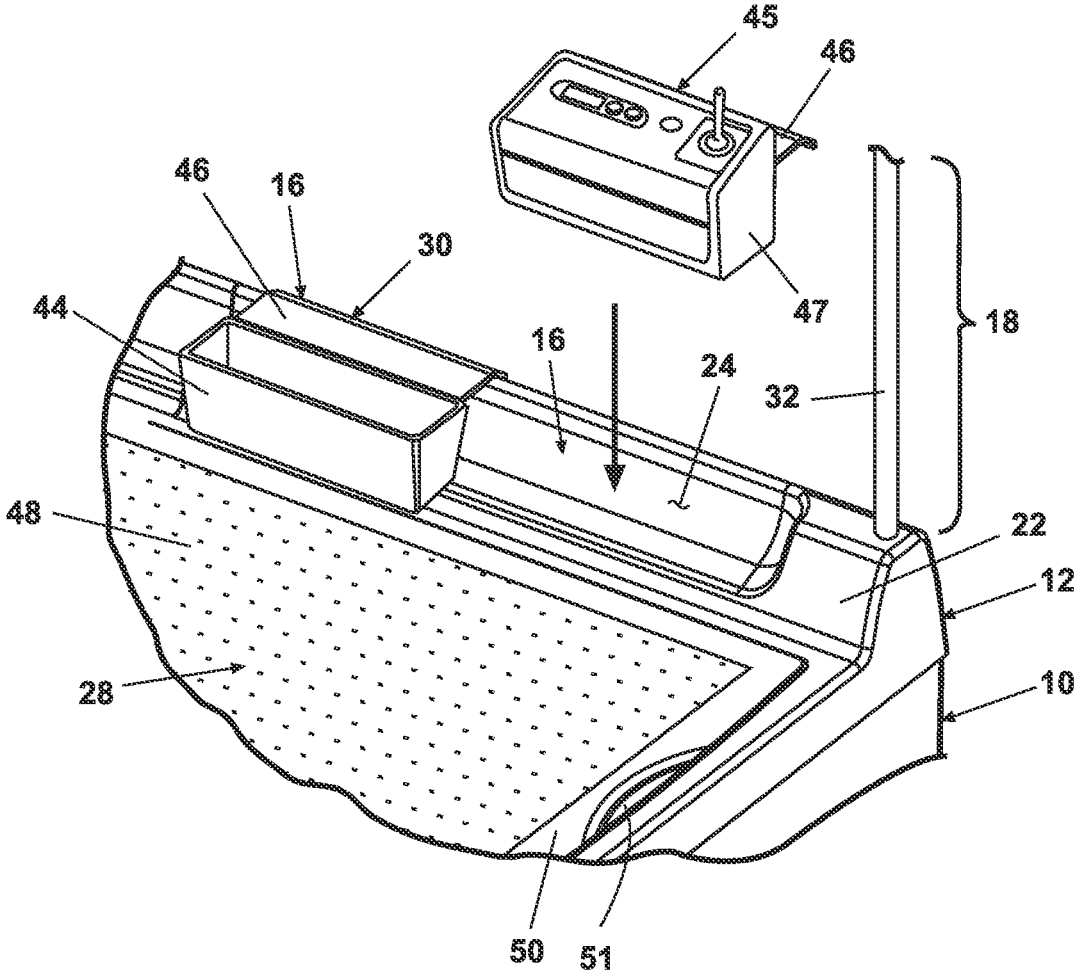
FIG. 13 is a perspective view showing one of the hanging storage compartments located in the staging area on the worksurface of FIG. 12 in greater detail and also showing a radio module located in the staging area on the worksurface.

FIG. 12 is a perspective view of the embodiment shown in FIG. 10 wherein the storage/staging area 16 further comprises at least one staging bin 30 in the staging recess 24 on the worksurface 12 extending across both horizontally-disposed laundry appliances 10. In this embodiment, the staging bin 30 comprises a well 44 with a rearwardly-extending flange 46 attached thereto. The staging bin 30 can be mounted within the staging recess 24 by hooking the flange 46 over an upper rear surface of the backsplash 22 located behind the staging recess 24. The staging bins 30 can be slid longitudinally along the staging recess 24 to further optimize the functionality of the storage/staging area 16 of the worksurface 12. FIG. 13 is a perspective view showing one of the staging bins 30 located in the storage/staging area 16 on the worksurface 12 of FIG. 12 in greater detail and also showing a radio module 45 staged in the staging recess 24. The radio module 45 comprises a body 47 sized for receipt within the staging recess 24 and a rearwardly-extending flange 46 attached thereto. Similar to the staging bin 30, the radio module 45 can be mounted within the staging recess 24 by hooking the flange 46 over an upper rear surface of the backsplash 22 located behind the staging recess 24. It is within the scope of the invention to stage modules other than the staging bin 30 and the radio module 45 in the storage recess 24.

Figure 14:
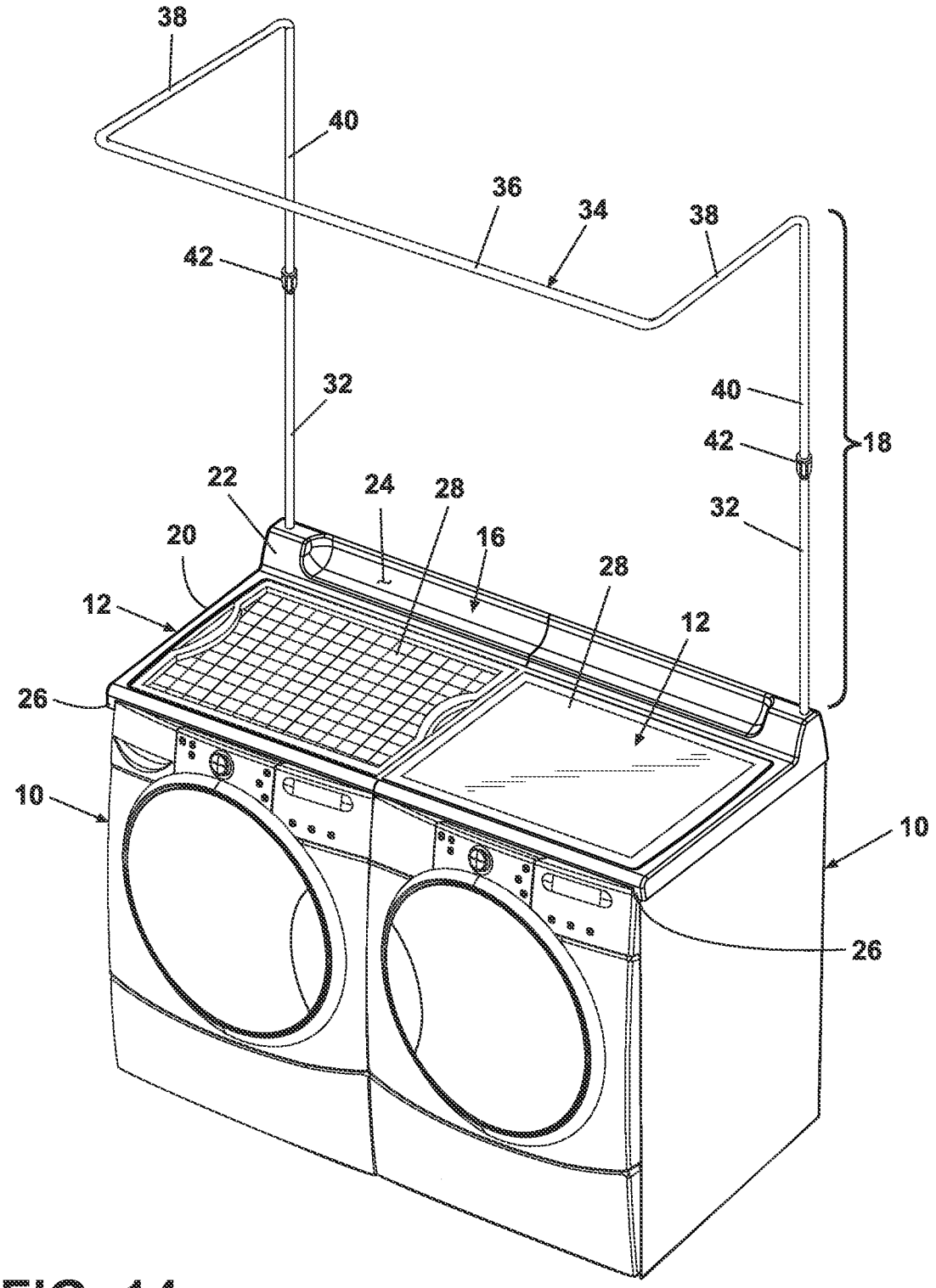
FIG. 14 is a perspective view of another embodiment of the modular laundry system similar to that shown in FIG. 10, wherein the insert is shown as a pair of adjacent, rectangular mats, each of which is reversible to expose a different functional surface of the respective insert.
Figure 15:
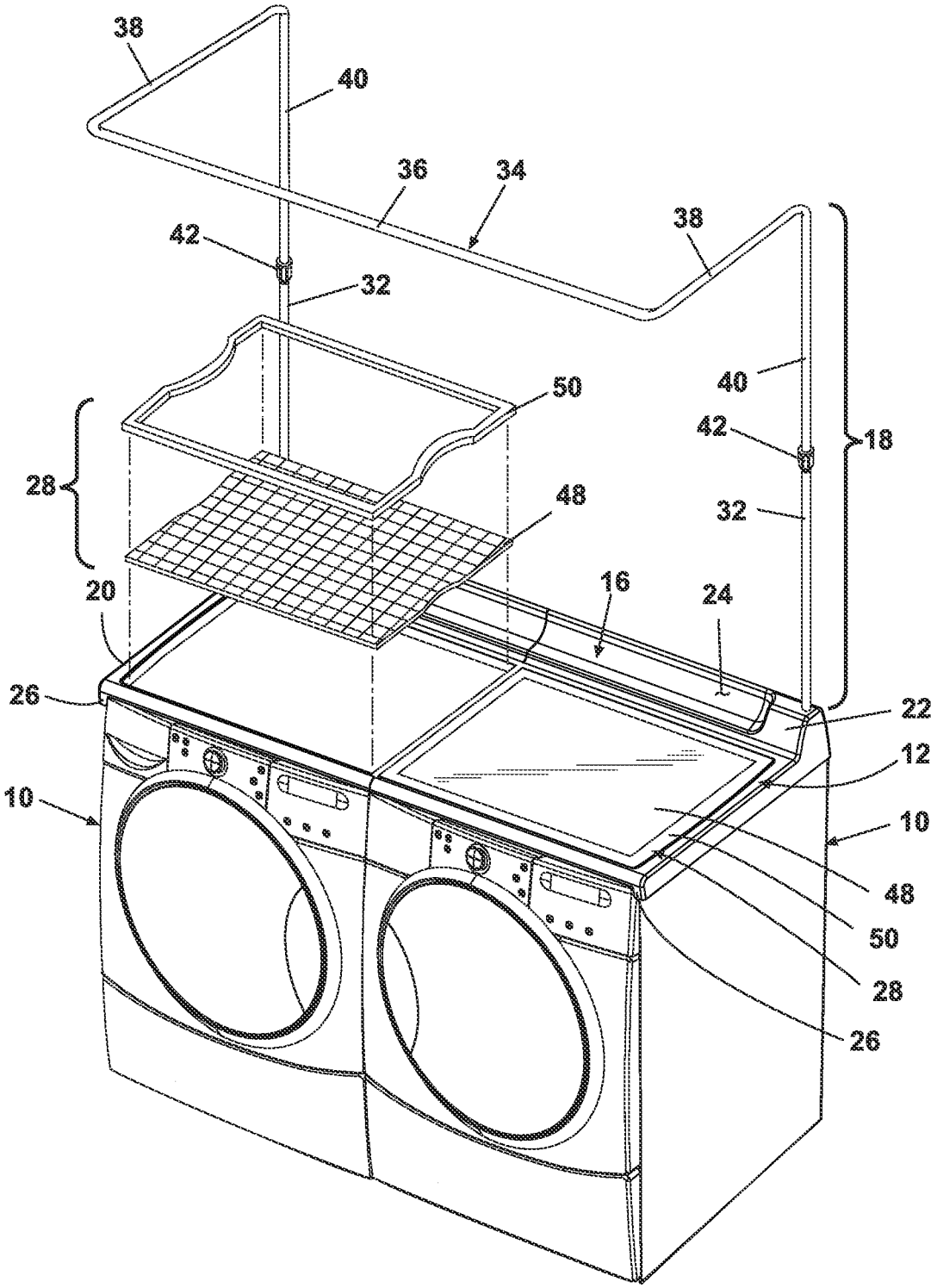
FIG. 15 is a perspective view of the embodiment shown in FIG. 14, wherein one of the reversible worksurface insert is shown in an exploded configuration.

FIG. 14 is a perspective view of another embodiment of the modular laundry system similar to that shown in FIG. 10, wherein the functional insert 28 provided on the worksurface 12 is shown as a pair of adjacent, rectangular individual functional inserts 28, each of which can be reversible to expose a different functional surface of the functional insert 28. FIG. 15 is a perspective view of the embodiment shown in FIG. 14, wherein one of the reversible functional inserts 28 of the worksurface 12 is shown in an exploded configuration. Each functional insert 28 comprises a reversible mat 48 removably mounted within a frame 50. The mat 48 can be removed from the frame 50 for cleaning or replacement with a different mat 48 having a different laundry-related functionality than the mat 48 that was initially removed. The mat 48 and frame 50 are interchangeable between longitudinal positions on the worksurface 12 and can assist a user in optimally performing laundry-related functions on the worksurface 12.

Figure 16:
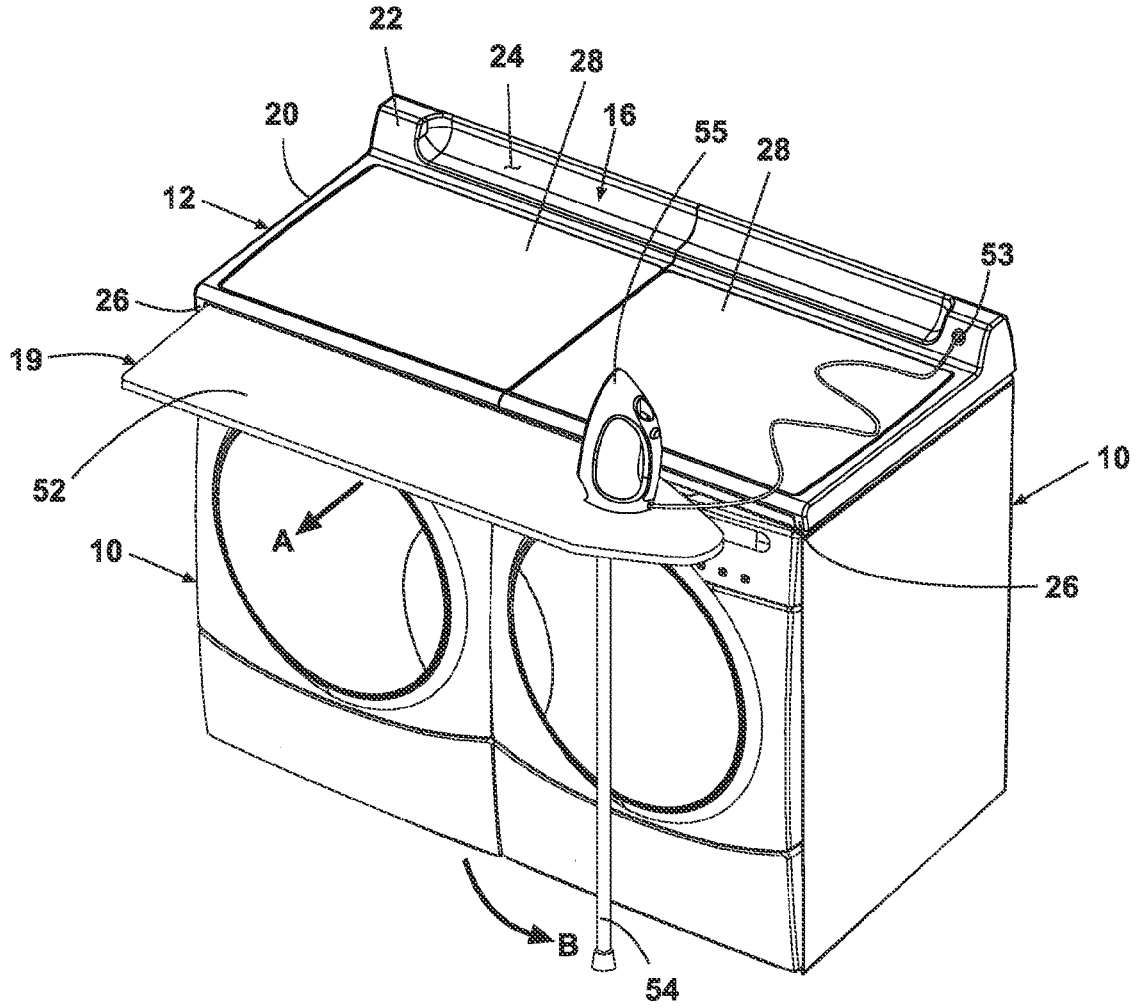
FIG. 16 is a perspective view of another embodiment of the modular laundry system similar to that shown in FIG. 6, wherein an ironing board is shown extended from the worksurface whereby arrows illustrate a first extending direction to expose the ironing board from within the worksurface and a second pivoting direction to position a supporting leg for the ironing board on a floor.

FIG. 16 is a perspective view of another embodiment of the modular laundry system similar to the embodiment shown in FIG. 16. In the embodiment shown in FIG. 16, a shelf area 19 in the form of an ironing board 52 is provided on the worksurface 12. The ironing board 52 is preferably associated with the worksurface 12 so that it can be repositioned, such as by sliding, with respect to the worksurface 12 between an extended position (as shown in FIG. 16) and a retracted position, wherein the ironing board is stowed within a recess in the underside of the worksurface 12 defined by an upper surface of the laundry appliances 10, the underside of the worksurface 12 and the flanges 26 at each longitudinal end of the worksurface 12. The ironing board 52 is shown in FIG. 16 extended from the worksurface 12 whereby arrow "A" illustrates a first extending direction to expose the ironing board 52 from within the worksurface 12 and arrow "B" illustrates a second direction by which a foldable leg 54 can be dropped from a folded position adjacent the underside of the ironing board 52 to a floor-engaging position to support the ironing board 52 on a floor.

Figure 17:
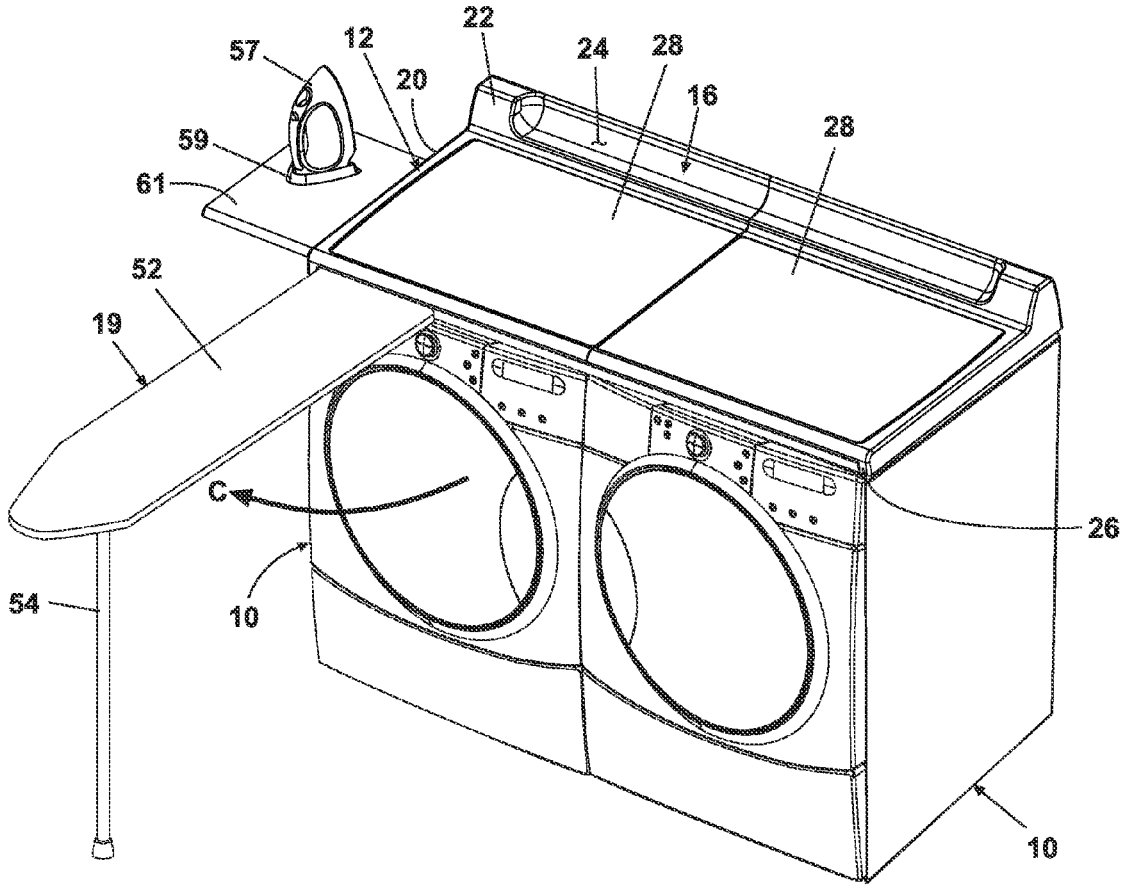
FIG. 17 is a perspective view of the embodiment of the modular laundry system shown in FIG. 16 wherein the ironing board has been rotated to a generally perpendicular position with respect to the worksurface to allow for greater functionality and usability of the workspace in which the modular laundry system resides.

FIG. 17 is a perspective view of the embodiment of the modular laundry system shown in FIG. 16 wherein the ironing board 52 is pivotally mounted to at least one of the worksurface 12 and the laundry appliances 10 so that it can be rotated with respect to the worksurface 12 between a first position that is generally parallel to the longitudinal axis of the worksurface 12 and a second position that is generally perpendicular to the longitudinal axis of the worksurface 12. The pivotal mounting of the ironing board 52 with respect to the worksurface 12 can be accomplished with known parts and need not be described to be understood by one skilled in the art. In the embodiment shown in FIG. 17, the ironing board 52 has been rotated to the second generally perpendicular position with respect to the worksurface 12 (as shown by arrow "C") to allow for greater functionality and usability of the workspace in which the modular laundry system resides.

To stow the ironing board 52 within the worksurface 12, the ironing board 52 is rotated in the reverse direction shown by arrow "C" in FIG. 17 to the first generally parallel position, the leg 54 is folded up against the ironing board 52 in the reverse direction shown by arrow "B" in FIG. 16, and, finally, the ironing board 52 is slid back along a reverse direction shown by arrow "A" in FIG. 16 into its stowed position beneath the worksurface 12.

The worksurface 12 can further comprise a power outlet 53 located anywhere on the worksurface 12, such as in the backsplash 22, as illustrated in FIG. 16. The power outlet 53 can be used to provide power to any device, including an iron 55 for use with the ironing board 52. The worksurface 12 can also or alternatively comprising a docking station 59 for a cordless iron 57, as shown in FIG. 17. The docking station 59 can be located anywhere on the worksurface 12, such as on an iron platform 61 extending laterally from the worksurface 12, and can provide a place to rest the cordless iron 57 when the cordless iron 57 is not in use. The iron platform 61 can be, for example, fixedly mounted to the worksurface 12 in the extended position of FIG. 17, slidably mounted to worksurface 12 such that the iron platform 61 is located below the upper surface of the worksurface 12 when not in use, or pivotally mounted to the worksurface 12 such that the iron platform 61 is oriented generally parallel to the side of the laundry appliance 10 when not in use. The docking station 59 can also be coupled to a source of power, such as the main power supply of the home or a battery, to recharge the cordless iron 57.

Figure 18:
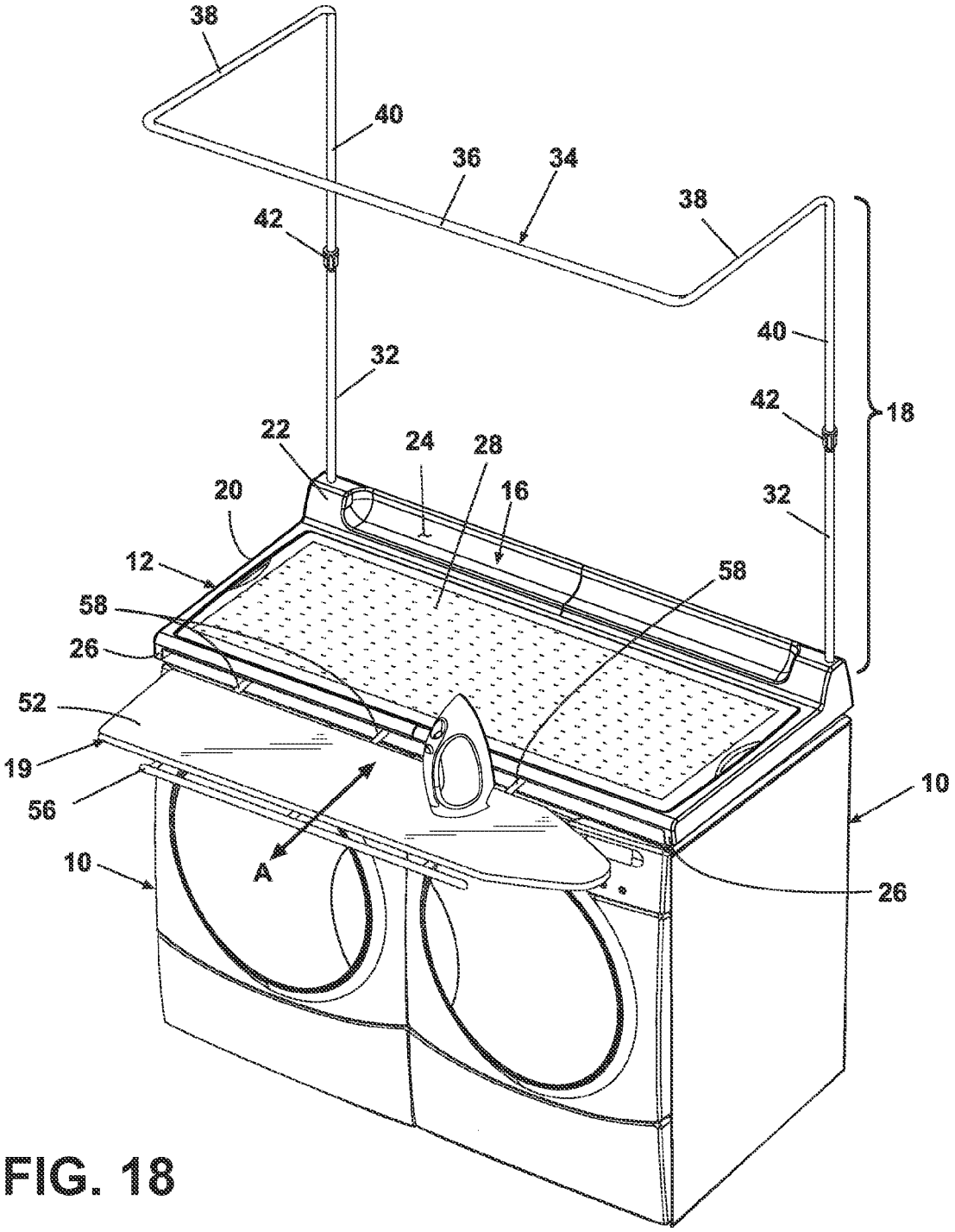
FIG. 18 is a perspective view of another embodiment of the modular laundry system similar to that shown in FIG. 16, wherein an ironing board is shown in an extended use position with respect to the worksurface.
Figure 19:
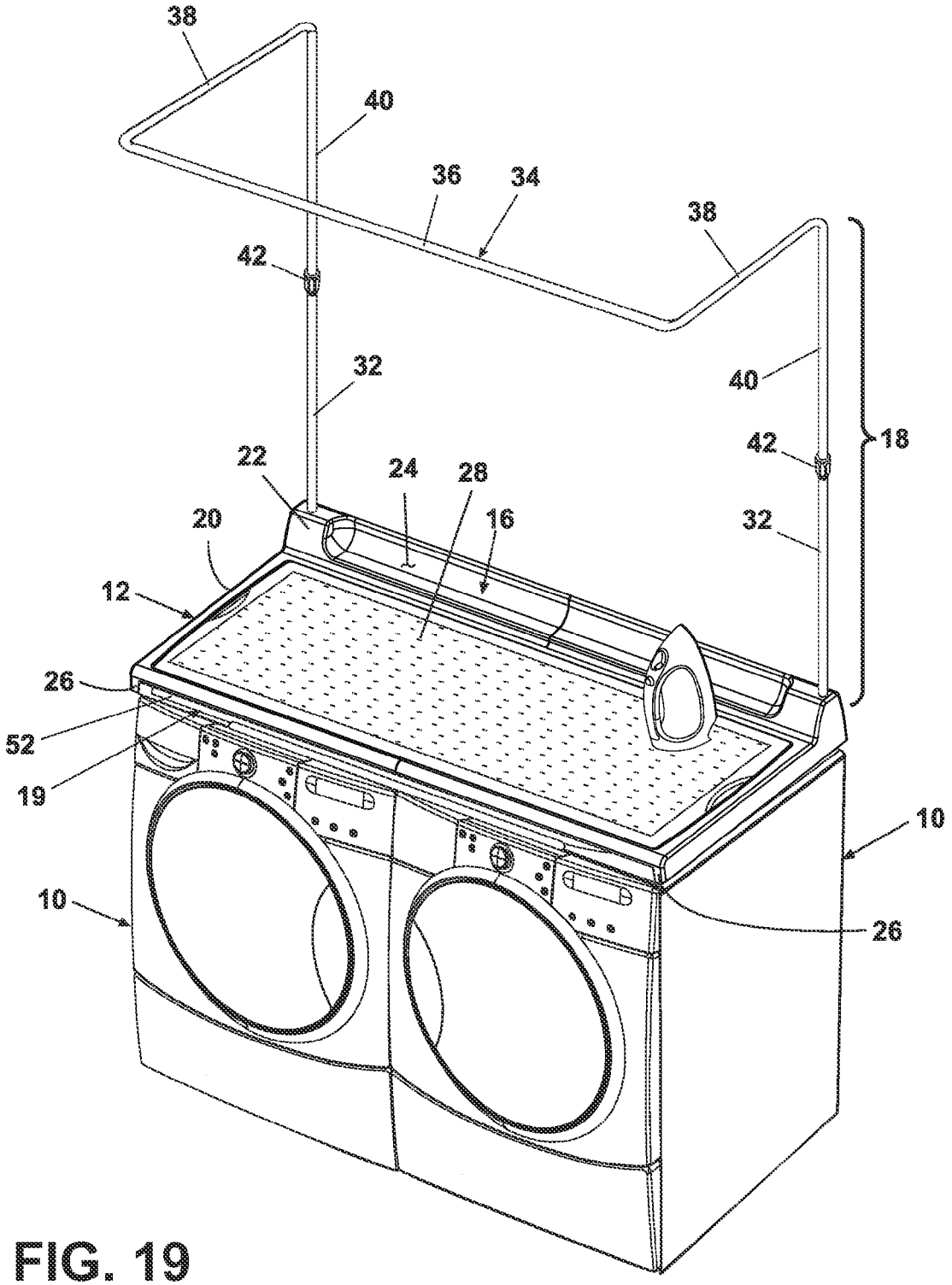
FIG. 19 is a perspective view of the embodiment of the modular laundry system shown in FIG. 18, wherein the ironing board has been slid from the extended use position located adjacent to the worksurface to a retracted, stored position located within the worksurface.

FIG. 18 is a perspective view of another embodiment of the modular laundry system having a shelf area 19 in the form of an ironing board 52, wherein the ironing board 52 has been slid in a direction shown by arrow "A" from a retracted, stored position located within the worksurface 12, as shown in FIG. 19, to an extended, use position located adjacent to the worksurface 12. In the embodiment shown in FIGS. 18 and 19, the ironing board 52 is mounted to the worksurface 12 via a mounting rack 56, which includes a set of rails 58, which allow the slidable movement of the ironing board 52 with respect to the worksurface 12. In the embodiment of the invention shown in FIGS. 18 and 19, the foldable leg 54 described with respect to the embodiment shown in FIG. 16 is not needed because the mounting rack 56 and the rails 58 support the ironing board 52 in cantilevered fashion with respect to the laundry appliances 10 and the worksurface 12. The embodiment shown in FIGS. 18 and 19 further includes the hanging area 18 similar to that of the embodiment illustrated in FIG. 10.

Figure 20:
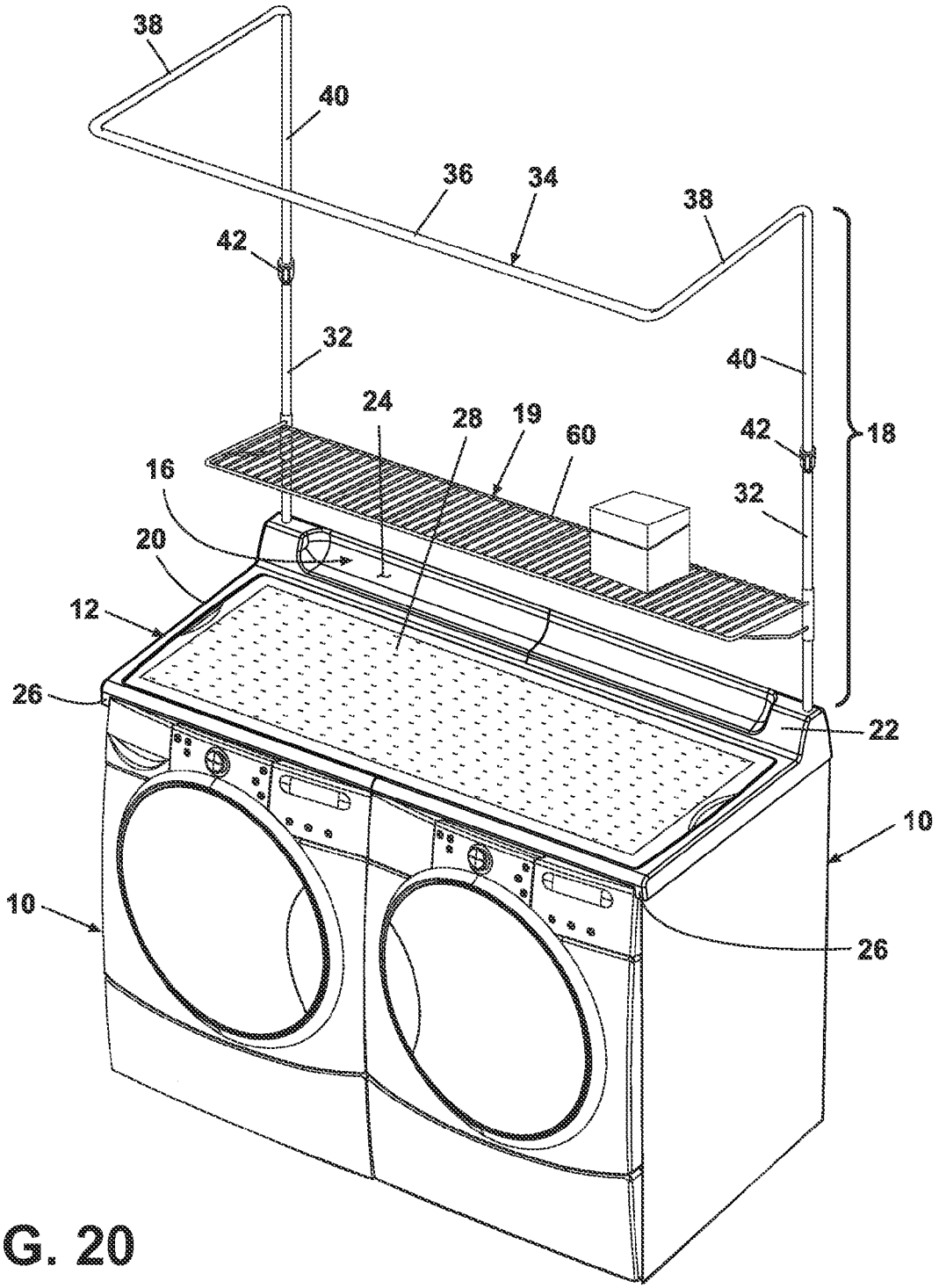
FIG. 20 is a perspective view of another embodiment of the modular laundry system shown in FIG. 10, wherein the hanging area provided above the worksurface has a first embodiment of a shelf area.
Figure 21:
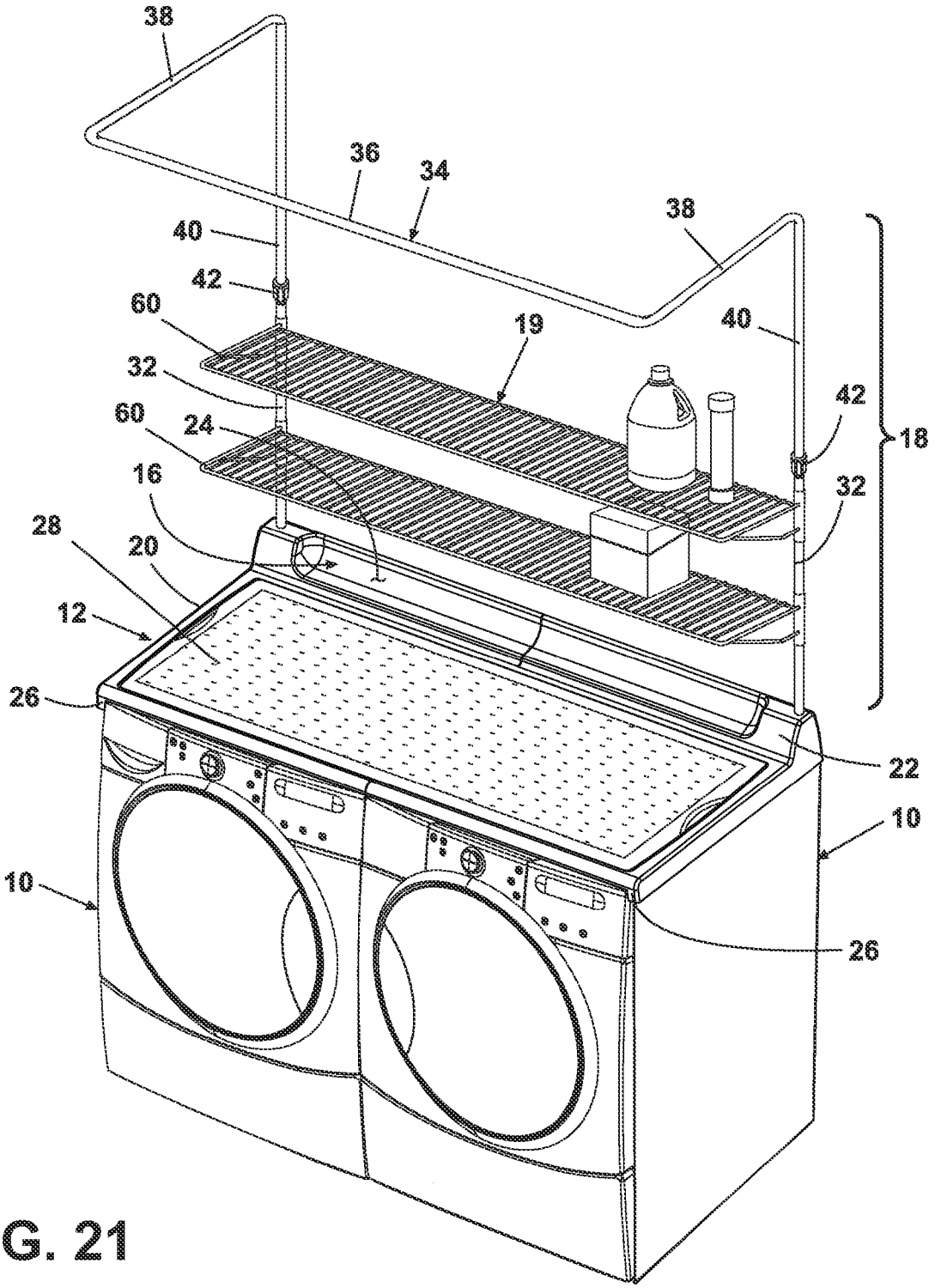
FIG. 21 is a perspective view of another embodiment of the modular laundry system shown in FIG. 20, wherein the hanging area provided above the worksurface has a second embodiment of a shelf area.
Figure 22:
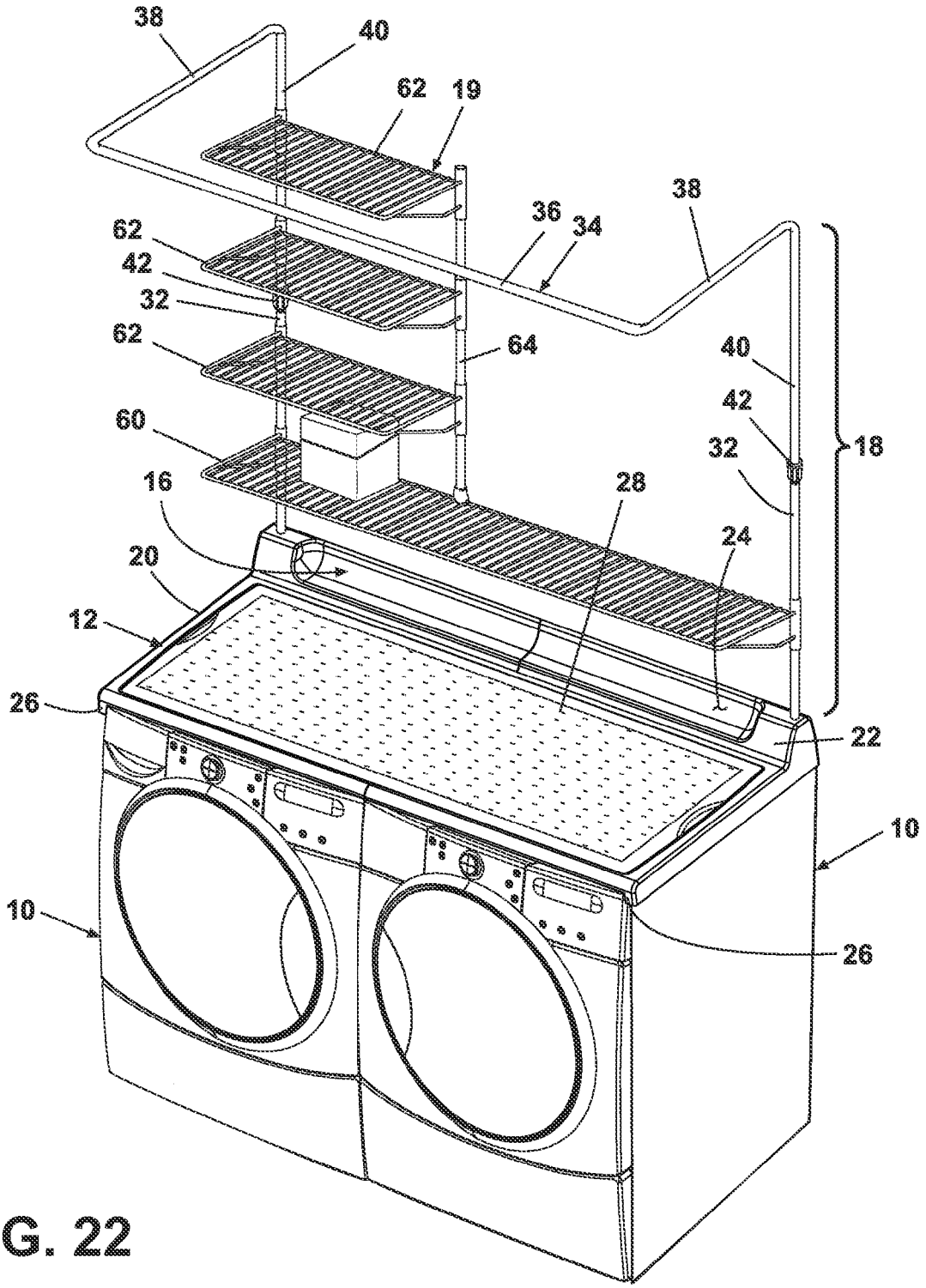
FIG. 22 is a perspective view of another embodiment of the modular laundry system shown in FIG. 20, wherein the hanging area provided above the worksurface has a third embodiment of a shelf area.

It is also contemplated that, in accordance with the invention, the hanging area 18 can also include additional components to optimize the functionality of the hanging area 18 of the modular laundry system described herein. For example, FIG. 20 is a perspective view of another embodiment of the modular laundry system, wherein the hanging area 18 provided above the worksurface 12 has a first embodiment of a shelf area 19 comprising an elongated shelf 60 extending the length between the upright members of the hanging area 18, which are the base rods 32 and the extension rods 40 in the current embodiment. FIG. 21 is a perspective view of another embodiment of the modular laundry system shown in FIG. 20, wherein the hanging area 18 provided above the worksurface 12 has a second embodiment of a shelf area 19 comprising a vertically-spaced arrangement of a plurality of full-length shelves 60 extending the length of the hanging area 18. FIG. 22 is a perspective view of another embodiment of the modular laundry system shown in FIG. 20, wherein the hanging area 18 provided above the worksurface 12 as a third embodiment of a shelf area 19 comprising at least one full-length shelf 60 and at least one vertically spaced arrangement of a partial-length shelf 62 which can be connected at one end to one of the vertical upright members of the hanging area 18 and at an opposite end by a vertical stile 64.

The provision of at least a portion of the shelving associated with the hanging area 18 allows for garments of a longer length to be hung in the portion of the hanging area 18 not occupied by the shelving 60, 62 while optimizing the storage space in the hanging area 18 as well.

Figure 23:
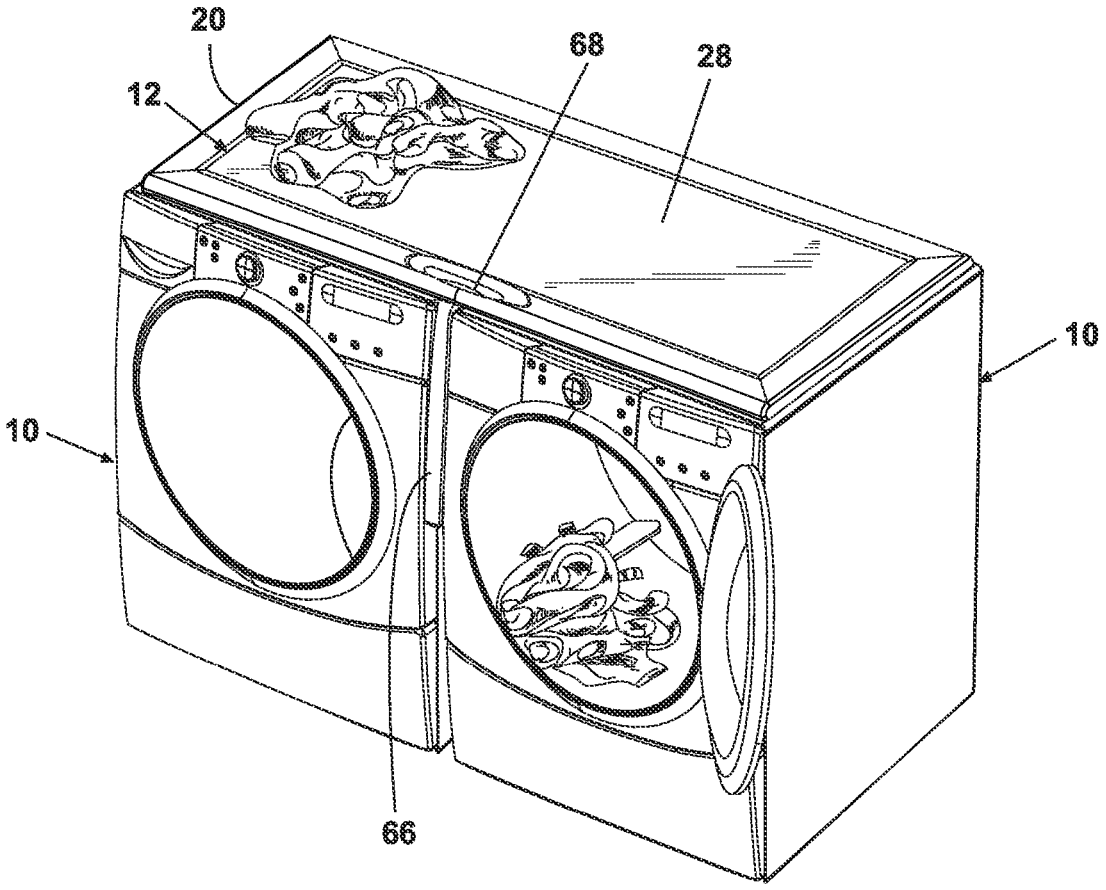
FIG. 23 is a perspective view of another embodiment of the modular laundry system shown in FIG. 8, wherein a worksurface extends across a pair of horizontally-disposed laundry appliances, and a hinge supporting the worksurface locates the worksurface at a first position located atop the horizontally-disposed laundry appliances.
Figure 24:
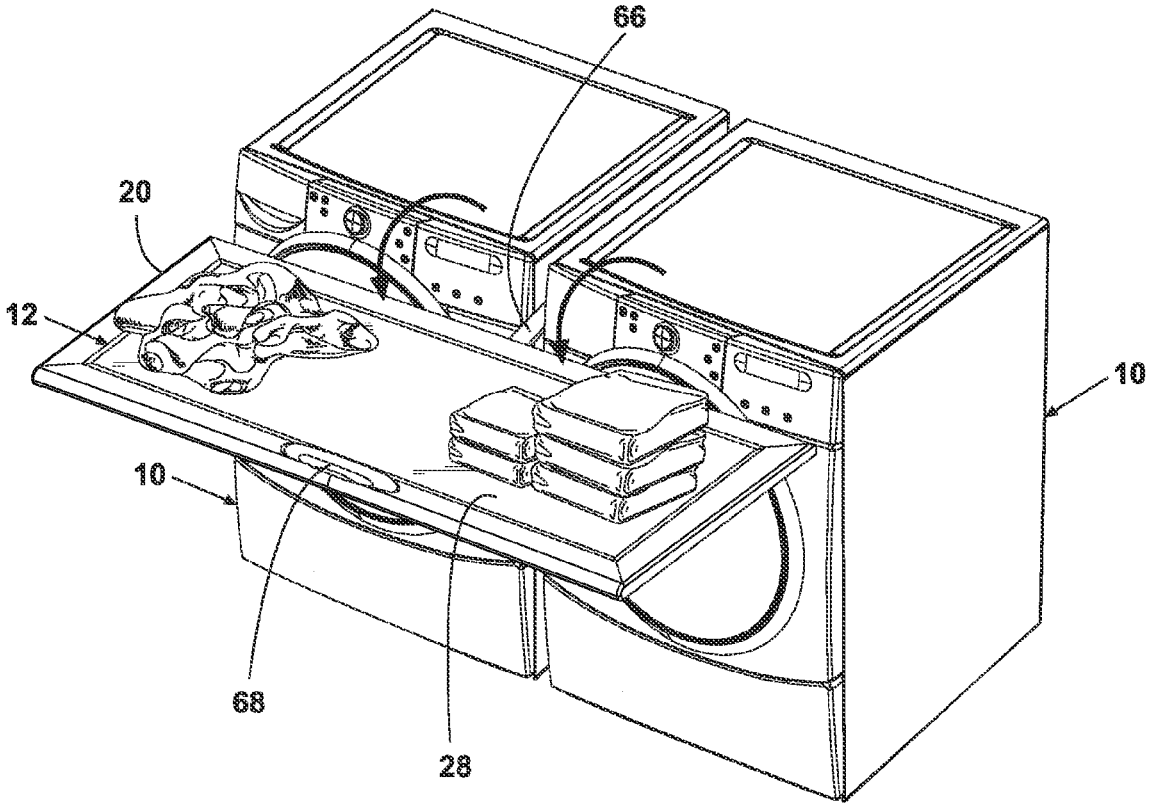
FIG. 24 is a perspective view of the embodiment of the modular laundry system shown in FIG. 23, wherein the hinge supporting the worksurface can be rotated to locate the worksurface at a second position located angularly and forwardly of the horizontally-disposed laundry appliances.

The worksurface 12 can also be moveable in and of itself. For example, FIG. 23 is a perspective view of another embodiment of the modular laundry system shown in FIG. 8, wherein the worksurface 12 extends across a pair of horizontally-disposed laundry appliances 10, and a hinge 66 is mounted in a location between the laundry appliances 10 and the underside of the worksurface 12. The hinge 66 movably mounts the worksurface 12 between a first position located atop or overlying the horizontally-disposed laundry appliances 10 and a second position, as shown in FIG. 24, located angularly and forwardly of the horizontally-disposed laundry appliances 10. A user-graspable handle 68 is provided on the worksurface 12 to assist the user in moving the worksurface 12 between the first position shown in FIG. 23 and the second position shown in FIG. 24. It is within the scope of the invention to employ hinges other than the exemplary hinge 66 of FIGS. 23 and 24 to movably support the worksurface 12.

Figure 25:
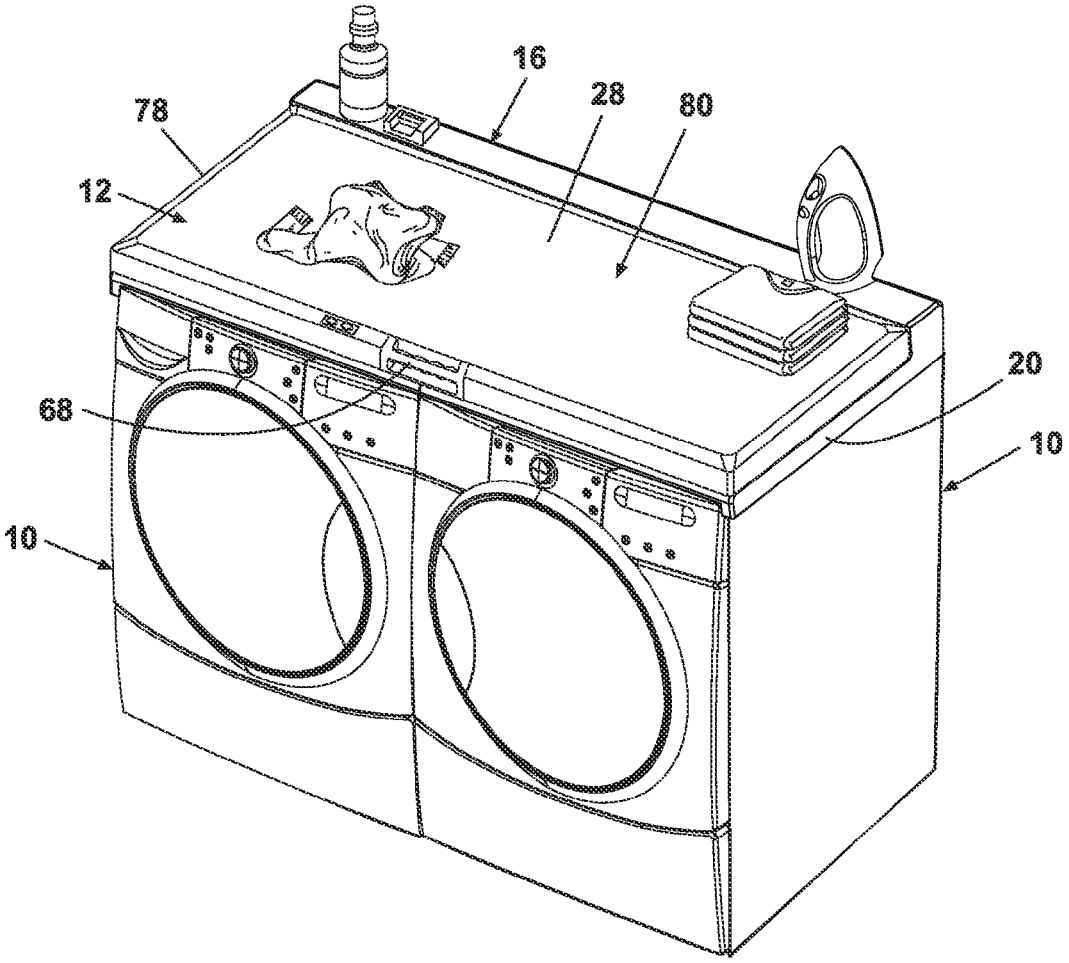
FIG. 25 is a perspective view of another embodiment of the modular laundry system shown in FIG. 8, wherein a worksurface comprises a wrinkle removing press shown in a closed position.
Figure 26:
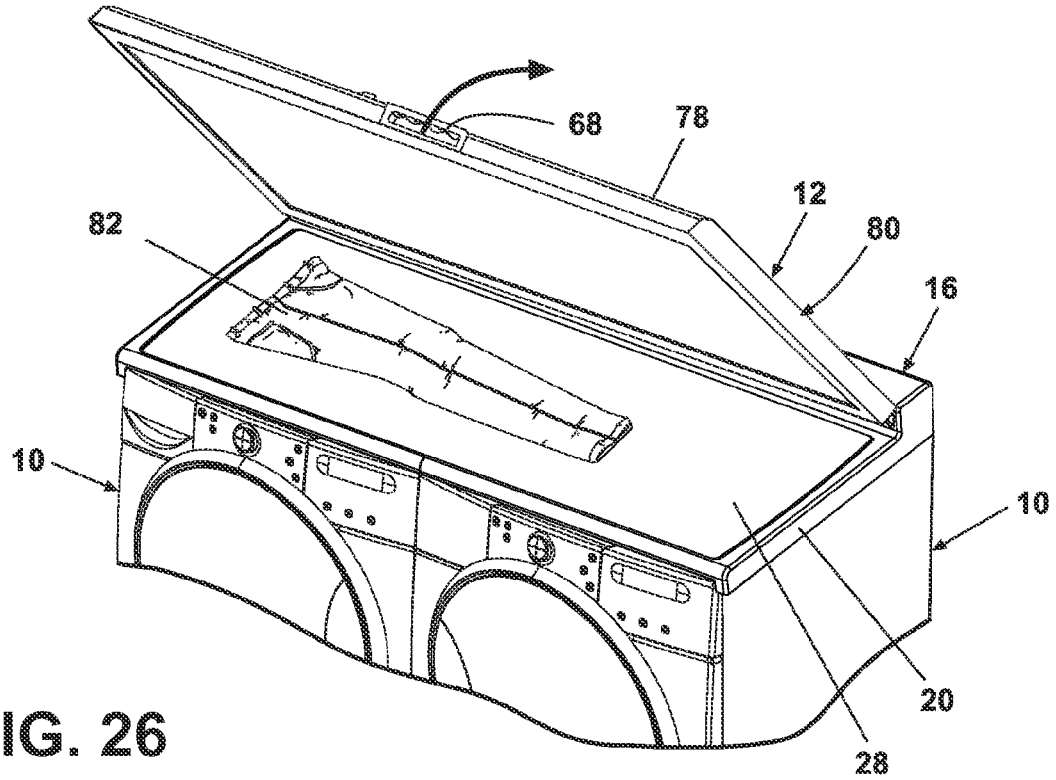
FIG. 26 is a fragmentary, perspective view of the embodiment of the modular laundry system shown in FIG. 25, wherein the wrinkle removing press has been pivoted to an open position and an article of clothing has been placed therein.
Figure 27:
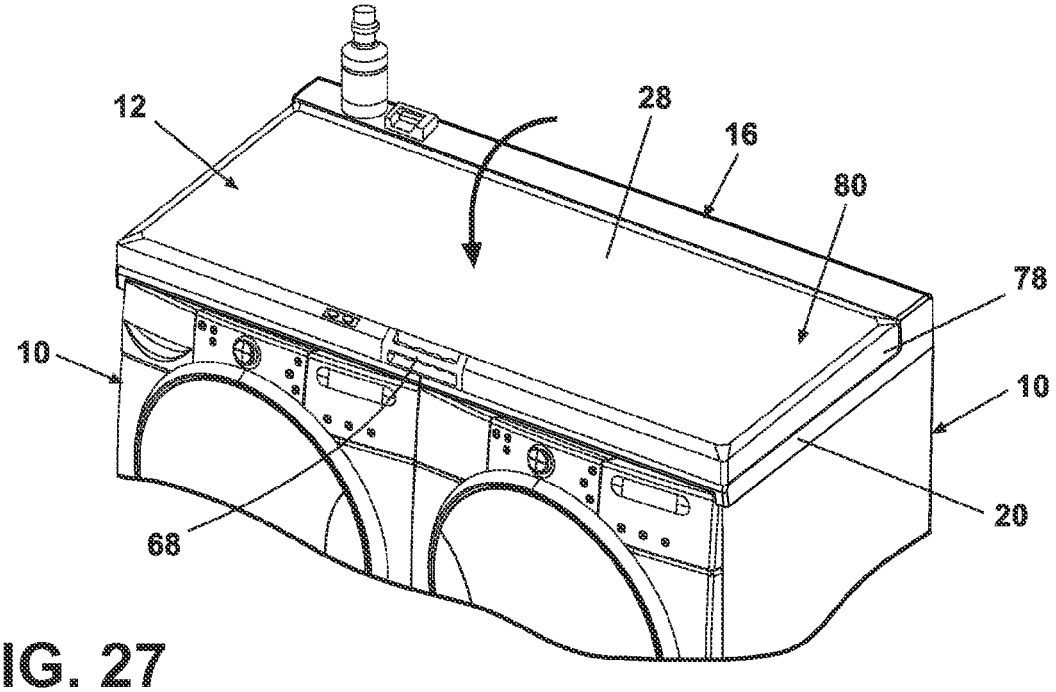
FIG. 27 is a fragmentary, perspective view of the embodiment of the modular laundry system shown in FIG. 24, wherein the wrinkle removing press has been re-pivoted to the closed position to provide a pressing function to the article of clothing placed therein.

The worksurface 12 can also have a laundry-related function built into its interior. For example, FIG. 25 is a perspective view of another embodiment of the modular laundry system shown in FIG. 8, wherein a worksurface 12 comprises a wrinkle removing press 80, which is shown in a closed position in FIG. 25. FIG. 26 shows the wrinkle removing press 80 being pivoted to an open position, and an article of clothing 82 placed therein. The actual structure and function of the press 80 is well-known and need not be described in detail and would be apparent to one skilled in the art. In general, the press 80 is a clamshell-type device which has a cover 78 that can be opened so that an article of clothing 82 placed between the cover 78 and the body 20 of the worksurface 12, as shown in FIG. 26, and closed, as illustrated by an arrow in FIG. 27, so that a laundry-related function, e.g., steaming, pressing, wrinkle removal, etc., can be performed on the clothing 82 placed therein. The worksurface 12 can include a first functional cover 28 on the body 20 to protect the body 20 from the heat generated by the press 80, and a second functional cover 28 on top of the cover 78 so that another task, such as ironing, can be performed on the worksurface 12. A user-graspable handle 68 is provided as well to assist the movement of the press 80 between the positions shown in FIGS. 25-27. FIG. 27 shows the wrinkle removing press has been re-pivoted to the closed position to provide a pressing function to the article of clothing 82 placed therein.

Figure 28:
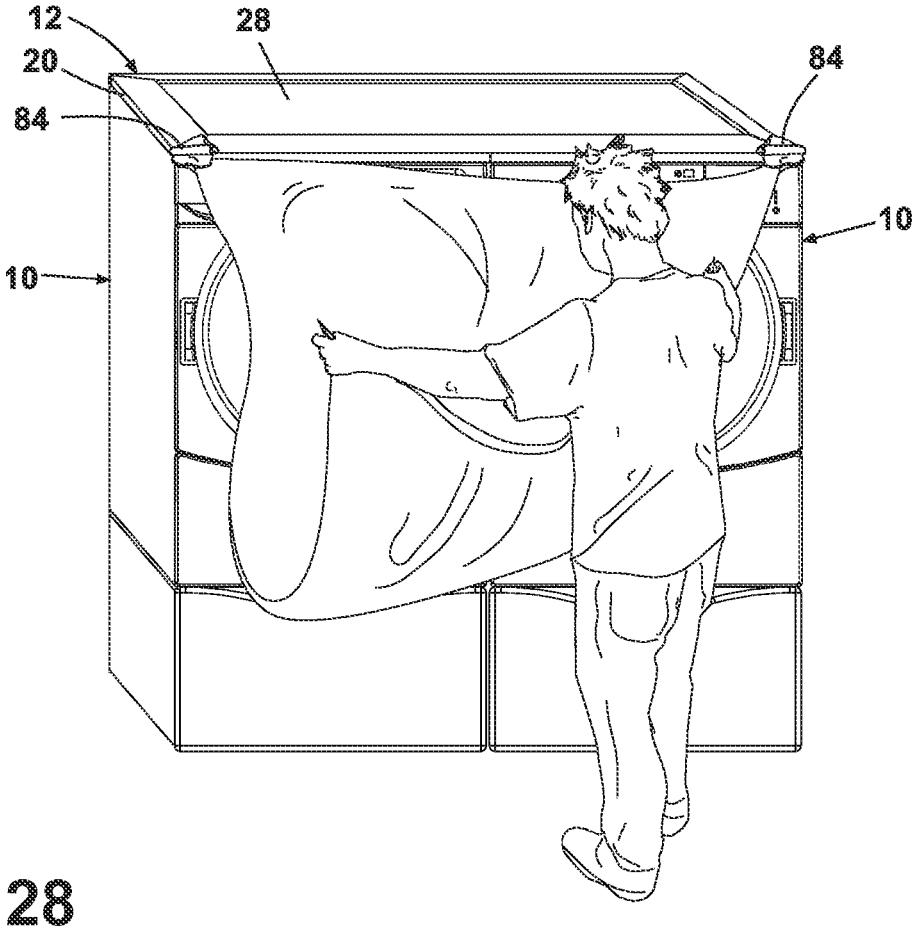
FIG. 28 is a perspective view of another embodiment of the modular laundry system shown in FIG. 8, wherein a pair of clothing-retaining clips is integrated with the worksurface to assist a user in folding operations thereon.
Figure 29:
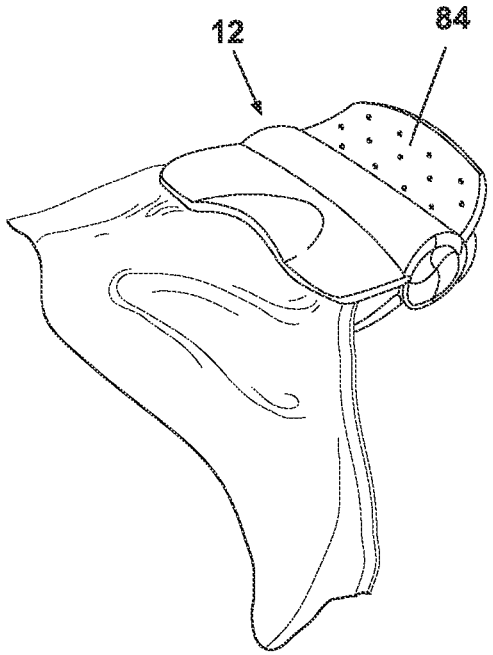
FIG. 29 is a fragmentary, perspective view of FIG. 28 showing the clothing-retaining clips in greater detail.

In addition, a folding function can be provided to the modular laundry system according to the invention. For example, FIG. 28 is a perspective view of another embodiment of the modular laundry system shown in FIG. 8, wherein a pair of clothing-retaining clips 84 are integrated with a worksurface 12 located above a pair of horizontally-disposed laundry appliances 10 to assist a user in folding operations thereon. FIG. 29 is a fragmentary, perspective view of FIG. 28 showing the clothing-retaining clips 84 in greater detail.

Figure 30:
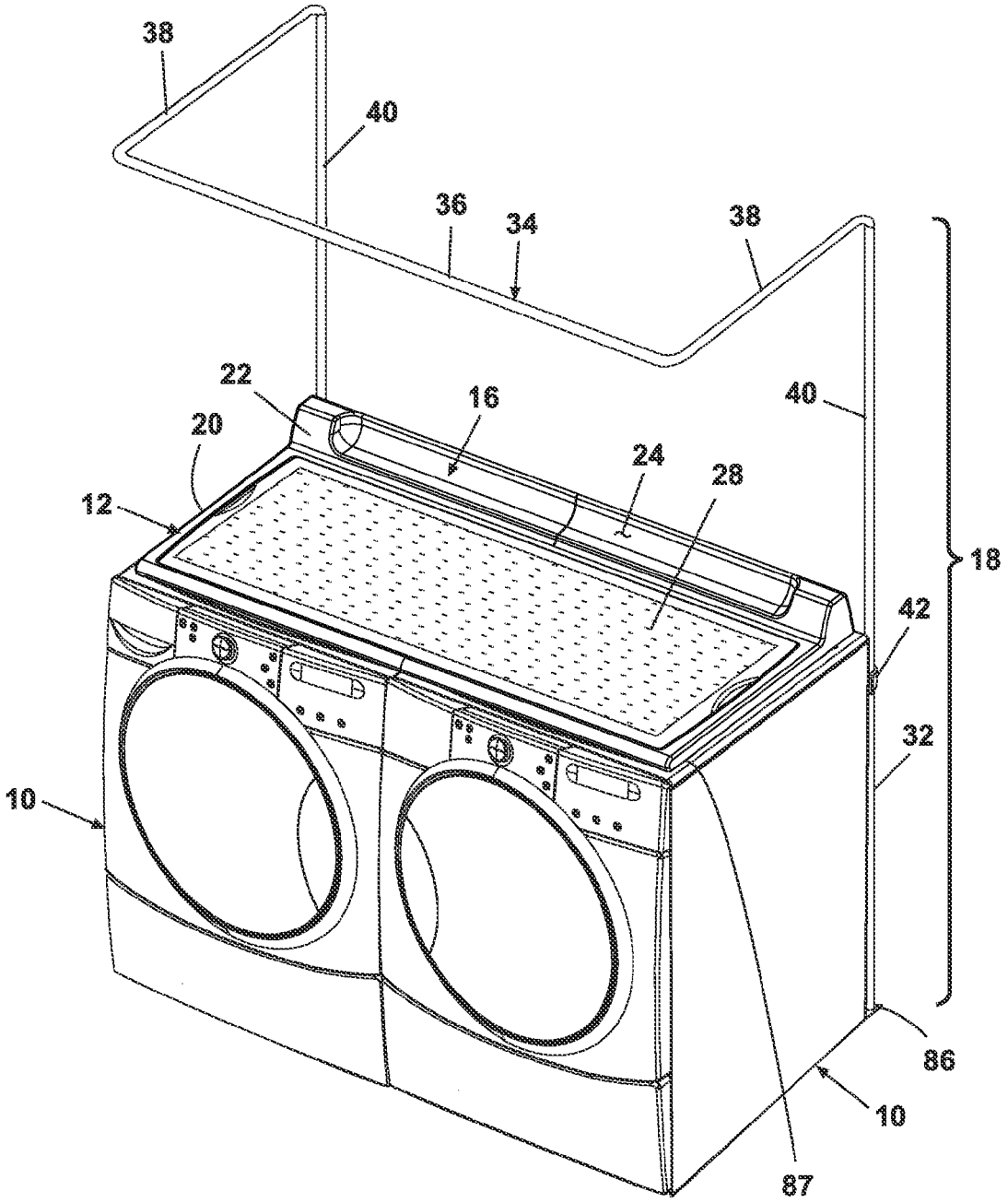
FIG. 30 is a perspective view of another embodiment of the modular laundry system shown in FIG. 10, wherein a worksurface extends across a pair of horizontally-disposed laundry appliances, and a hanging area is associated with the modular laundry system to allow articles of holding to be hung on a rod comprising a portion of the hanging area.
Figure 31:
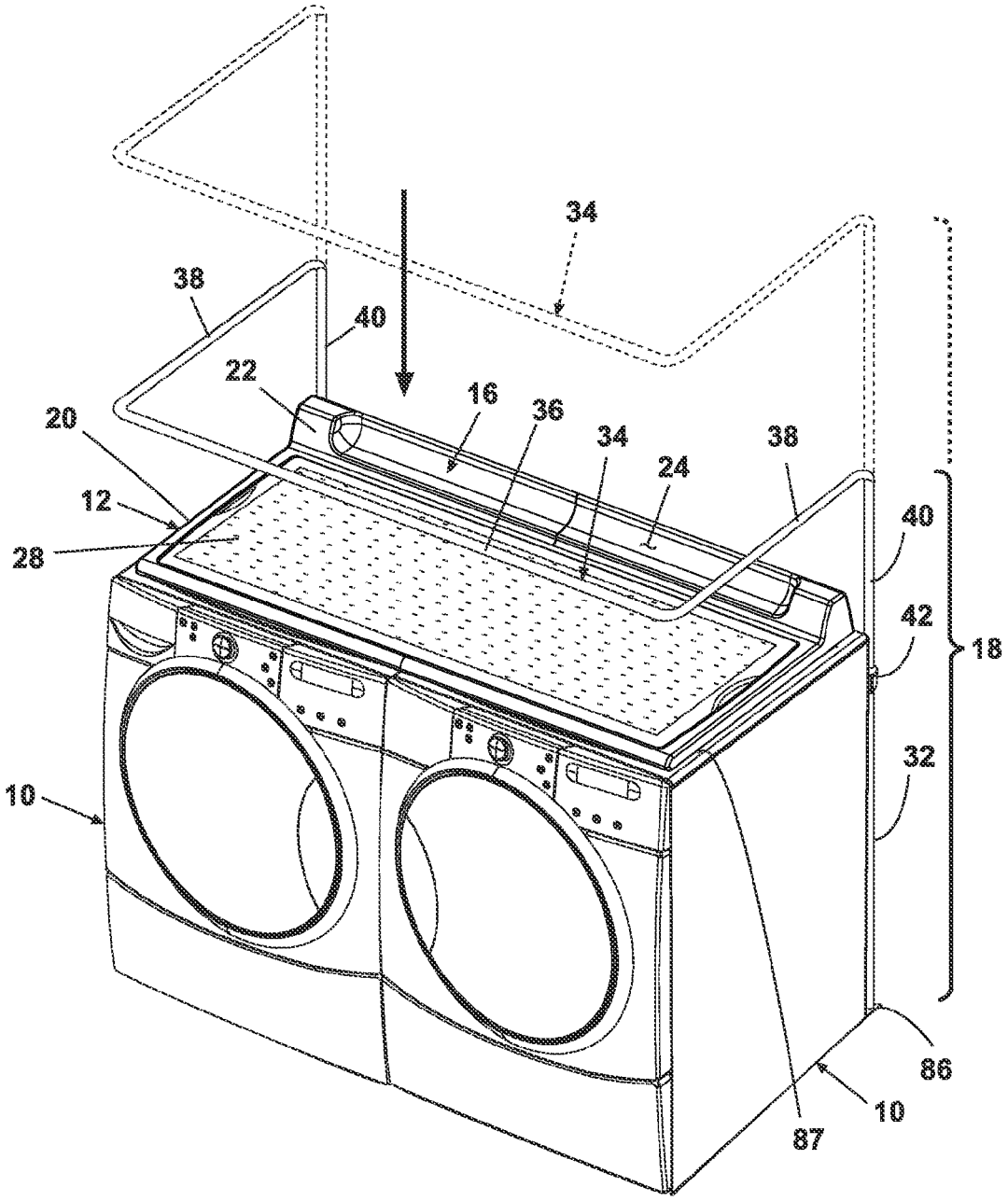
FIG. 31 is a perspective view of the embodiment of the modular laundry system shown in FIG. 30, wherein the hanging area is vertically adjustable via a selectively repositionable telescoping rod.
Figure 32:
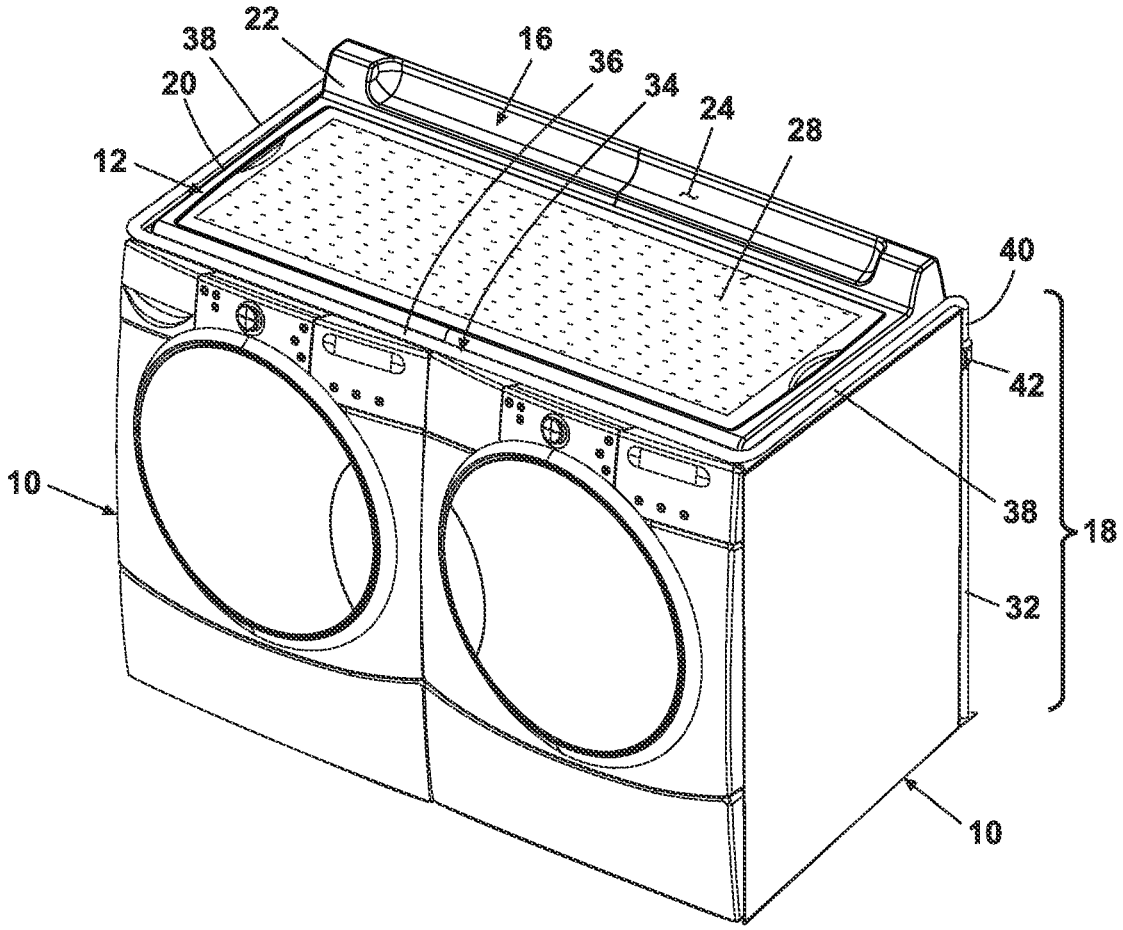
FIG. 32 is a perspective view of the embodiment of the modular laundry system shown in FIG. 30, wherein the hanging area has been completely and downwardly positioned to locate the hanging rod of the hanging area directly adjacent the worksurface extending across both horizontally-disposed laundry appliances.

Various embodiments of the hanging area 18 will now be described in further detail. FIG. 30 is a perspective view of another embodiment of the modular laundry system shown in FIG. 10, wherein a worksurface 12 extends across a pair of horizontally-disposed laundry appliances 10, and a hanging area 18 is associated with the modular laundry system. As opposed to the embodiment of the hanging area 18 shown by example in FIG. 10, which supports the hanging area 18 on the worksurface 12, the hanging area 18 comprises a base rod 32 which stands on a foot 86 on a floor surface. The remaining components 32, 34, 36, 38, 40, 42 of the hanging area 18 operate in the same manner as described earlier and need not be further described. Resting the base rod 32 on the floor surface (via the foot 86) allows for the base rod 32 to occupy a greater vertical length and can therefore telescopingly receive a longer length of the extension rod 40. As can be seen in FIG. 31, this allows for greater vertical adjustability of the extension rod 40 with respect to the base rod 32. Further, if the base rod 32 is selected so that the upper edge of the base rod 32 is generally aligned with an upper edge of the worksurface 12 (or a backsplash 22 if provided thereon), the extension rod 40 can be received wholly within the base rod 32 so that the elongated central rod 36 and the spacer rods 38 can be lowered adjacent to the worksurface 12 as shown in FIG. 32. To accommodate the central rod 36 and the spacer rods 38, the worksurface 12 includes a peripheral U-shaped recess 87 in register with and sized to receive the central rod 36 and the spacer rods 38 in a flush manner.

Figure 33A:
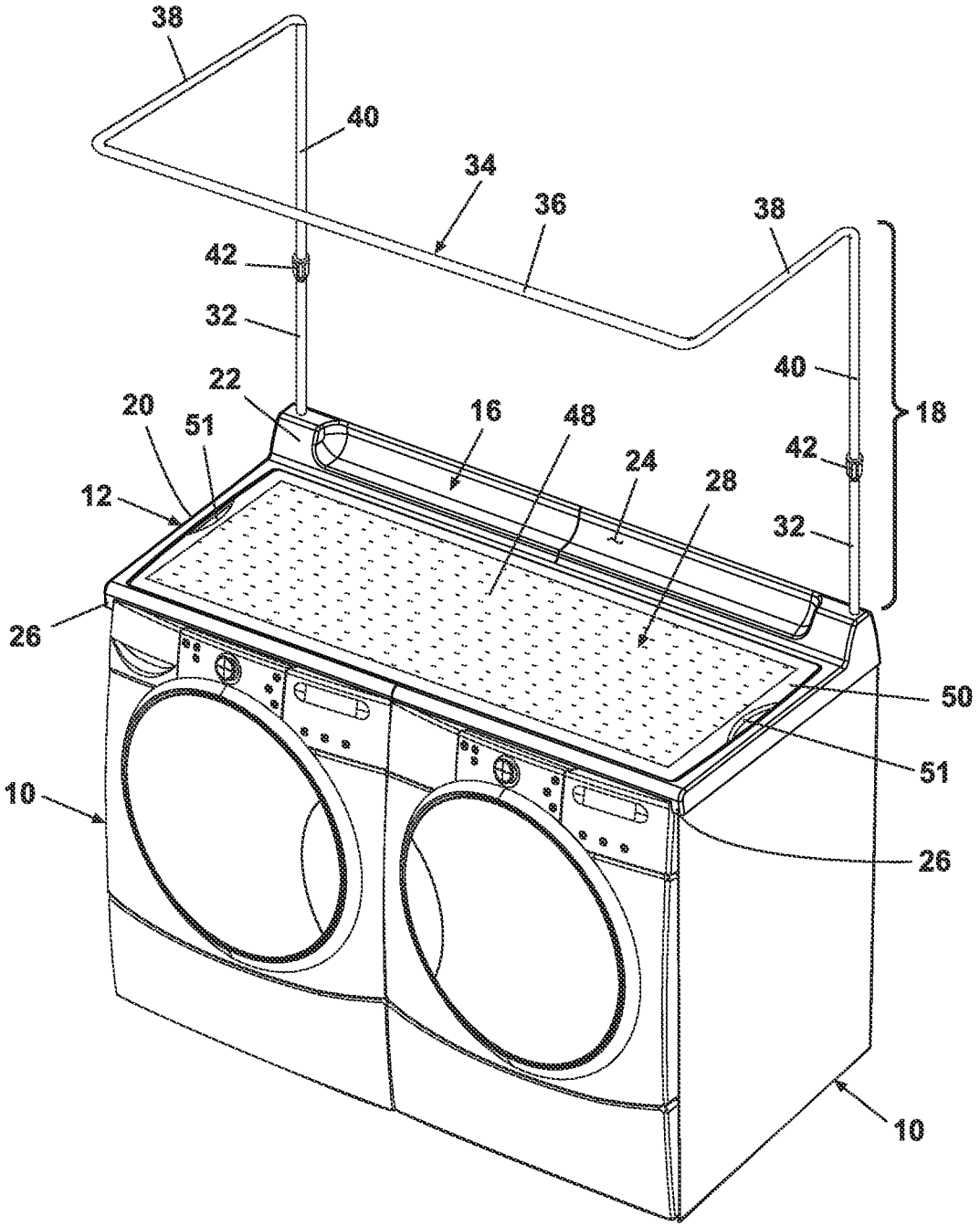
FIG. 33A is a perspective view of another embodiment of the modular laundry system shown in FIG. 30, wherein the worksurface extends across a pair of horizontally-disposed laundry appliances, and a hanging area is associated with the modular laundry system and extends through the worksurface, whereby the worksurface provides a base for the hanging area.
Figure 33B:
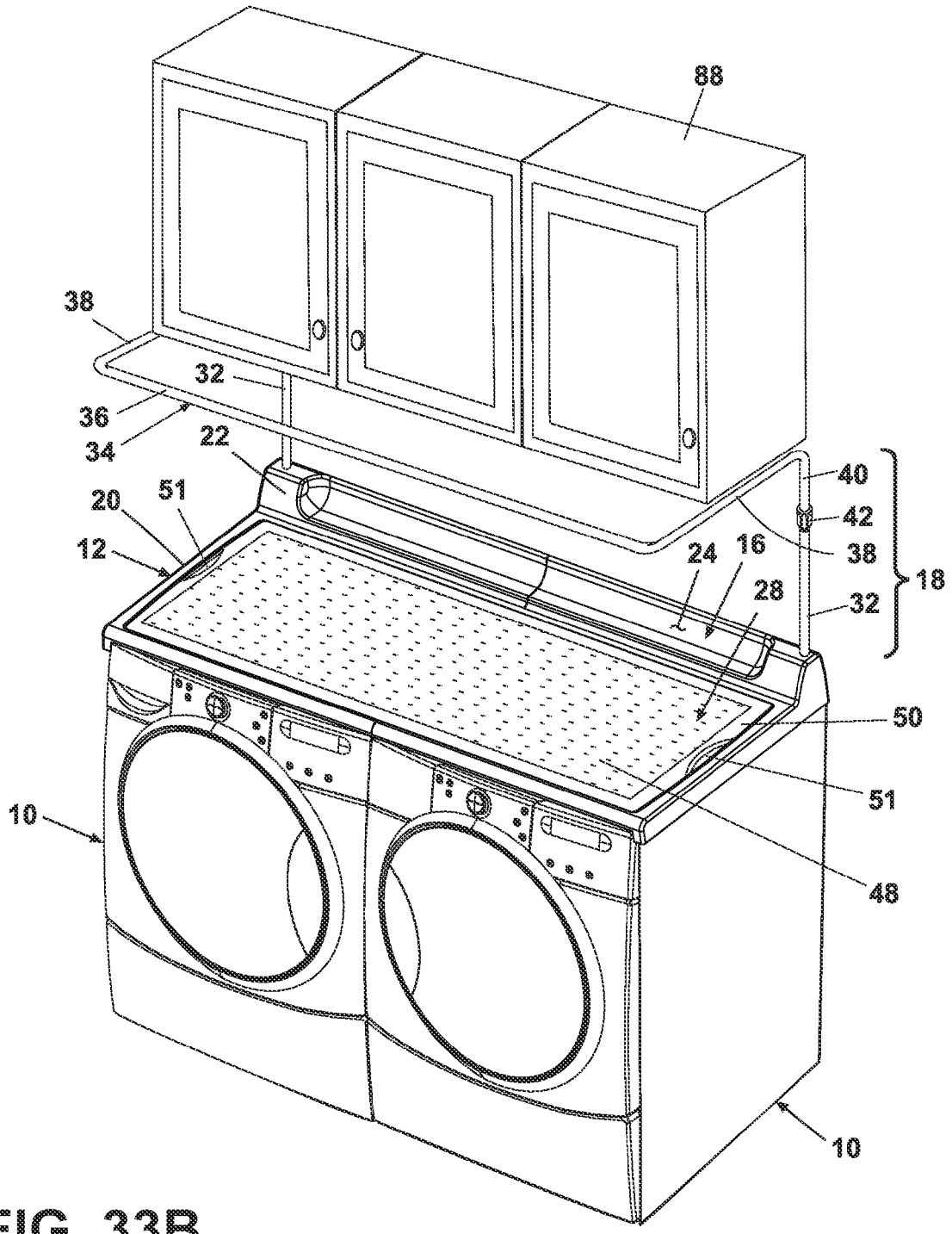
FIG. 33B is a perspective view of the embodiments of the modular laundry system shown in particular in FIG. 33A and also with respect to FIGS. 30-32 in which the vertical adjustability of the hanging area is shown to be useful when positioning the modular laundry system with respect to existing wall cabinets.

The adjustability of the elongated central rod 36 via the receipt of the extension rod 40 into the base rod 32 can also assist a user in repositioning the elongated central rod 36 when various obstructions are present in the laundry area in which the modular laundry system resides. For example, FIG. 33A is a perspective view of the embodiment of the modular laundry system shown in FIG. 10, wherein the worksurface 12 extends across a pair of horizontally-disposed laundry appliances 10 and a hanging area 18 is associated with the modular laundry system and extends through the worksurface 12, whereby the worksurface 12 provides a base for the hanging area 18. FIG. 33B is a perspective view of the embodiments of the modular laundry system shown in particular in FIG. 33A, and also with respect to FIGS. 30-32, in which the vertical adjustability of the hanging area 18 is shown to be useful when positioning the modular laundry system with respect to existing wall cabinets, shown by example with reference numeral 88.

Figure 34A:
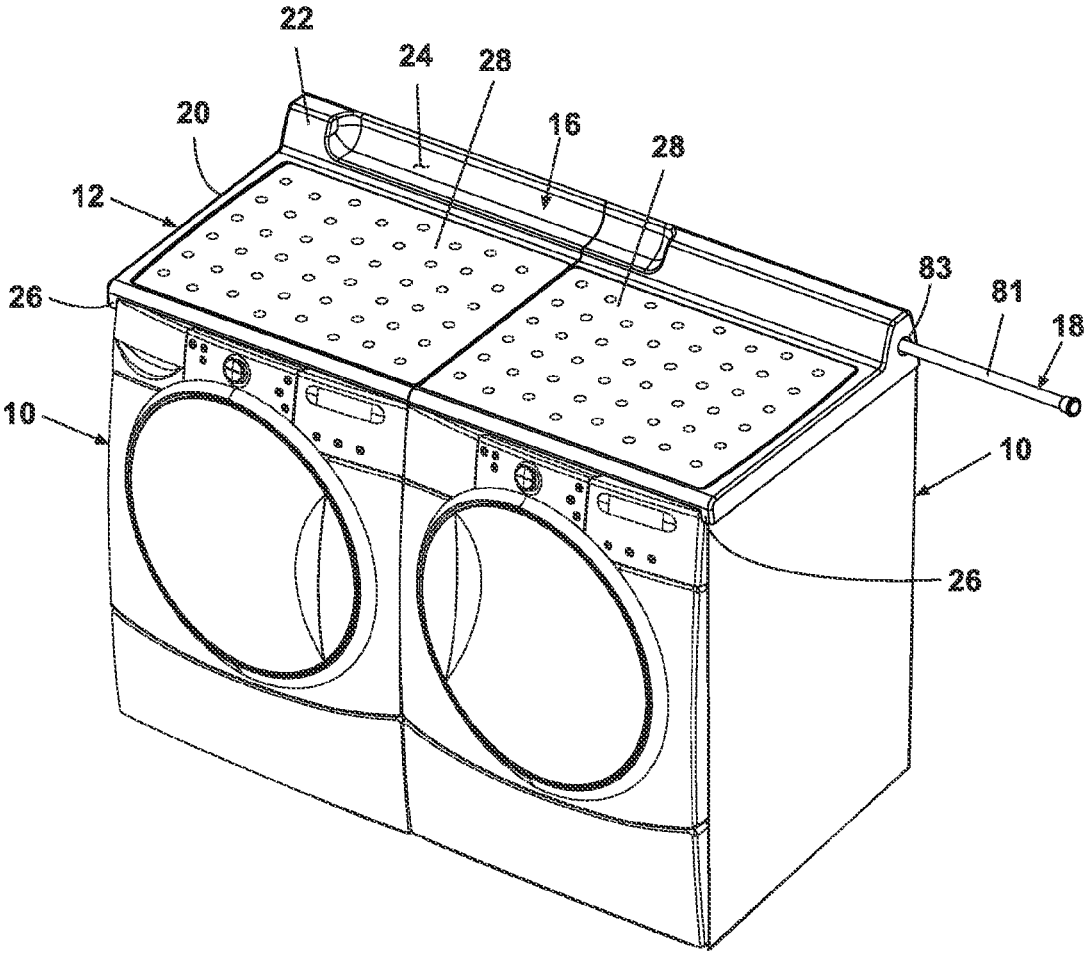
FIG. 34A is a perspective view of another embodiment of the modular laundry system shown in FIG. 10, wherein a worksurface extends across a pair of horizontally-disposed laundry appliances, and a hanging area is associated with the modular laundry system to allow articles of holding to be hung on a laterally extended hanging rod.
Figure 34B:
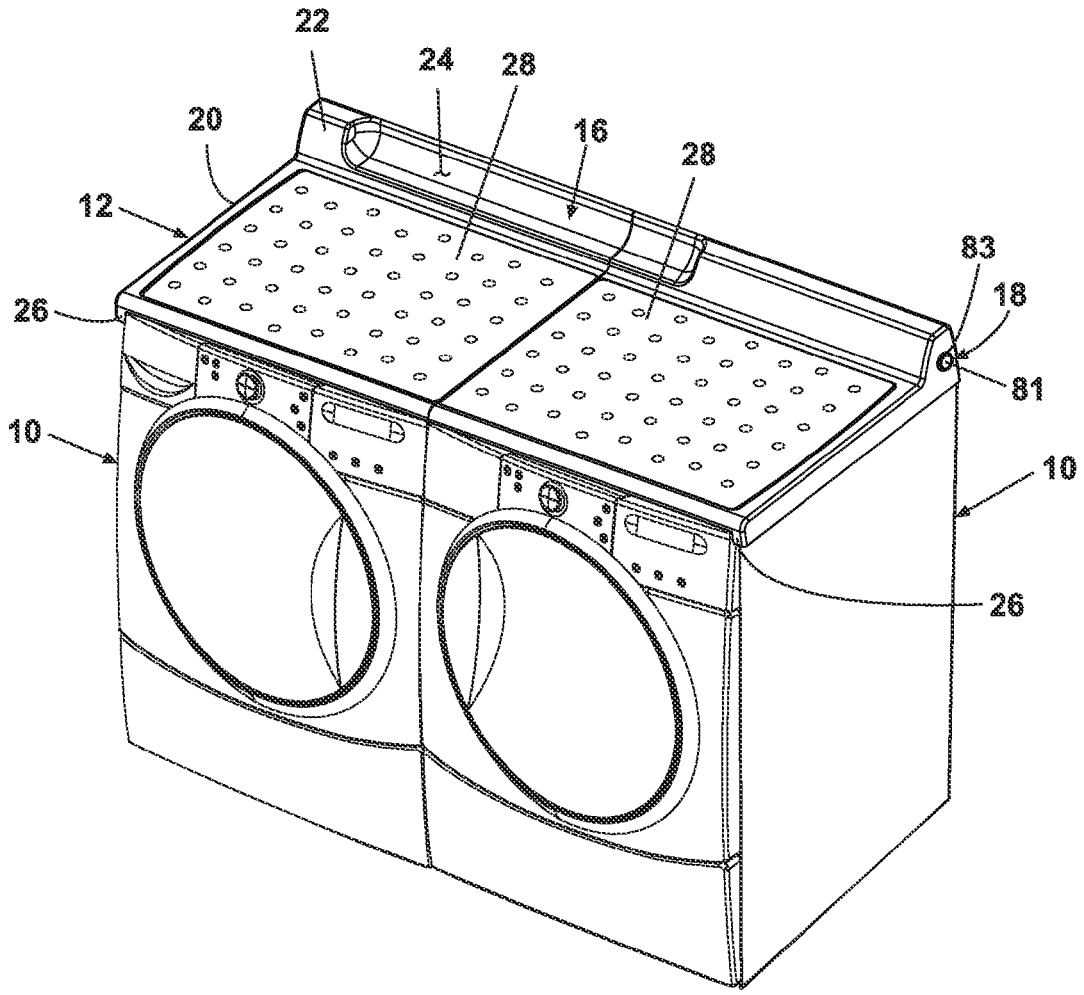
FIG. 34B is a perspective view of the embodiment of the modular laundry system shown in FIG. 34A with the hanging rod retracted into the worksurface.

FIG. 34A is a perspective view of another embodiment of the modular laundry system shown in FIG. 10, wherein a worksurface 12 extends across a pair of horizontally-disposed laundry appliances 10, and a hanging area 18 is associated with the modular laundry system. As opposed to the embodiment of the hanging area 18 shown by example in FIG. 10, which extends upward from the worksurface 12, the hanging area 18 comprises a hanging rod 81 that extends laterally from the worksurface 12. The hanging rod 81 is slidably mounted to the worksurface 12 through an opening 83 such that the hanging rod 81 can be extended laterally from the worksurface 12, as shown in FIG. 34A, for hanging items, such as on a hanger, or retracted into the worksurface 12, as shown in FIG. 34B, when not in use. In the illustrated embodiment, the hanging rod 81 is stored within the backsplash 22 when in the retracted position. The hanging rod 81 can be manually moved between the extended and retracted positions, or any type of actuator, such as a push-push type actuator, can be utilized to facilitate movement of the hanging rod 81. More details of exemplary hanging rods 81 are provided in application Ser. No. 11/322,503, filed Dec. 30, 2005, and titled "Retractable Hanging Element," now U.S. Pat. No. 7,954,914, issued Jun. 7, 2011, which is incorporated herein by reference in its entirety. Furthermore, it is within the scope of the invention for the hanging rod 81 to be mounted to the worksurface 12 in another manner, such as in a pivotable fashion, and to extend from the worksurface 12 in another direction, such as a forward direction.

Figure 35A:
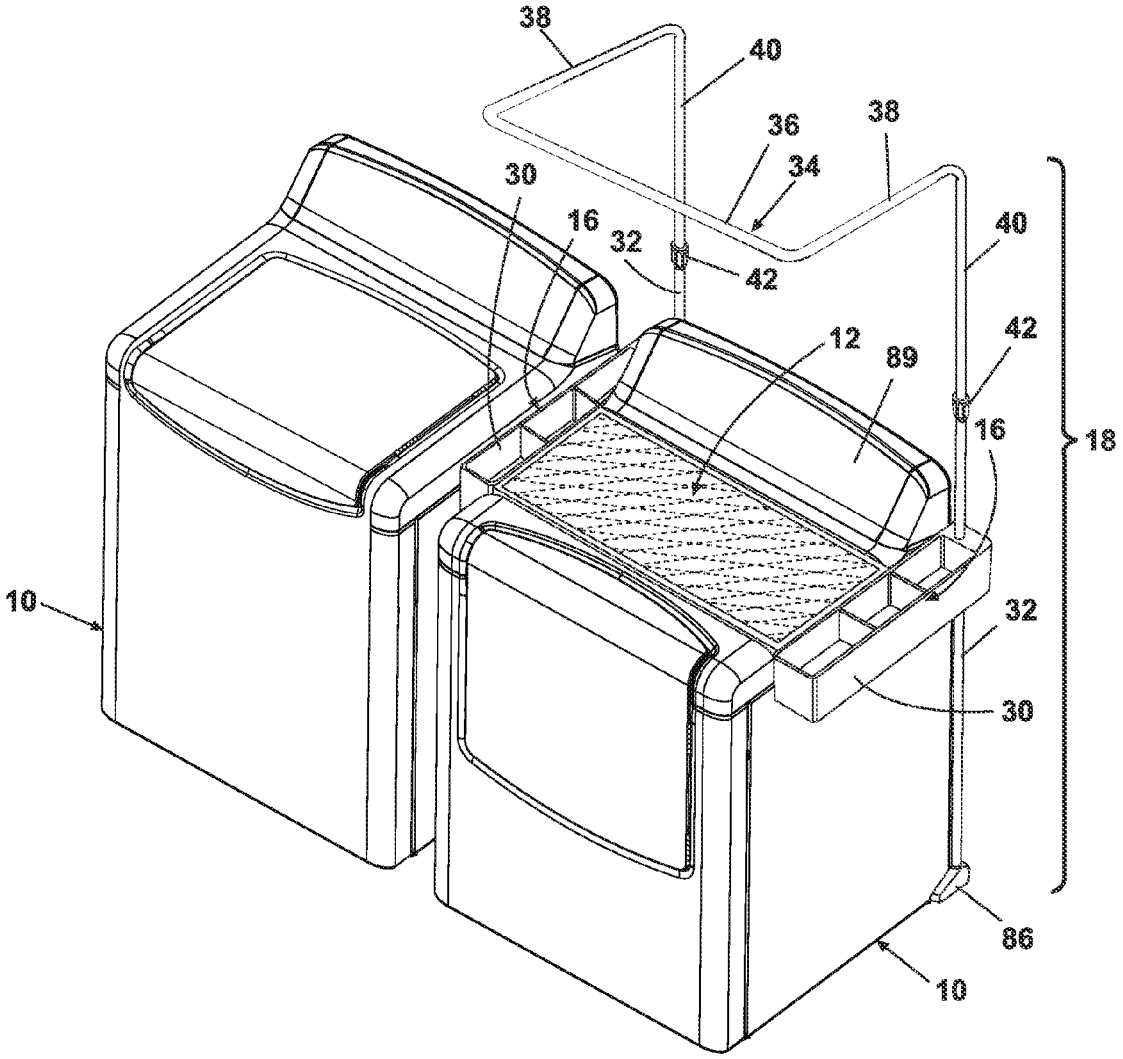
FIG. 35A is a perspective view of another embodiment of the modular laundry system, wherein the worksurface extends across a single horizontally-disposed laundry appliance and a single-width hanging area is associated with the worksurface of this embodiment.

FIG. 35A is another embodiment of the modular laundry system, wherein the worksurface 12 extends across a laundry appliance 10 and a single-width hanging area 18 is associated with the modular laundry system of this embodiment. The worksurface 12 is sized to accommodate a backsplash 89 of the laundry appliance 10 and includes a pair of the saddle-bad staging bins 30 arranged on opposite sides of the worksurface 12.

Figure 35B:
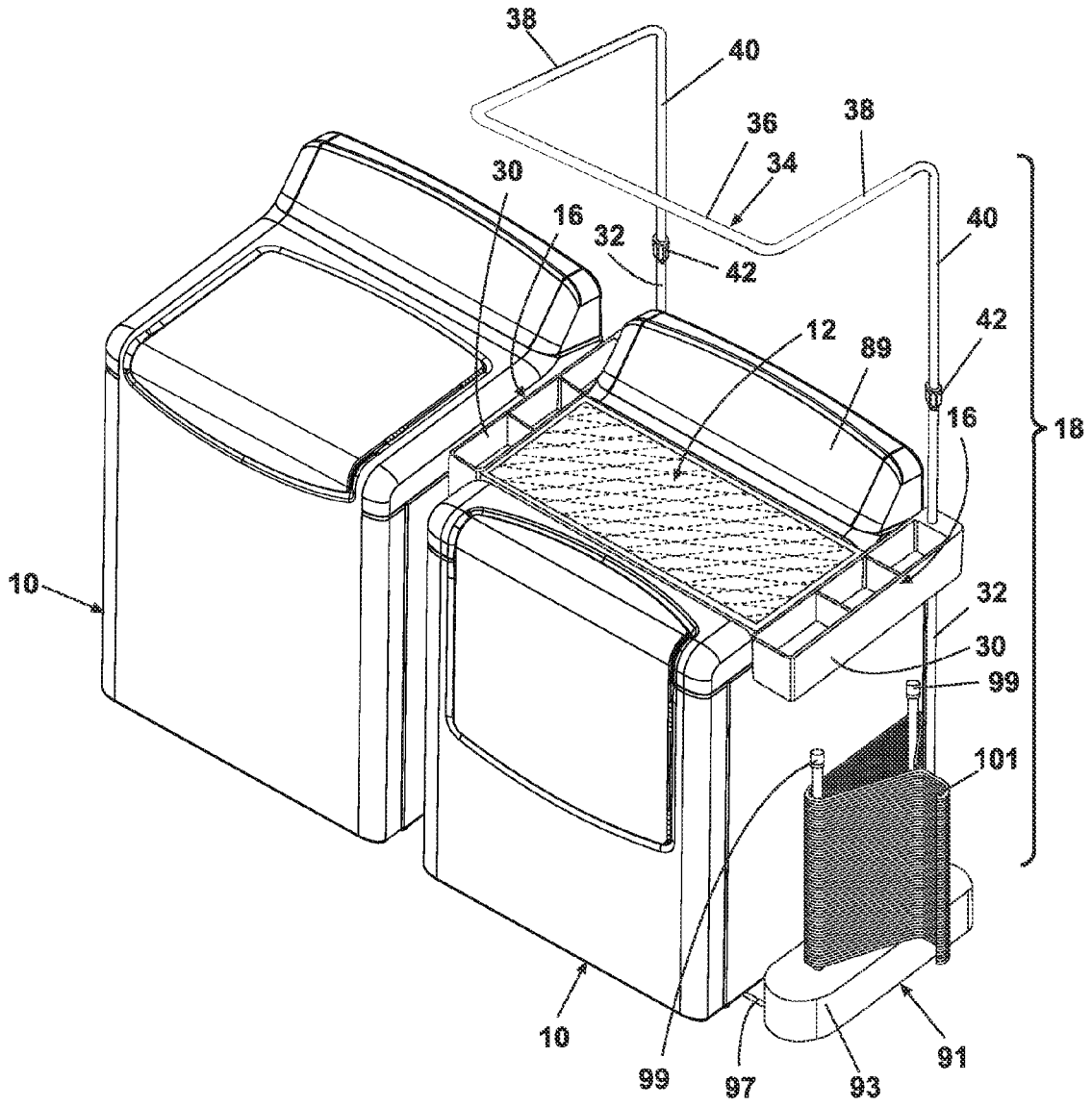
FIG. 35B is a perspective view of another embodiment of the modular laundry system similar to the embodiment of FIG. 35A and comprising a hanger staging area.
Figure 35C:
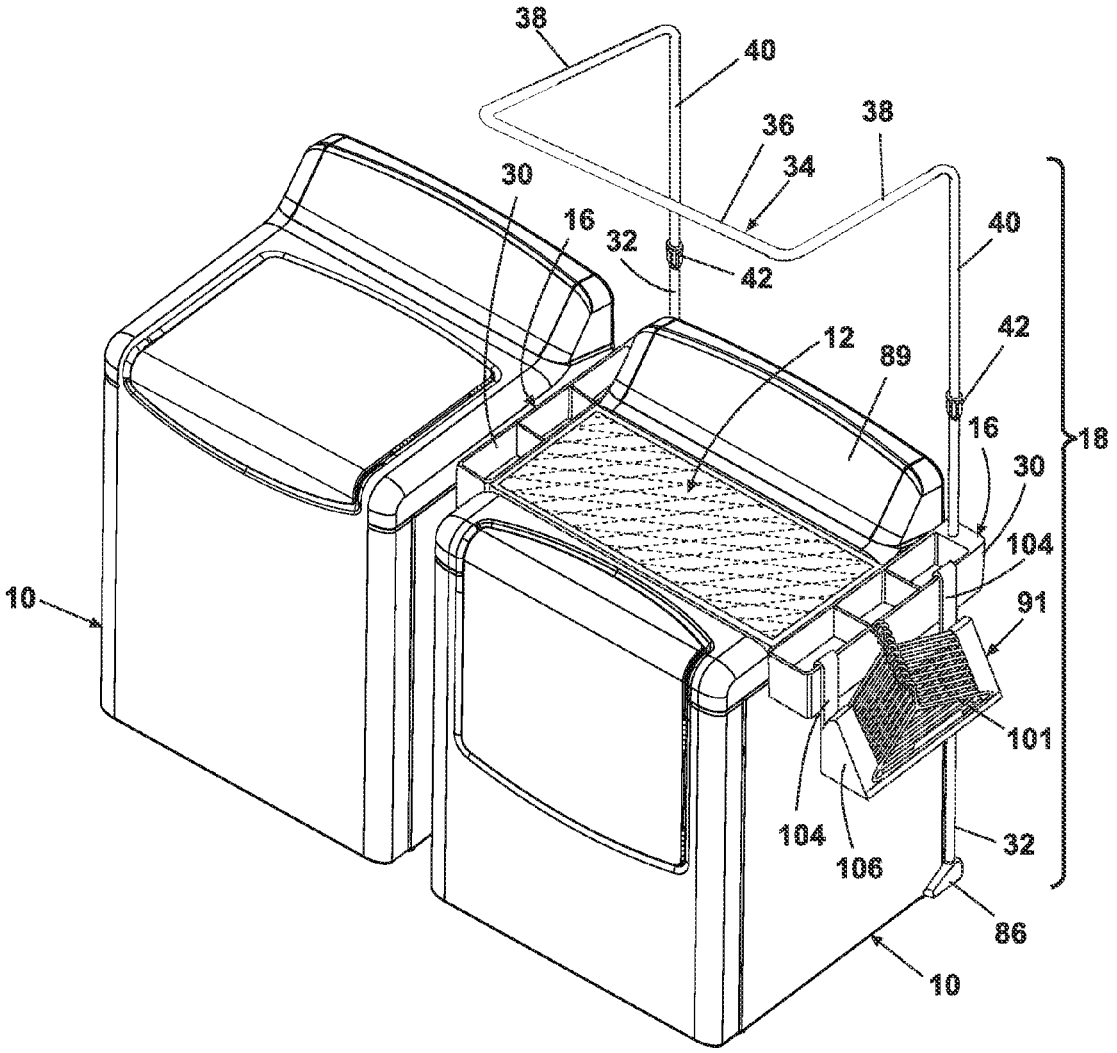
FIG. 35C is a perspective view of another embodiment of the modular laundry system similar to the embodiment of FIG. 35B and comprising an alternative hanger staging area.

FIG. 35B is a perspective view of another embodiment similar to that of FIG. 35A, but the worksurface 12 further comprises a hanger staging area 91. The hanger staging area 91 comprises a base 93 with a laterally extending flange 97 that can be slid under the laundry appliance 10 or integrally formed with the feet 86 of the hanging area 18 such that the hanger staging area 91 is disposed on one side of the worksurface 12. A pair of hanger rods 99 project upwardly from the base 93 and are spaced from one another a distance sufficient to support a plurality of hangers 101. Another embodiment of the hanger staging area 91 is illustrated in FIG. 35C. The hanger staging area 91 in FIG. 35C is supported by one of the staging bins 30 and comprises a pair of support hooks 104 to hang the hanger staging area 91 from the staging bin 30. The support hooks 104 terminate at a generally triangular shaped open-face hanger container 106 sized to receive a plurality of hangers 101 that can be easily accessed.

Figure 36:
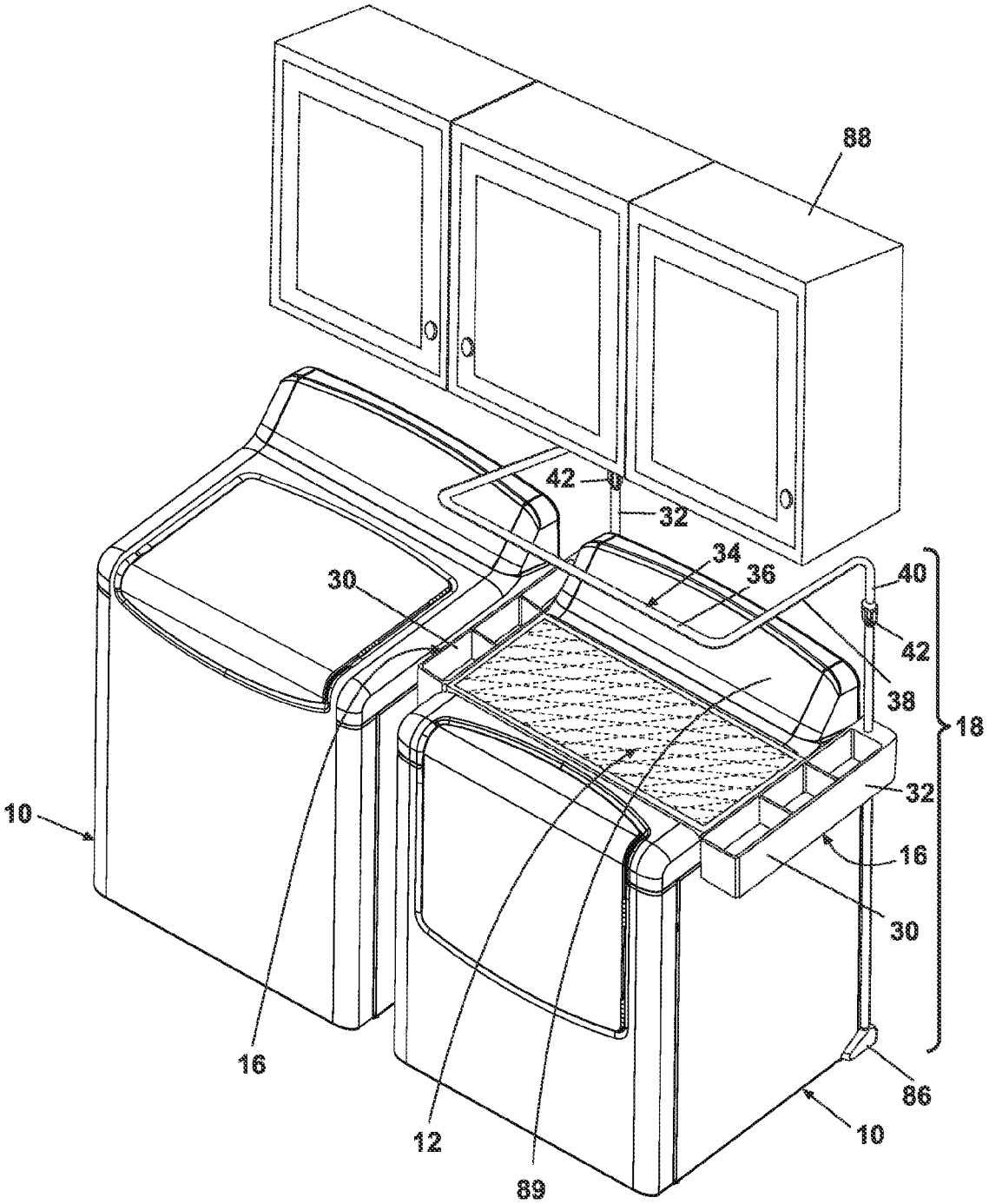
FIG. 36 is a perspective view of the embodiment of the modular laundry system shown in FIG. 35A in which the vertical adjustability of the hanging area is shown to be useful when positioning the modular laundry system with respect to existing wall cabinets.

FIG. 36 is a perspective view of the embodiment of the modular laundry system shown in FIG. 35A in which the vertical adjustability of the hanging area 18 is shown to be useful when positioning the modular laundry system with respect to existing wall cabinets 88. The worksurface 12 is also shown as an embodiment placed across the width of a single laundry appliance 10 and having saddle-bag staging bins 30 attached thereto, useful for organization and presentation of laundry-related items stored therein.

Figure 37A:
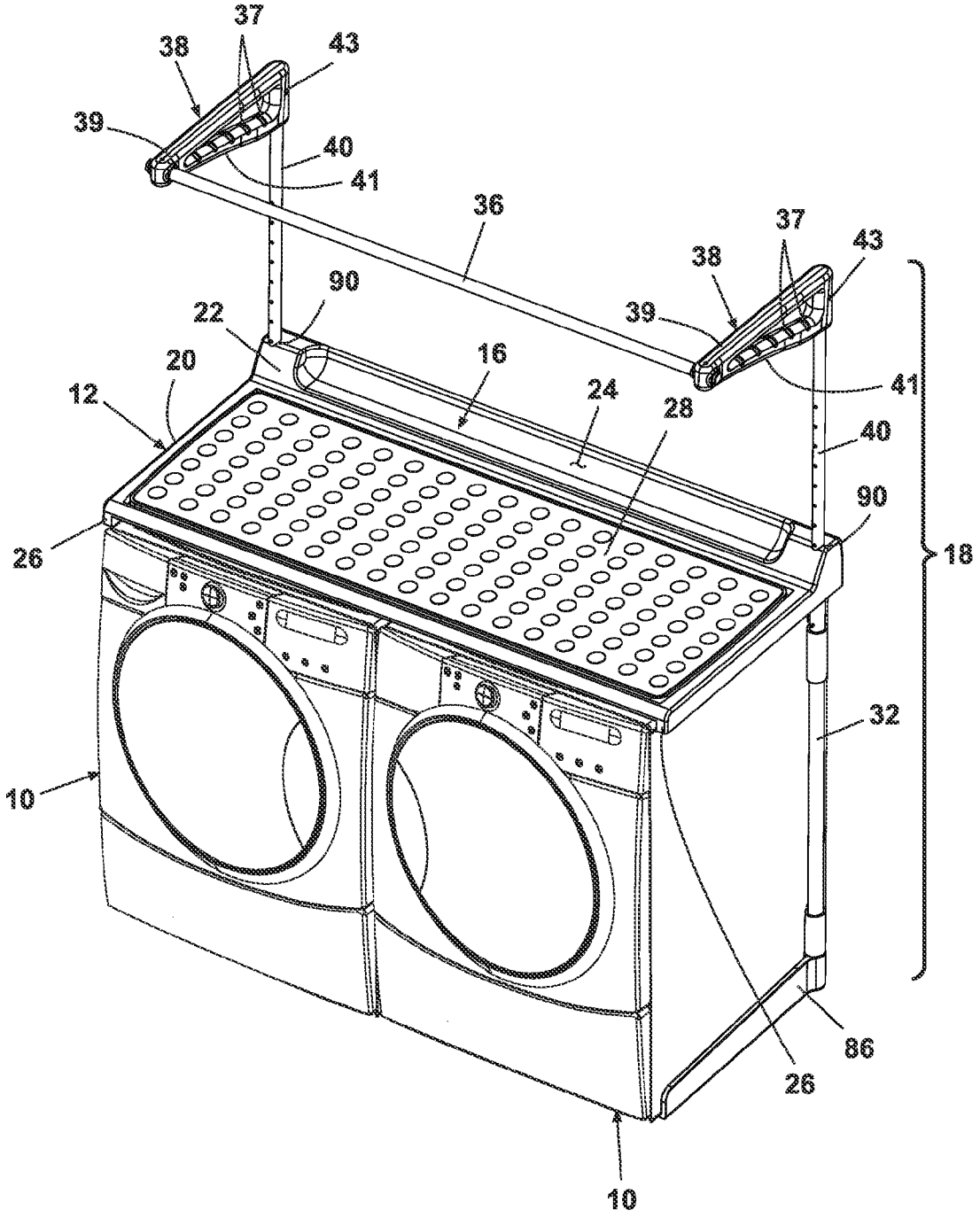
FIG. 37A is a perspective view of another embodiment of the modular laundry system shown in FIG. 10 in which the worksurface and hanging area are provided on a stand which can rest on a floor surface, and wherein the worksurface and hanging area are shown as, by example, a double-width across a pair of horizontally-disposed laundry appliances.

FIG. 37A is a perspective view of another embodiment of the modular laundry system in which the worksurface 12 and hanging area 18 are provided on a stand which can rest on a floor surface, and wherein the worksurface 12 and hanging area 18 are shown as, by example, a double-width across a pair of horizontally-disposed laundry appliances 10. The hanging area 18 rests on a floor surface via a foot 86, and the extension rod 40 is received within the base rod 32 and held in place by a clamp mount as previously described. In this embodiment, at least one of the base rod 32 and the extension rod 40 extends through an aperture 90 in the worksurface 12, and the elongated central rod 36 and the extension rods 40 of the hanging area 18 can be raised and lowered relative to the base rods 32 to achieve a desired vertical position of the central rod 36. Furthermore, the spacer rods 38 are generally triangular shaped and formed by an upper rod 39 and a lower rod 41 that intersect at their front ends and are joined at their rear ends by a vertical rod 43 that receives the extension rod 40. Items to be hung can be hung on the lower rod 41 of the spacer rod 38 in addition to on the central rod 36. To facilitate hanging the items on the lower rod 41, the lower rod 41 can comprise a plurality of notches 37 sized to each receive a hanger.

Figure 37B:
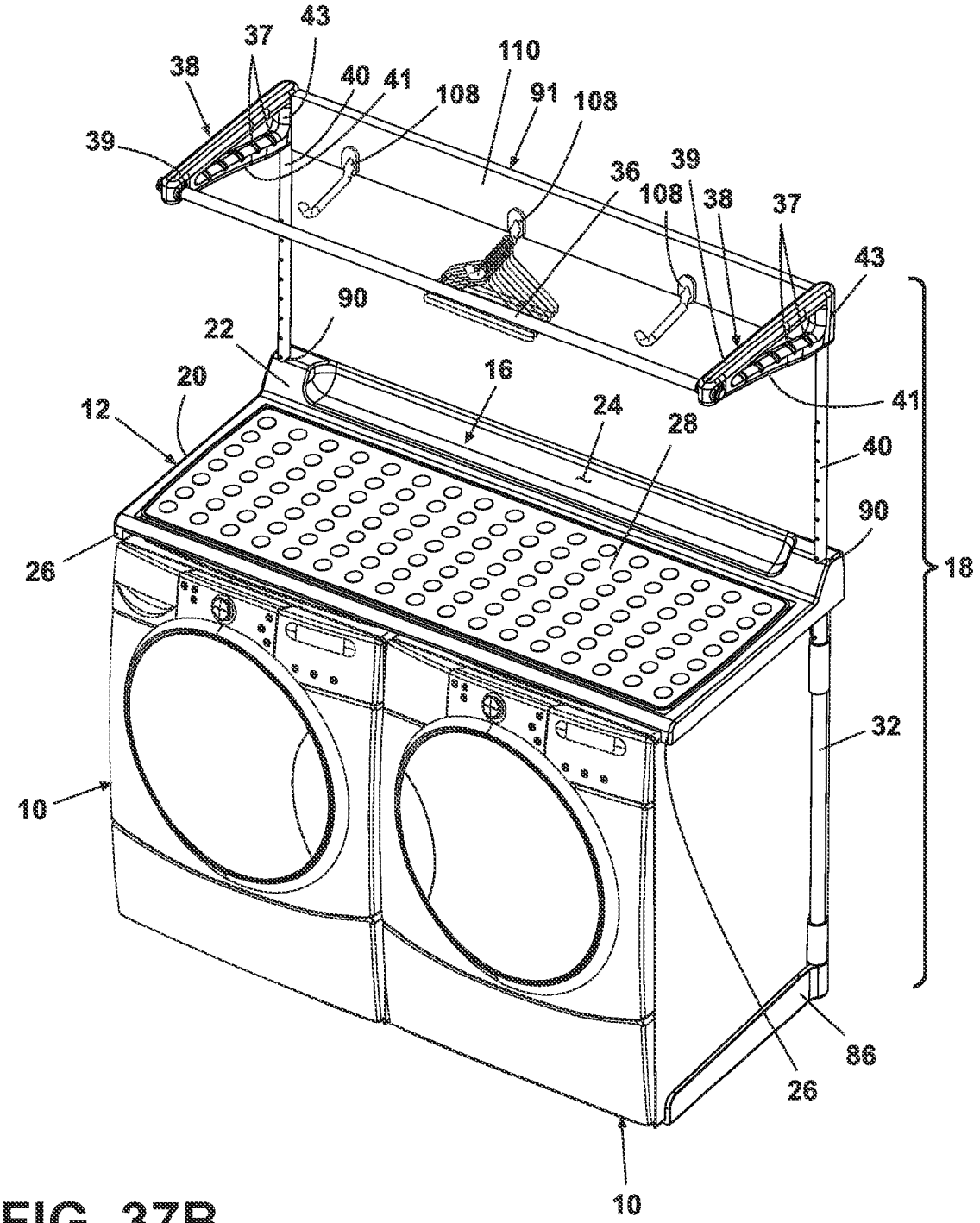
FIG. 37B is a perspective view an embodiment similar to the embodiment of FIG. 37A and further comprising a hanger staging area.

FIG. 37B is a perspective view of an embodiment of the modular laundry system similar to that of FIG. 37A, but the worksurface 12 further comprises the hanger storage area 91 in the form of hanger hooks 108 provided on a panel 110 that extends between rear ends of the spacer rods 38.

FIG. 38 shows the embodiment of the modular laundry system in FIG. 37A in greater detail in which the worksurface 12 and hanging area 18 are provided on a floor standing stand, and a functional insert 28 provided on the worksurface 12 is reversible to provide for a plurality of functions to be performed on the worksurface 12 depending upon which side of the functional insert 28 of the worksurface 12 is exposed. As can be seen from FIG. 38, the feet 86 of the hanging area 18 can be formed as right-angle channels to allow for a portion of the laundry appliance 10 to rest thereon and provide a stabilizing force by sitting on at least a portion of the feet 86. A cross brace 92 can be provided at a lower rear vertical area of the hanging area 18 which supports the opposing base rods 32 in bearings 94. The cross brace 92 can assist the hanging area 18 in resisting torque forces applied on the hanging area 18 when a large amount of clothing is hung on the elongated central rod 36 and/or the spacer rods 38 of the hanging area 18 during use of the hanging area 18.

Figure 39:
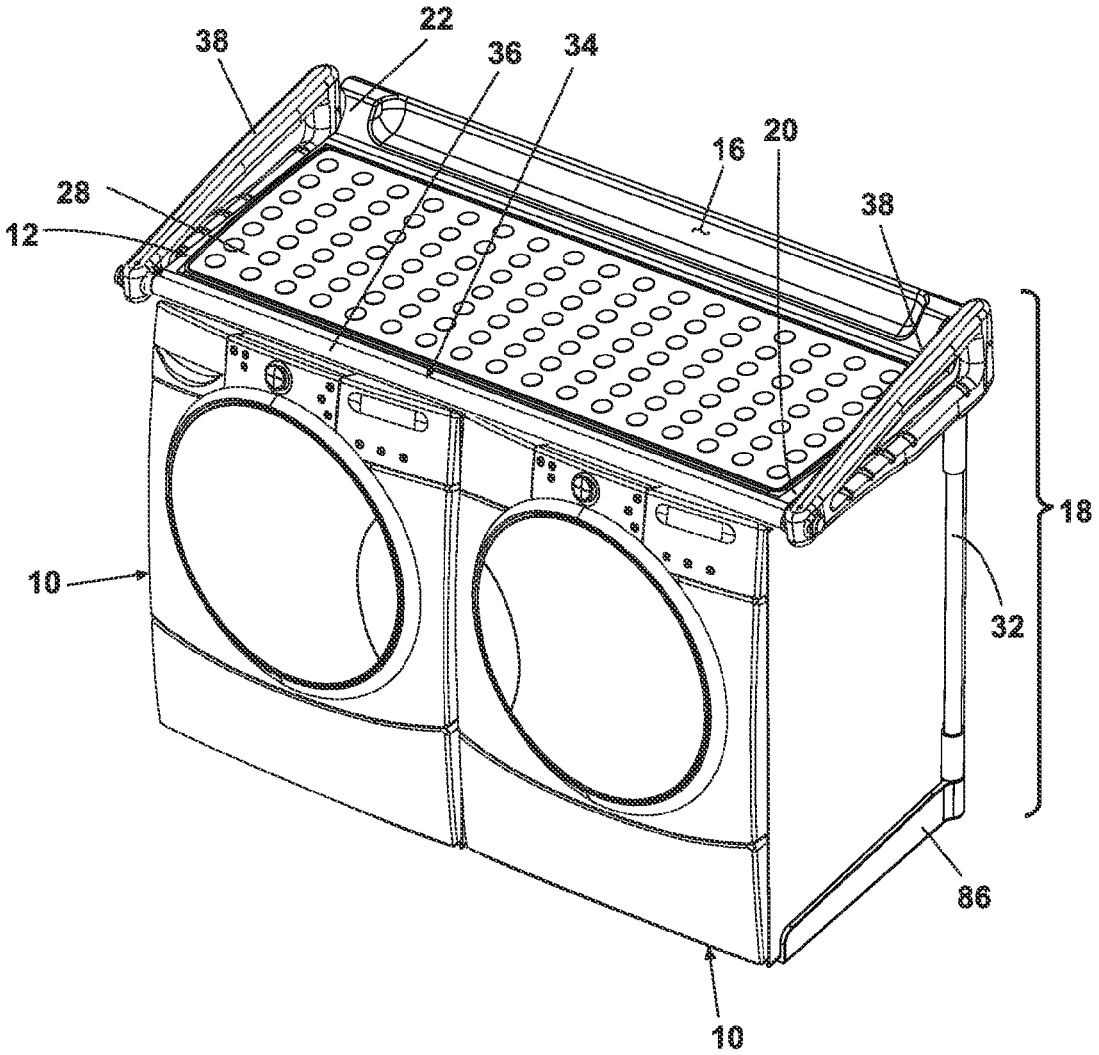
FIG. 39 is a perspective view of another embodiment of the modular laundry system similar to that shown in FIG. 37A in which the hanging area associated with the worksurface can be vertically adjusted down to a lowered position whereby a hanging rod provided on the hanging area is located adjacent to the worksurface.

FIG. 39 is a perspective view of an embodiment of the modular laundry system similar to FIG. 37A, except that the worksurface 12 is adapted to locate a portion of the hanging area 18 directly adjacent to the worksurface 12 when the hanging area 18 is fully retracted and not employed for hanging clothes. In this manner, the central rod 36 and the spacer rods 38, which, according to the illustrated embodiment, are generally triangular, can be retracted and stored in a flush manner adjacent to the worksurface 12, thereby, providing an aesthetically pleasing appearance to the modular laundry system.

Figure 40:
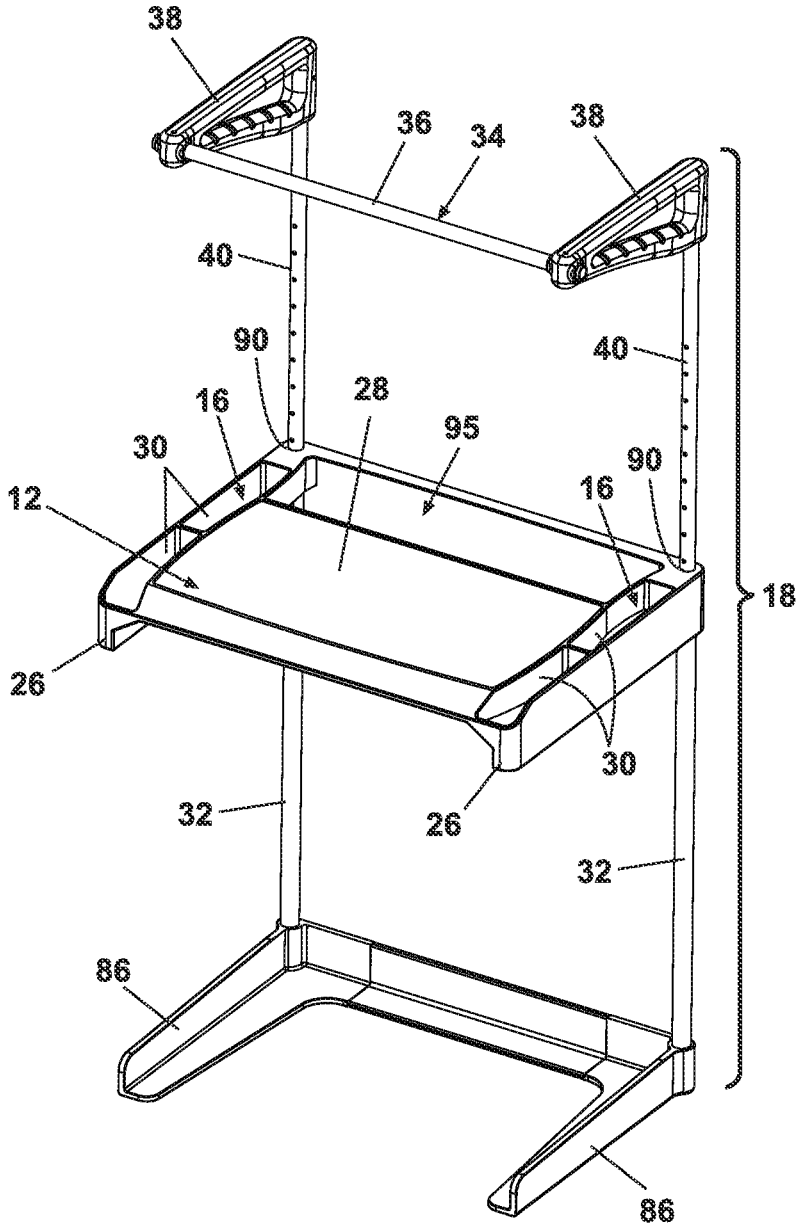
FIG. 40 is a perspective view of another embodiment of the modular laundry system similar to that shown in FIG. 38 in which a worksurface and hanging area are provided on a floor standing stand, and wherein the worksurface is provided with a saddle-bank-type staging area associated with the worksurface and an aperture to accommodate a backsplash of a laundry appliance.
Figure 41:
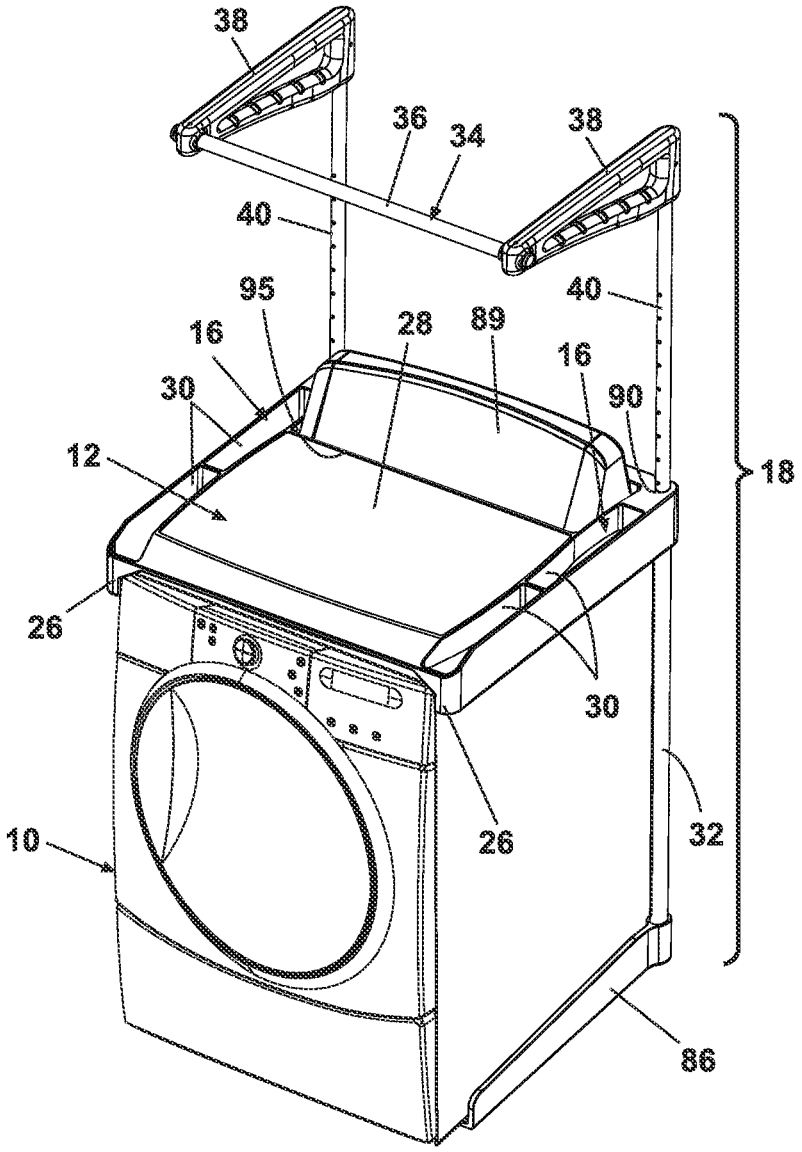
FIG. 41 is a perspective view of the embodiment of the modular laundry system shown in FIG. 40 in which a single horizontally-disposed laundry appliance is located within a recess created by the stand and the worksurface.

FIG. 40 is a perspective view of another embodiment of the modular laundry system similar to that shown in FIG. 38 in which a worksurface 12 and hanging area 18 are provided on a freestanding stand and a functional insert 28 of the worksurface 12 is optionally reversible to provide for a plurality of laundry-related functions, and wherein the worksurface 12 is provided with saddle-bag staging bins 30 forming a storage/staging area 16 on the worksurface 12. The worksurface 12 further includes an elongated aperture 95 positioned and sized to receive a corresponding backsplash 89 of the laundry appliance 10, as illustrated in FIG. 41. When the worksurface 12 is supported by a plurality of laundry appliances 10 and/or modules, such as two of the laundry appliances 10, the aperture 95 can be sized to accommodate the backsplashes of the plurality of laundry appliances 10 and/or modules.

FIG. 41 is a perspective view of the embodiment of the modular laundry system shown in FIG. 40 in which a single horizontally-disposed laundry appliance 10 is located within a recess created by the feet 86 and the worksurface 12. The weight of the laundry appliance 10 can transmit a stabilizing force to the hanging area 18 via the feet 86. Additionally, it can be seen in FIG. 41 that the staging bins 30 are located beyond a width of the laundry appliance 10 that is located in the recess created by the feet 86 and the worksurface 12.

Figure 42:
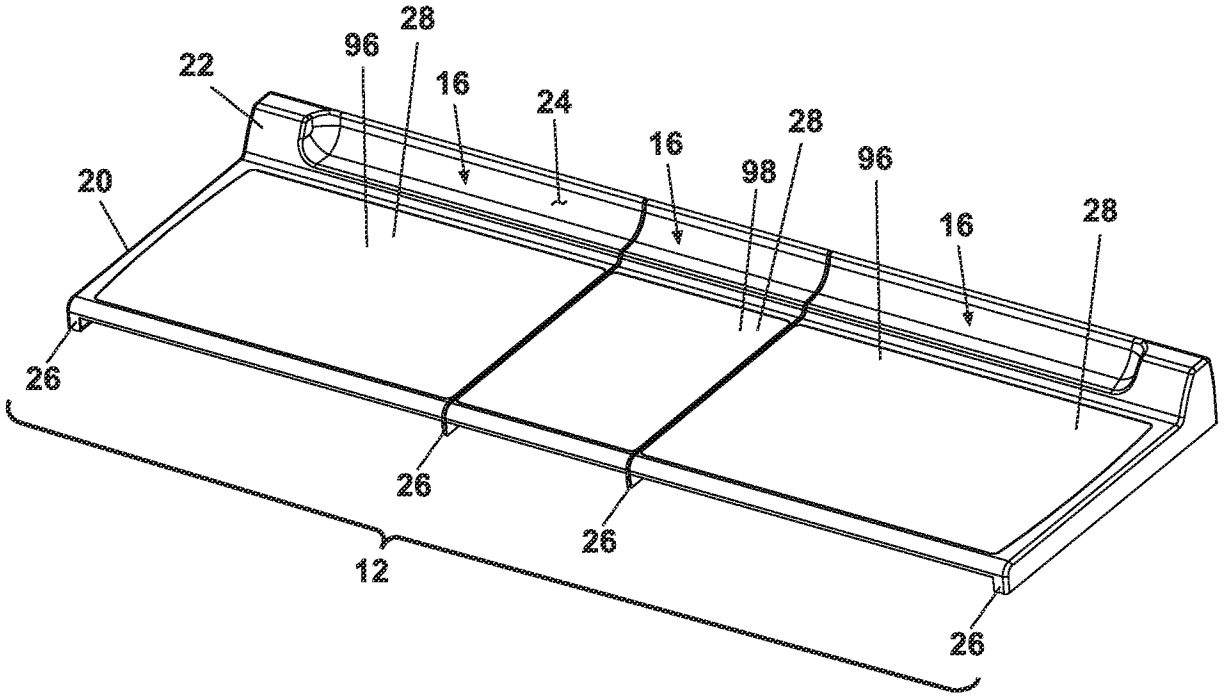
FIG. 42 is a perspective view of another embodiment of the modular laundry system similar to that shown in FIG. 8 in which the worksurface is provided as a leaf-type structure, generally comprised of end structures corresponding generally to the width of a single laundry appliance and an optional intermediate leaf for extending the overall length of the worksurface to selectively extend across at least two horizontally-disposed laundry appliances and a shelf module or other structure disposed between the horizontally-disposed laundry appliances.

As described earlier, the worksurface 12 can be provided as a contiguous integral structure, or as a leaf-type structure having multiple interconnected pieces connected laterally to one another as shown by example in FIG. 42. FIG. 42 is a perspective view of another embodiment of the modular laundry system in which the worksurface 12 is provided as a leaf-type structure, generally comprised of end structures or pieces 96, each corresponding generally to the width of a single laundry appliance 10, and at least one intermediate leaf or piece 98 for extending the overall length of the worksurface 12 to selectively extend across at least two horizontally-disposed laundry appliances 10 and a shelf module 14 and/or third laundry appliance 10 and/or other modules disposed between the horizontally-disposed laundry appliances 10. Examples of the other modules that can be disposed between the laundry appliances 10 are disclosed in the aforementioned and incorporated modular laundry system and module patent applications. The worksurface 12 can include any suitable number and sizes of the intermediate leafs 98 to achieve a desired longitudinal length (i.e., width) of the worksurface 12. Furthermore, the worksurface 12 need not incorporate the intermediate leaf 98 when the modular laundry system comprises only the two laundry appliances 10 and the worksurface 12. It is also within the scope of the invention for the worksurface 12 to comprise any size or number of segments or pieces that can be connected together laterally to form the worksurface 12 and to define the width of the worksurface 12.

Figure 43:
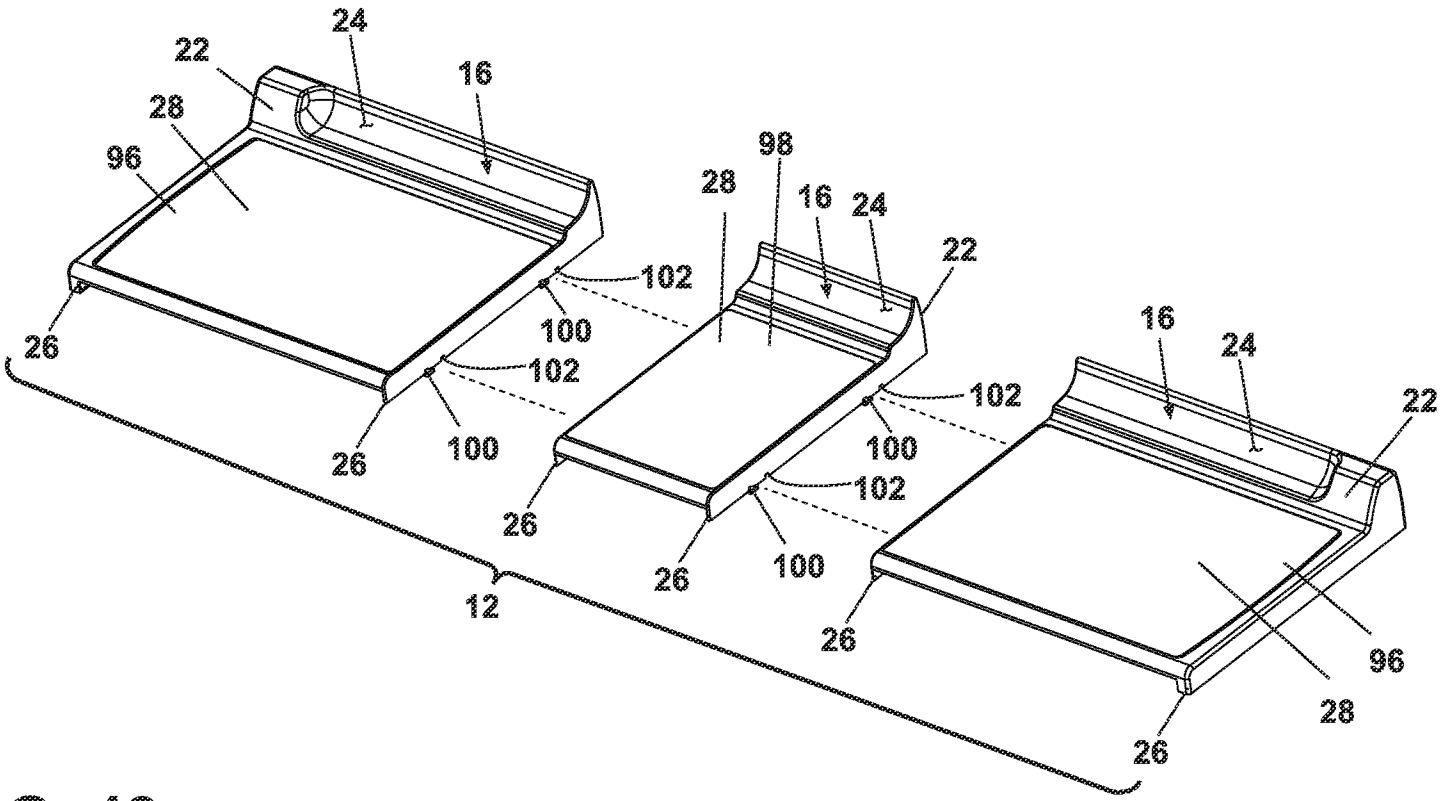
FIG. 43 is an exploded, perspective view of the leaf-type worksurface shown in FIG. 42.

FIG. 43 is an exploded, perspective view of the leaf-type worksurface 12 shown in FIG. 42 in which the interconnection between one of the end structures 96 and either the intermediate leaf 98 or another end structure 96 is shown as an interconnection between mating detents 100 and sockets 102. Of course, another attachment method can be employed, including, but not limited to, conventional fasteners or other mechanical attachment implements that do not require the use of tools to perform the interconnection and disassembly between adjacent portions of the worksurface 12.

Additionally, it can be seen in FIG. 43 that the end structures 96 and the intermediate leaf 98 can each comprise a portion of the backsplash 22, and the portions of the backsplash 22 mate or abut when the end structures 96 and the intermediate leaf 98 are connected together to form the unitary backsplash 22, as shown in FIG. 42. Similarly, the portions of the backsplash 22 can each include a portion of the staging recess 24, which mate or abut to form the unitary staging recess 24 when the end structures 96 and the intermediate leaf 98 are connected together.

Figure 44:
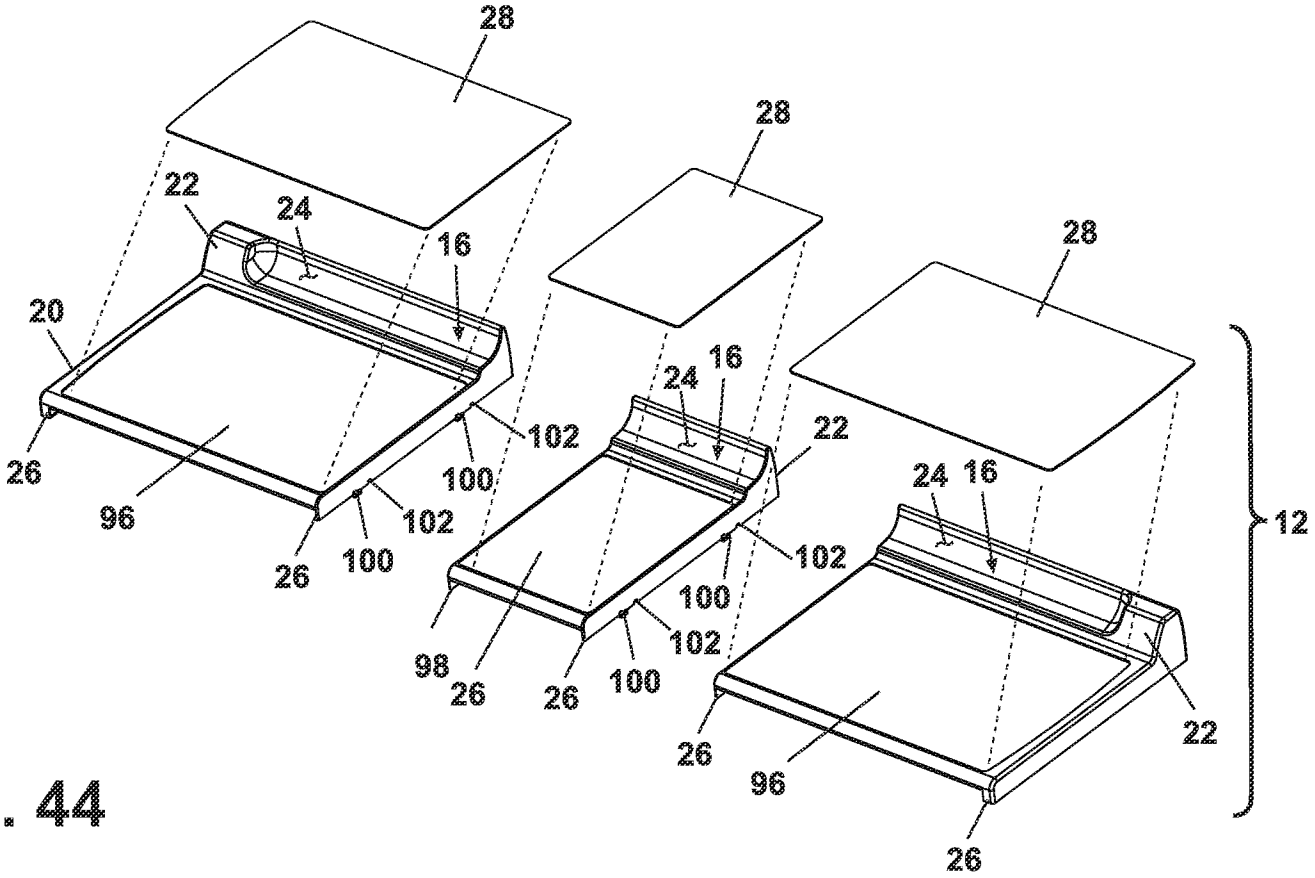
FIG. 44 is an exploded, perspective view of the leaf-type worksurface shown in FIGS. 42-43, and wherein the worksurface as shown having a removable and reversible functional insert provided thereon.
Figure 45:
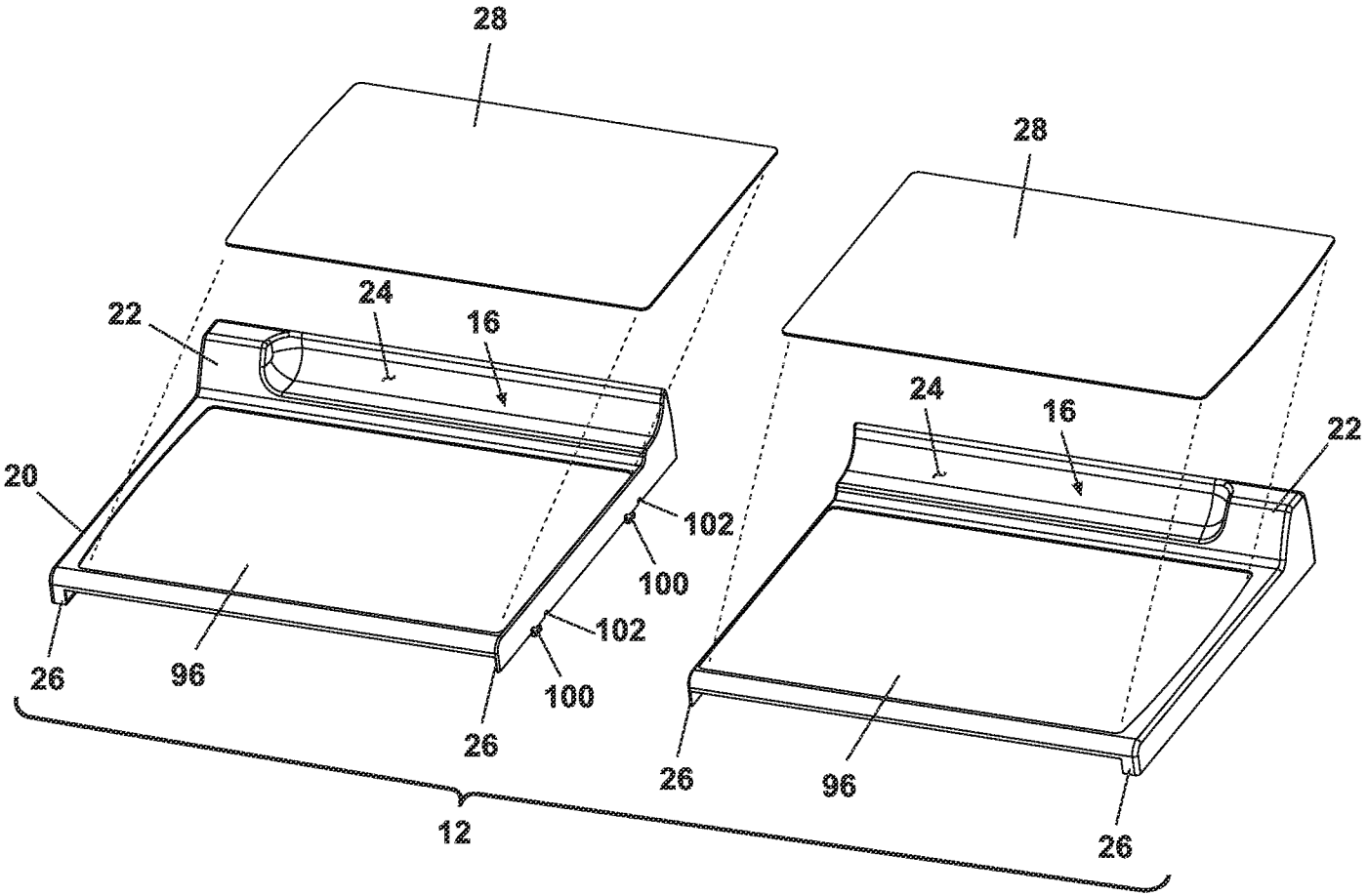
FIG. 45 is an exploded, perspective view of the leaf-type worksurface shown in FIGS. 42-44, wherein the intermediate leaf has been removed to illustrate the interconnectability of the end structures directly to one another.

As can be seen from FIGS. 43-44, the flanges 26 and functional insert 28 of the worksurface 12 can be formed on each of the components of the worksurface 12 (i.e., the end structures 96 and the intermediate leaf 98) to perform the functions as described earlier herein. The flanges 26 can be formed on both longitudinal ends of each of the components of the worksurface 12, as shown in FIGS. 43 and 44, or the flanges 26 can be formed only on one longitudinal end of each of the end structures 96 so that the worksurface 12 comprises only two of the flanges 26, with one flange 26 at each longitudinal end of the worksurface 12. The functional insert 28 can be formed by a plurality of adjacent individual functional inserts 28, wherein each of the components of the worksurface 12 has one of the individual functional inserts 28, as illustrated in FIGS. 43 and 44, or the functional insert 28 can be a unitary functional insert that extends across all of the components of the worksurface 12. FIG. 44 is an exploded, perspective view of the leaf-type worksurface 12 shown in FIGS. 42-43, and wherein the worksurface 12 is shown having a removable and reversible functional inserts 28 on each portion of the worksurface 12 provided thereon. FIG. 45 is an exploded, perspective view of the leaf-type worksurface 12 shown in FIGS. 42-44, wherein the intermediate leaf 98 has been removed to illustrate the interconnectability of the end structures 96 directly to one another.

Figure 46:
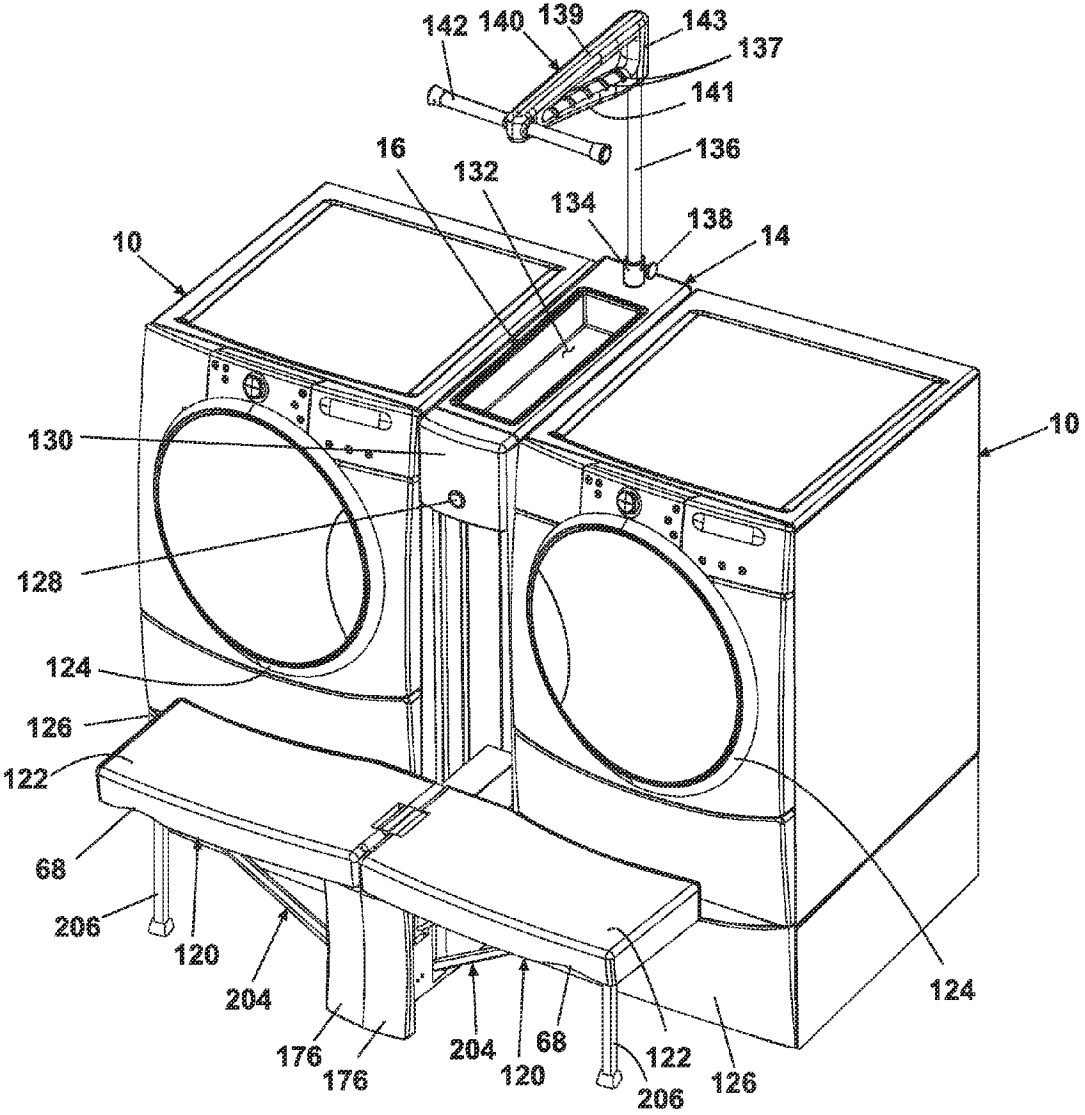
FIG. 46 is a perspective view of another embodiment of the modular laundry system of FIG. 1 and arranged in a configuration similar to that shown in FIG. 4, wherein a shelf module is disposed between a pair of laundry appliances, and which a pair of shelf assemblies of the shelf module has been extended to a use position.
Figure 47:
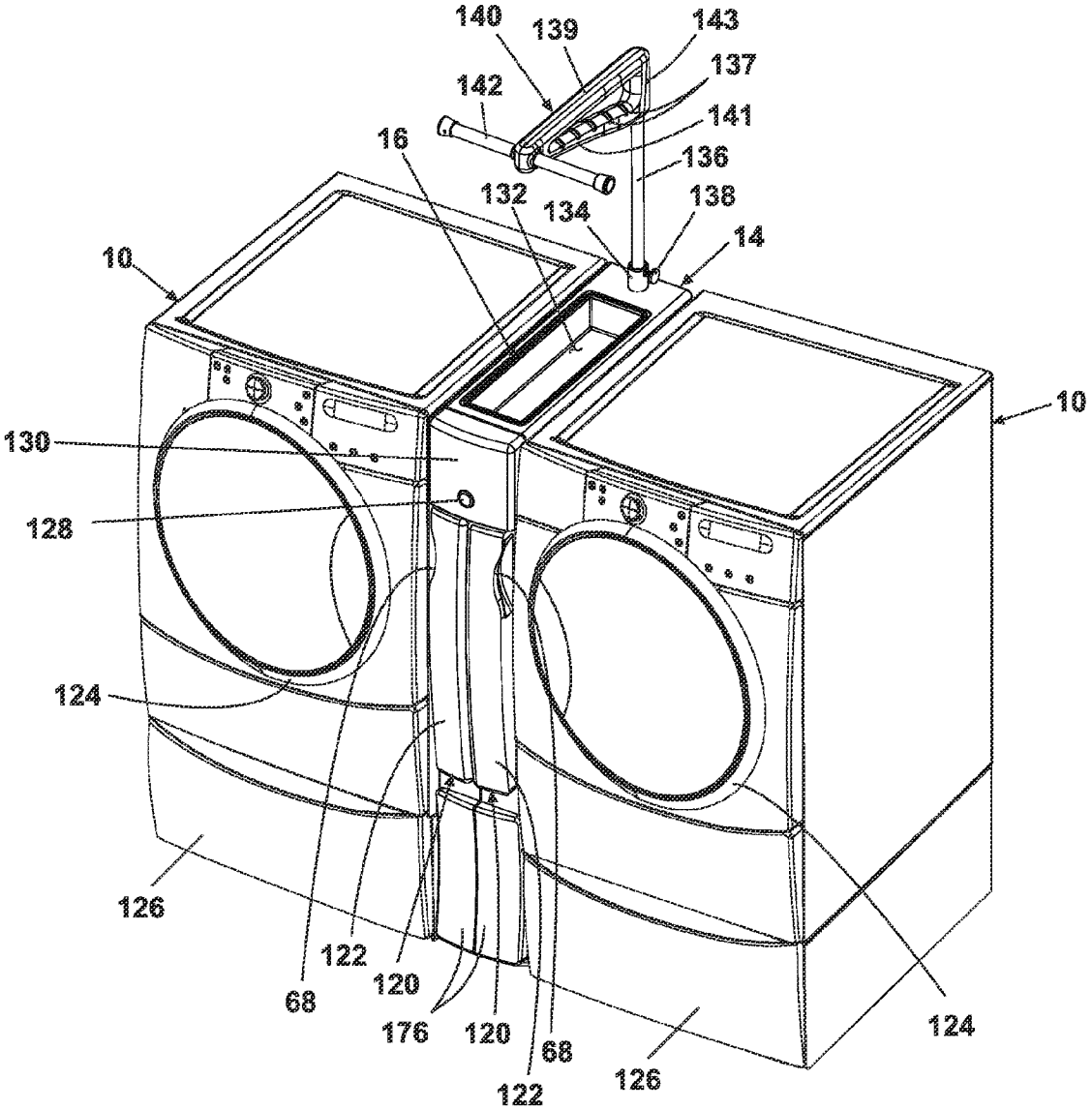
FIG. 47 is a perspective view of the embodiment of the modular laundry system of FIG. 46 wherein the pair of shelf assemblies has been retracted to a stored position, located generally in a flush retracted position between the laundry appliances.

In another embodiment, a shelf module 14 can be arranged adjacent to one of the laundry appliances 10 or between a pair of horizontally arranged laundry appliances 10 and includes at least one shelf mounted therein. For example, FIG. 46 shows an embodiment of the modular laundry system of FIG. 1 and arranged in a configuration similar to that shown in FIG. 4, wherein a shelf module 14 is disposed between a pair of horizontally arranged laundry appliances 10, which are both front-loading. The shelf module 14 comprises a pair of shelf assemblies 120, each having a shelf 122, which are shown in FIG. 46 in an extended, use position. Each of the shelf assemblies 120 provides a shelf for one of the laundry appliances 10 and can be moved to the extended, use position independently of one another. FIG. 47 shows the embodiment of the modular laundry system of FIG. 46 wherein the shelf assemblies 120 have been retracted to a stored position, located within the shelf module 14 generally in a flush retracted position between the laundry appliances 10. A user-graspable handle 68 is provided on each shelf assembly 120 to assist the user in moving the respective shelf 122 between the retracted and extended positions.

In the extended position of FIG. 46, the shelf 122 is in a generally horizontal orientation and, according to one embodiment, is located below a front opening 124 of the corresponding laundry appliance 10. The shelf assembly 120 in this position can be employed to perform various laundry-related activities thereon. For example, the shelf 122 can support a laundry basket to facilitate loading and unloading of clothes from the laundry appliances 10. When both of the shelves 122 are in the extended position, as shown in FIG. 46, the shelves 122 form a generally continuous horizontal surface so that the laundry basket can be slid from a position in front of one of the laundry appliances 10, such as a clothes washer, to a position in front of the other of the laundry appliances 10, such as a dryer. In this fashion, the clothes can easily be transferred from one laundry appliance 10 to another.

In the retracted position of FIG. 47, the shelf 122 is in a generally vertical orientation and is stored in a non-obstructive fashion within the shelf module 14, and the shelf assembly 120 frees up area within the area in which the modular laundry system resides. For example, when the shelf assembly 120 is in the stored position of FIG. 47, the shelf assembly 120 is out of the path of movement of a pair of lower storage drawers 126 upon which the laundry appliances 10 rest, so that the lower storage drawers 126 can be moved between retracted and extended positions in a manner which would be apparent to one skilled in the art. The lower storage drawers 126 can also be replaced with horizontal modules described in the aforementioned and incorporated modular laundry system and modules applications.

Figure 48:
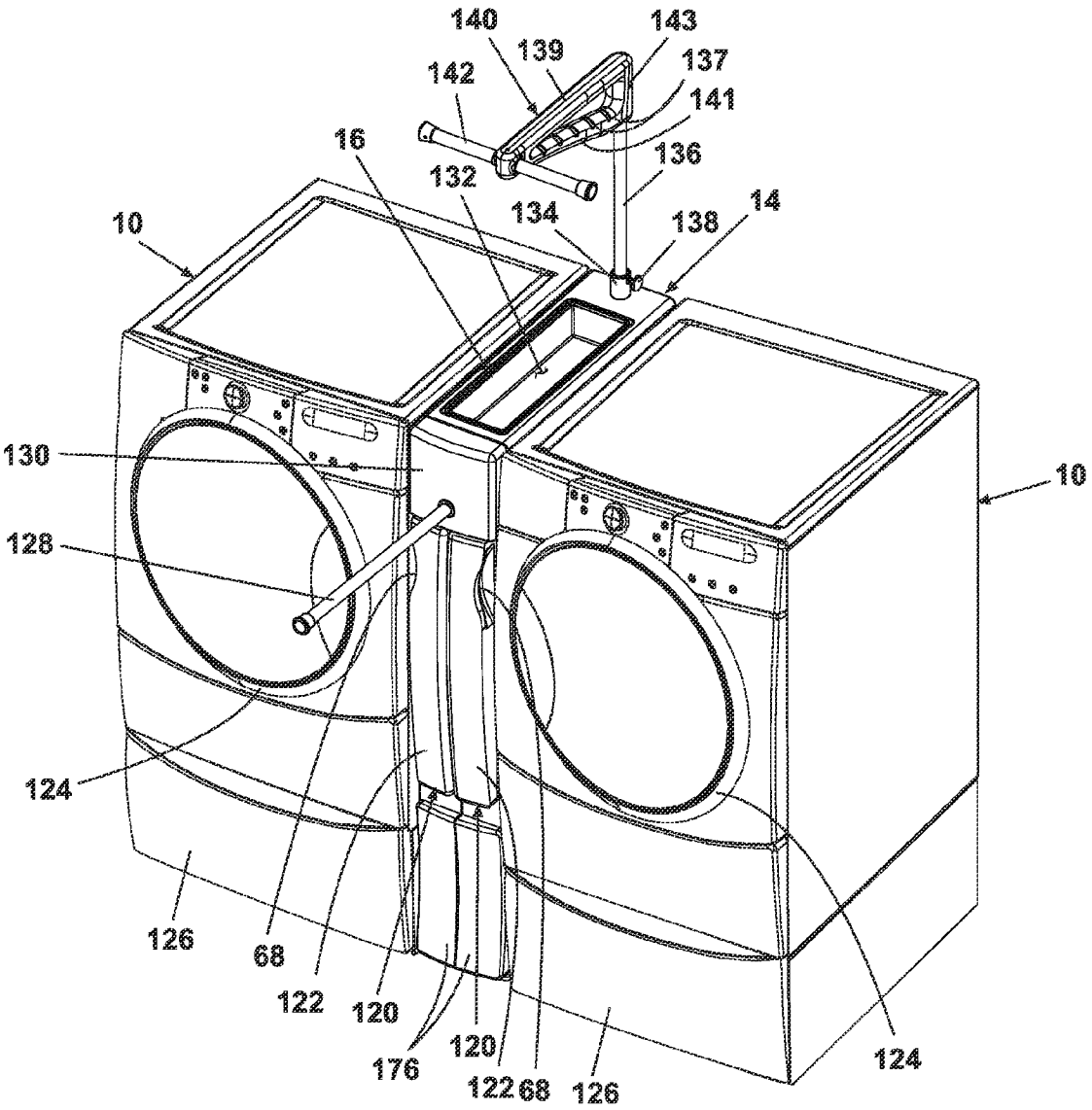
FIG. 48 is a perspective view of the embodiment of the modular laundry system of FIG. 46 wherein the pair of shelf assemblies has been retracted to the stored position, and wherein a hanging post has been extended from the shelf module to a use position.

Other functional features of the shelf module 14 are also contemplated. For example, FIG. 48 is a perspective view of the embodiment of the modular laundry system of FIG. 46 wherein the shelves 122 have been retracted to the stored position, and wherein a hanging post 128 has been extended from the shelf module 14 to a use position. In the extended use position, the hanging post 128 can be used as a rod for hanging clothes thereon. In one embodiment, the hanging post 128 can be an "antenna"-type device which collapses upon itself in discrete segments, so that it takes up very little space within the interior of the shelf module 14. In another embodiment, the hanging post 128 can be a solid rod member which simply extends and retracts into a chamber within the shelf module 14. Other embodiments of the hanging post 128 would be apparent to one skilled in the art, and the particular embodiment of the hanging post 128 illustrated in the drawings shall not be interpreted as limiting upon the scope of this invention. More detailed descriptions of the hanging post 128 are presented in the aforementioned and incorporated "Retractable Hanging Element" patent application.

Figure 49:
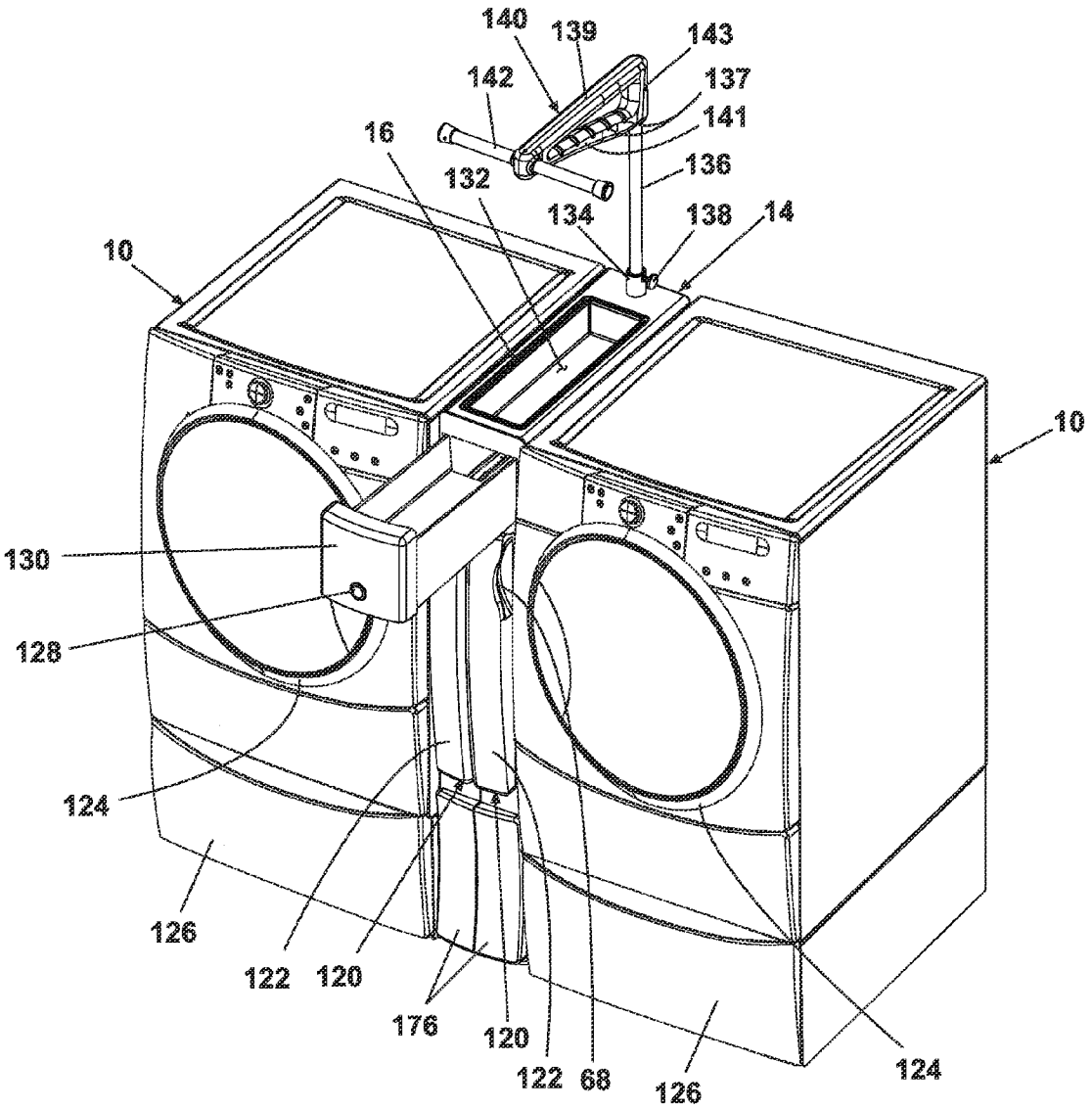
FIG. 49 is a perspective view of the embodiment of the modular laundry system of FIG. 46 wherein the pair of shelf assemblies has been retracted to the stored position, and wherein a storage drawer has been extended from the shelf module to a use position.

Another optional feature of the shelf module 14 of FIGS. 46-47 is the storage/staging area 16 in the form of a storage drawer 130. FIG. 49 is a perspective view of the embodiment of the modular laundry system of FIGS. 46-47 wherein the shelves 122 have been retracted to the stored position, and wherein the storage drawer 130 has been extended from the shelf module 14 to a use position. The storage drawer can incorporate the hanging rod 128, as shown in FIG. 49, or can be provided without the hanging rod 128. The storage drawer 130 can be mounted to the shelf module 14 via conventional drawer slides, in a tongue-in-groove manner, or any other known manner by which to slidably mount one component to another to perform slidable movement between the components. The particular examples shown herein shall not be limiting on the scope of this invention. The storage drawer 130 can provide a beneficial storage function for small items used in laundry-related operations, but which can be unsightly when simply strewn about an upper surface of a laundry appliance 10 (such as is typically done with conventional appliances not provided with the system described herein).

Figure 50:
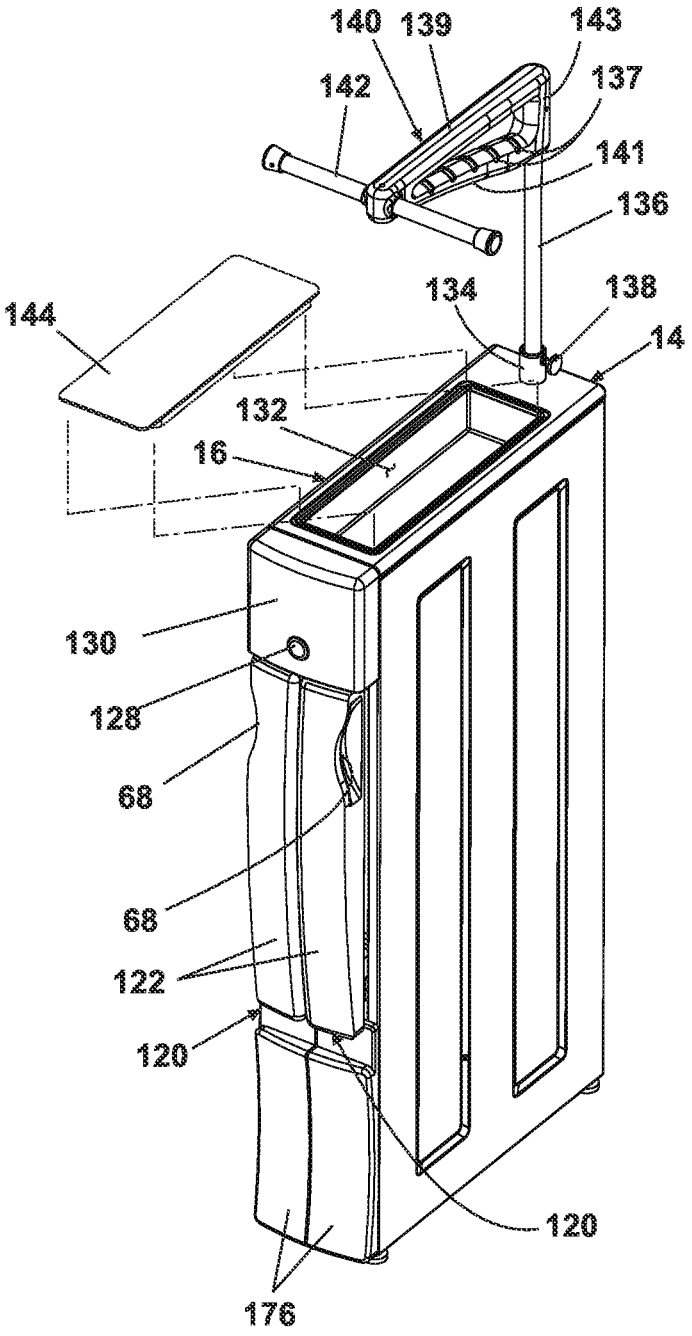
FIG. 50 is a perspective view of the shelf module illustrated in FIGS. 46-47 with the pair of shelf assemblies located in the retracted position and showing a removable cover for a staging area for accessing the contents therein from an upward location.

In addition, the shelf module 14 set forth in FIGS. 46-47 can also have an additional storage/staging area 16 comprising a convenient well area 132 provided as an open-top recess extending downwardly into an upper surface of the shelf module 14 as seen in FIGS. 46-49. The well area 132 can provide an additional staging option to the modular laundry system set forth herein. FIG. 50 is a perspective view of the shelf module 14 of FIGS. 46-47 with the shelves 122 located in the retracted position and showing a removable cover 144 which can optionally be employed to selectively close the well area 132 and thereby conceal the contents of the well area 132 of the storage/staging area 16.

Figure 51:
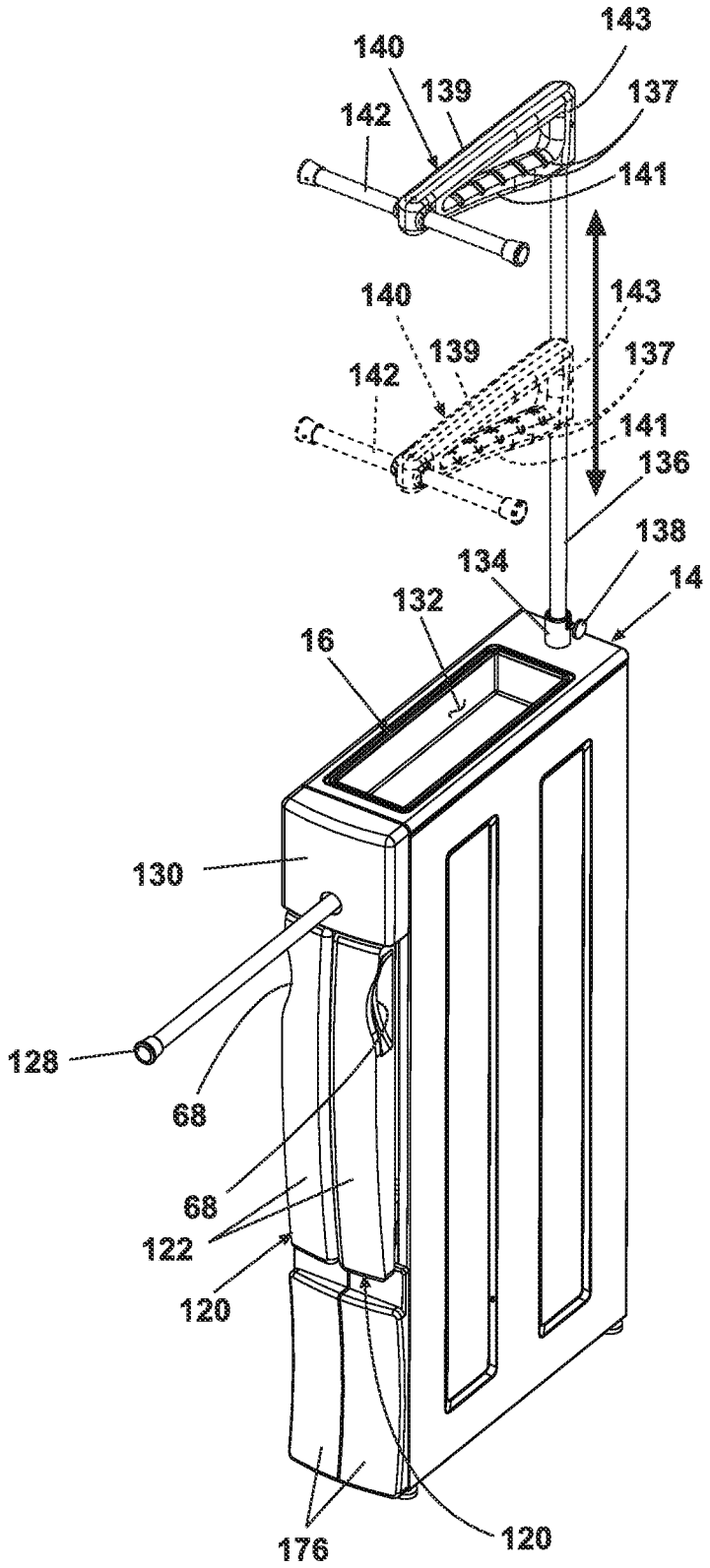
FIG. 51 is a perspective view of the shelf module illustrated in FIGS. 46-47 showing a forward hanging post extended and with phantom lines illustrating the adjustability of an upwardly-extending hanging rod.

The shelf module 14 can also have a hanging area 18, supplementary to the hanging rod 128 previously described. The hanging area 18 comprises a base 134 which has an extension rod 136 mounted thereto by a conventional mounting member, such as a clamp mount 138. An upper portion of the extension rod 136 has a spacer bracket 140 mounted thereto. The spacer bracket 140 is generally triangular shaped and is formed by an upper rod 139 and a lower rod 141 that intersect at their front ends and are joined at their rear ends by a vertical rod 143 that receives the extension rod 136. Items to be hung can be hung on the lower rod 141 of the spacer bracket 140. To facilitate hanging the items on the lower rod 141, the lower rod 141 can comprise a plurality of notches 137 sized to each receive a hanger. A centrally-mounted elongated hanging rod 142 which extends laterally from each side of the spacer bracket 140 provides another option for the user to hang clothes in the modular laundry system using the hanging area 18. Releasing the clamp mount 138 allows the extension rod 136 to be vertically adjusted with respect to the base 134 of the shelf module 14. FIG. 51 illustrates the various functionality and adjustability of the shelf module 14 of FIGS. 46-47 showing the hanging post 128 extended and with phantom lines illustrating the adjustability of the hanging area 18, which can vertically reposition the hanging rod 142 and the spacer rod 140.

Figure 52:
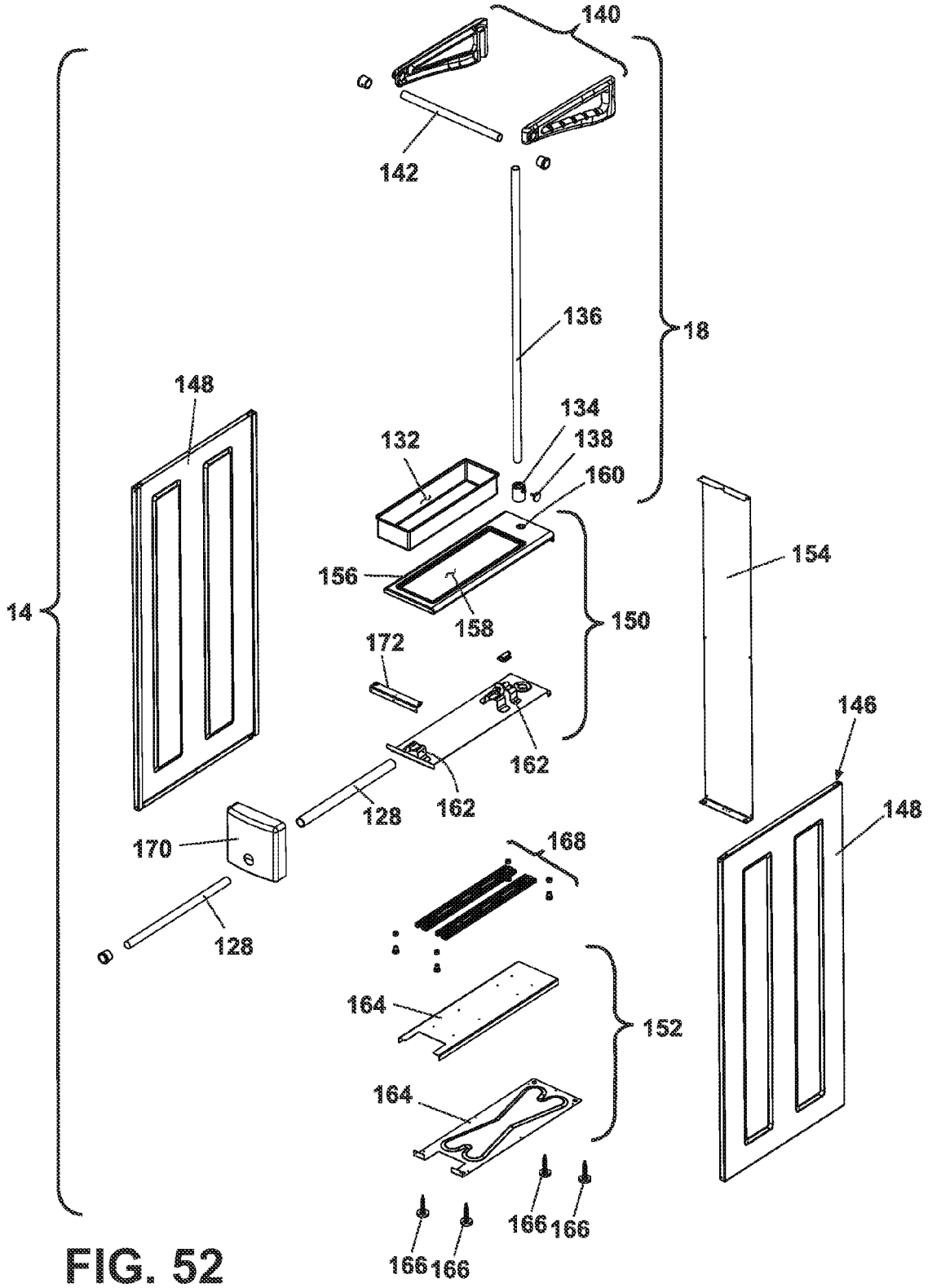
FIG. 52 is an exploded perspective view of a housing for the shelf module of FIGS. 46-47.
Figure 53:
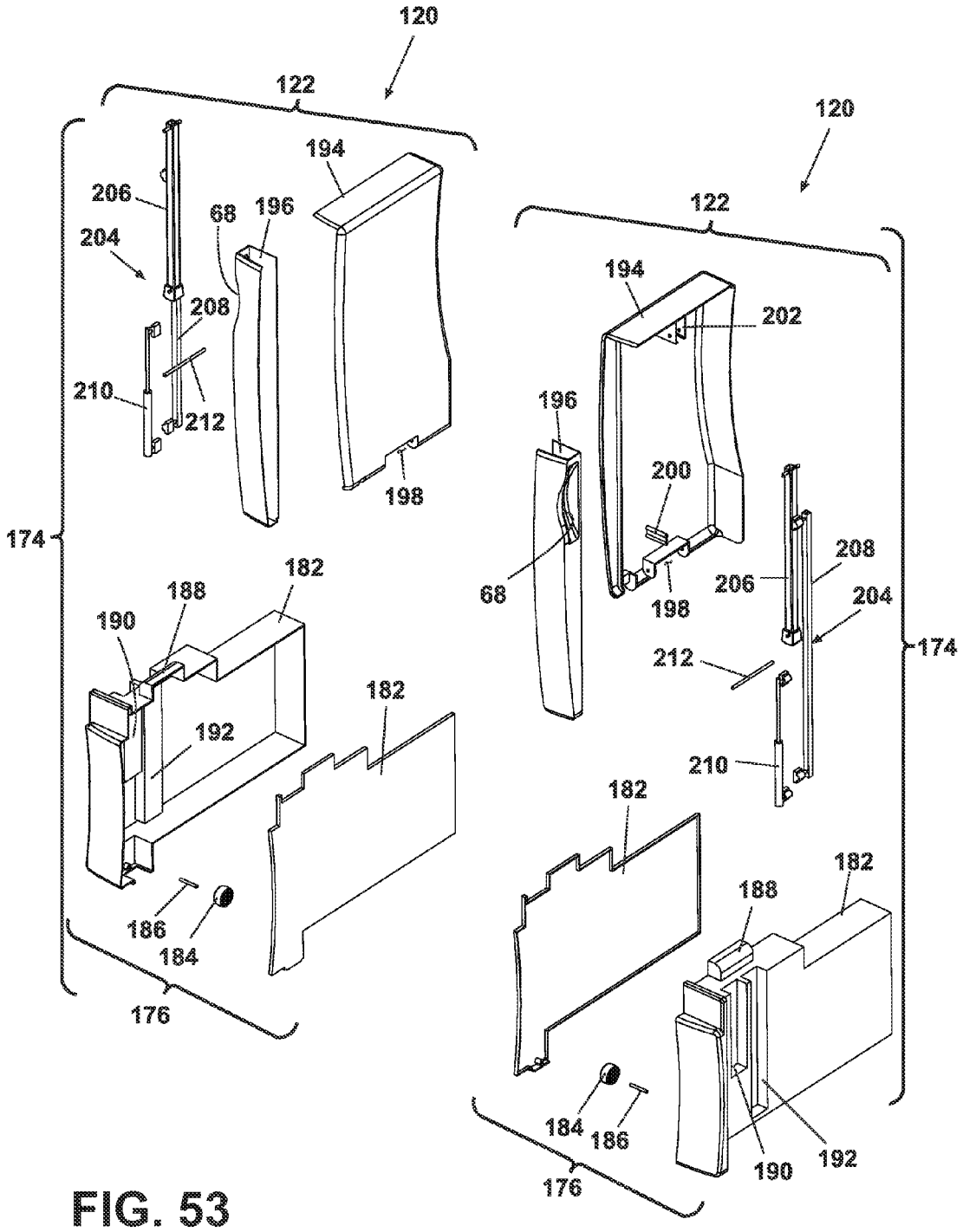
FIG. 53 is an exploded perspective view of the pair of shelf assemblies for the shelf module of FIGS. 46-47.

The components of the embodiment of the shelf module 14 shown in FIGS. 46-47 will be described in detail with respect to FIGS. 52-53. FIG. 52 is an exploded perspective view of a housing 146 for the shelf module 14 of FIGS. 46-47. FIG. 53 is an exploded perspective view of the shelf assemblies 120 for the shelf module 14 of FIGS. 46-47.

With reference to FIG. 52, the housing 146 of the shelf module 14 comprises a pair of sidewalls 148, which are interconnected at their respective upper and lower ends to an upper wall 150 and a lower wall 152, respectively. A rear wall 154 forms a rear surface of the housing 146. The upper, lower and rear walls 150, 152 and 154 cooperate to form an open-face chamber in which the shelf assemblies 120 are mounted. The upper wall 150 comprises a top plate 156 having an elongated forward aperture 158 for receipt of the well 132 in drop-in fashion and a rear aperture 160 that mounts the base 134 of the hanging area 18. The upper wall 156 also has a support plate mounted beneath the top plate 158 and including forward and rearward journals 162 for mounting the hanging post 128. Alternatively, the journals 162 can be provided as stamped spring members that retain the hanging post 128 thereagainst. The bottom wall 152 comprises a pair of bottom plates 164 mounted in juxtaposed relationship and provided with a plurality of glide feet 166 threadingly mounted thereto. A pair of slide tracks 168 is mounted to an interior surface of the bottom plate assembly 164 to provide for a low-friction method by which the shelf assemblies 120 can be moved between the retracted and the extended positions. A front fascia 170 is mounted to the housing 146 by a mounting bracket 172. The front fascia 170 provides a flush outer surface for the housing 146 above the shelf assemblies 120 when the shelf assemblies 120 are in the stored position. The front fascia 170 has an aperture therethrough which journals the hanging post 128 therein and provides a flush mounted seat when the hanging post 128 is located in the retracted position.

With respect to the shelf assemblies 120 shown in FIG. 53, the shelf assemblies 120 each comprise, in this embodiment, a pivotal assembly 174 comprising the shelf 122 pivotally connected to a base 176. The shelf 122 of each pivot assembly 174 can rotate relative to the base 176 about a generally horizontal axis when the shelf assembly 120 is extended from the interior chamber of the shelf module 14.

The base 176 comprises a clamshell housing 182 having a wheel 184 on an axle 186 located at a lower forward portion of the clamshell housing 182. The wheel 184 is received on the axle 186 for rotational movement, and the axle 186 is mounted to the lower forward portion of the housing 182 via suitably-size and located bosses in the housing 182. Preferably, when the wheel 184 is so mounted, it extends beneath a lower surface of the base 176 so that the base 176 can travel over a supporting surface and provide a low-friction method of movement of the base 176.

An upper portion of the housing 182 is provided with a hinge mount 188, and an exterior side surface of each opposed outer face of each base 176 further comprises a first partial-height channel 190 and a second full-height channel 192 in generally parallel relationship. The partial height channel 190 and the full-height channel 192 each extend downwardly from an upper surface of the base 176, with the partial-height channel 190 having a vertical height less than the full-height channel 192.

The shelf 122 comprises a top panel 194 having a front fascia 196 attached thereto and forming an aesthetically-pleasing forward face of the shelf 122. The user-graspable handle 68 is preferably provided on the front fascia 196. The underside of the top panel 194 has a recess 198 extending inwardly from an interior side surface thereof in general registry with and sized to receive the hinge mount 188 on the base 176. A damper mount 200 is located adjacent the hinge recess 198 and depends downwardly from the underside of the top panel 194. Opposite the hinge recess 198 and the damper mount 200 is provided a leg mount 202. It will be understood that the particular embodiments of the mounts 198, 200, 202 shown in the drawings are by example only, and other suitable mountings could be substituted therefor without departing from the scope of this invention.

A leg assembly 204 is provided for supporting the top panel 194 above a floor surface and comprises a leg 206, a brace 208 and a damper 210. An upper end of the brace 208 is pivotally mounted to an upper region of the leg 206. The damper 210 is a conventionally-known fluid damper, such as the shock absorber/piston-type device shown in FIG. 53.

The assembly of the shelf module 14 and the shelf assemblies 120 will now be described with reference to FIGS. 52-53. It will be understood that any suitable attachment method can be employed to attach the components together as described including, but not limited to, conventional fasteners, snap-fit components, detents, and the like.

The upper, lower and rear walls 150, 152 and 154 are assembled together to form the rectangular housing 146 with an open front. The housing 146 is vertically oriented in that its height is greater than its width. The glide feet 166 are mounted within the bottom plate 164 of the bottom wall 152 to support the shelf module 14 on a floor surface. The hanging post 128 is received within the retainers 162 on the top plate 150 and is passed through the central aperture on the front fascia 170 so that the hanging post 128 can be extended and retracted with respect to its retention on the top wall 152. The front fascia 170 is mounted to the top wall 152 by the mounting bracket 172. The well 132 is dropped into place within the forward aperture 158 in the top wall 152. The base 134 of the hanging area 18 is mounted to the top wall 152, the extension rod 136 is mounted to the base 134 via the clamp mount 138, and the spacer bracket 140 is mounted atop the extension rod 136 with the hanging rod 142 attached thereto.

To assemble each of the shelf assemblies 120, the base 176 is assembled by mounting the clamshell housings 182 together with the axle 186 and wheel 184 subassembly located therebetween to rotatably mount the wheel 184 to the housing 182. The top panel 194 (with the front fascia 196 attached thereto) is attached to the base 176 by inserting the hinge mount 188 into the hinge recess 198 and rotatably mounting it thereto, such as by a hinge rod 212, which passes generally coaxially though each component to create a rotatable pivot mounting therebetween. An upper end of the leg 206 is pivotally mounted within the leg mount 202 on the underside of the top panel 194. An upper end of the brace 208 is mounted to the leg 206 adjacent to, but spaced longitudinally from, the upper end of the leg 206. An opposite end of the brace 208 is mounted within the full-height channel 192 of the base 176. Opposite ends of the damper 210 are mounted respectively to the damper mount 200 on the underside of the top panel 194 and adjacent to a lower end of the partial-height channel 190 of the base 176.

A pair of shelf assemblies 120 are constructed as described herein and arranged in opposed relationship to one another, and a lower surface of each base 176 rearward of the wheel 184 on each base 176 is mounted upon a corresponding slide 168 located within the interior of the housing 146. The slides 168 assist the forward and rearward sliding of each base 176 and, thereby, each shelf 122 with respect to the housing 146 as assisted by each wheel 184 on the base 176.

Figure 54:
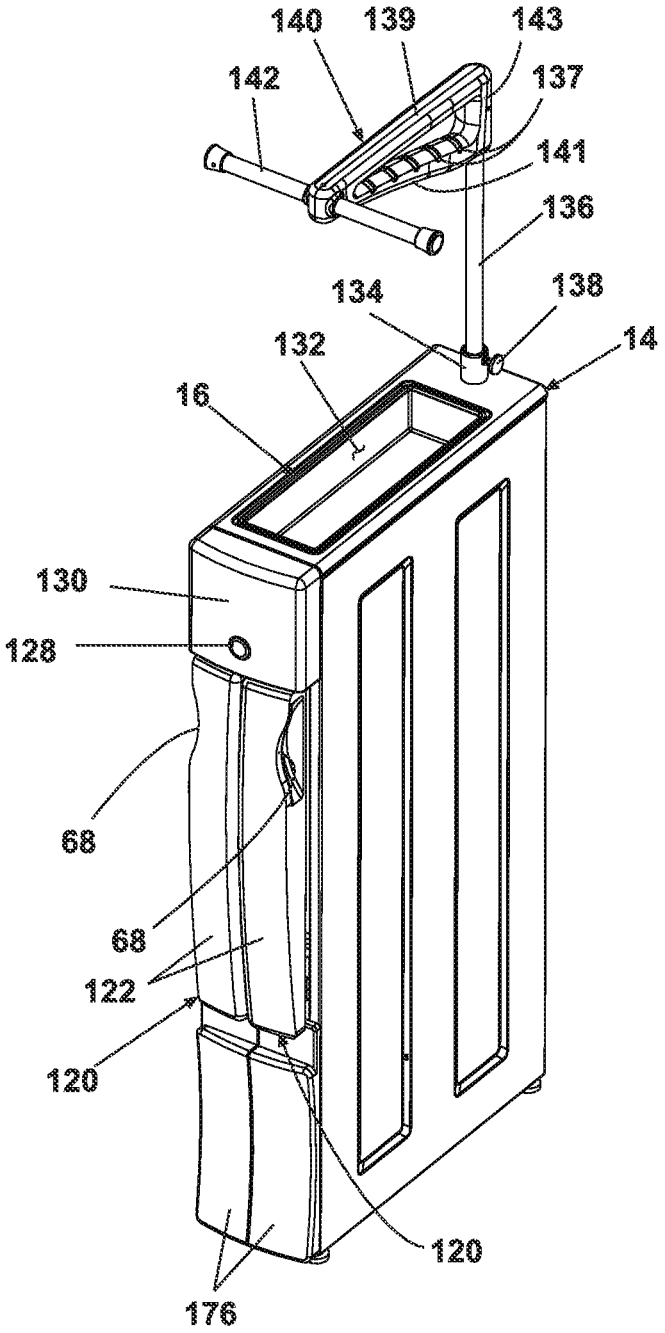
FIG. 54 is a perspective view of the shelf module illustrated in FIGS. 46-47 with the pair of shelf assemblies positioned in the retracted position.
Figure 55:
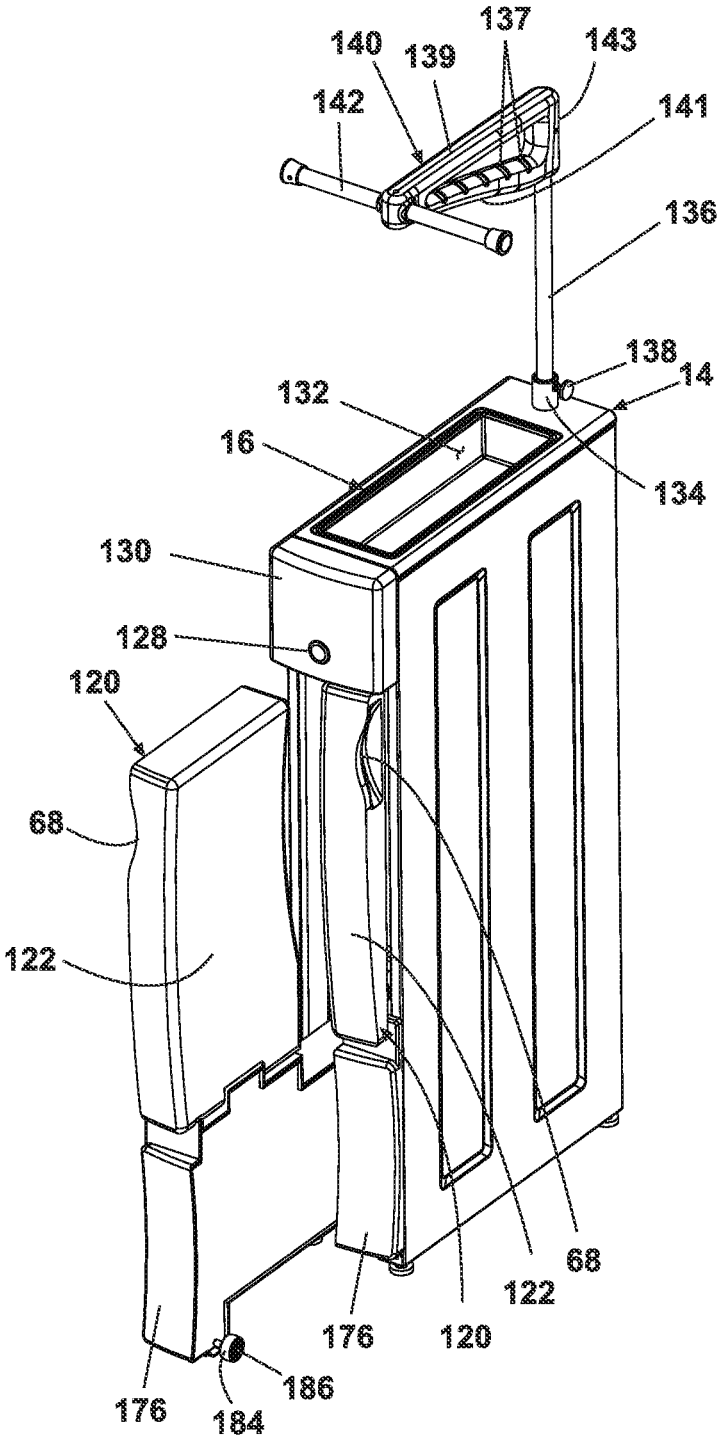
FIG. 55 is a perspective view of the shelf module of FIG. 54 showing one of the shelf assemblies in an intermediate position and the other of the shelf assemblies retracted.
Figure 56:
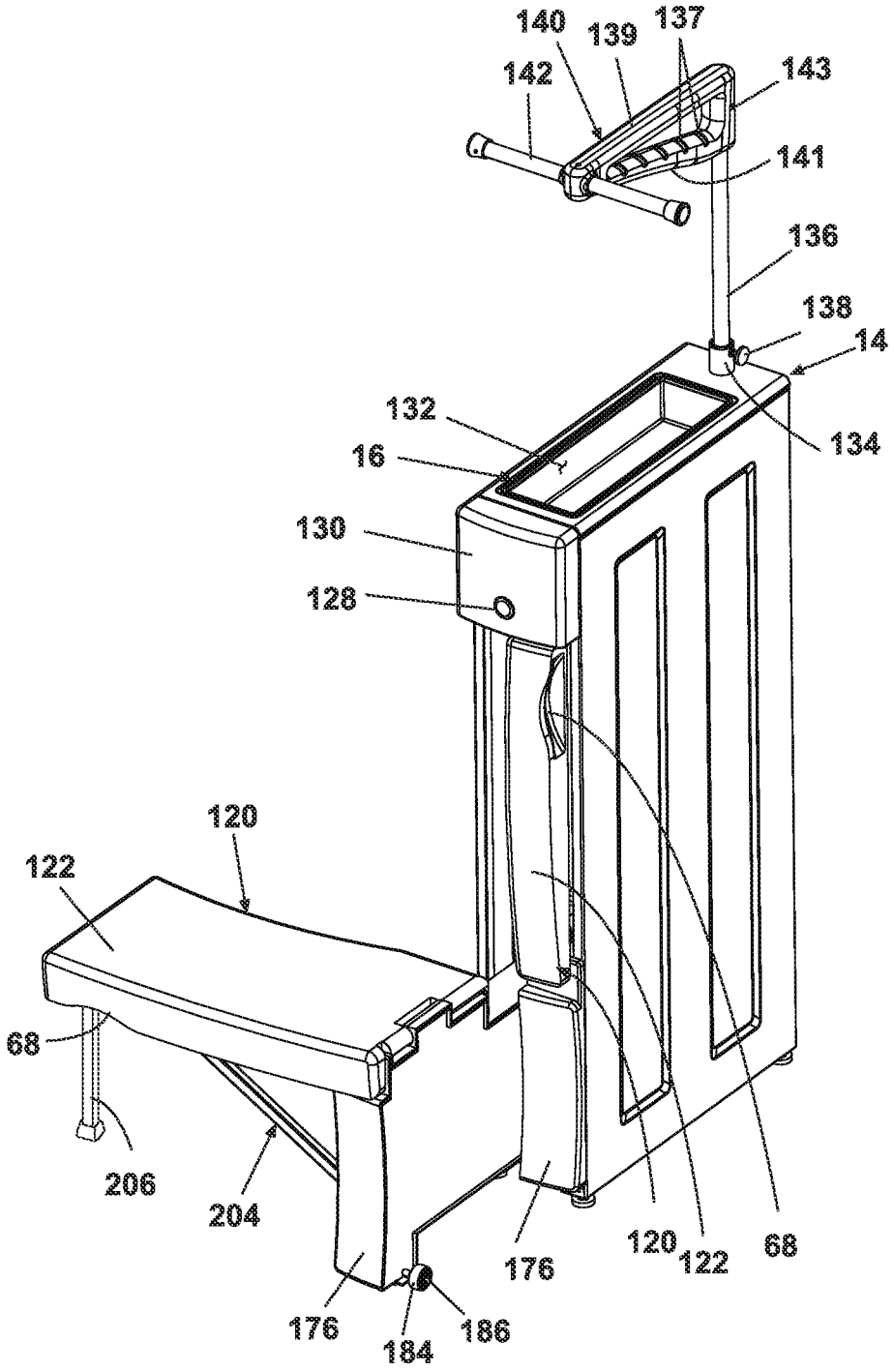
FIG. 56 is a perspective view of the shelf module of FIG. 54 showing one of the shelf assemblies fully extended to the use position and the other of the shelf assemblies retracted.

The shelves 122 of the shelf module 14 can be moved individually or simultaneously between the retracted and extended positions. The process of moving one of the shelves 122 is illustrated in FIGS. 54-56. When the shelf 122 is in the retracted position of FIG. 54, the shelf 122 is received within the housing 146 and is in a generally vertical orientation.

To move one of the shelves 122 from the retracted position of FIG. 54, the shelf 122 is grasped, such as by the handle 68, and the shelf assembly 120 is pulled outwardly. During sliding movement of the shelf assembly 120 from the retracted position, the shelf 122 and the base 176 extend beyond the front opening of the housing 146. At this point, the shelf assembly 120 achieves an intermediate position, as shown in FIG. 55, where the shelf 122 is located exteriorly of the housing 146 and is in a generally vertical orientation.

Next, the shelf 122 pivots about the hinge mount 188 to the extended use position shown in FIG. 56, where the shelf 122 is located exteriorly of the housing and is in a generally horizontal position. Pivotal movement of the shelf 122 relative to the base 176 can be accomplished by gravity acting on the shelf 122. As the gravity pivots the top panel 194 of the shelf 122, the leg 206 pivots about the leg mount 202 and drops into a generally vertical position as restricted by the damper 210 acting on the top panel 194. Once the top panel 194 has dropped from a generally vertical position into a generally horizontal position, the leg 206 supports an outboard end of the top panel 194 as reinforced by the brace 208. Alternatively, the shelf 122 can be manually pivoted relative to the base 176. The other shelf 122 is placed in the extended position in the same manner, and when both of the shelves 122 are extended, as shown in FIG. 46, the shelves 122 form a generally continuous horizontal surface.

When the shelf assemblies 120 are to be returned to the stored position within the shelf module 14, the user grasps the handles 68 on each front fascia 196 and pivots the shelves 122 upwardly about the hinge mount 188 to the intermediate position, where the shelves 122 are generally vertically oriented. As each top panel 194 approaches the generally vertical orientation, the leg 206 pivots back against the underside of the top panel 194, and the damper 210 and the brace 208 also pivot vertically and are countersunk within the partial-height channel 190 and the full-height channel 192, respectively. Then, the shelf assemblies 120 can be pushed rearwardly so that the base 176 travels rearwardly into the front opening of the housing 146 through the action of the slides 168 and the wheels 184. The shelves 122 are thereby stored in a convenient manner.

The modular laundry system shown in FIGS. 46-47 can further be modified by adding a worksurface 12 across the top of the laundry appliances 10 and the shelf module 14, similar to the configuration shown in FIG. 3. For example, the leaf-type worksurface 12 of FIG. 42 is especially suited for use with the modular laundry system of FIGS. 46-47. The worksurface 12 can be adapted to accommodate the upwardly extending hanging area 18, or the upwardly extending hanging area 18 can be removed or modified to accommodate the worksurface 12, such as by being mounted to the rear wall 154 of the housing 146. Furthermore, the relative arrangement of the laundry appliances 10 and the shelf module 14 can differ from that shown in the figures; the shelf module 14 can be positioned at the far ends of the laundry appliances 10 rather than between the laundry appliances 10 or can be utilized with just one of the laundry appliances 10. When the shelf module 14 is utilized with just one of the laundry appliances 10, it is within the scope of the invention for the shelf module 14 to comprise only one of the shelf assemblies 120 or the pair of the shelf assemblies 120.

The modular laundry system according to one embodiment of the invention can be designed to incorporate lighting into the worksurface 12, such as directly into the worksurface 12 or into the storage/staging area, the hanging area 18, and/or the shelving area 19, or into the shelf module 14. The lighting provides illumination to the laundry area and can replace or supplement lighting already present in the laundry area. The lighting can be general lighting that illuminates a general space in which the modular laundry system resides or task lighting that illuminates a specific area for performing one or more particular tasks. For task lighting, the lighting can comprise conventional white illumination sources or a task-specific illumination source, such as black lights that can be used for detecting spots on clothing items. Examples of worksurfaces 12 that incorporate lighting are illustrated in FIGS. 57-62.

Figure 57:
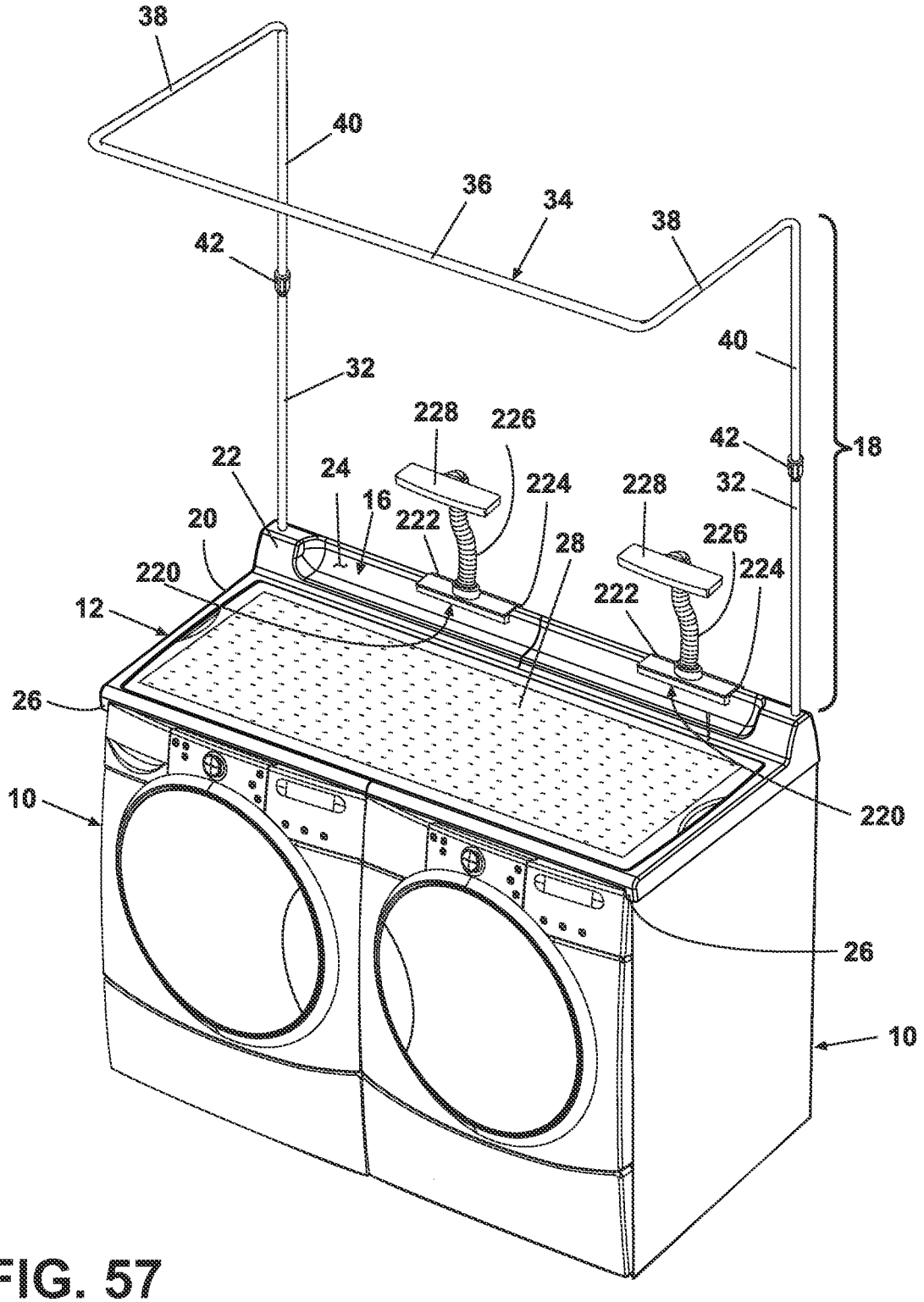
FIG. 57 is a perspective view of another embodiment of the modular laundry system similar to that shown in FIG. 12 in which lighting is incorporated into the worksurface.

FIG. 57 shows an embodiment of a worksurface 12 similar to that illustrated in FIG. 12, except that the bins 30 are replaced with illumination sources 220. Each of the illumination sources 220 comprises a base 222 with a rearwardly extending flange 224. The base 222 is sized for receipt within the staging recess 24 on the backsplash 22, and when the base 222 is received by the staging recess 24, the flange 224 hooks over an upper rear surface of the backsplash 22 located behind the staging recess 24 to mount the illumination source 220 to the worksurface 12. The illumination source 220 further comprises an adjustable neck 226 extending upward from the base 222 and terminating in a light support 228 that supports a source of light (not shown) and directs the light from the light source toward the worksurface 12. The particular illumination source 220 shown in FIG. 57 is provided for exemplary purposes only and can be replaced or modified in any suitable manner. For example, the neck 226 can be elongated so that a user can position the light source over a specific location on the worksurface 12. Additionally, the illumination source 220 can be mounted to an upper surface of the backsplash 22 if the backsplash 22 does not include the staging recess 24. Alternatively, the illumination source 220 can be mounted to other locations of the worksurface 12, such as to the staging bins 30 shown in FIGS. 7, 35A, and 40.

Figure 58:
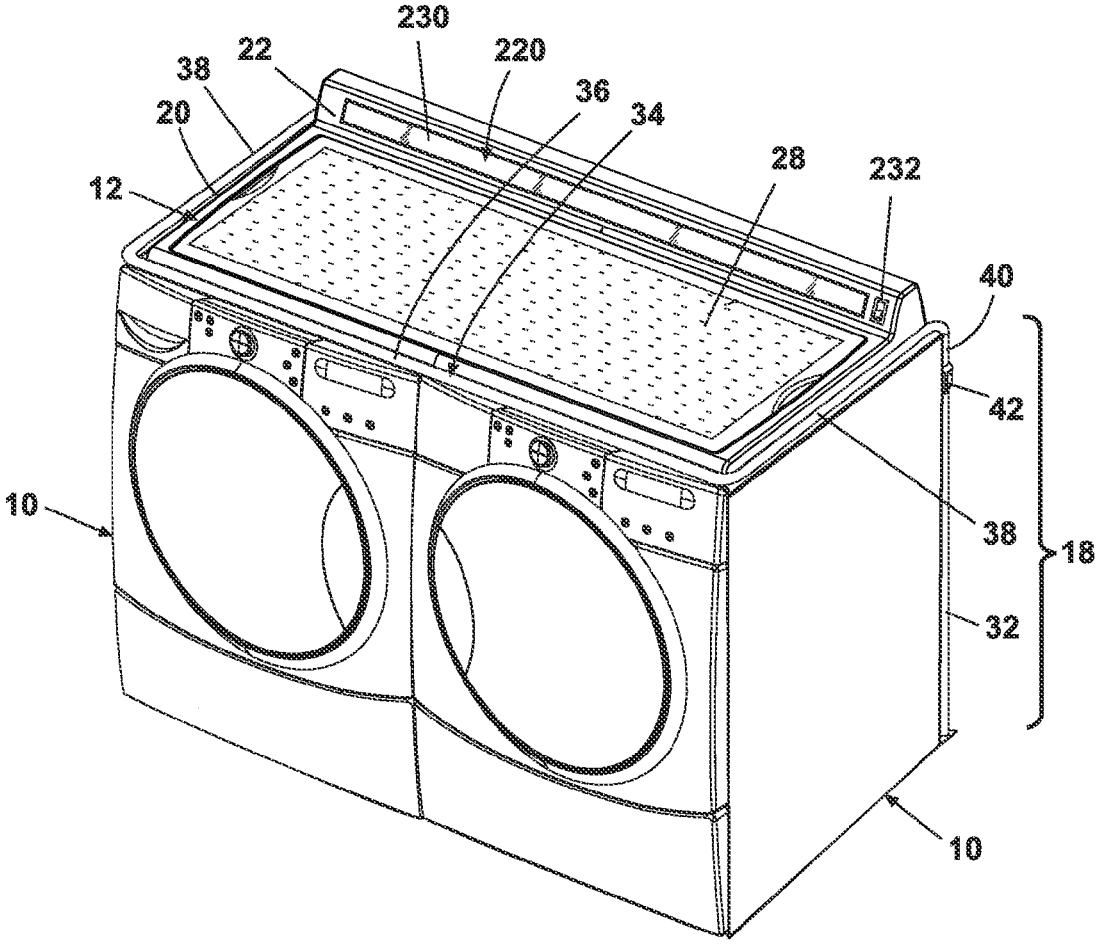
FIG. 58 is perspective view of another embodiment of the modular laundry system similar to that shown in FIG. 32 in which lighting is incorporated into a backsplash of the worksurface.

FIG. 58 illustrates another embodiment of a worksurface 12, which is similar to that illustrated in FIG. 32, wherein the lighting is incorporated into the worksurface 12. In this example, an illumination source 220 in the form of an elongated light 230 is mounted within the backsplash 22 of the worksurface 12. A switch 232 for controlling operation of the elongated light 230 is located adjacent to the elongated light 230 in the backsplash 22.

Figure 59:
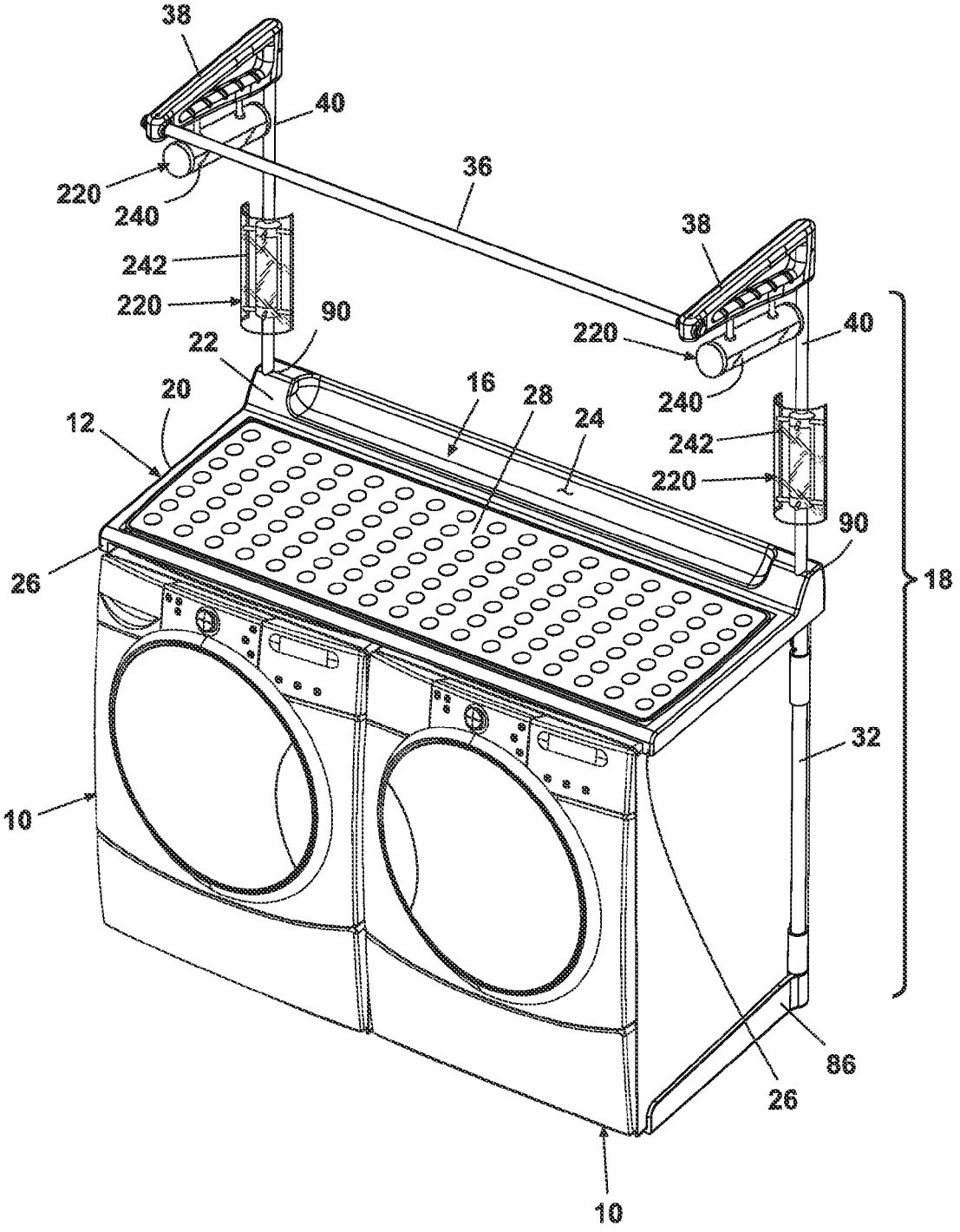
FIG. 59 is another embodiment of the modular laundry system similar to that shown in FIG. 37A in which lighting is incorporated into the hanging area of the worksurface in the form of horizontal and vertical lamps.
Figure 60:
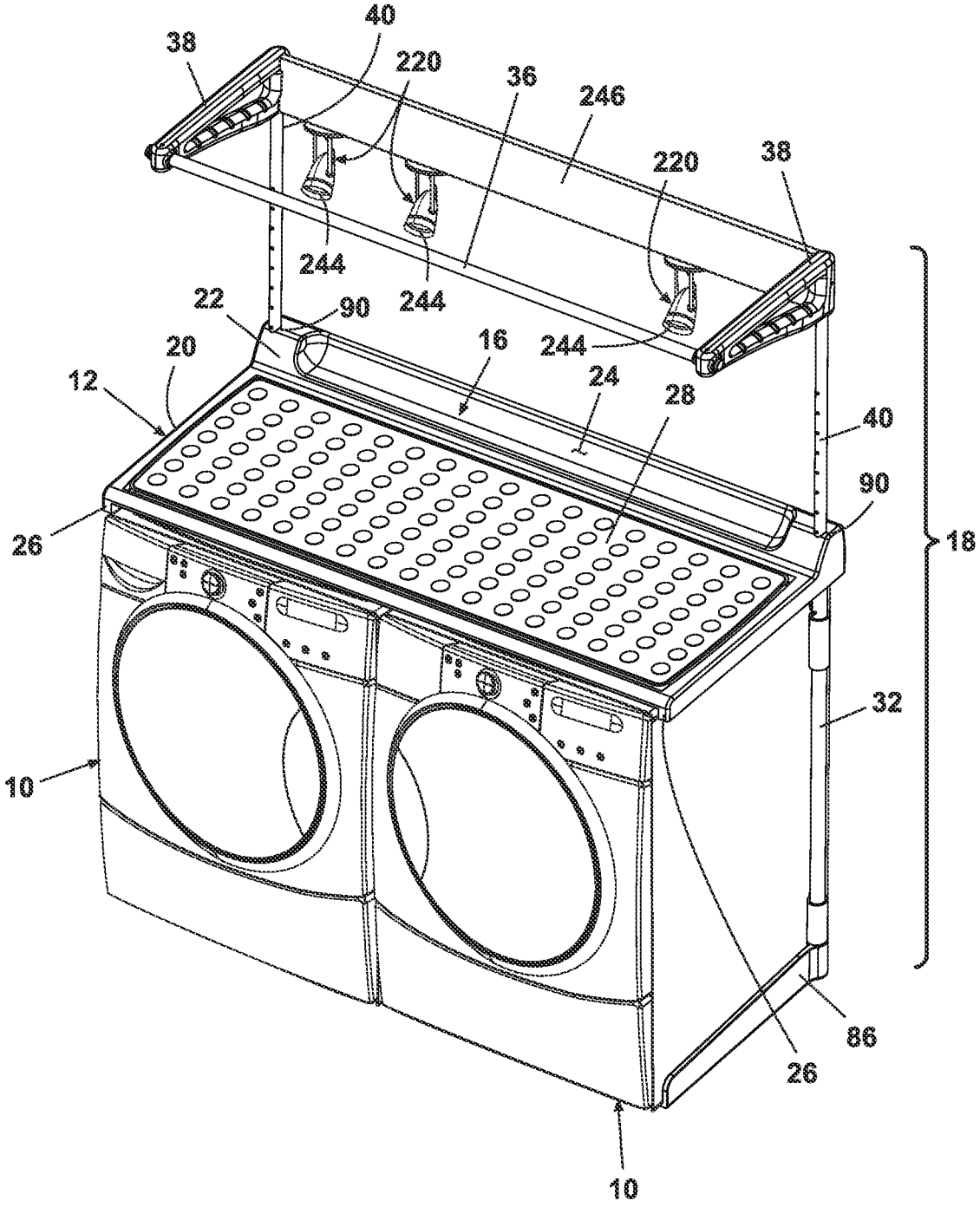
FIG. 60 is another embodiment of the modular laundry system similar to that shown in FIG. 37A in which lighting is incorporated into the hanging area of the worksurface in the form of a plurality of spotlights.
Figure 61:
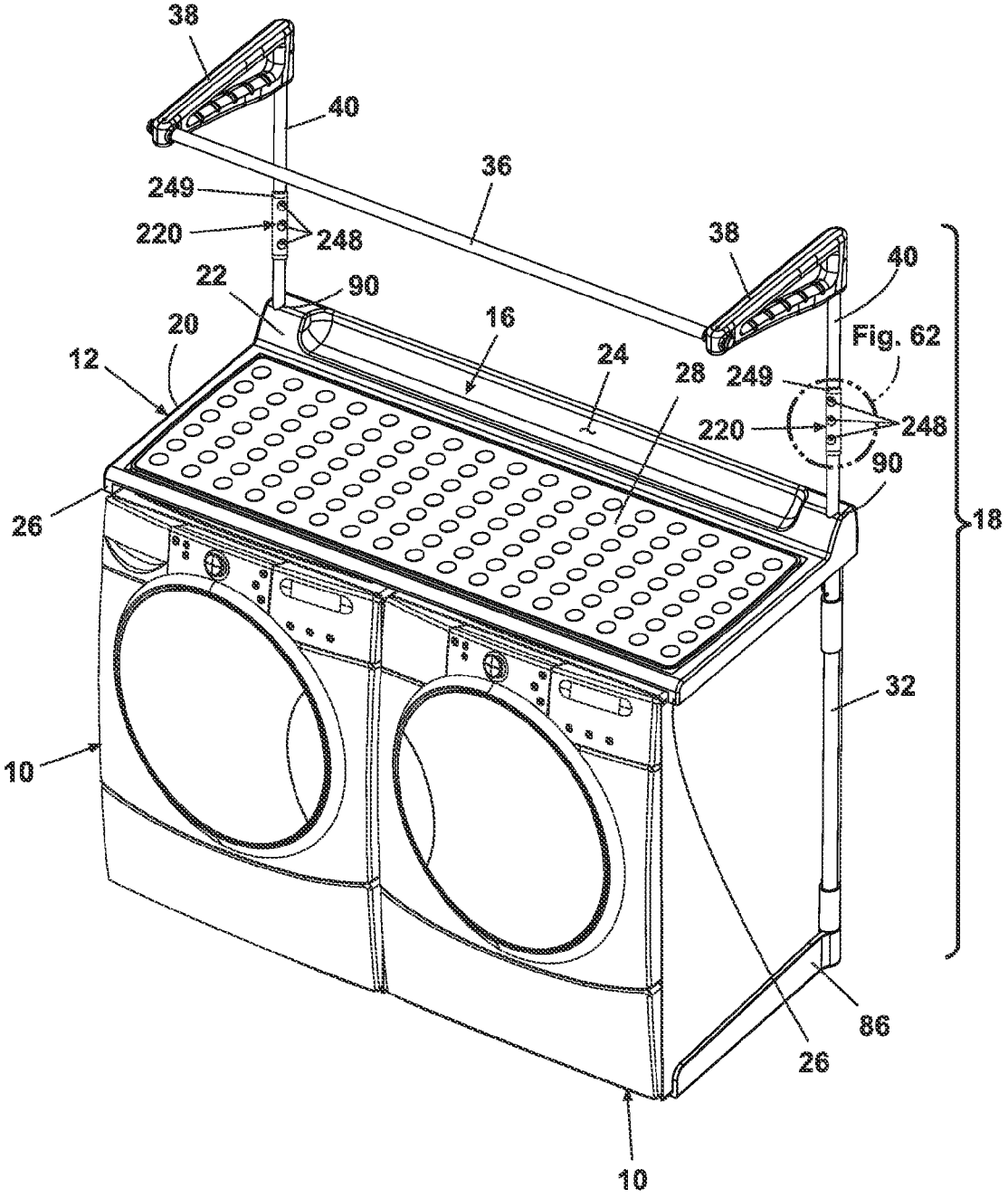
FIG. 61 is another embodiment of the modular laundry system similar to that shown in FIG. 37A in which lighting is incorporated into the hanging area of the worksurface in the form of a plurality of vertically spaced lights.
Figure 62:
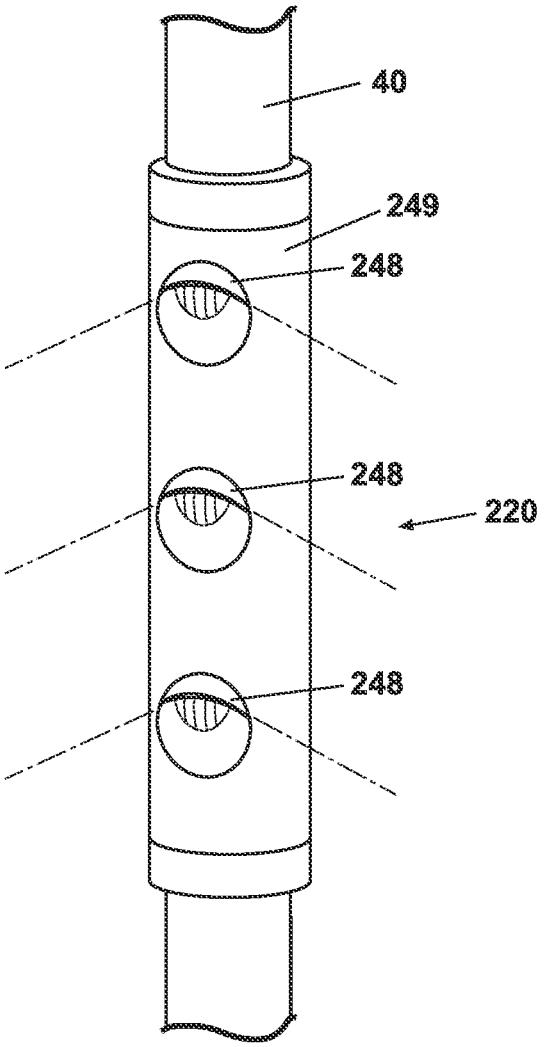
FIG. 62 is an enlarged view of the vertically spaced lights of FIG. 61.

FIGS. 59-62 present embodiments of worksurfaces 12 with an associated hanging area 18, and the lighting is incorporated into the hanging area 18. For example, in FIG. 59, which is similar to the embodiment shown in FIG. 37A, the lighting comprises several illumination sources 220 in the forms of horizontal lamps 240 depending from the spacer rods 38 and vertical lamps 242 mounted to the extension rods 40. FIG. 60 shows an embodiment similar to that of FIG. 59, except that the illumination sources 220 are in the form of a plurality of spotlights 244 mounted along a rear panel 246 that spans between the spacer rods 38. The spotlights 244 can be individually adjusted, such as by swiveling or pivoting, to direct the light to desired areas of the worksurface 12. In the embodiment of FIG. 61, the illumination sources 220 are in the form of a plurality of vertically spaced lights 248 mounted along the extension rods 40. The vertically spaced lights 248 of the illustrated embodiment are mounted in a sleeve 249 that surrounds the corresponding extension rod 40. FIG. 62 presents an enlarged view of the vertically spaced lights 248 from the embodiment of FIG. 61.

When the hanging area 18 includes the illumination sources 220, the adjustable nature of the hanging area 18 can be removed or modified for the type of the illumination sources 220, or the illumination sources 220 can be removable from the hanging area 18 so that the hanging area 18 can be adjusted or stored when not in use. Additionally, the illumination sources 220 in the hanging areas 18 can be battery powered or powered via a wired connection that can be hidden within the hanging area 18, such as, for example, by running wires though the extension rods 40, spacer rods 38, and central rod 34.

As previously mentioned, the worksurface 12 can be adapted to prevent transference of vibration between the laundry appliance 10 and the worksurface 12 and/or between adjacent laundry appliances 10. Consequently, the worksurface 12 remains relatively stationary during operation of the laundry appliance 10, and any items supported by the worksurface 12 will not shake or fall from the worksurface 12 during operation of the laundry appliance 10. The worksurface 12 can incorporate any suitable means for damping vibration or preventing transference of vibration from the laundry appliance 10 to the worksurface 12. For example, vibration dampening or isolation pads can be positioned between the worksurface 12 and the laundry appliance 10. The isolation pads physically space the worksurface 12 from the laundry appliance 10 and can be made of a material that dampens vibrations. Exemplary embodiments of the worksurface 12 incorporating the vibration isolation pads are illustrated in FIGS. 63-65.

Figure 63:
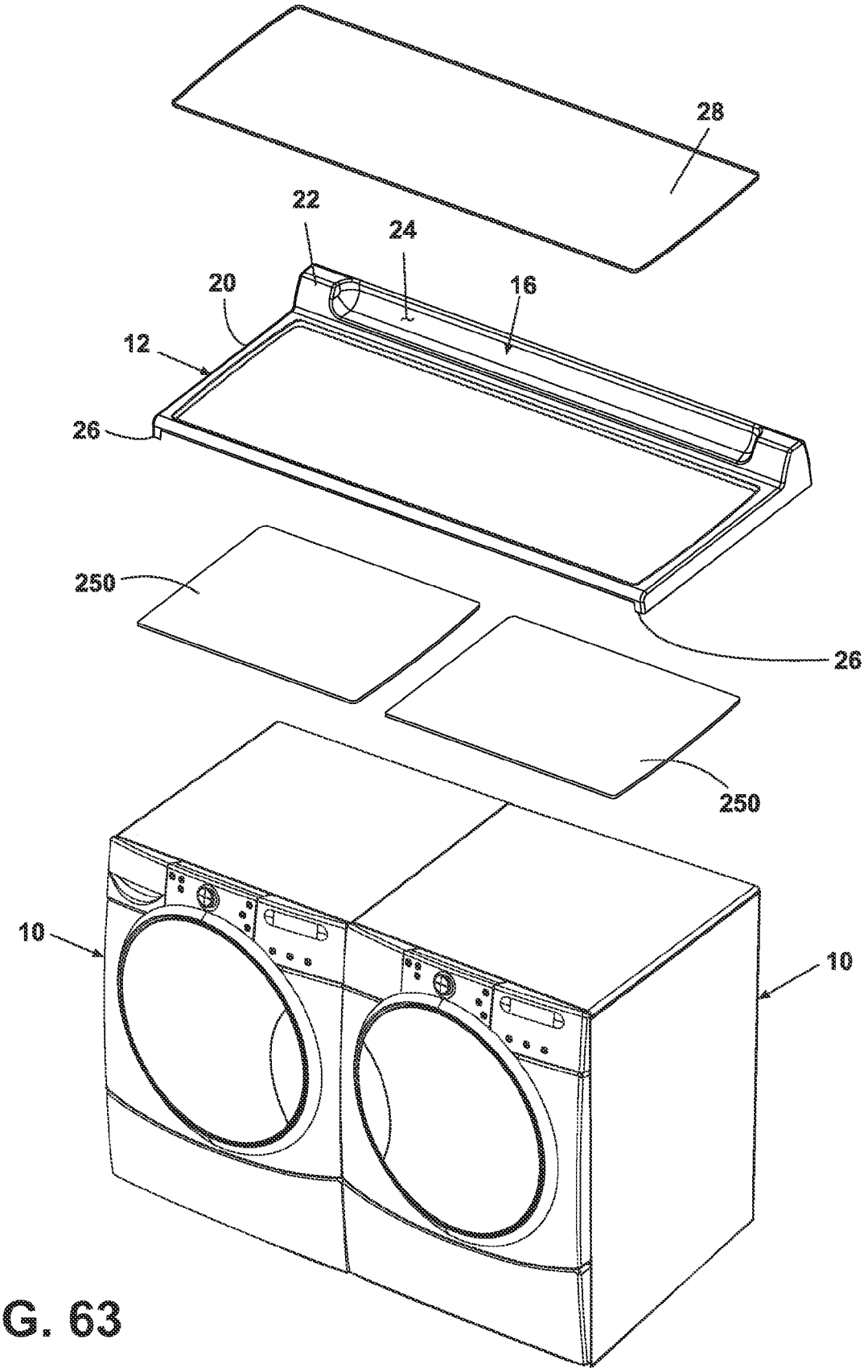
FIG. 63 is an exploded perspective view of another embodiment of the modular laundry system similar to that shown in FIG. 6 in which vibration isolation pads are located between the worksurface the laundry appliances.

FIG. 63 shows a worksurface 12 similar to that illustrated in FIG. 6, except that the worksurface 12 is formed by a unitary body 20, and the worksurface 12 includes a pair of horizontally juxtaposed isolation pads 250 between a lower surface of the worksurface 12 and the laundry appliances 10. The isolation pads 250 can be made as a unitary isolation pad rather than separate, if desired. Additionally, the isolation pads 250 can be mounted to the bottom of the worksurface 12 so that the isolation pads 250 move with the worksurface 12 when the worksurface 12 is mounted to or removed from the laundry appliances 10. Alternatively, the isolation pads 250 can be separate from the worksurface 12, whereby the isolation pads 250 are mounted to the laundry appliances 10 before the worksurface 12 is positioned on the laundry appliances 10. The isolation pads 250 are composed of a material that vibrationally isolates the worksurface 12 from the laundry appliances 10. Examples of suitable materials include, but are not limited to, rubber and polymeric foams. The isolation pads 250 can have any suitable thickness, depending on the material of the isolation pads 250. For example, the thickness of the isolation pads 250 can range from about one-eighth of an inch to about one inch.

Figure 64:
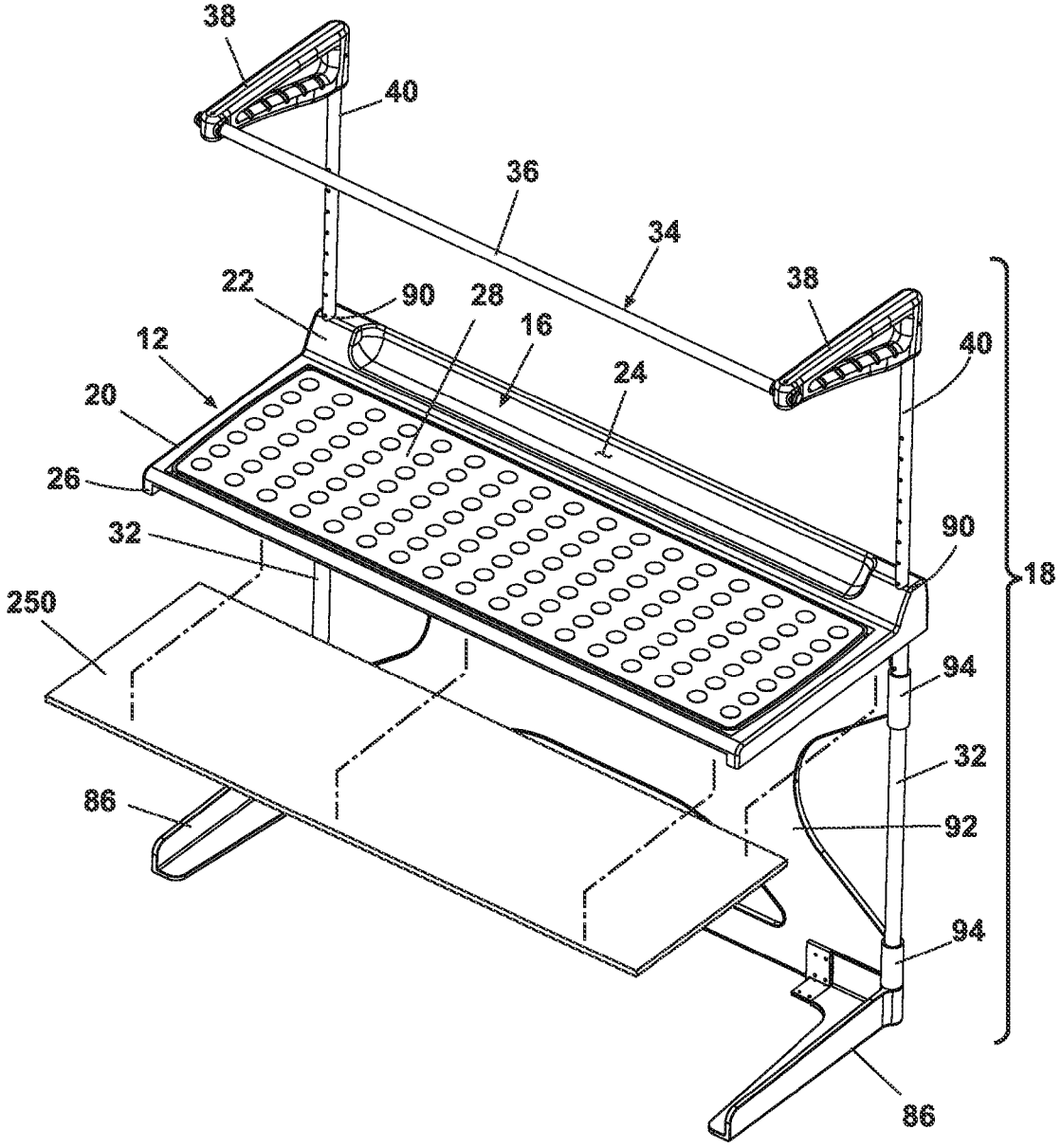
FIG. 64 is a perspective view of another embodiment of the modular laundry system similar to that shown in FIG. 38 with the addition of a vibration isolation pad.

Another embodiment of the worksurface 12 with the isolation pad 250 is shown in FIG. 64. The worksurface 12 in FIG. 64 is similar to that shown in FIG. 37A, except that the worksurface 12 in FIG. 64 includes a unitary isolation pad 250 positioned below the worksurface body 20.

Figure 65:
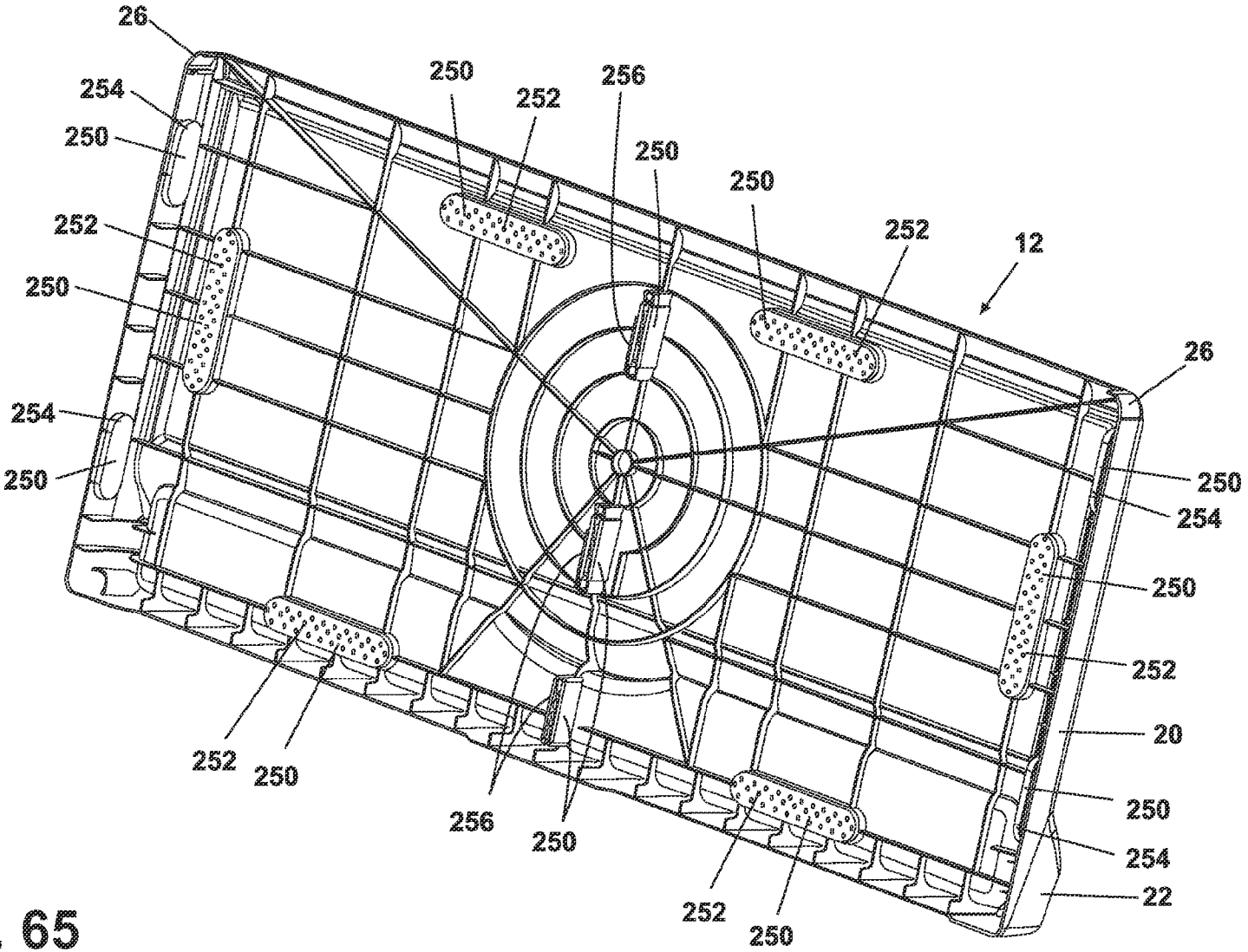
FIG. 65 is a bottom perspective view of the worksurface similar to that shown in FIG. 6 with a plurality of vibration isolation pads mounted to a bottom surface of the worksurface.

The vibration dampening and isolation means can alternatively comprise a plurality of relatively smaller isolation pads 250 mounted to the bottom of the worksurface 12, as illustrated in FIG. 65. The isolation pads 250 can be randomly positioned on the bottom of the worksurface 12 or strategically located. In the illustrated embodiment, the isolation pads 250 comprise a first set 252 of the isolation pads 250 in a horizontal orientation along the bottom of the body 20 to prevent transfer of vibration from the tops of the laundry appliances 10 to the worksurface 12, a second set 254 of the isolation pads in a generally vertical orientation along the depending flanges 26 to prevent transfer of vibration from the sides of the laundry appliances 10 to the worksurface 12, and a third set 256 of the isolation pads 250 in a generally vertical orientation and located centrally on the body 20 such that the isolation pads 250 of the third set 256 reside between the adjacent laundry appliances 10 that support the worksurface 12 to prevent transference of vibration therebetween.

Rather than utilizing the isolation pads 250, the worksurface 12 can be made such that natural resonating frequency of the worksurface 12 is a frequency that is quickly passed through during a spin operation of the laundry appliance 10 in the form of a clothes washer yet greater than the frequencies at which the laundry appliance 10 in the form of a clothes dryer operates. The natural resonating frequency of the worksurface 12 can be tailored by altering the mass of the worksurface 12, such as by altering the thickness of the body 20 or adding counterweights.

To add stability to the modular laundry system, the worksurface 12 can be attached to the laundry appliance 10 to create a physically interconnected structure. For example, the worksurface 12 and the laundry appliance 10 can be connected by interlocking components, such as a socket and detent, fasteners, or adhesives. The worksurface 12 and the laundry appliance 10 can also be joined together with a joining process, such as welding.

Figure 66:
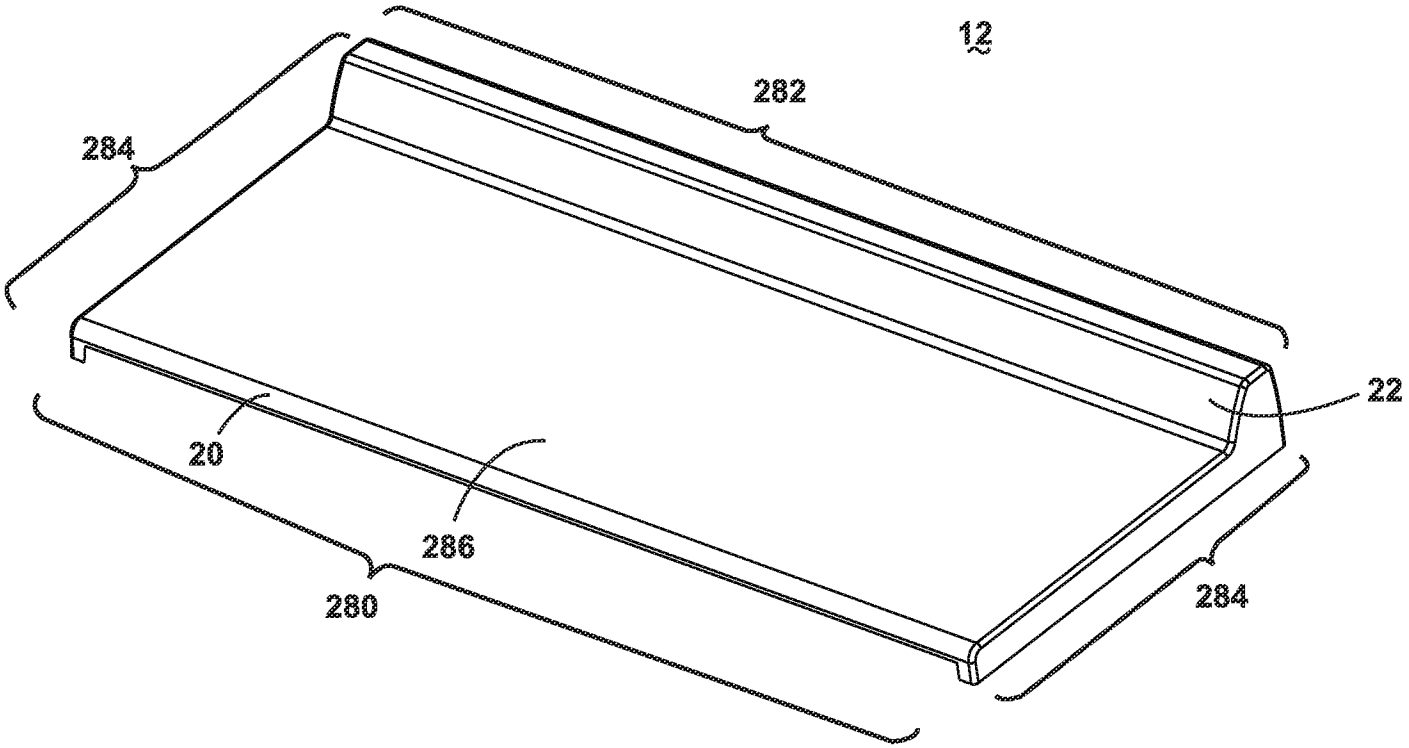
FIG. 66 is a perspective view of another embodiment of the modular laundry system similar to that shown in FIG. 6.

Many embodiments of the worksurface 12 have been described above and shown in the drawings. Several of these embodiments of the worksurface 12 include a functional element configured to provide an associated functionality. Examples of the functional elements include the hanging area 18, the storage/staging area 16, the shelving area 19, which includes the ironing board 52, the wrinkle removing press 80, the illumination source 220, the vibration isolation pads 250, the hinge 66, the power outlet 53, and the iron docking station 59 on the iron platform 61. While the functional elements can be provided in any suitable location on the worksurface 12, the functional elements in the illustrated embodiments have been shown as being located or accessed either along a perimeter of the worksurface 12 or below the upper surface of the worksurface 12 so that the functional element does not interfere with the portion of the upper surface of the worksurface 12 that the user would typically employ for performing functions or tasks. As shown in FIG. 66, the perimeter of the worksurface 12 defines a front 280, a back 282, and opposite sides 284. In the illustration of FIG. 66, the backsplash 22 is located at the back 282 of the perimeter. The upper surface of the worksurface is identified with the reference numeral 286 in FIG. 66. The upper surface 286 is formed by the uppermost surface of the worksurface 12. For example, the upper surface 286 can be defined by the upper surface of the functional insert 28 when the worksurface 12 comprises the functional insert 28, the upper surface of the cover 78 of the wrinkle removing press 80, or the upper surface of the body 20.

Examples of some of the functional elements provided on or accessed from the perimeter in the previously described embodiments include the staging recess 24 formed at the back 282 in the backsplash 22 (e.g., FIG. 6), the staging bins 30 at the opposite sides 284 (e.g., FIGS. 7 and 35), the hanging area located at the back 282 (e.g., FIGS. 10, 30, 37A, 41), the staging wells 44 located at the back 282 in the staging recess 24 (e.g., FIG. 12), the radio module 45 located at the back 282 in the staging recess 24 (e.g., FIG. 13), the shelving area 19 in the form of the ironing board 52 accessible through the front 280 (e.g., FIGS. 16 and 18), the power outlet 53 provided at the back 282 in the backsplash 22 (e.g., FIG. 16), the iron docking station 59 located at one of the opposite sides 284 (e.g., FIG. 17), the shelving area 19 located at the back 282 and mounted to the hanging area 18 at the back 282 (e.g., FIGS. 20-22), the clothing-retaining clips 84 located at the front 280 (e.g., FIG. 28), the hanging area 18 extending laterally from one of the opposite sides 284 (e.g., FIG. 34A), the hanger staging area 91 located at one of the opposite sides 284 (e.g., FIG. 35C), the hanger staging area 91 located at the back 282 and mounted to the hanging area 18 at the back 282 (e.g., FIG. 37B), the illumination source 220 provided at the back 282 on the backsplash 22 (e.g., FIGS. 57 and 58), and the illumination source 220 provided at the back 282 on the hanging area 18 at the back 282 (e.g., FIGS. 59-61).

Examples of some of the functional elements provided below the upper surface 286 of the worksurface 12 in the previously described embodiments include the shelving area 19 in the form of the ironing board 52 stored below the upper surface 286 when not in use (e.g., FIGS. 16 and 18), the hinge 66 for moving the worksurface 12 relative to the laundry appliances 10 (e.g., FIG. 24), the wrinkle removing press 80 (e.g., FIG. 25), and the vibration isolation pads 250 located below the upper surface 286 (e.g., FIGS. 63-65).

In addition to the current application, the modular laundry system is also described in the following related applications: application Ser. No. 11/322,773, filed Dec. 30, 2005, and titled "Modular Laundry System with Segmented Work Surface," now abandoned, application Ser. No. 11/322,741, filed Dec. 30, 2005, and titled "Modular Laundry System with Work Surface Having a Functional Insert," now abandoned, application Ser. No. 11/322,740, filed Dec. 30, 2005, and titled "Modular Laundry System with Work Surface Having a Functional Element," now abandoned, and application Ser. No. 11/323,658, filed Dec. 30, 2005, and titled "Modular Laundry System with Shelf Module," now U.S. Pat. No. 7,587,917, issued Sep. 15, 2009, which are incorporated herein by reference in their entirety.

As can be seen from the numerous embodiments of this invention, a modular laundry system having an integrated worksurface 12 and/or an optional shelf module 14 can have beneficial effects on a user's ability to organize the workspace surrounding one or more laundry appliances 10.

A modular laundry system according to the invention comprises at least one laundry appliance 1010 and at least one module 1020. According to one embodiment of the invention, the laundry system comprises two laundry appliances 1010 and at least one module 1020, which can be selected and configured to provide desired laundry care functionality within a given laundry area. The laundry area is a space of a home in which the laundry appliance 1010 conventionally resides. The laundry area can be, for example, a dedicated laundry room, a shared room, such as a combined laundry and utility room or a combined laundry room and garage, a closet, or part of another room or hallway of the home.

The laundry appliance 1010 is a conventional appliance for washing and drying fabric items, such as clothes and linens. Examples of the laundry appliance include, but are not limited to, a washing machine, including top-loading, front-loading, vertical axis, and horizontal axis washing machines, a dryer, such as a tumble dryer, including top-loading dryers and front-loading dryers, a combination washing machine and dryer, a tumbling refreshing machine, an extractor, and a non-aqueous washing apparatus. An exemplary non-aqueous washing apparatus is disclosed in the aforementioned U.S. Patent Application Publication No. 2005/0155393, incorporated above. The non-aqueous washing apparatus of the incorporated application publication comprises a wash unit and a reclamation unit, and the laundry appliance 1010 can be the wash unit. When the laundry system comprises two of the laundry appliances 1010, a first laundry appliance and a second laundry appliance, the first and second laundry appliances 1010 can be the same type of laundry appliance, such as two washing machines, or different types of laundry appliances, such as a washing machine and a dryer.

Referring now to the schematic three-dimensional illustration in FIG. 67A, the laundry appliance 1010 is defined by a space bounded by spaced left and right side walls 1012, 1013, spaced front and rear walls 1014, 1015, and spaced top and bottom walls 1016, 1017 that together define for the laundry appliance 1010 a width W, a height H, and a depth D. In FIG. 67A, the laundry appliance 1010 is depicted as a cube; however, the width W, the height H, and the depth D need not be equal. The width W and the depth D determine a footprint of the laundry appliance 1010. The footprint corresponds to the amount of floor space required by the laundry appliance 1010. The laundry appliances 1010 that are presently commercially available have a range of dimensions, and it is within the scope of the invention to utilize a laundry appliance having any suitable dimensions. Exemplary dimensions for the laundry appliance 1010 are 27"W×38"H×31.5"D. A survey of multiple commercially available washing machines and dryers resulted in the following exemplary dimensions, which are given in inches and rounded to the nearest whole number:

| DIMENSION | AVERAGE | MAXIMUM | MINIMUM |
|---|---|---|---|
| Washing machine W | 24 | 27 | 20 |
| Washing machine H | 35 | 39 | 26 |

-continued

| DIMENSION | AVERAGE | MAXIMUM | MINIMUM |
|---|---|---|---|
| Washing machine D | 25 | 34 | 20 |
| Dryer W | 27 | 29 | 23 |
| Dryer H | 36 | 38 | 31 |
| Dryer D | 28 | 32 | 21 |

Figure 67B:
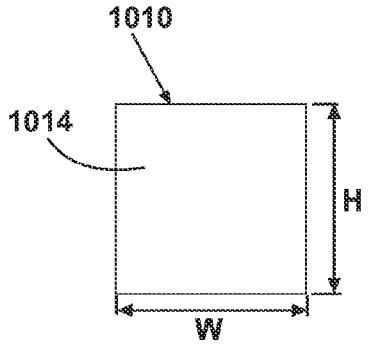
FIG. 67B is a view of a symbol representative of the laundry appliance of FIG. 67A.

FIG. 67B displays a two-dimensional symbol for the laundry appliance 1010, and the symbol is used in the drawings of this application to represent the laundry appliance 1010 in the modular laundry system. The symbol corresponds to the front wall 1014 of the laundry appliance 1010, and, therefore, the shape of the symbol is determined by the width W and the height H. As explained in further detail below, the width W, the height H, and the depth D of the laundry appliance 1010 are reference dimensions, and dimensions for the modules 1020 are described with respect to the reference dimensions.

The modules 1020 can be stand-alone units that do not require physical connection to the laundry appliance 1010 for operation, or, alternatively, they can be coupled to the laundry appliance 1010, either as a requirement for operation of the module 1020 or to support operation of the laundry appliance 1010. The modules 1020 can be characterized in terms of their geometry and function and will first be described with respect to their geometry. The geometry of the modules 1020 enables the modules 1020 to form an aesthetically coherent system with the laundry appliances 1010 and to optimize the space available in the laundry area. The modules 1020 according to one embodiment of the invention are illustrated schematically in FIGS. 68A-71F. The modules 1020 are grouped into horizontal modules (FIGS. 68A-68D, 70A-70F), vertical modules (FIGS. 69A-69D), and cabinet modules (71A-71F).

FIG. 68A shows a single width horizontal module 1030 that is defined by a space bounded by spaced left and right side walls 1032, 1033, spaced front and rear walls 1034, 1035, and spaced top and bottom walls 1036, 1037. The single width horizontal module 1030 has a width W approximately equal to the width W of the laundry appliance 1010. When the single width horizontal module 1030 has a depth D that is approximately equal to the depth D of the laundry appliance 1010, the single width horizontal module 1030 has the same footprint as the laundry appliance 1010, whereby the bottom wall 1037 of the single width horizontal module 1030 is generally the same size as the bottom wall 1017 of the laundry appliance 1010. Because the single width horizontal module 1030 has the same width W as the laundry appliance 1010, the single width horizontal module 1030 can be arranged above or below the laundry appliance 1010 with the left side walls 1012, 1032 forming a generally continuous surface and the right side walls 1013, 1033 likewise forming a generally continuous surface. The single width horizontal module 1030 can have any suitable height H less than the height H of the laundry appliance 1010, and an exemplary height for a 27" wide single width horizontal module 1030 is about 15.5". A symbol for the single width horizontal module 1030 is illustrated in FIG. 68B. The symbol corresponds to the front wall 1034 of the single width horizontal module 1030, and, therefore, the shape of the symbol is determined by the width W and the height H.

FIG. 68C illustrates a double width horizontal module 1040 that is defined by a space bounded by spaced left and right side walls 1042, 1043, spaced front and rear walls 1044, 1045, and spaced top and bottom walls 1046, 1047.

Figure 68D:
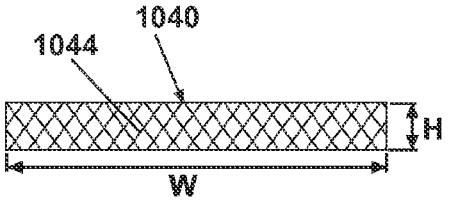
FIG. 68D is a view of a symbol representative of the double width horizontal module of FIG. 68C.

The double width horizontal module 1040 has a width W approximately equal to twice the width W of the laundry appliance 1010 or approximately equal to a collective width of two of the laundry appliances 1010, i.e., the first and second laundry appliances, which can have differing individual widths. When the double width horizontal module 1040 has a depth D approximately equal to that of the laundry appliance 1010, the double width horizontal module 1040 has a footprint that is twice as wide as that of the laundry appliance 1010 or as wide as the collective width of two of the laundry appliances 1010. The double width horizontal module 1040 can be arranged above or below two laundry appliances 1010 arranged side-by-side. In this configuration, because the width W of the double width horizontal module 1040 is twice that of the laundry appliance 1010, the left side wall 1042 of the double width horizontal module 1040 and the left side wall 1012 of one of the laundry appliances 1010 form a generally continuous surface, while the right side wall 1043 of the double width horizontal module 1040 and the right side wall 1013 of the other of the laundry appliances 1010 form a generally continuous surface. The double width horizontal module 1040 can have any suitable height H less than the height H of the laundry appliance 1010, and, according to the illustrated embodiment, the height H of the double width horizontal module 1040 is less than that of the single width horizontal module 1030; however, it is within the scope of the invention for the height H of the double width horizontal module 1040 to be equal to or greater than that of the single width horizontal module 1030. Exemplary heights for a 54" wide double width horizontal module 1040 are about 6" and 10". A symbol for the double width horizontal module 1040 is illustrated in FIG. 68D. The symbol corresponds to the front wall 1044 of the double width horizontal module 1040, and, therefore, the shape of the symbol is determined by the width W and the height H.

In addition to the single width horizontal module 1030 and the double width horizontal module 1040, the modular laundry system can include a less than single width horizontal module 2050, an intermediate width horizontal module 2060, and a greater than double width horizontal module 2070. These additional horizontal modules are described below with respect to FIGS. 70A-70F.

FIG. 69A depicts a single height vertical module 1050 that is defined by a space bounded by spaced left and right side walls 1052, 1053, spaced front and rear walls 1054, 1055, and spaced top and bottom walls 1056, 1057. The single height vertical module 1050 has a height H approximately equal to the height H of the laundry appliance 1010. Because the heights H of the single height vertical module 1050 and the laundry appliance 1010 are substantially equal, the single height vertical module 1050 can be positioned adjacent to the laundry appliance 1010 in a side-by-side relationship with the top walls 1016, 1056 forming a generally continuous surface. The single height vertical module 1050 can have any suitable depth D, such as a depth equal to the depth D of the laundry appliance 1010. Further, the single height vertical module 1050 can have any suitable width W less than the width W of the laundry appliance 1010. Thus, the footprint of the single height vertical module 1050 is less wide than that of the laundry appliance 1010. Exemplary widths W for the single height vertical module 1050 are about 10.5", 13.5", and 15.5". A symbol for the single height vertical module 1050 is illustrated in FIG. 69B. The symbol corresponds to the front wall 1054 of the single height vertical module 1050, and, therefore, the shape of the symbol is determined by the width W and the height H.

Figure 69D:
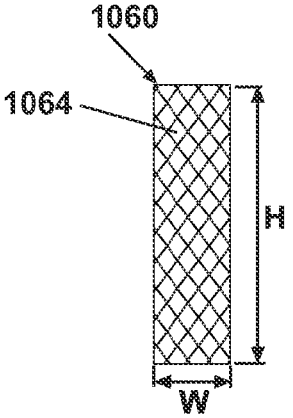
FIG. 69D is a view of a symbol representative of the intermediate height vertical module of FIG. 69C.

FIG. 69C shows an intermediate height vertical module 1060 that is defined by a space bounded by spaced left and right side walls 1062, 1063, spaced front and rear walls 1064, 1065, and spaced top and bottom walls 1066, 1067. The intermediate height vertical module 1060 has a height H approximately equal to a height of the laundry appliance 1010 vertically stacked with one or more of the horizontal modules 1030, 1040, 2050, 2060, 2070 and less than a collective height of two of the laundry appliances vertically stacked. Because the height H of the intermediate height vertical module 1060 and the height of the laundry appliance 1010 vertically stacked with one or more of the horizontal modules 1030, 1040, 2050, 2060, 2070 are substantially equal, the intermediate height vertical module 1060 can be positioned in a side-by-side relationship with the laundry appliance 1010 vertically stacked with one or more of the horizontal modules 1030, 1040, 2050, 2060, 2070 such that the top wall 1066 of the intermediate height vertical module 1060 and the top wall of the laundry appliance 1010 or the one or more of the horizontal modules 1030, 1040, 2050, 2060, 2070, depending on the relative vertical positioning, form a generally continuous surface. The intermediate height vertical module 10 60 can have any suitable depth D, such as a depth equal to the depth D of the laundry appliance 1010. Further, as with the single height vertical module 1050, the intermediate height vertical module 1060 can have any suitable width W less than the width W of the laundry appliance 1010. Thus, the footprint of the intermediate height vertical module 1060 is less wide than that of the laundry appliance 1010. Exemplary widths W for the intermediate height vertical module 1060 are about 10.5", 13.5", and 15.5". A symbol for the intermediate height vertical module 1060 is illustrated in FIG. 69D. The symbol corresponds to the front wall 1064 of the intermediate height vertical module 1060, and, therefore, the shape of the symbol is determined by the width W and the height H.

FIG. 70A illustrates the less than single width horizontal module 2050, which is defined by a space bounded by spaced left and right side walls 2052, 2053, spaced front and rear walls 2054, 2055, and spaced top and bottom walls 2056, 2057. As with the single and double width horizontal modules 1030, 1040, the less than single width horizontal module 2050 can have any suitable height H less than the height H of the laundry appliance 1010. The less than single width horizontal module 2050 has a width W less than the width W of the laundry appliance 1010. For example, the width W of the less than single width horizontal module 2050 can be about equal to the width D of one or more the vertical modules 1050, 1060. When the width W of the less than single width horizontal module 2050 is about the same as that of the one or more vertical modules 1050, 1060, the less than single width horizontal module 2050 can be arranged above or below the one or more vertical modules 1050, 1060 with the left side walls 1052 or 1062, 2052 forming a generally continuous surface and the right side walls 1053 or 1063, 2053 likewise forming a generally continuous surface. Further, the less than single width horizontal module 2050 can have any suitable depth D, and an exemplary depth D for the less than single width horizontal module 2050 is about equal to the depth D of the laundry appliance 1010. A symbol for the less than single width horizontal module 2050 is illustrated in FIG. 70B. The symbol corresponds to the front wall 2054 of the less than single width horizontal module 2050, and, therefore, the shape of the symbol is determined by the width W and the height H.

FIG. 70C illustrates the intermediate width horizontal module 2060, which is defined by a space bounded by spaced left and right side walls 2062, 2063, spaced front and rear walls 2064, 2065, and spaced top and bottom walls 2066, 2067. The intermediate width horizontal module 2060 can have any suitable height H less than the height H of the laundry appliance 1010. The intermediate width horizontal module 2060 has a width W approximately equal to a collective width of the laundry appliance 1010 arranged side-by-side with one or more of the vertical modules 1050, 1060 and less than a collective width of two of the laundry appliances 1010 arranged side-by-side. Because the width of the intermediate width horizontal module 2060 and the collective width of the laundry appliance 1010 arranged side-by-side with one or more of the vertical modules 1050, 1060 are substantially equal, the intermediate width horizontal module 2060 can be vertically stacked with the laundry appliance 1010 arranged side-by-side with one or more of the vertical modules 1050, 1060 such that the left side wall 2062 of the intermediate width horizontal module 2060 forms a generally continuous surface with the leftmost side wall of the laundry appliance 1010 arranged side-by-side with one or more of the vertical modules 1050, 1060, while the right side wall 2063 of the intermediate width horizontal module 2060 forms a generally continuous surface with the rightmost side wall of the laundry appliance 1010 arranged side-by-side with one or more of the vertical modules 1050, 1060. Further, the intermediate width horizontal module 2060 can have any suitable depth D, and an exemplary depth D for the intermediate width horizontal module 2060 is about equal to the depth D of the laundry appliance 1010. A symbol for the intermediate width horizontal module 2060 is illustrated in FIG. 70D. The symbol corresponds to the front wall 2064 of the intermediate width horizontal module 2060, and, therefore, the shape of the symbol is determined by the width W and the height H.

Figure 70F:
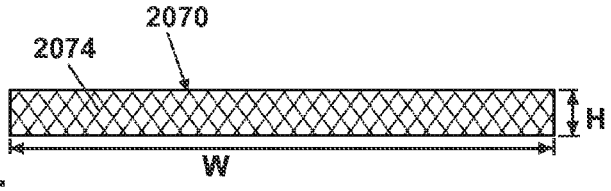
FIG. 70F is view of a symbol representative of the greater than double width horizontal module of FIG. 70E.

FIG. 70E illustrates the greater than double width horizontal module 2070, which is defined by a space bounded by spaced left and right side walls 2072, 2073, spaced front and rear walls 2074, 2075, and spaced top and bottom walls 2076, 2077. The greater than double width horizontal module 2070 can have any suitable height H less than the height H of the laundry appliance 1010. The greater than double width horizontal module 2070 has a width W greater than a collective width of two of the laundry appliances 1010 arranged side-by-side. For example, the width W of the greater than double width horizontal module 2070 can be about equal to a collective width of two of the laundry appliances 1010 and one of the vertical modules 1050, 1060 arranged side-by side or about equal to a collective width of three of the laundry appliances 1010 arranged side-by-side. In the latter example, the greater than double width horizontal module 2070 can be vertically stacked with the three laundry appliances 1010 arranged side-by-side such that the left side wall 2072 of the greater than double width horizontal module 2070 forms a generally continuous surface with the leftmost side wall of the three side-by-side laundry appliances 1010, while the right side wall 2073 of the greater than double width horizontal module 2070 forms a generally continuous surface with the rightmost side wall of the three side-by-side laundry appliances 1010. Further, the greater than double width horizontal module 2070 can have any suitable depth D, and an exemplary depth D for the greater than double width horizontal module 2070 is about equal to the depth D of the laundry appliance 1010. A symbol for the greater than double width horizontal module 2070 is illustrated in FIG. 70F. The symbol corresponds to the front wall 2074 of the greater than double width horizontal module 2070, and, therefore, the shape of the symbol is determined by the width W and the height H.

FIG. 71A illustrates a single height cabinet module 1070 that is defined by a space bounded by spaced left and right side walls 1072, 1073, spaced front and rear walls 1074, 1075, and spaced top and bottom walls 1076, 1077. The single height cabinet module 1070 has a width W and a height H approximately equal to the width W and the height H, respectively, of the laundry appliance 1010. Thus, the single height cabinet module 1070 can be positioned adjacent to the laundry appliance 1010 with the top walls 1016, 1076 forming a generally continuous surface or can be vertically stacked with the laundry appliance 1010, whereby the left side walls 1012, 1072 and the right side walls 1013, 1073 each form a generally continuous surface. The single height cabinet module 1070 can have any suitable depth D, such as a depth equal to the depth D of the laundry appliance 1010. When the depth D is equal to that of the laundry appliance 1010, a footprint of the single height cabinet module 1070 is the same as that of the laundry appliance 1010. A symbol of the single height cabinet module 1070, which corresponds to the front wall 1074 of the single height cabinet module 1070 and is shown in FIG. 71B, is the same as that of the laundry appliance 1010, except for cross-hatching, which indicates that the symbol represents one of the modules 1020.

FIG. 771C depicts an intermediate height cabinet module 1080 that is defined by a space bounded by spaced left and right side walls 1082, 1083, spaced front and rear walls 1084, 1085, and spaced top and bottom walls 1086, 1087. The intermediate height cabinet module 1080 has a width W approximately equal to the width W of the laundry appliance 1010. Further, the intermediate height cabinet module 1080 has a height H approximately equal to the height of the laundry appliance 1010 vertically stacked with one or more of the horizontal modules 1030, 1040, 2050, 2060, 2070 and less than a collective height of two of the laundry appliances 1010 vertically stacked. Because the height H of the intermediate height cabinet module 1080 and the height of the laundry appliance 1010 vertically stacked with one or more of the horizontal modules 1030, 1040, 2050, 2060, 2070 are substantially equal, the intermediate height cabinet module 1080 can be positioned in a side-by-side relationship with the laundry appliance 1010 vertically stacked with one or more of the horizontal modules 1030, 1040, 2050, 2060, 2070 such that the top wall 1086 of the intermediate height cabinet module 1080 and the top wall of the laundry appliance 1010 or the one or more of the horizontal modules 1030, 1040, 2050, 2060, 2070, depending on the relative vertical positioning, form a generally continuous surface. The intermediate height cabinet module 1080 can have any suitable depth D, such as a depth equal to the depth D of the laundry appliance 1010. When the depth D is equal to that of the laundry appliance 1010, intermediate height cabinet module 1080 has a footprint that is the same as that of the laundry appliance 1010. A symbol for the intermediate height cabinet module 1080 is illustrated in FIG. 71D. The symbol corresponds to the front wall 1084 of the intermediate height cabinet module 1080, and, therefore, the shape of the symbol is determined by the width W and the height H.

FIG. 71E shows a double height cabinet module 1090 that is defined by a space bounded by spaced left and right side walls 1092, 1093, spaced front and rear walls 1094, 1095, and spaced top and bottom walls 1096, 1097. The double height cabinet module 1090 has a width W approximately equal to the width W of the laundry appliance 1010. Further, the double height cabinet module 1090 has a height H approximately equal to a height of two vertically stacked laundry appliances 1010 or approximately equal to a collective height of two of the laundry appliances 1010, i.e., the first and second laundry appliances, which can have differing individual heights. Because the height H of the double height cabinet module 1090 and the height of the two vertically stacked laundry appliances 1010 are substantially equal, the double height cabinet module 1090 can be positioned in a side-by-side relationship with the two vertically stacked laundry appliances 1010 such that the top wall 1096 of the double height cabinet module 1090 and the top wall 1016 of the upper laundry appliance 110 form a generally continuous surface. The double height cabinet module 1090 can have any suitable depth D, such as a depth equal to the depth D of the laundry appliance 1010. When the depth D is equal to that of the laundry appliance 1010, the double height cabinet module 1090 has a footprint that is the same as that of the laundry appliance 1010. A symbol for the double height cabinet module 1090 is illustrated in FIG. 71F. The symbol corresponds to the front wall 1094 of the double height cabinet module 1090, and, therefore, the shape of the symbol is determined by the width W and the height H.

The single and intermediate height vertical modules 1050, 1060 and the single and intermediate height cabinet modules 1070, 1080 are geometrically similar in that their heights H can be about equal to the height of the laundry appliance 1010 alone for the single height vertical and cabinet modules 1050, 1070 or vertically stacked with one or more of the horizontal modules 1030, 1040, 2050, 2060, 2070 for the intermediate height vertical and cabinet modules 1060, 1080. Furthermore, although not disclosed above, it is within the scope of the invention for one of the modules 1020 to be a double height vertical module, which would be a counterpart to the double height cabinet module 1090 with respect to height. The heights H of both of the double height vertical module and the double height cabinet module 1090 are about equal to that of two of the laundry appliances 1010 vertically stacked. The primary differentiating geometrical feature between the vertical modules 1050, 1060 and the cabinet modules 1070, 1080, 1090 is width. While the width of the vertical modules 1050, 1060 is less than a standard width, i.e., the width W of the laundry appliance 1010, the width W of the cabinet modules 1070, 1080, 1090 is about equal to the standard width. A possible guideline for the standard width is the table given above for the dimensions of the multiple commercially available washing machines and dryers.

In the above descriptions of the laundry appliances 1010 and of each type of the modules 1020, the laundry appliance 1010 and the modules 1020 are described as being is defined by a space bounded by walls, and in the corresponding schematic figures, the laundry appliances 1010 and the modules 1020 are represented schematically by boxes defined by the walls of the space. When the laundry appliances 1010 and the modules 1020 are box-like with six generally planar walls joined at their edges, then the walls of the space and the walls of the laundry appliance 1010 or module 1020 are effectively the same, and the walls in the schematic figures effectively correspond to the walls of the box-like laundry appliance 1010 or module 1020. However, when the laundry appliances 1010 and the modules 1020 are not box-like, the walls of the space do not necessarily conform to the walls of the laundry appliance 1010 or the module 1020. Some of the walls of the space might correspond to the walls of the laundry appliance 1010 or the module 1020, but the portion of the laundry appliance 1010 or module 1020 that causes the laundry appliance 1010 or the module 1020 to deviate from the box-like shape do not correspond to the walls of the space. Thus, the walls in the schematic figures do not necessarily correspond to the walls of the non-box-like laundry appliance 1010 or module 1020; rather, the totality of the walls used in the schematic representations of each of the non-box-like laundry appliances 1010 and modules 1020 only represents the space in which the laundry appliance 1010 or module 1020 fits.

The dimensions of the modules 1020 are described above with respect to the dimensions of the laundry appliance(s) 1010 alone or in combination with the module(s) 1020. The terminology used to describe each of the modules 1020, i.e., less than single, single, intermediate, double, and greater than double width and single, intermediate, and double height, is meant to distinguish the modules 1020 from one another and to describe the general dimensions of the modules 1020 relative to the dimensions of the laundry appliance 1010. The descriptors are not intended to require the modules 1020 to have exactly the same width or height as the laundry appliance(s) 1010 alone or in combination with the module(s) 1020. Thus, it is within the scope of the invention for the modules 1020 to have about the same width or height as the laundry appliance(s) 1010 alone or in combination with the module(s) 1020. In other words, minor deviations in width or height can be tolerated. A specific threshold for acceptance does not exist; rather, the acceptability of dimensional deviations depends on whether the deviations are sufficiently small such that they do not interfere with forming an assembly of the laundry appliances 1010 and the modules 1020 of the modular laundry system or with expanding an existing assembly of the modular laundry system by adding another one of the laundry appliances 1010 and/or modules 1020. For example, a deviation on the order of multiple inches is likely to be considered not acceptable, while deviations of fractions of an inch are more likely to be deemed acceptable. Additionally, it is within the scope of the invention to add height to the modules 1020 with a base or pedestal positioned below or above the modules 1020 so that the modules 1020 conform to the respective height requirements.

Figure 72:
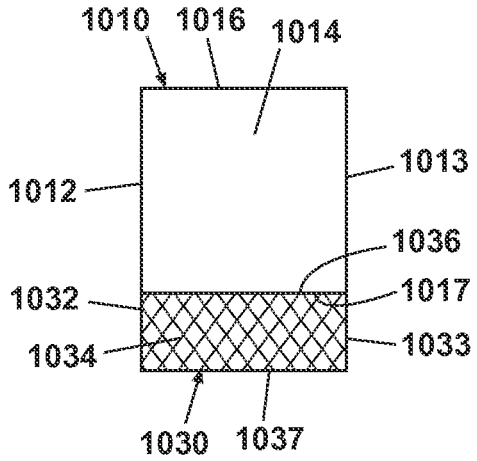
FIG. 72 is a schematic view of an arrangement of the laundry appliance of FIG. 67A and the single width horizontal module of FIG. 68A, wherein the arrangement forms generally continuous left and right side walls.

Additionally, the above description identifies arranging the modules 1020 with the laundry appliance(s) 11010 alone or in combination with the module(s) 1020 based on the relative dimensions of the laundry appliances 1010 and the modules 1020. The arrangements are formed by vertically stacking the modules 1020 with the laundry appliances 1010 or positioning the modules 1020 in side-by-side relationship with the laundry appliances 1010. Each of the arrangements calls for formation of a generally continuous surface by the side walls or the top walls, and the laundry appliances 1010 and the modules 1020 can also be arranged so that the front wall 1014 of the laundry appliance 1010 and the front walls 1034, 1044, 1054, 1064, 1074, 1084, 1094, 2054, 2064, 2074 of the modules 1020 are flush and form a generally continuous surface, regardless of whether the laundry appliances 1010 and the modules 1020 have the same or differing depths D. An example of an arrangement of the laundry appliances 1010 and the modules 1020 with generally continuous surfaces is illustrated schematically in FIG. 72. In this example, the laundry appliance 1010 is stacked with the single width horizontal module 1030 with the left side walls 1012, 1032 forming a generally continuous surface and the right side walls 1013, 1033 forming a generally continuous surface. The generally continuous surface does not require the individual walls that form the generally continuous surface to lie in the same plane; rather, it is within the scope of the invention for the walls to be slightly offset from one another.

Figure 73A:
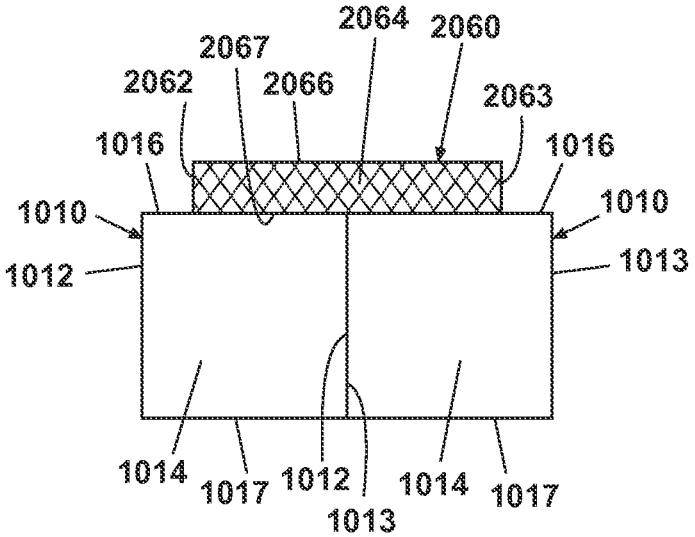
FIG. 73A is a schematic view of an arrangement of two of the laundry appliances of FIG. 67A and the intermediate width horizontal module of FIG. 70C, wherein the intermediate width horizontal module spans an interface between the laundry appliances.
Figure 73B:
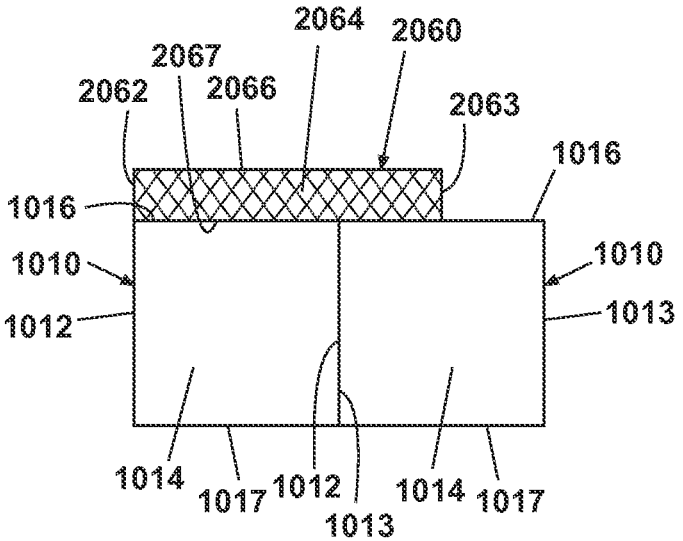
FIG. 73B is a schematic view of an arrangement of two of the laundry appliances of FIG. 67A and the intermediate width horizontal module of FIG. 70C, wherein the intermediate width horizontal module spans the interface between the laundry appliances, and the arrangement forms a generally continuous left side wall.

Other arrangements of the laundry appliances 1010 and the modules 1020 can be made without formation of the continuous surface. An example of an arrangement of the laundry appliances 1010 and the modules 1020 without formation of the generally continuous surfaces is illustrated schematically in FIG. 73A. In this example, two of the laundry appliances 1010 are arranged side-by-side with the left side wall 1013 of one of the laundry appliances 1010 adjacent to the right side wall 1012 of the other of the laundry appliances 1010 to form an interface between the laundry appliances 1010. The interface can be formed by the left and right side walls 1012, 1013 contacting one another or by a space formed between the adjacent left and right side walls 1012, 1013. The intermediate width horizontal module 2060 is stacked with the laundry appliances 1010 such that the intermediate width horizontal module 2060 spans the interface between the laundry appliances 1010. Hybrid arrangements are also contemplated, as shown schematically in FIG. 73B. In this example, two of the laundry appliances 1010 are arranged side-by-side with the left side wall 1013 of one of the laundry appliances 1010 adjacent to the right side wall 1012 of the other of the laundry appliances 1010 to form the interface between the laundry appliances 1010. The intermediate width horizontal module 2060 is stacked with the laundry appliances 1010 such that the intermediate width horizontal module 2060 spans the interface as well as forms a generally continuous surface at the left side wall 1012 of one of the laundry appliances 1010 and the left side wall 2062 of the intermediate width horizontal module 2060. In addition to the arrangements described above, the modules 1020 can be combined with the laundry appliances 1010 and other modules 1020 to form other arrangements that include and do not include formation of a generally continuous surface.

According to the invention, the laundry appliances 1010 and the modules 1020 can be arranged into core configurations, wherein each core configuration comprises a pair of the laundry appliances 1010 and one or two of the modules 1020. The core configuration can be viewed as a foundation to which other modules 1020 can be added to form more complex configurations. Examples of the core configurations are illustrated in FIGS. 74A-81B. In the following descriptions, the laundry appliances 1010 and the modules 1020 are described as being horizontally arranged, vertically arranged, or stacked. The horizontal and vertical arrangements refer to the laundry appliances 1010 and/or the modules 1020 as positioned horizontally and vertically, respectively, relative to one another in space and does not require, although it is possible, for the laundry appliances 1010 and/or the modules 1020 to be directly horizontally or vertically adjacent to one another (i.e., without an intervening laundry appliance 1010 or module 1020). The stacked descriptor is intended to be equivalent to vertically arranged and does not require the laundry appliances 1010 and/or the modules 1020 to be directly vertically adjacent to one another.

Figure 74B:
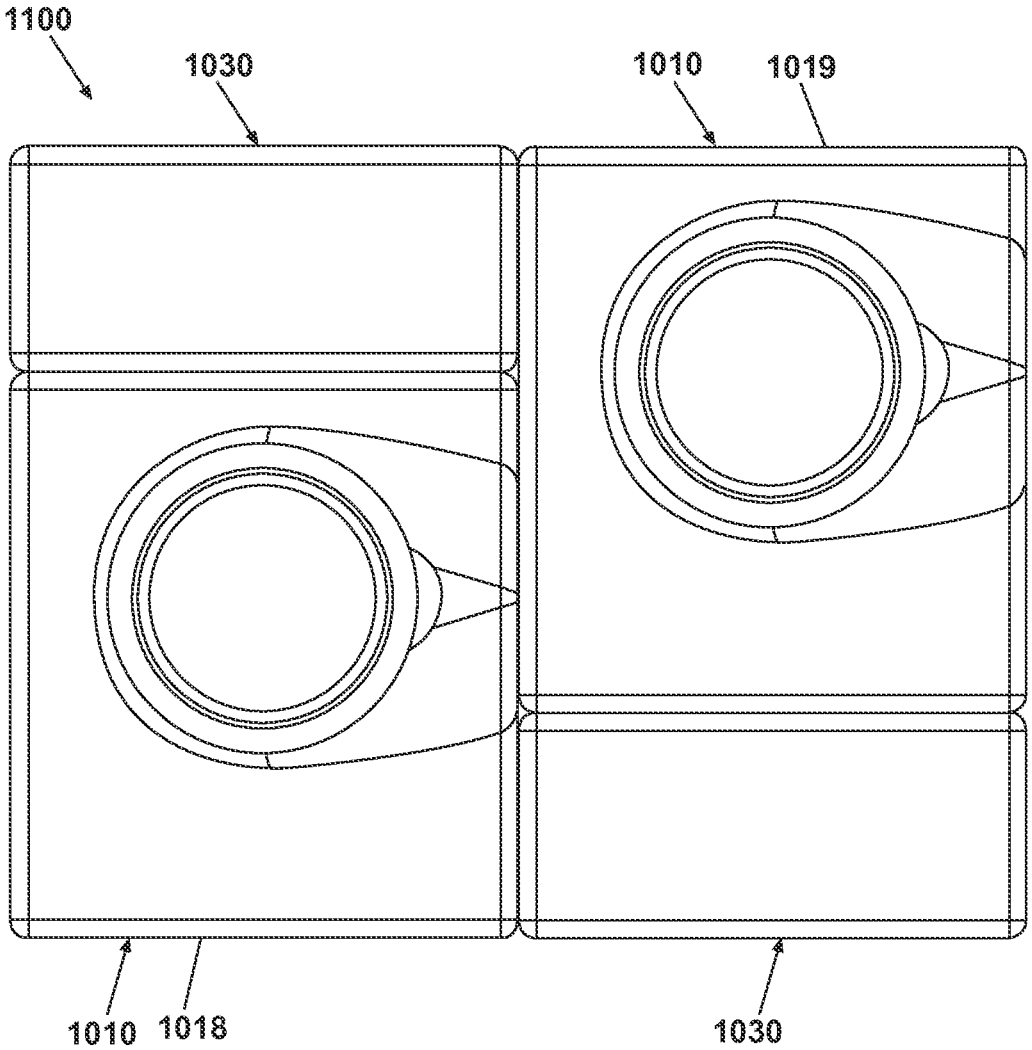
FIG. 74B is a schematic view of the core configuration A of FIG. 74A with the one of the single width horizontal modules stacked above one of the laundry appliances and the other of the single width horizontal modules stacked below the other of the laundry appliances.

FIG. 74A illustrates a core configuration A 1100 comprising two of the laundry appliances 1010, a first laundry appliance 1018 and a second laundry appliance 1019, arranged in a horizontal relationship and two of the single width horizontal modules 1030. According to the illustrated embodiment, the single width horizontal modules 1030 are each vertically stacked beneath one of the laundry appliances 1010. The single width horizontal modules 1030 can also be both vertically stacked above the respective laundry appliances 1010, or one of the single width horizontal modules 1030 can be vertically stacked above its respective laundry appliance 1010 while the other of the single width horizontal modules 1030 can be vertically stacked below its respective laundry appliance 1010, as shown in FIG. 74B.

FIG. 75 illustrates a core configuration B 1102 comprising two of the laundry appliances 1010, the first laundry appliance 1018 and the second laundry appliance 1019, arranged in a horizontal relationship and one of the double width horizontal modules 1040. According to the illustrated embodiment, the double width horizontal module 1040 is vertically stacked above and extends across both of the laundry appliances 1010. The double width horizontal module 1040 can also be described as completely spanning both of the laundry appliances 1010, as compared to the intermediate width horizontal module 2060 in the arrangement of FIG. 73A, wherein the intermediate width horizontal module 2060 partially spans both the laundry appliances 1010. The double width horizontal module 1040 can also be vertically stacked below both of the laundry appliances 1010.

FIG. 76 illustrates a core configuration R 1134 comprising two of the laundry appliances 1010, the first laundry appliance 1018 and the second laundry appliance 1019, arranged in a horizontal relationship and one of the single height vertical modules 1050 horizontally arranged relative to the first and second laundry appliances 1018, 1019. The core configuration R 1134 further comprises the greater than double width horizontal module 2070 stacked with the first and second laundry appliances 1018, 1019 and the single height vertical module 1050.

Figure 77B:
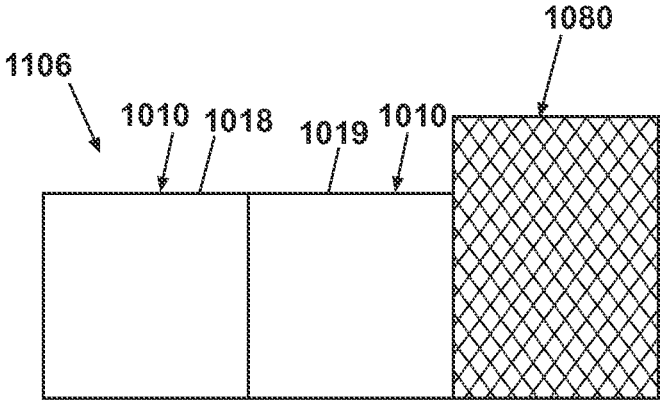
FIG. 77B is a schematic view of a core configuration D formed by two of the laundry appliances of FIG. 67A in a horizontal arrangement and the intermediate height cabinet module of FIG. 71C positioned adjacent to the laundry appliances.
Figure 77C:
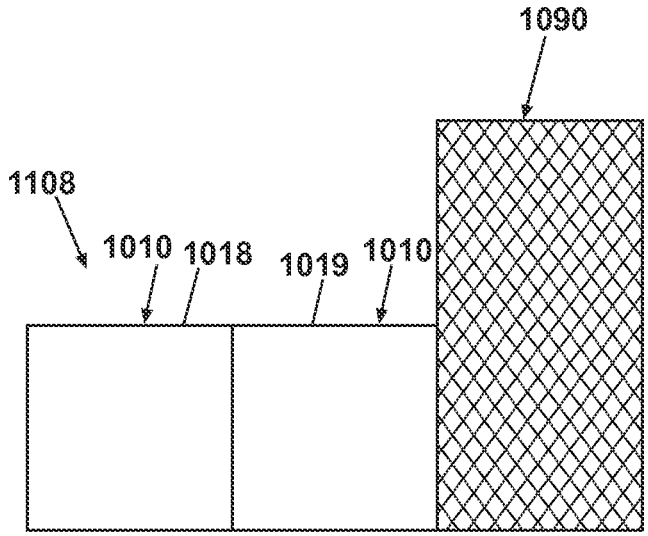
FIG. 77C is a schematic view of a core configuration E formed by two of the laundry appliances of FIG. 67A in a horizontal arrangement and the double height cabinet module of FIG. 71E positioned adjacent to the laundry appliances.

FIGS. 77A-77C illustrate core configurations comprising two of the laundry appliances 1010, the first laundry appliance 1018 and the second laundry appliance 1019, in a horizontal arrangement and one of the cabinet modules 1070, 1080, 1090 horizontally arranged relative to the first and second laundry appliances 1018, 1019. Thus, the core configurations of FIGS. 77A-77C each have a configuration footprint having a width about equal to that of three horizontally aligned laundry appliances 1010. In a core configuration C 1104, shown in FIG. 77A, the cabinet module is the single height cabinet module 1070. According to the illustrated embodiment, the first and second laundry appliances 1018, 1019 are side-by-side, and the single height cabinet module 1070 is positioned directly adjacent to only the second laundry appliance 1019. Alternatively, the single height cabinet module 1070 can be positioned directly adjacent to only the first laundry appliance 1018 or between the first and the second laundry appliances 1018, 1019. In a core configuration D 1106, shown in FIG. 77B, the cabinet module is the intermediate height cabinet module 1080. According to the illustrated embodiment, the first and second laundry appliances 1018, 1019 are side-by-side, and the intermediate height cabinet module 1080 is positioned directly adjacent to only the second laundry appliance 1019. Alternatively, the intermediate height cabinet module 1080 can be positioned directly adjacent to only the first laundry appliance 1018 or between the first and the second laundry appliances 1018, 1019. In a core configuration E 1108, shown in FIG. 77C, the cabinet module is the double height cabinet module 1090. According to the illustrated embodiment, the first and second laundry appliances 1018, 1019 are side-by-side, and the double height cabinet module 1090 is positioned directly adjacent to only the second laundry appliance 1019. Alternatively, the double height cabinet module 0190 can be positioned directly adjacent to only the first laundry appliance 1018 or between the first and the second laundry appliances 1018, 1019.

Figure 78C:
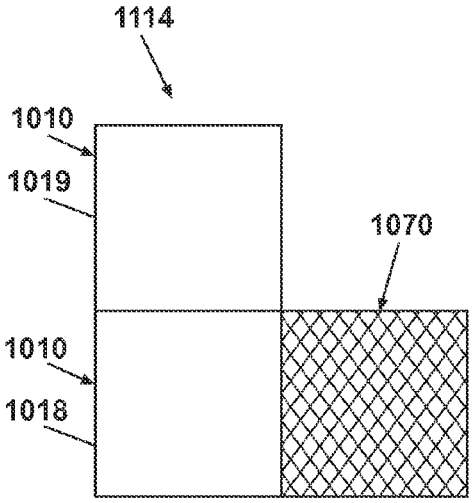
FIG. 78C is a schematic view of a core configuration H formed by two of the laundry appliances of FIG. 67A in a vertical arrangement and the single height cabinet module of FIG. 71A positioned adjacent to the laundry appliances.
Figure 78D:
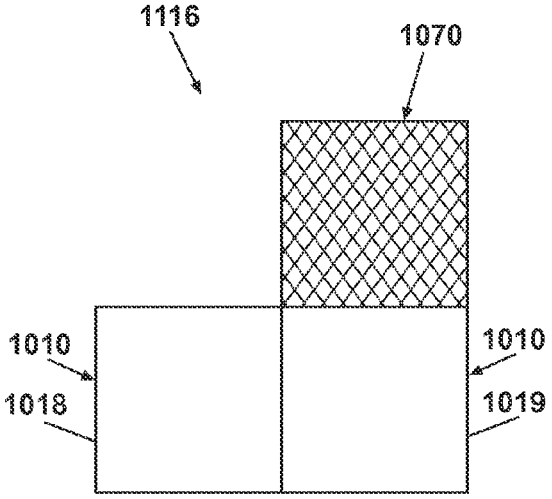
FIG. 78D is a schematic view of a core configuration I formed by two of the laundry appliances of FIG. 67A in a horizontal arrangement and the single height cabinet module of FIG. 71A vertically stacked with one of the laundry appliances.

FIGS. 78A-78D illustrate core configurations comprising two of the laundry appliances 1010, the first laundry appliance 1018 and the second laundry appliance 1019, in either a horizontal or vertical arrangement and one of the cabinet modules 1070, 1080, 1090 arranged relative to the first and second laundry appliances 1018, 1019 to form a configuration footprint having width about equal to that of two horizontally arranged laundry appliances 1010 or that of one of the laundry appliances 1010 horizontally arranged with one of the cabinet modules 1070, 1080, 1090. In a core configuration F1 110, shown in FIG. 78A, the cabinet module is the double height cabinet module 1090, and the first and second laundry appliances 1018, 1019 are vertically stacked adjacent to the cabinet module 1090. In the illustrated embodiment, the double height cabinet module 1090 is on the right side of the first and second laundry appliances 1018, 1019, but the double height cabinet module 1090 can be located on the left side of the first and second laundry appliances 1018, 1019. A core configuration G 1112, shown in FIG. 78B, and a core configuration H 1114, illustrated in FIG. 78C, are similar to the core configuration F 1110, except that the cabinet module is the intermediate height cabinet module 1080 and the single height cabinet module 1070, respectively. In a core configuration I 1116, depicted in FIG. 78D, the first and second laundry appliances 1018, 1019 are horizontally arranged, and the cabinet module, which is the single height cabinet module 1070, is vertically stacked on top of the second laundry appliance 1019. Alternatively, the single height cabinet module 1070 can be stacked on top of the first laundry appliance 1018 or below either of the first and second laundry appliances 1018, 1019.

Figure 79A:
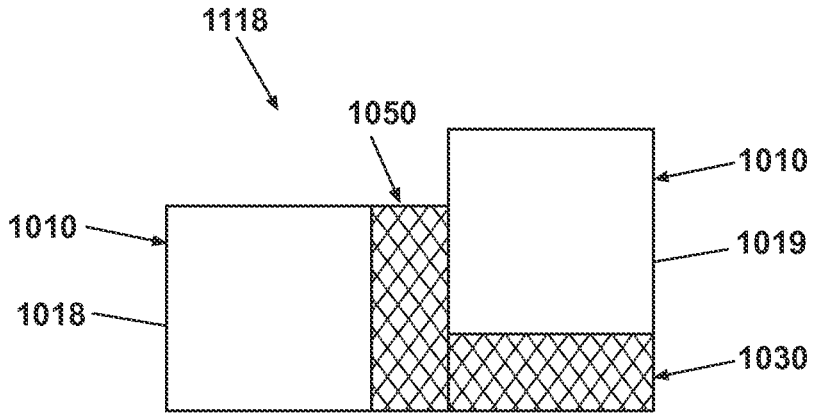
FIG. 79A is a schematic view of a core configuration J formed by two of the laundry appliances of FIG. 67A in a horizontal arrangement, the single height vertical module of FIG. 69A positioned adjacent to the laundry appliances, and the single width horizontal module of FIG. 68A vertically stacked with one of the laundry appliances.
Figure 79B:
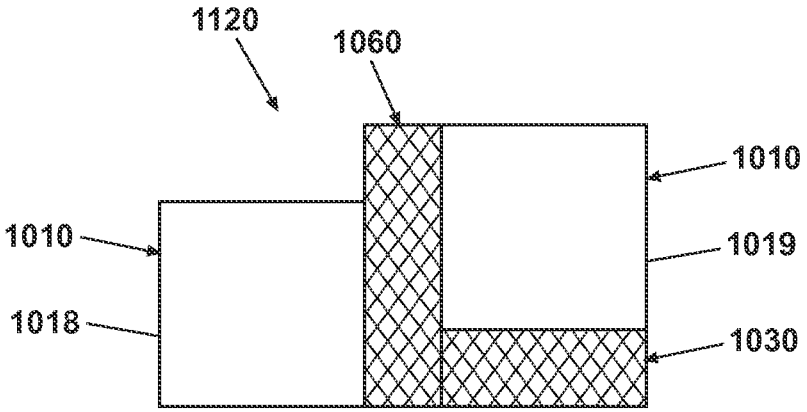
FIG. 79B is a schematic view of a core configuration K formed by two of the laundry appliances of FIG. 67A in a horizontal arrangement, the double height vertical module of FIG. 69C positioned adjacent to the laundry appliances, and the single width horizontal module of FIG. 68A vertically stacked with one of the laundry appliances.

FIGS. 79A and 79B illustrate core configurations comprising two of the laundry appliances 1010, the first laundry appliance 1018 and the second laundry appliance 1019, one of the single width horizontal modules 1030, and one of the vertical modules 1050, 1060. In both of the figures, the first and second laundry appliances 1018, 1019 are horizontally arranged with the single width horizontal module 1030 located below the second laundry appliance 1019. Alternatively, the single width horizontal module 1030 can be positioned above the second laundry appliance 1019 or above or below the first laundry appliance 1018. In a core configuration J 1118, shown in FIG. 79A, the vertical module is the single height vertical module 1050. In the illustrated embodiment, the single height vertical module 1050 is located between the first and second laundry appliances 1018, 1019. Alternatively, the single height vertical module 1050 can be positioned to the left of the first laundry appliance 1018 or to the right of the second laundry appliance 1019. In a core configuration K 1120, depicted in FIG. 79B, the vertical module is the intermediate height vertical module 1060. In the illustrated embodiment, the intermediate height vertical module 1060 is located between the first and second laundry appliances 1018, 1019. Alternatively, the intermediate height vertical module 1060 can be positioned to the left of the first laundry appliance 1018 or to the right of the second laundry appliance 1019. Regardless of the relative positioning of the modules 1050, 1060 in the core configuration J 1118 and the core configuration K 1120, each of the core configurations J and K 1118, 1120 have a configuration footprint having a width about equal to the width of two side-by-side laundry appliances 1010 plus the width of the single or intermediate height vertical module 1050, 1060. Because the vertical modules 1050, 1060 each have a width less than that of the laundry appliance 1010, the configuration footprint is wider than that of two side-by-side laundry appliances 1010 but less wide than that of three side-by-side laundry appliances 1010.

FIGS. 80A-80C illustrate core configurations comprising two of the laundry appliances 1010, the first laundry appliance 1018 and the second laundry appliance 1019, in a horizontal arrangement and two of the vertical modules 1050, 1060. In a core configuration L 1122, shown in FIG. 80A, both of the vertical modules are the single height vertical modules 1050. In the illustrated embodiment, the single height vertical modules 1050 are arranged with one on the left side of the first laundry appliance 1018 and the other on the right side of the second laundry appliance 1019; thus, the single height vertical modules 1050 are located on the ends of the core configuration L 1122. Alternatively, the single height vertical modules 1050 can be positioned with both between the first and second laundry appliances 1018, 1019, both to the left side of the first laundry appliance 1018, both to the right side of the second laundry appliance 1019, or one between the laundry appliances 1018, 1019 and the other either on the left side of the first laundry appliance 1018 or on the right side of the second laundry appliance 1019. A core configuration M 1124, shown in FIG. 80B, and a core configuration N 1126, illustrated in FIG. 80C, are similar to the core configuration L 1122, except that the two vertical modules are, for the former, the single height vertical module 1050 and the intermediate height vertical module 1060, or, for the latter, two of the intermediate height vertical modules 1060. Regardless of the relative positioning of the modules 1050, 1060 and the laundry appliances 1018, 1019 in the core configurations L, M, N 1122, 1124, 1126, the configuration footprint has a width about equal to the width of two side-by-side laundry appliances 1010 plus the width of the two vertical modules 1050, 1060.

FIGS. 81A-81C illustrate core configurations comprising two of the laundry appliances 1010, the first laundry appliance 1018 and the second laundry appliance 1019, in a vertical arrangement and two of the vertical modules 1050, 1060. In a core configuration O 1128, shown in FIG. 81A, both of the vertical modules are the single height vertical modules 1050. In the illustrated embodiment, the single height vertical modules 1050 are arranged with both on the right side of the stacked laundry appliances 1010. Alternatively, the single height vertical modules 1050 can be positioned with both on the left side of the stacked laundry appliances 1010, or one on each side of the stacked laundry appliances 1010. A core configuration P1 130, shown in FIG. 81B, and a core configuration Q 1132, illustrated in FIG. 81C, are similar to the core configuration O 1128, except that the two vertical modules are, for the former, the single height vertical module 1050 and the intermediate height vertical module 1060, or, for the latter, two of the intermediate height vertical modules 1060. Regardless of the relative positioning of the modules 1050, 1060 and the laundry appliances 1018, 1019 in the core configurations O, P, Q 1128, 1130, 1132, the configuration footprint has a width about equal to the width of a single laundry appliance 1010 plus the width of the two vertical modules 1050, 1060.

When adding the modules 1020 to the laundry appliances 1010 to form the core configurations, the horizontal modules 1030, 1040, 2050, 2060, 2070 add height to the laundry appliance 1010, the vertical modules 1050, 1060 add width to the laundry appliance 1010, and the cabinet modules 1070, 1080, 1090 add width to the laundry appliance 1010 when horizontally arranged with the laundry appliance 1010 (e.g. the core configurations C-H 1104-1114) and add height to the laundry appliance 1010 when vertically arranged with the laundry appliance 1010 (e.g., the core configuration I 1116). Thus, the core configuration can be selected according to the spatial limitations of the particular laundry area in which the modular laundry system is used. For example, if the laundry area has only extra width next to the laundry appliances 1010, then the core configurations having only the vertical modules 1050, 1060 or the cabinet modules 1070, 1080, 1090 (except the core configuration I 1114) can be employed. The core configurations that fall into this group are the core configurations C-H 1104-1114 and the core configurations L-Q 1122-1132. Alternatively, if the laundry area has only extra height above the laundry appliances 1010, then the core configurations having only the horizontal modules 1030, 1040, 2050, 2060, 2070 which are the core configurations A, B 1100, 1102, or the core configuration I 1114, where the single height cabinet module 1070 is vertically stacked with one of the laundry appliances 1010, can be utilized. In another scenario, if the laundry area has extra width next to and extra height above the laundry appliances 1010, then any of the core configurations A-R 1100-1134 can be employed as long as the core configuration fits within the spatial limitations of the laundry area. Further, any of the core configurations A-R 1100-1134 can be used if the laundry area does not have substantial spatial limitations.

As stated above, the modules 1020 can be added to the core configurations A-R 1100-1134 to form more complex configurations that are customized according to the preferences of a user and to optimize the space of the laundry area. By using the core configurations A-R 1100-1134 and the other modules 1020 as building blocks, numerous customized configurations can be constructed. The modules 1020 that are added to the core configurations A-R 1100-1134 to form the customized configurations can depend on whether height or width or both is available in the laundry area. When adding the modules 1020 to the core configurations to create the customized configurations, the horizontal modules 1030, 1040, 2050, 2060, 2070 add height to the laundry appliances 1010 and/or the modules 1020 (i.e., the horizontal modules 1030, 1040, 2050, 2060, 2070 can be stacked with other modules 1020 in addition to being stacked with the laundry appliances 1010), the vertical modules 1050, 1060 add width to the laundry appliances 1010 and/or the modules 1020, and the cabinet modules 1070, 1080, 1090 add width to the laundry appliances 1010 and/or the modules 1020 when horizontally arranged with the laundry appliances 1010 and/or the modules 1020 and add height to the laundry appliance 1010 when vertically arranged with the laundry appliances 1010 and/or the modules 1020. If the space of the laundry area is not limited, then any of the modules 1020 can be added to the core configurations A-R 1100-1134. Examples of customized configurations are illustrated in FIGS. 82A-88C.

Figure 82B:
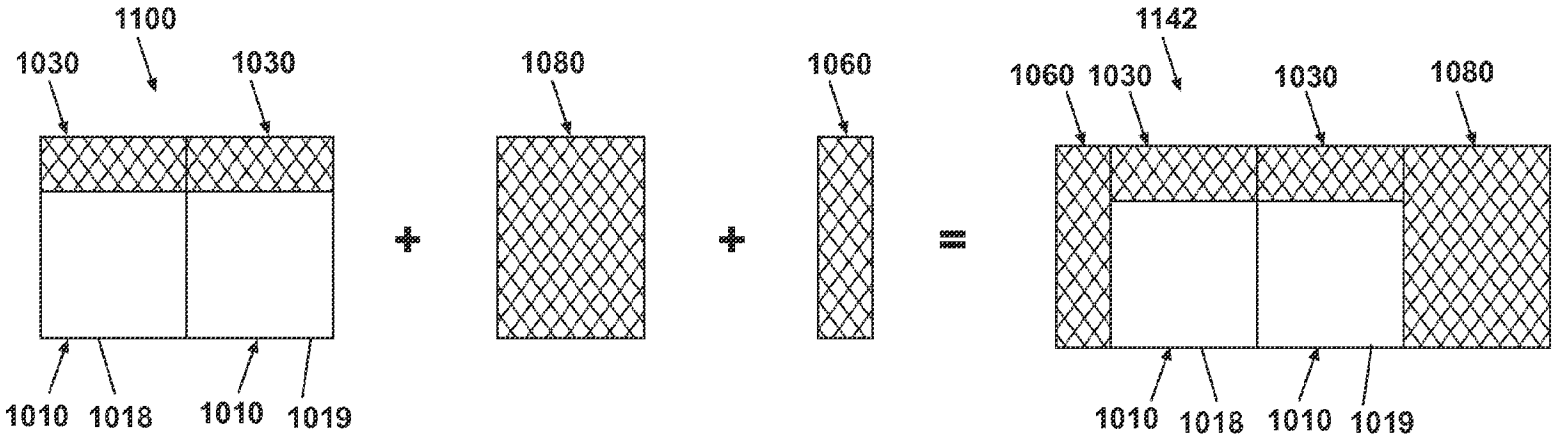
FIG. 82B is a schematic view illustrating construction of a customized configuration B formed from the core configuration A of FIG. 74A.

FIG. 82A schematically represents the construction of a customized configuration A 1140 having the core configuration A 1100 as the foundation. The customized configuration A 1140 is formed by adding the single height cabinet module 10 70 and the single width horizontal module 1030 to the core configuration A1 100. A customized configuration B 1142, shown in FIG. 82B, is also created with the core configuration A 1100. The customized configuration B 1142 is formed by adding the intermediate height cabinet module 1080 and the intermediate height vertical module 1060 to the core configuration A 1100.

Inspection of the customized configurations A, B 1140, 1142 reveals that a particular customized configuration can be formed from more than one of the core configurations. For example, the customized configuration A 1140 can be created from the core configuration A 1100, as described above, or the core configuration C 1104. Adding three of the single width modules 1030 to the core configuration C 1104 achieves the customized configuration A 1140. Similarly, the customized configuration B 1142 can be formed from the core configuration D 1106 rather than the core configuration A 1100. This is the case for many of the customized configurations shown in FIGS. 82A-88C, but each one will only be described with respect to one of the core configurations A-R 1100-1134.

Figure 83A:
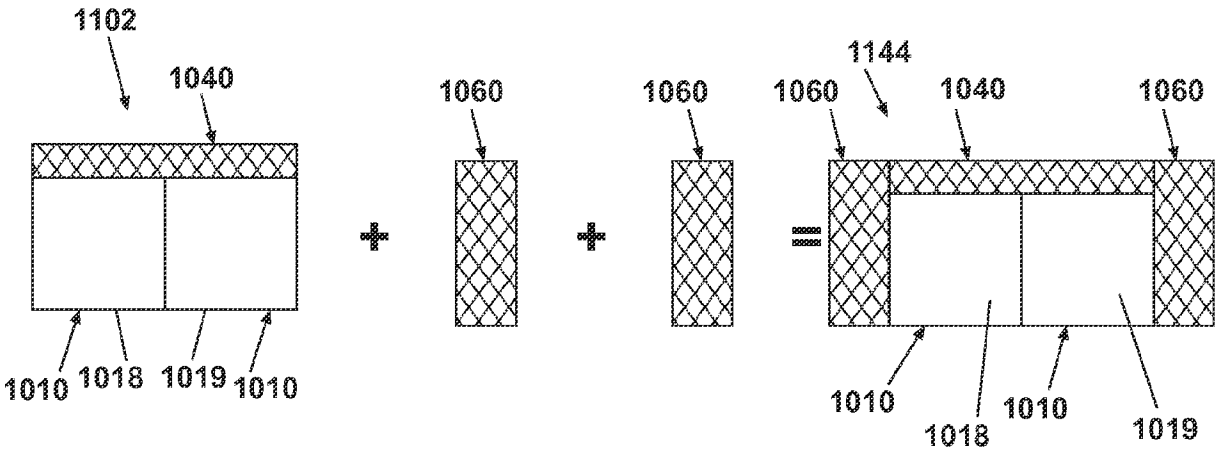
FIG. 83A is a schematic view illustrating construction of a customized configuration C formed from the core configuration B of FIG. 75.
Figure 83B:
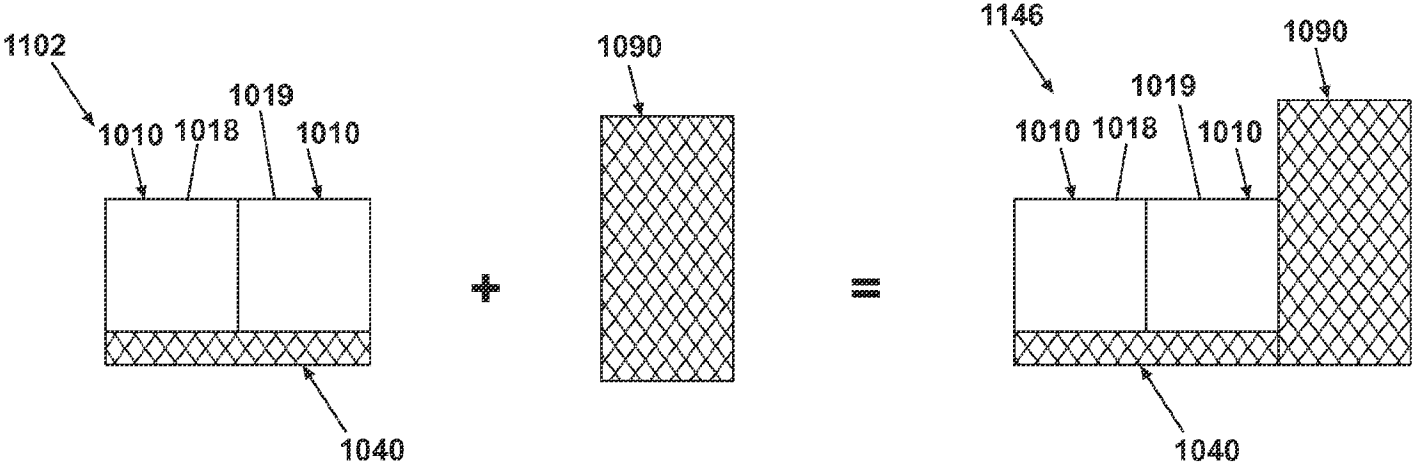

FIGS. 83A and 83B represent construction of a customized configuration C 1144 and a customized configuration D 1146, respectively, from the core configuration B 1102. The customized configuration C 1144 is formed by adding two of the intermediate height vertical modules 60 to the core configuration B 1102, while the double height cabinet module 1090 is added to the core configuration B 1102 to create the customized configuration D 1146.

FIGS. 84A-84C schematically illustrate construction of customized configurations E, F, G 1148, 1150, 1152, respectively, from the core configurations C, D, E 1104, 1106, 1108, which comprise two of the laundry appliances 1010 in a vertically stacked arrangement and horizontally arranged with one of the cabinet modules 1070, 1080, 1090. As shown in FIG. 84A, the single height vertical module 1050 combined with the core configuration C 1104 forms the customized configuration E 1148. Referring now to FIG. 84B, the core configuration D 1106 plus the intermediate height vertical module 1060 and two of the single width horizontal modules 1030 results in the customized configuration F 1150. The customized configuration G 1152 can be formed by adding two of the single height cabinet modules 1070 to the core configuration E 1108, as illustrated in FIG. 84C.

Figure 85A:
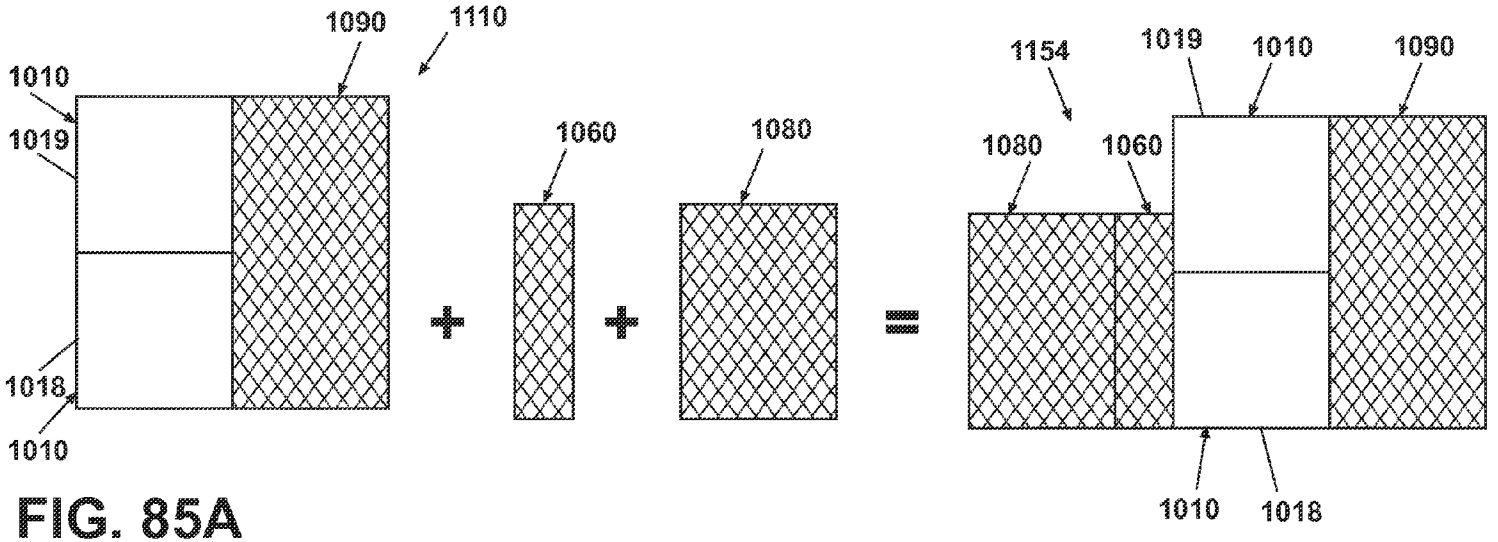
Figure 85B:
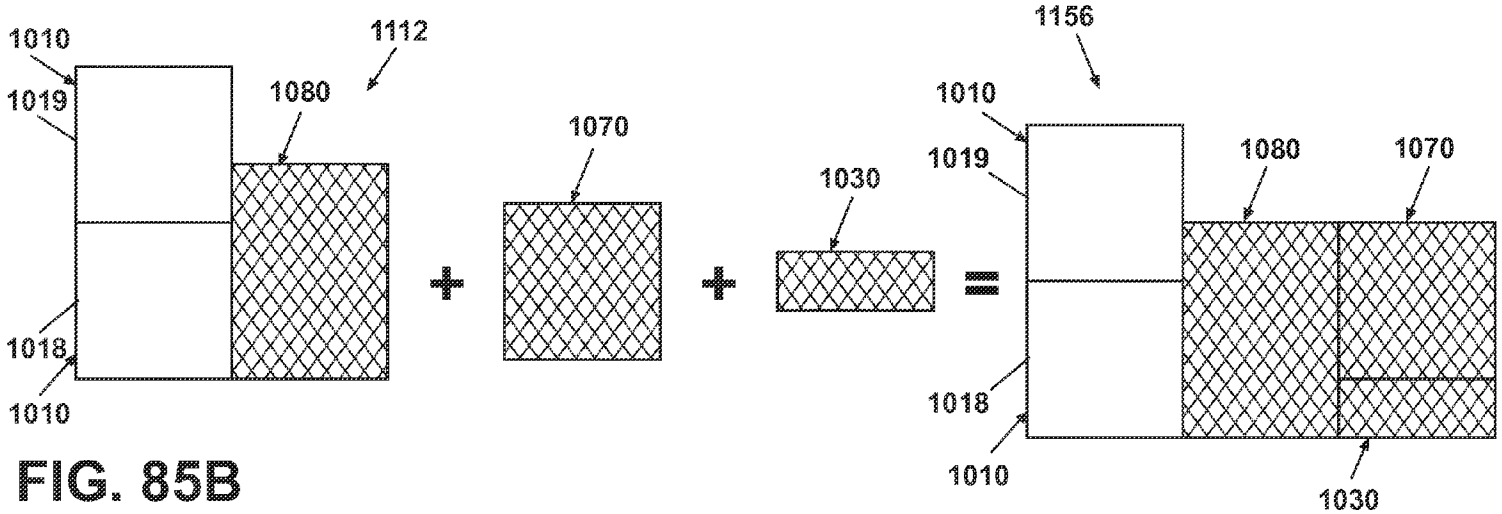
Figure 85C:
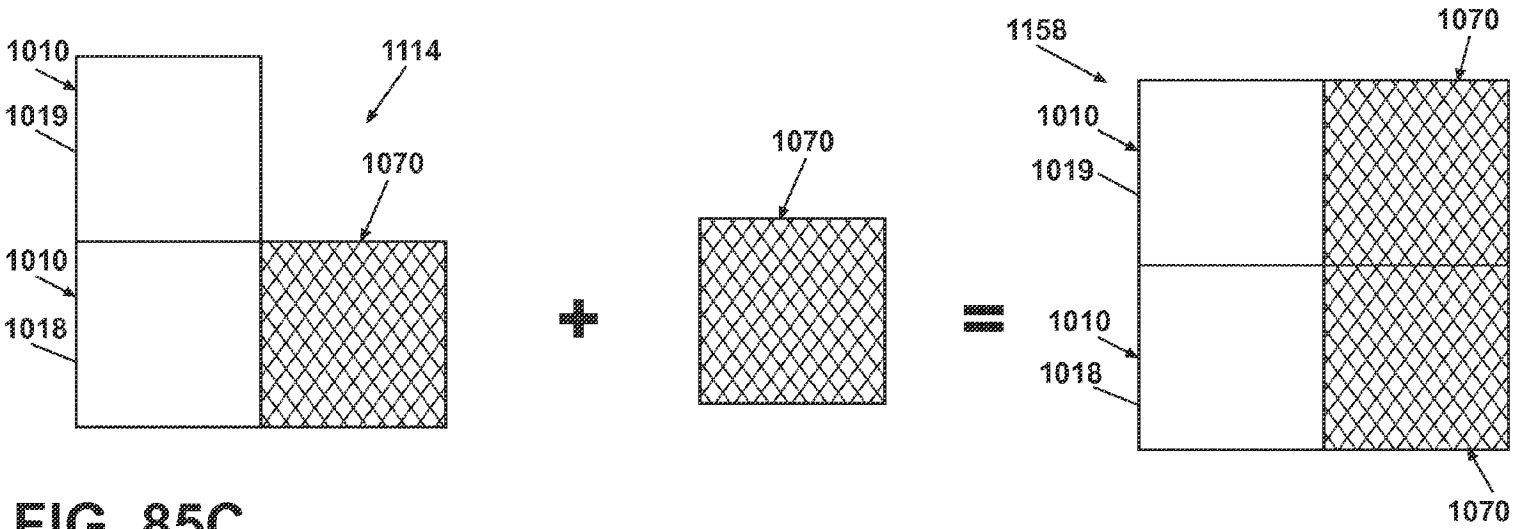
Figure 85D:
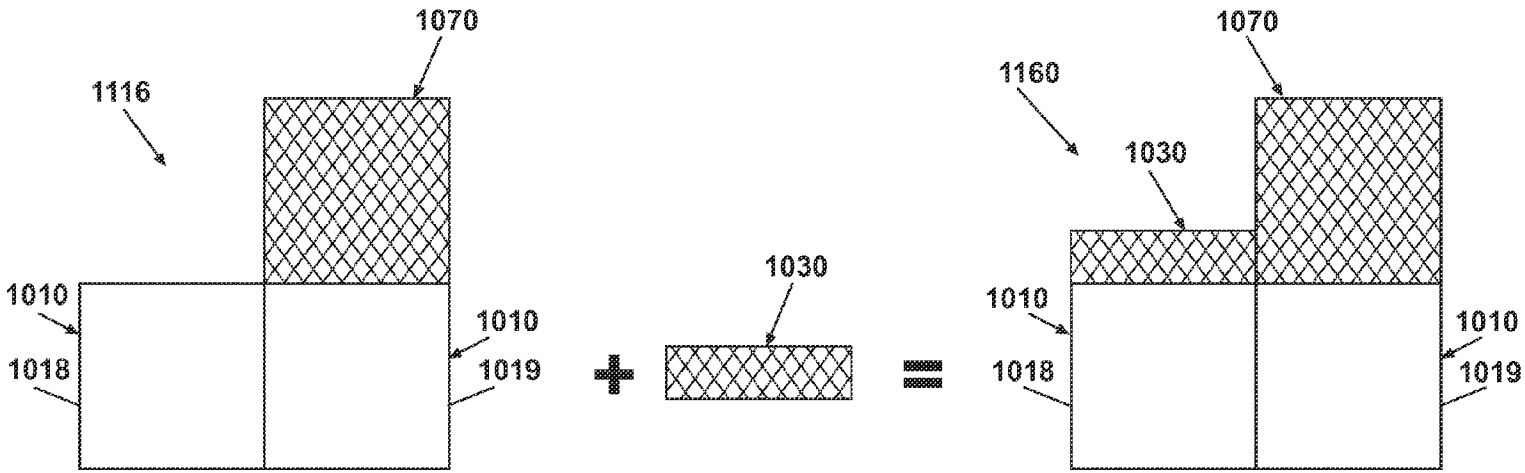

FIGS. 85A-85D represent construction of customized configurations with the core configurations F, G, H, I 1110, 1112, 1114, 1116, which each comprise two of the laundry appliances 1010 and one of the cabinet modules 1070, 1080, 1090 and have the configuration footprint of two of the laundry appliances 1010 in a side-by-side arrangement. FIG. 85A shows a customized configuration H 1154 formed by the core configuration F 1110, the intermediate height vertical module 1060, and the intermediate height cabinet module 1080. The core configuration G 1112 can be combined with the single height cabinet module 1070 and the single width horizontal module 1030 to form a customized configuration I 1156, as illustrated in FIG. 85B. Referring now to FIG. 85C, adding the single height cabinet module 1070 to the core configuration H 1114 results in the customized configuration J 1158. Finally, as shown in FIG. 85D, a customized configuration K 1160 is created by combining the core configuration I 1116 with the single width horizontal module 1030.

FIGS. 86A and 86B schematically illustrate construction of a customized configuration L 1162 and a customized configuration M 1164, respectively, from the core configuration J 1118 and the core configuration K 1120, respectively. The customized configuration L 1162 can be formed by adding the intermediate width horizontal module 2060 to the core configuration J 1118, while adding the single width horizontal module 1030 to the core configuration K 1120 results in the customized configuration M 1164.

FIGS. 87A-87C show construction of customized configurations based on the core configurations L, M, N 1122, 1124, 1126, which all comprise two of the laundry appliances 1010 in a horizontal arrangement and two of the vertical modules 1050, 1060. A customized configuration N 166, illustrated in FIG. 87A, can be formed by adding the double width horizontal module 1040 to the core configuration L 1122. Alternatively, the double with horizontal module 1040 can be replaced with, for example, the greater than double width horizontal module 2070, which can span the laundry appliances 1010 and the single height vertical modules 1050. Referring now to FIG. 87B, the single width horizontal module 1030 can be combined with the core configuration M 1124 to create a customized configuration O 1168, while two of the single width horizontal modules 1030 can be added to the core configuration N 1126 to construct a customized configuration P 1170, as shown in FIG. 87C. In the customized configuration P 1170, the two single width horizontal modules 1030 can easily be replaced with, for example, the double width horizontal module 1040.

FIGS. 88A-88C schematically illustrate construction of customized configurations based on the core configurations O, P, Q 1128, 1130, 1132, which all comprise two of the laundry appliances 1010 in a vertical arrangement and two of the vertical modules 1050, 1060. Adding the double height cabinet module 1090 to the core configuration O 1128 results in a customized configuration Q 1172, as shown in FIG. 88A. A customized configuration R 1174, as illustrated in FIG. 88B, can be formed by combining the core configuration P 1130 with the intermediate height cabinet module 1070. Further, the intermediate height cabinet module 1070 can be added to the core configuration Q 1132 to obtain a customized configuration S 1176, which is shown in FIG. 88C.

The modules 1020 and the core and customized configurations created from the modules 1020 and the laundry appliances 1010 have thus far been described with respect to their geometry. As stated above, the modules 1020 can also be characterized according to their function. The modules 1020 can comprise one or more functional elements or functional structures that perform or carry out the function. In general, the functions for the modules 1020 can be grouped according to laundry care functions and non-laundry care functions.

The laundry care functions are functions that are associated with an aspect of treating the laundry. Exemplary laundry care functions include, but are not limited to, washing, drying, refreshing, sanitizing, stain removal, ironing, hand steaming, and sink. The washing function corresponds to subjecting a fabric item to a wash process wherein wash liquid is used to clean the fabric item, such as in a washing machine specifically suited for delicate items, including lingerie and sweaters. The drying function relates to evaporation of liquid from a fabric item by subjecting the fabric item to forced air, which can optionally be heated. The fabric item can be laid flat for non-tumble drying.

The refreshing function involves exposing the fabric item to a refreshing medium for wrinkle removal and/or odor removal of the fabric item without fully washing the fabric item. The refreshing function thereby improves the appearance and smell of the fabric item. The sanitizing function is similar to the refreshing function, except that the fabric item is exposed to a sanitizing medium that disinfects the fabric item by removal of germs, microbes, and the like. The refreshing and sanitizing functions can be performed independently of one another or simultaneously. For example, the fabric item can be exposed to steam, which can reduce wrinkles and odors from clothing (the refreshing function) while removing germs (the sanitizing function), or the fabric item can be exposed to air containing a material that imparts a pleasant scent, such as in the form of a cool mist, to the fabric item (the refreshing function). The refreshing and/or sanitizing functions can utilize misting technologies, which can use nebulizers that incorporate chemicals that remove wrinkles, odors, germs, microbes, and combinations thereof.

The stain removal function corresponds to treating a stained area of the fabric item to remove the stain without washing the fabric item or to reduce the severity of the stain prior to washing the fabric item. The ironing and hand steaming functions relate to removing wrinkles from the fabric item with an iron and a hand steamer, respectively. The sink function can involve several processes, such as soaking the fabric item to wash the fabric item or to treat a stain prior to washing or simply wetting the fabric item. While any of the modules 1020 can be associated with any of the laundry care functions, a table in FIG. 89 indicates the laundry care functions that are especially suited for particular modules 1020.

The non-laundry care functions are functions that are not associated with an actual treatment of the laundry. Examples of non-laundry care functions are storage, garbage and recycling collection, shelving, laundry sorting, hanging, bulk dispensing, resource management, resource supply and/or recovery/reclamation, resource treatment, lighting, refrigeration, entertainment, pet care, data collection and communication, home automation, home security, home safety, power outlet and supply, and module controller.

The storage function relates to storing anything, whether related to laundry care or to something else. Some items that are commonly stored in the laundry area are detergents, bleach, fabric softeners, irons, stain pre-treatment products, and household cleaning products. The items can be stored in an enclosed space so that the items are not visible unless accessed by the user, such as by opening a drawer or a door, or the items can be staged in a location that is exposed and readily available to the user without having to perform an action to make the items visible. Garbage and recycling collection are similar to storage, but the storage is specifically designated for the collection of garbage and recyclable materials. The shelving function corresponds to providing a generally horizontal surface that can optionally be retracted when not in use and extended when used for numerous purposes, including, but not limited to, sorting laundry, folding fabric items, and supporting a laundry basket. The hanging function relates to providing a location to hang a fabric item, either directly on the location or through a hanger supported at the location. Any of the modules 1020 can be associated with any of the non-laundry care functions. The laundry sorting function can relate to the shelving function, as described above, or to a plurality of bins designated for particular types of laundry. The bins can be differentiated based on type of fabric, such as delicates or regular, or color of the fabric items, such as lights or darks.

The bulk dispensing function is used in conjunction with the laundry appliance 1010 and relates to storing a bulk supply of detergent or other chemicals and dispensing a charge of the detergent or other chemicals to the laundry appliance 1010 upon request from the laundry appliance 1010. In this case, the bulk supply is considered to be an amount greater than the charge. The resource management function deals with managing electrical and/or water supply to the laundry appliances 1010 and/or to the other modules 1020 and/or to other areas of the home. The available electrical and water resources can be managed to ensure that the laundry appliances 1010 and the modules 1020 properly function without detrimentally affecting the performance of the other laundry appliances 1010 and the other modules 1020. The resource supply and/or recovery/reclamation function relates to providing resources to the laundry appliance 1010 and/or the modules 1020 and/or reclaiming the resources from the laundry appliance 1010 and/or the modules 1020. For example, the reclamation unit of the aforementioned non-aqueous washing apparatus performs the resource supply and/or recovery/reclamation function. Other examples of this function include, but are not limited to, water supply and recovery and suds and additive recovery. The resource treatment function relates to treating a resource that is supplied to the laundry appliance 1010 and/or the modules 1020. Examples of the treatment include, but are not limited to, water heating, water filtering, and water softening.

The lighting function corresponds to providing illumination either as general lighting to the laundry area or as task lighting to a specific area of the laundry appliance 1010 and/or the module 1020 for performing a particular task. For example, the task lighting can include a black light to facilitate identification of spots and stains on fabric items. The refrigeration function relates to cooling a chamber in the module 1020 so that items, such as food items, can be stored in the cooled chamber and kept at a desired temperature. The entertainment function relates to providing audio and/or visual media that entertains a user. Examples of components that can be integrated into or mounted to the module 1020 for providing the entertainment function include, but are not limited to, a television, a video player, such as a VCR, DVD player, and DVR, or an audio player, such as a radio, a cassette player, a record player, a CD player, and a digital music player, such as an MP3 player. The pet care function corresponds to providing food or water to a household pet or a location where the household pet can urinate or defecate, such as a kitty litter.

The data collection and communication function corresponds to receiving data from the laundry appliance 1010 and/or the module 1020 related to the operation of the laundry appliance 1010 and/or the module 1020 and communicating the data, such as through a network, to a computer or other device. The home automation function relates to participating in a system for controlling operation of various devices in the home. For example, several devices, including the laundry appliance 1010 and the module 1020, can be included in the system and controlled remotely or automatically. The home security function relates to providing a home security system to detect intruders in the home, and the home safety function relates to detecting harmful substances, such as fire and smoke detection and carbon monoxide detection. The power outlet function corresponds to providing an electrical plug receptacle into which various electronic devices can be plugged for receiving power. The power can be provided by an external power supply, such as the main power supply for the home, or a compact power supply, such as a battery stored in the module 1020. The module controller function relates to providing a user-interactive control panel for controlling operation of the module 1020. The control panel can receive input from the user, such as input regarding desired operational modes for the module 1020, and can communicate output to the user, such as output related to the operational status of the module 1020 and/or the laundry appliance 1010.

Each of the modules 1020 can have one or more of the laundry care functions, one or more of the non-laundry care functions, or a combination of the laundry care and the non-laundry care functions. Some of the laundry care functions are more suited for being combined together than others. For example, the refreshing and sanitizing functions are strong candidates for being integrated together into one of the modules 1020, and these two functions can also be combined either separately or together with the drying function. Another exemplary combination of the laundry care functions is the drying function and the hand steaming or ironing function. In this case, the module 1020 can be designed for the drying function and include a built-in ironing or hand-steaming station. Furthermore, any of the laundry care functions can easily be integrated with the non-laundry care functions of storage and hanging.

Examples of the modules 1020 having the laundry care functions, the non-laundry care functions, or combinations thereof are shown in FIGS. 90A-102B. In the following descriptions of the modules 1020 in FIGS. 90A-102B, the functional elements/structures that provide the corresponding laundry care and/or laundry care functions are at least partially described. The modules 1020 in these figures are provided for illustrative purposes and are not intended to limit the invention in any manner. It is within the scope of the invention for the modules 1020 to differ in structure from the particular embodiments of FIGS. 90A-102B while remaining within the general limitations described above for the modules 1020 and to have functions other than those of FIGS. 90A-102B. Furthermore, the modules 1020 of FIGS. 90A-102B are named below according to the function or one of the functions associated with the module 1020 to differentiate the modules 1020 from one another. The naming of the modules 1020 according to the function is not intended to limit the invention in any manner.

FIGS. 90A and 90B show an embodiment of a washing function single width horizontal module 1200. The particular embodiment of the washing function single width horizontal module 1200 shown in FIGS. 90A and 90B is adapted for gentle washing delicate fabric items. The washing function single width horizontal module 1200 comprises an open-face cabinet 1202 and an open-top drawer 1204 slidably mounted to the cabinet 1202. The drawer 1204 supports an imperforate tub 1206, a perforated open-top wash basket 1208 rotatably mounted within the tub 1206 and defining a wash chamber 1210, and a detergent dispenser 1212 located adjacent to the tub 1206. The drawer 1204 is movable relative to the open face of the cabinet 1202 between a closed position, as shown in FIG. 90A, where the drawer 1204 closes the open face of the cabinet 1202 and the wash chamber 1210 is inaccessible, and an opened position, as illustrated in FIG. 90B, where the drawer 1204 extends forwardly from the cabinet 1202 and the user can access the wash chamber 1210. The user can select a desired wash cycle through a control panel 1214 mounted on the drawer 1204.

According to one embodiment, the washing function single width horizontal module 1200 has a low capacity relative to a capacity of the laundry appliance 1010. Although the washing function single width horizontal module 1200 can be used for any small volume loads of fabric items, the washing function single width horizontal module 1200 can be designed for gentle washing fabric items that require special care, such as fabric items that are intended to be hand washed or washed in a delicate wash cycle.

FIGS. 91A and 91B illustrate an embodiment of a drying function single width horizontal module 1250, which comprises an open-face cabinet 1252 and an open-top drawer 1254 slidably mounted to the cabinet 1252. The drawer 1254 defines an open-top drying chamber 1256 through which forced air can flow to dry fabric items. The fabric items can be positioned on a drying rack 1258 removably mounted in the drying chamber 1256. The drying rack 1258 comprises a rack frame 1260 that supports a mesh panel 1262 through which the forced air can flow. The drawer 1254 is movable relative to the open face of the cabinet 1252 between a closed position, as shown in FIG. 91A, where the drawer 1254 closes the open face of the cabinet 1252 and the drying chamber 1256 is inaccessible, and an opened position, as illustrated in FIG. 91B, where the drawer 1254 extends forwardly from the cabinet 1252 and the user can access the drying chamber 1256. The user can select a desired drying cycle through a control panel 1264 mounted on the drawer 1254. The refreshing and/or sanitizing functions can be incorporated into the drying function single width horizontal module 1250 or can replace the drying function, if desired.

FIGS. 92A and 92B illustrate an embodiment of a drying function double width horizontal module 300 comprising an open-face cabinet 302 defining a drying chamber 304 through which forced air can flow to dry fabric items and a drawer 306 slidably mounted to the cabinet 302. The drawer 306 is formed by a drawer frame 308 connected to a drawer front 310. The drawer frame 308 supports a drying rack in the form of a mesh panel 312 that extends across the width and the depth of the drawer frame 308 and is held in place, at least partially, by a grid 314 positioned on top of the mesh panel 312. The drawer 306 is movable relative to the open face of the cabinet 302 between a closed position, as shown in FIG. 92A, where the drawer 306 closes the open face of the cabinet 302 and is received within the drying chamber 304, and an opened position, as illustrated in FIG. 92B, where the drawer 306 extends forwardly from the cabinet 302 so that the user can place fabric items to be dried on the mesh panel 312. Thus, the fabric items arranged on the drawer 306 are received within the drying chamber 304 when the drawer 306 is in the closed position. The user can select a desired drying cycle through a control panel 316 mounted on the cabinet 302 adjacent to the drawer 306. The refreshing and/or sanitizing functions can be incorporated into the drying function double with horizontal module 300 or can replace the drying function, if desired. The drying function single width horizontal module 250 and the drying function double width horizontal module 300 are described in more detail in the aforementioned application Ser. No. 11/322,502, and titled "Non-Tumble Clothes Dryer," which is incorporated above.

The washing function single width horizontal module 1200, the drying function single width horizontal module 1250, and the drying function double width horizontal module 300 comprise some common elements. For example, each of these horizontal modules 1200, 1250, 300 has a cabinet or housing that defines an interior space and a drawer slidable relative to the interior space. The function of the horizontal modules 1200, 1250, 300 is at least partially formed by or carried out by the drawer. These common elements can also be found in at least some of the exemplary vertical modules described below.

FIGS. 93A and 93B illustrate an embodiment of a drying function intermediate height vertical module 350 comprising an open-face cabinet 352 defining a drying chamber 354 through which forced air can flow to dry fabric items and a drawer 356 slidably mounted to the cabinet 352. The drawer 356 is formed by a generally U-shaped drawer frame 358 connected to a drawer front 360. The drawer frame 358 includes at a lower end a pair of side panels 362 that form an open-top cavity 364 sized to receive various items to be dried, such as shoes. The drawer frame 358 further comprises a plurality of paired spaced ledges 366 dimensioned to support one or more drying shelves 368, and the drying shelf 368 of the illustrated embodiment is formed by a frame 370 and a mesh panel 372 through which forced air can flow. In addition to the cavity 364 and the drying shelf 368, items to be dried can be hung on a hanging bar 374, such as on a hanger supported by the hanging bar 374, mounted at an upper end of the drawer frame 358. The drawer 356 further comprises guide rollers 376 positioned on the side panels 362 and sized for receipt within a track 378 formed on the cabinet 352 to facilitate sliding movement of the drawer 356 relative to the cabinet 352. The drawer 356 is movable relative to the open face of the cabinet 352 between a closed position, as shown in FIG. 93A, where the drawer 356 closes the open face of the cabinet 352 and is received within the drying chamber 354, and an opened position, as illustrated in FIG. 93B, where the drawer 356 extends forwardly from the cabinet 352 so that the user can place fabric items to be dried in the drawer 356, such as in the cavity 364, on the drying shelf 368, and on the hanging bar 374. Thus, the items arranged on the drawer 356 are received within the drying chamber 354 when the drawer 356 is in the closed position. The user can select a desired drying cycle through a control panel 380 mounted on the cabinet 352 above the drawer 356. The refreshing and/or sanitizing functions can be incorporated into the drying function intermediate height vertical module 350 or can replace the drying function, if desired.

Adjacent to the control panel 380, the cabinet 352 supports a hanging rod 382 movable between an extended position, as shown in FIG. 93A, where fabric items can be hung from the hanging rod 382, such as on a hanger, and a retracted position, as illustrated in FIG. 93B, where the hanging rod 382 is stored within the cabinet 352. Any type of actuator, such as a push-push type actuator, can be utilized to move the hanging rod 382 between the extended and retracted positions. More details of an example of the hanging rod 382 are provided in the aforementioned application Ser. No. 11/322,503, titled "Retractable Hanging Element," which is incorporated above. Additionally, the cabinet 352 further comprises a top 384 having a depression 386 that can be used to stage a variety of items.

FIGS. 94A and 94B illustrate an embodiment of a stain removal function single height vertical module 400 comprising an open-face cabinet 402, a plurality of vertically juxtaposed drawers 404 slidably mounted to the cabinet 402, and a stain removal assembly 406 mounted at an upper portion of the cabinet 402. According to the illustrated embodiment, the drawers 404 are storage drawers, and each of the drawers 404 is movable between a closed position, as shown in FIG. 94A, where the drawer 404 closes the open face of the cabinet 402, and an opened position, as illustrated in FIG. 94B, where the drawer 404 extends forwardly from the cabinet 402.

The stain removal assembly 406 comprises a basin 408 that forms part of the cabinet 402 and a lid 410 hingedly mounted to the cabinet 402 for selectively covering the basin 408. The basin 408 is adapted to store a container 412 that receives a stain removal agent, such as a detergent or bleach, and a stain removal wand 414 fluidly coupled to the container 412 for dispensing the stain removal agent either alone or in combination with a fluid, such as water or steam. The stain removal assembly 406 further comprises a board drawer 416 slidably mounted to the cabinet 402 above the drawers 404. The board drawer 416 forms a vacuum cavity located beneath a perforated stain removal board 418 and fluidly coupled to a source of vacuum. The stain removal assembly 406 is operable between a storage position, as illustrated in FIG. 94A, where the lid 410 covers the basin 408 and the board drawer 416 is received within the cabinet 402, and a use position, as shown in FIG. 94B, where the lid 410 is opened and the board drawer 416 is slid forwardly from the cabinet 402 such that the stain removal wand 414 can be removed from the basin 408 and utilized on the stain removal board 418. During use, the stained fabric item is placed on the board 418, and the stain removal agent is dispensed onto the fabric item through the stain removal wand 414 and suctioned through the fabric item and the stain removal board 418.

FIGS. 95A and 95B illustrate an embodiment of an ironing function single height vertical module 450 comprising an open-face cabinet 452, a plurality of vertically juxtaposed drawers 454 slidably mounted to the cabinet 452, and an ironing board assembly 456 mounted at an upper portion of the cabinet 452. According to the illustrated embodiment, the drawers 454 are storage drawers, and each of the drawers 454 is movable between a closed position, as shown in FIG. 95A, where the drawer 454 closes the open face of the cabinet 452, and an opened position, as illustrated in FIG. 95B, where the drawer 454 extends forwardly from the cabinet 452.

The ironing board assembly 456 comprises a slidable ironing board support 458 having a platform 460, a front panel 462 hingedly mounted to the platform 460, and an ironing board 464 slidably and rotatably mounted to the platform 460. The ironing board support 458 is movable between a closed position, as shown in FIG. 95A, where the platform 460 and the ironing board 464 are received within the cabinet 452, and an opened position, as illustrated in FIG. 95B, where the platform 460 and the ironing board 464 extend forwardly from the cabinet 452. When the ironing board support 458 is in the opened position, the front panel 462 can be pivoted from a generally vertical position to a generally horizontal orientation, which allows the ironing board 464 to be slid forwardly toward the front panel 462 and rotated one hundred eighty degrees about a generally vertical axis to the position shown in FIG. 95B. In this position, the user can place fabric items to be ironed on the ironing board 464 and utilize an iron, such as a cordless iron 466 mounted in a docking station 468 formed in a top 470 of the cabinet 452, to remove wrinkles. The ironing function single height vertical module 450 is described in more detail in the aforementioned application Ser. No. 11/323,270, titled "Ironing Station," which is incorporated above.

FIGS. 96A and 96B illustrate an embodiment of a sink function single height vertical module 500 comprising an open-face cabinet 502, a pair of vertically juxtaposed drawers 504 slidably mounted to the cabinet 502, a pivoting compartment 506 pivotally mounted to the cabinet 502 above the vertically juxtaposed drawers 504, and a sink assembly 508 mounted at an upper portion of the cabinet 502. According to the illustrated embodiment, the drawers 504 are storage drawers, and each of the drawers 504 is movable between a closed position, as shown in FIG. 96A, where the drawer 504 closes the open face of the cabinet 502, and an opened position, as illustrated in FIG. 96B, where the drawer 504 extends forwardly from the cabinet 502. The pivoting compartment 506 comprises an open-top storage bin 510 mounted to an inside surface thereof. Like the drawers 504, the pivoting compartment 506 is movable between closed and opened positions shown in FIGS. 96A and 96B, respectively, and the bin 510 is accessible when the pivoting compartment 506 is in the opened position.

The sink assembly 508 comprises an open-top basin 512 and a cover or lid 514 movable relative to the cabinet 502 for selectively closing the basin 512. The lid 514 can be operably coupled to the cabinet 502 through a coupling assembly 516 that allows the lid 514 to be lifted up to a generally vertical orientation and slid behind cabinet 502. Alternatively, the lid 514 can be coupled to the cabinet 502 through another type of coupling assembly or can be separate from the cabinet 502 such that the lid 514 can be removed completely from the cabinet 502 when not used to cover the basin 512. The sink assembly 508 further comprises a spout or spigot 518 mounted in the basin 512. The spout 518 is pivotable between a folded position, as shown in phantom in FIG. 96B, where the spout 518 is completely received within the basin 502 so that the lid 514 can close the basin 502, and an unfolded position, as shown in solid lines in FIG. 96B, where the spout 518 projects upwardly from the basin 502 for use. Thus, the sink assembly 508 has a storage position, as depicted in FIG. 96A, where the lid 514 closes the basin 512 and the spout 518 (not visible in FIG. 96A) is folded, and a use position, as illustrated in FIG. 96B, where the lid 514 is removed from the basin 512 and the spout 518 is unfolded. The lid 514 and the spout 518 can be coupled so that when the lid 514 is moved to provide access to the basin 512, the spout 518 automatically pivots out of the basin 512 to the unfolded position, and when the lid 514 is moved to close the basin 512, the spout 518 automatically pivots into the basin 512 to the folded position. The sink assembly 508 can be plumbed into the laundry appliance 1010 in the form of the washing machine or can have independent plumbing. The sink assembly 508 can be used to treat stains on fabric items or to hand-wash or soak delicate fabric items. The sink function single height vertical module 500 is described in more detail in the aforementioned application Ser. No. 11/322,944, titled "Sink Station with Cover," which is incorporated above.

FIGS. 97A and 97B illustrate an embodiment of a storage function single height vertical module 550 comprising an open-face cabinet 552 and a plurality of vertically juxtaposed drawers 554 slidably mounted to the cabinet 552. According to the illustrated embodiment, the drawers 554 are storage drawers, and each of the drawers 554 is movable between a closed position, as shown in FIG. 97A, where the drawer 554 closes the open face of the cabinet 552, and an opened position, as illustrated in FIG. 97B, where the drawer 554 extends forwardly from the cabinet 552. The storage function single height vertical module 550 further comprises a backsplash 556 mounted to a top 558 of the cabinet 552. The backsplash 556 prevents items from falling behind the storage function single height vertical module 550 and, according to one embodiment, has an appearance similar to a backsplash on the laundry appliance 1010 to provide an aesthetically pleasing appearance and to form a generally continuous backsplash when the storage function single height vertical module 550 is positioned adjacent to the laundry appliance 1010.

FIGS. 98A and 98B illustrate another embodiment of a storage function single height vertical module 600 comprising an open-face cabinet 602 and vertically juxtaposed upper and lower drawers 604, 606 slidably mounted to the cabinet 602. Each of the drawers 604, 606 is movable between a closed position, as shown in FIG. 98A, where the drawer 604, 606 closes the open face of the cabinet 602, and an opened position, as illustrated in FIG. 98B, where the drawer 604 extends forwardly from the cabinet 602. The upper drawer 604 is a conventional open-top storage drawer and is illustrated as holding a compartmentalized storage tray 608. The lower drawer 606 comprises a generally U-shaped drawer frame 610 mounted to a drawer front 612. The drawer frame 610 includes a pair of vertically spaced shelves 614 for supporting various items in the lower drawer 606. The storage function single height vertical module 600 further comprises a hanging rod 616 movably mounted to the cabinet 602. As with the hanging rod 382 of the drying function intermediate height vertical module 350, the hanging rod 616 is movable between an extended position, as shown in FIG. 98A, where fabric items can be hung from the hanging rod 616, such as on a hanger, and a retracted position, as illustrated in FIG. 98B, where the hanging rod 616 is stored within the cabinet 602. Any type of actuator, such as a push-push type actuator, can be utilized to move the hanging rod 616 between the extended and retracted positions.

FIGS. 99A and 99B illustrate an embodiment of a storage function single height cabinet module 650 comprising an open-face cabinet 652 defining a storage chamber 654 and a door 656 hingedly mounted to the cabinet 652. The door 656 is movable between a closed position, as shown in FIG. 99A, where the door 656 prevents access to the storage chamber 654, and an opened position, as illustrated in FIG. 99B, to allow access to the storage chamber 654. The cabinet 652 includes spaced pairs of tracks 658 that slidably receive removable shelves, such as a half depth shelf 660 and a full depth shelf 662. Additionally, the cabinet 652 further comprises a top 674 having a depression 676 that can be used for staging. The door 656 supports a peg board 664 having a plurality of holes 666 sized to receive pegs (not shown) of various support items to removably mount the support items to the peg board 664. Examples of the support items include hooks 668, a half width open-top storage unit 670, and a full width open-top storage unit 672. The peg board 664 is located on an inside surface of the door 656; thus, the support items are located in the storage chamber 654 when the door 656 is in the closed position.

FIGS. 100A and 100B illustrate an embodiment of a drying function intermediate height cabinet module 700 comprising an open-face cabinet 702 defining a drying chamber 704 through which forced air can flow to dry fabric items and a pair of doors 706 hingedly mounted to the cabinet 702. The doors 706 are movable between a closed position, as shown in FIG. 100A, where the doors 706 close the drying chamber 704, and an opened position, as illustrated in FIG. 100B, where the doors 706 allow access to the drying chamber 704. The cabinet 702 includes a hanging bar 708 for hanging fabric items, such as by a hanger on the hanging bar 708. Additionally, fabric items can be supported on shelves. In the illustrated embodiment, the cabinet 702 comprises spaced pairs of tracks 710 for slidably mounting a perforated shelf 712 and a mesh shelf 714. Additionally, the cabinet 702 comprises a pair of hingedly mounted perforated shelves 716 that can be pivoted from a generally horizontal position, as shown in FIG. 100B, where the shelves 716 form a substantially continuous shelf, and a generally vertical position (not shown), where the shelves 716 are pivoted away from each other so that the shelves 716 do not interfere with fabric items hung from the hanging bar 708. Forced air can flow through all of the shelves 712, 714, 716. Additionally, the cabinet 702 further comprises a top 718 having a depression 720 that can be used for staging. The doors 706 each support a peg board 722 having a plurality of holes 724 sized to receive pegs of various support items, such as hooks 726, to removably mount the support items to the peg board 722. The peg boards 722 are each located on an inside surface of the respective door 706; thus, the support items are located in the drying chamber 704 when the door 706 is in the closed position. The user can select a desired drying cycle through a control panel 728 mounted on the cabinet 702 above the doors 706. The refreshing and/or sanitizing functions can be incorporated into the drying function intermediate height cabinet module 700 or can replace the drying function, if desired.

FIGS. 101A and 101B illustrate an embodiment of a drying function double height cabinet module 750 comprising an open-face cabinet 752 defining a drying chamber 754 through which forced air can flow to dry fabric items and a door 756 hingedly mounted to the cabinet 752. The door 756 is movable between a closed position, as shown in FIG. 101A, where the door 756 closes the drying chamber 754, and an opened position, as illustrated in FIG. 101B, where the door 756 allows access to the drying chamber 754. The cabinet 752 comprises a top 758 having a depression 760 that can be used for staging. Inside the cabinet 752, several pairs of hingedly mounted perforated shelves 762 similar to the hinged perforated shelves 716 shown with respect to the drying function intermediate cabinet module 700 of FIGS. 101A and 101B can be utilized to support fabric items to be dried. The shelves 762 can be pivoted from a generally horizontal position, as shown in FIG. 101B, where each of the pairs of shelves 762 form a substantially continuous shelf, and a generally vertical position, where the shelves 762 in each pair are pivoted away from each other so that the shelves 762 do not interfere with fabric items hung from a hanging bar in the cabinet 752. Below the shelves 762, the cabinet 752 houses a water reservoir 764 that can be removed to be emptied or filled with water. The water reservoir 764 is fluidly coupled with a steam generator that generates steam from the water in the water reservoir 764 for delivery to a hand-held steam tool 766 fluidly coupled to the steam generator through a hose 768. The steam tool 766 is removably mounted to a steamer tool support 770 located on an inside surface of the door 756. In particular, the steamer tool support 770 is attached to a pivot plate 772 that pivotally mounts a steamer board 774 to the door 756. The steamer board 774 is pivotable between a generally vertical position, as shown in solid lines in FIG. 101B, against the door 756 and an inclined position, as shown in phantom in FIG. 101B, where a lower end of the steamer board 774 is pivoted away from the door 756 such that the steamer board 774 is ergonomically positioned for comfortable hand-steaming of fabric items supported by the steamer board 774. The steamer board 774 can be secured in the inclined position by a movable spacer located at a lower end of the steamer board 774 between the steamer board 774 and the door 756. The user can select a desired drying cycle and control operation of the steam generator through a control panel 776 mounted on an outside surface of the door 756. The refreshing and/or sanitizing functions can be incorporated into the drying function double height cabinet module 750 or can replace the drying function, if desired.

The storage function single height cabinet module 650, the drying function intermediate height cabinet module 700, and the drying function double height cabinet module 750 comprise some common elements. For example, each of these cabinet modules 650, 700, 750 has an open-face housing that defines an interior space and at least one door that selectively closes the open face of the housing. The function of the horizontal modules 1200, 1250, 300 is at least partially formed by or carried out in the interior space and/or the door. Additionally, it is within the scope of the invention for the cabinet modules 650, 700, 750 to comprise a drawer slidably mounted for movement relative to the interior space, as with several of the exemplary horizontal and vertical modules shown in FIGS. 90A-98B.

FIGS. 102A and 102B illustrate an embodiment of one of the modules 1020 having the shelving function. The module 1020 in these figures is a shelving function intermediate height vertical module 800 comprising an open-face cabinet 802 and a pair of horizontally juxtaposed shelves 804 slidably mounted to the cabinet 802. Each of the shelves 804 comprises an upper, shelf portion 806 and a lower, base portion 808. The shelf portion 806 is pivotable between a generally vertical position, as shown in FIG. 102A, where the shelf portion 806 and the base portion 808 are vertically aligned and substantially colinear, and a generally horizontal position, as illustrated in FIG. 102B, where the shelf portion 806 is oriented substantially parallel to the ground and perpendicular to the base portion 808. When the shelf portion 806 is in the vertical position, the shelf 804 can be slid into a retracted position, as illustrated in FIG. 102A, where the shelf 804 is received within the cabinet 802. From the retracted position, the shelf 804 can be slid forwardly from the cabinet 802 to an extended position so that the shelf portion 806 can be pivoted from the vertical position to the horizontal position, as shown in FIG. 102B, so that items can be set upon the shelf portion 806. The shelves 804 can be adapted to slide between the retracted and extended positions independently or together. While the shelving function intermediate height vertical module 800 can be utilized in any suitable configuration with the laundry appliances 1010, the shelving function intermediate height vertical module 800 is especially suited for use between two horizontally arranged laundry appliances 1010 such that the shelf portions 806 can be extended and placed in the horizontal position in front of both of the laundry appliances 1010 (i.e., one of the shelf portions 806 in front of each of the laundry appliances 1010).

The shelving function intermediate height vertical module 800 also incorporates the hanging and storage functions. Similar to the drying function intermediate height vertical module 350 and the storage function single height vertical module 600, the shelving function intermediate height vertical module 800 comprises a hanging rod 810 movably mounted to the cabinet 802 between an extended position, as shown in FIG. 102A, where fabric items can be hung from the hanging rod 810, such as on a hanger, and a retracted position, as illustrated in FIG. 102B, where the hanging rod 810 is stored within the cabinet 802. Any type of actuator, such as a push-push type actuator, can be utilized to move the hanging rod 810 between the extended and retracted positions. Additionally, the hanging function is also carried out by a hanging T-bar 812 mounted to a top 814 of the cabinet 802. The hanging T-bar 812 comprises a post 816 slidably mounted to the top 814, a generally triangular body 818 at an upper end of the post 816, and a generally horizontal bar 820 mounted at a forward end of the body 818. Fabric items can be hung, such as on a hanger, from the bar 820, and the height of the bar 820 relative to the top 814 can be adjusted by sliding the post 816 upward or downward and securing the post 816 in a desired position by a clamp 822. For the storage function, the top 814 forms an open-top cavity 824 that can be used for staging. The shelving function intermediate height vertical module 800 is described in more detail in the aforementioned application Ser. No. 11/323,658, titled "Modular Laundry System with Shelf Module," which is incorporated above.

In addition to the laundry appliances 1010 and the modules 1020, the modular laundry system can incorporate accessories, such as work surfaces. The work surfaces can be positioned on top of one or more of the laundry appliances 1010 or modules 1020 to adapt the top of the laundry appliances 1010 or modules 1020 for the user to perform various tasks or functions. The work surfaces can be rigid or flexible and can include various features. For example, the work surface can include a non-skid surface or can comprise a hygienic material, such as by being made of, impregnated with, or coated with a hygienic material, that kills or prevents proliferation of germs, microbes, fungus, and the like. Examples of the work surfaces are illustrated in FIGS. 103A-105B.

FIGS. 103A and 103B depict an embodiment of a segmented work surface 850 comprising first and second laundry appliance segments 852, 854 and a module segment 856 that can be positioned between the first and second laundry appliance segments 852, 854. The first and second laundry appliance segments 852, 854 are each sized to be positioned on top of the laundry appliance 1010, while the module segment 856 is sized to be positioned on top of the module 1020. Each of the segments 852, 854, 856 comprises a platform 858 and an integral backsplash 860 in which is formed a recess 862 that can be used for staging. The segments 852, 854, 856 further comprise a functional insert 864, such as a mat, which can have a texture corresponding to the type of task or function to be performed on the work surface, that extends across the platform 858. Furthermore, the laundry appliance segments 852, 854 each have a depending flange 866 along one side edge to facilitate positioning the segmented work surface 850 on the laundry appliances 1010 and to prevent lateral movement of the segmented work surface 850 relative to the laundry appliances 1010. The segments 852, 854, 856 each comprise couplers for connecting the segments 852, 854, 856 together to form a generally unitary work surface, as shown in FIG. 103A. The segments 852, 854, 856 can also be separated, as illustrated in FIG. 103B, so that the segmented work surface 850 can be configured according to the laundry appliances 1010 and the modules 1020 used in the modular laundry system. For example, all three of the segments 852, 854, 856 can be employed when the module 1020 is positioned between the laundry appliances 1010, or just the first and second laundry appliance segments 852, 852 can be used if no module 1020 is disposed between the laundry appliances 1010. The segmented work surface 850 is not limited to having three segments; the segmented work surface 850 can include any number of segments having sizes corresponding to the laundry appliances 1010 and the modules 1020 used in the modular laundry system.

FIG. 104 shows an embodiment of another accessory in the form of a single laundry appliance work surface 900 comprising a work surface 902 and a hanging bar assembly 904 supported by a floor mount 906. The work surface 902 is sized to fit on top of one of the laundry appliances 1010 and comprises a work surface platform 908 extending between depending flanges 910. A plurality of open-top cavities 912 located above the flanges 910 at the sides of the work surface platform 908 can be used for staging, and a functional insert 914, such as a mat, which can be textured corresponding to the type of task or function to be performed on the work surface, extends across the work surface platform 908. Furthermore, the work surface 902 forms an elongated opening or aperture 916 along a rear edge to accommodate a backsplash of the laundry appliance 1010. The hanging bar assembly 904 comprises a pair of posts 918, a body 920 mounted at an upper end of each of the posts 918, and a hanging bar 922 extending between the bodies 920. The floor mount 906 comprises a pair of posts 924 that are mounted in a base 926 that rests on the floor. The posts 922 of the floor mount 906 and the posts 918 of the hanging assembly 904 meet at the work surface 902, and the height of the hanging bar 922 can be adjusting by sliding the posts 918 relative to the posts 924 of the floor mount 906. The base 926 includes a pair of feet 928 that can be partially positioned beneath the laundry appliance 1010 when the single laundry appliance work surface 900 is used with the laundry appliance 1010. In other words, the laundry appliance 1010 is received between the feet 928 of the base 926 and the work surface 902.

FIGS. 105A and 105B illustrate another accessory embodiment in the form of a double laundry appliance work surface 950 comprising a work surface assembly 952, a hanging bar assembly 954, and a floor mount 956. The hanging bar assembly 954 and the floor mount 956 are substantially identical to those of the single laundry appliance work surface 950, except that the hanging bar assembly 954 and the floor mount 956 are adapted to fit two of laundry appliances 1010 in a side-by-side arrangement. The work surface assembly 952 comprises a work surface platform 958 extending between depending flanges 960. An integral backsplash 962 with a staging recess 964 is formed along a rear edge of the work surface platform 958. The work surface platform 958 includes a depression 966 sized to receive a removable functional insert 968. The functional insert 968 comprises a first side 970 having a first surface configured for performing a first function on the functional insert 968 and a second side 972 having a second surface different than the first surface and configured for performing a second function on the functional insert 968. For example, one of the first and second sides 970, 972 can be suited for ironing, while the other of the first and second sides 970, 972 can be utilized for cutting fabrics for sewing patterns. The functional insert 968 can be positioned with the first side 970 facing upwards, as shown in FIG. 105A, for performing the first function, or the functional insert 968 can be removed and flipped over, as depicted in FIG. 105B, so that the second side 972 faces upwards for performing the second function.

While the single and double laundry appliance work surfaces 900, 950 have been shown and described as being sized for use with a single laundry appliance 1010 or two side-by-side laundry appliances 1010, the work surfaces 900, 950 can be sized for use with one or more of the modules 1020, more than two of the laundry appliances 1010, or any combination of any quantity of horizontally arranged laundry appliances 1010 and modules 1020. Additionally, the single and double laundry appliance work surfaces 900, 950 have been shown and described as incorporating the hanging function, but it is within the scope of the invention to omit the hanging function for the work surfaces 900, 950.

FIGS. 106A-112B illustrate exemplary implementations of the modular laundry system employing the exemplary modules of FIGS. 90A-102B and the work surface accessories of FIGS. 103A-105B. FIGS. 106A-112B also include the schematics of the core and customized configurations corresponding the implementations of the modular laundry system. The implementations shown in FIGS. 106A-112B are provided for illustrative purposes and are not intended to limit the invention in any manner. Numerous implementations of the modular laundry system can be derived from the laundry appliances 1010 and the modules 1020.

An implementation A 1000 shown in FIG. 106A corresponding to the customized configuration M 1164 of FIG. 86B and reproduced in FIG. 106B comprises the first laundry appliance 1018 in the form of a front-loading washing machine vertically stacked above the washing function single width horizontal module 1200, the second laundry appliance 1019 in the form of a front-loading dryer vertically stacked above the drying function single width horizontal module 1250, and the drying function intermediate height vertical module 350 positioned between the laundry appliances 1018, 1019. The segmented work surface 850 can readily be incorporated into the implementation A 11000, as shown in FIG. 106C.

FIG. 107A shows an implementation B 1002 corresponding to the core configuration B 1102 of FIG. 75 and reproduced in FIG. 107B. The implementation B 1002 comprises the first laundry appliance 1018 in the form of the front-loading washing machine in side-by-side relationship with the second laundry appliance 1019 in the form of the front-loading dryer and the drying function double width horizontal module 300 vertically stacked above the laundry appliances 1018, 1019. The double laundry appliance work surface 950 with the three segments 852, 854, 856 can readily be incorporated into the implementation B 1002, as shown in FIG. 107C.

An implementation C 1004 shown in FIG. 108A corresponding to the customized configuration A 1140 of FIG. 82A and reproduced in FIG. 108B comprises the first laundry appliance 1018 in the form of the front-loading washing machine vertically stacked above the washing function single width horizontal module 1200 and the second laundry appliance 1019 in the form of the front-loading dryer vertically stacked above the drying function single width horizontal module 1250, similar to the implementation A 1000. However, the implementation C 1004 further comprises the storage function single height cabinet module 650 vertically stacked above a storage function single width horizontal module 290. The storage function single height cabinet module 650 and the storage function single width horizontal module 290 are positioned adjacent to the second laundry appliance 1019 and the drying function single width horizontal module 1250, respectively. The storage function single width horizontal module 290 is similar to the washing and drying function single width horizontal modules 1200, 1250 in that it comprises an open-face cabinet (not shown) and a drawer 294, but the drawer 294 is adapted for storage. The single laundry appliance work surface 900 can readily be incorporated into the implementation C 1004, as shown in FIG. 108C.

FIG. 109A shows an implementation D 1006 corresponding to the customized configuration F 1150 of FIG. 84B and reproduced in FIG. 109B. The implementation D 1006 comprises the first laundry appliance 1018 in the form of the front-loading washing machine horizontally arranged with the second laundry appliance 1019 in the form of the front-loading dryer. The first laundry appliance 1018 is vertically stacked above the wash function single width horizontal module 1200, and the second laundry appliance 1019 is vertically stacked above the storage function single width horizontal module 290. The shelving function intermediate height vertical module 800 is positioned between the laundry appliances 1018, 1019, and the drying function intermediate height cabinet module 700 is located adjacent to the second laundry appliance 1019. Although not shown, the work surface accessory can be incorporated into the implementation D 1006.

An implementation E 1008 shown in FIG. 110A corresponding to the core configuration F 1110 of FIG. 78A and reproduced in FIG. 110B comprises the first laundry appliance 1018 in the form of a front-loading washing machine vertically stacked below the second laundry appliance 1019 in the form of a front-loading dryer and the drying function double height cabinet module 750 positioned adjacent to the laundry appliances 1018, 1019.

FIG. 111A illustrates an implementation F 2010 corresponding to the core configuration L 1122 of FIG. 80A and reproduced in FIG. 111B with one of the single height vertical modules 1050 horizontally arranged between the laundry appliances 1018, 1019 and the other of the single height vertical modules 1050 positioned to the right of the second laundry appliance 1019. The implementation F 2010 comprises the first laundry appliance 1018 in the form of a top-loading washing machine with a backsplash horizontally arranged with the second laundry appliance 1019 in the form of a front-loading dryer with a backsplash. The storage function single height vertical module 550 is positioned between the laundry appliances 1018, 1019, and the ironing single height vertical module 450 is located adjacent to the second laundry appliance 1019. The single laundry appliance work surface 900 can readily be incorporated into the implementation F 2010, as shown in FIG. 111C.

An implementation G 2012 shown in FIG. 112A corresponding to the customized configuration E 1148 of FIG. 84A and reproduced in FIG. 112B comprises the first laundry appliance 1018 in the form of the top-loading washing machine horizontally arranged with the second laundry appliance 1019 in the form of the top-loading dryer. The sink function single height vertical module 500 is positioned to the left of the first laundry appliance 1018, and the storage function single height cabinet module 650 is located to the right of the second laundry appliance 1019. Although not shown, the work surface accessory can be incorporated into the implementation G 2012.

Utilization of the modular laundry system can be accomplished in at least two ways: with geometry as a primary driver or with function as a primary driver. In the former case, the configuration of the laundry appliances 1010 and the modules 1020 is initially determined by selecting one of the core configurations A-R 1100-1134 or building any customized configuration from the core configurations A-R 1100-1134. The determination of the configuration can be based on the spatial limitations of the laundry area or a desired overall appearance of the laundry appliances 1010 and the modules 1020. Selecting the core configuration or the customized configuration to spatially optimize the laundry area determines whether the modules 1020 that are to be used with the laundry appliances 1010 of the modular laundry system are the horizontal modules 1030, 1040, 2050, 2060, 2070, the vertical modules 1050, 1060, and/or the cabinet modules 1070, 1080, 1090. Once the module type is known, the user can select particular modules depending on the desired functions for the modules 1020. For example, if the selected configuration is the core configuration A 1100, then the user must select two of the single width horizontal modules 1030, which could be the washing function single width horizontal module 1200 and the drying function single width horizontal module 1250. By utilizing the modular laundry system in this manner, the laundry area can incorporate as much functionality as possible within a given or limited space.

Alternatively, when the laundry area does not have spatial limitations, such as in a large room, when a new home is being designed and built, or when the laundry area is being renovated, function of the modules 1020 can be the primary driver. In this case, the user can select the modules 1020 based on the desired functions and arrange them according to any of the core configurations A-R 1100-1134 or any customized configuration that includes the selected modules 1020. For example, if the user selects the sink and storage functions, then the user identifies the modules 1020 that have these functions, such as the sink function single height vertical module 500 and the storage function single height cabinet module 650. Once the modules 500, 650 having the desired functions are identified, then the modules 500, 650 can be arranged according to the customized configuration E 1148. When function is the primary driver and the laundry area is not limited spatially, the laundry area can include as much functionality as desired, and the modules 1020 that bring the desired functionality to the laundry area can be arranged relative to the laundry appliances 1010 and to each other in an aesthetically pleasing and efficient manner.

Regardless of whether the driver is the geometry or the function, the modular laundry system provides a system for spatially and functionally optimizing the laundry area. By utilizing the core configurations or building upon the core configurations to create the customized configurations and utilizing the modules 1020 having laundry care and non-laundry care functions, the modular laundry system can be employed to provide desired functionality within a given laundry area. Further, the implementations of the modular laundry system bring an aesthetically coherent appearance to the laundry area without sacrificing functionality.

The aesthetically coherent appearance can be enhanced by configuring the laundry appliances 1010 and the modules 1020 in the modular laundry system to have matching designs. When the laundry appliances 1010 and the modules 1020 match one another, not only does the modular laundry system provide an aesthetically pleasing appearance, but a consumer is more likely to purchase multiple items from the modular laundry system to create a coherent appearance in the laundry area rather than purchasing a hodgepodge of gadgets to fulfill their laundry care and non-laundry care functional needs in the laundry area. Various items can be added to the laundry appliances 1010 and the vertical modules 1020 to contribute to the aesthetically coherent appearance. For example, mats having a matching color/pattern and/or texture can be placed on top of the laundry appliances 1010 and the modules 1020. The mats can cover one or more of the laundry appliances 1010 and/or modules 1020.

The modular laundry system can also be adapted to prevent transference of vibration between the laundry appliance 1010 and the module 1020 and/or between adjacent laundry appliances 1010 or adjacent modules 1020. Consequently, vibration caused by operation of one of the laundry appliances 1010 and/or one of the modules 1020 does not transfer to other laundry appliances 1010 and modules 1020 in the modular laundry system. Thus, the other laundry appliances 1010 and modules 1020 remain relatively stationary, and any items supported by the laundry appliances 1010 and the modules 1020 will not shake or fall from the respective laundry appliances 1010 and the modules 1020. The modular laundry system can incorporate any suitable means for damping vibration or preventing transference of vibration. For example, vibration dampening or isolation pads can be positioned between adjacent components of the modular laundry system. The isolation pads can be made of a material, such as rubber, that dampens vibrations. Alternatively, the vibration dampening or isolation pads can be incorporated into the work surfaces, as described in the aforementioned and incorporated patent applications that disclose work surfaces.

As stated above, the modular laundry system comprises at least of the appliances 1010 and at least one of the modules 1020. However, the core configurations A-R 1100-1134 have been shown and described as comprising two of the laundry appliances 1010. It is within the scope of the invention to remove one of the laundry appliances from the core configurations A-R 1100-1134 to result in one of the laundry appliances 1010, except where both of the laundry appliances 1010 are required to vertically support the module 1020. For example, one of the laundry appliances 1010 of the core configuration B 1102 of FIG. 75 cannot be removed if the double width horizontal module 1030 is vertically stacked above the laundry appliances 1010. However, one of the laundry appliances 1010 can be removed if the double width horizontal module 1040 is vertically stacked below the laundry appliances 1010. An example of modifying the core configurations by removing the laundry appliance 1010 is shown in FIG. 113. In FIG. 113, the second laundry appliance 1019 has been removed from the core configuration C 1104 of FIG. 77A to form a modified core configuration C 1190. The modified core configuration C 1190, therefore, comprises the first laundry appliance 1018 horizontally arranged with the single height cabinet module 1070.

Similarly, it is within the scope of the invention to add one or more additional laundry appliances 1010 to the core configurations A-R 1100-1134 to result in three or more of the laundry appliances 1010. When adding one or more additional appliances 1010 to result in three or more of the laundry appliances 1010, the added laundry appliances 1010 can be vertically or horizontally arranged relative to the existing laundry appliances 1010. An example of modifying the core configurations by adding one of the laundry appliances 1010 is shown in FIG. 114. In FIG. 114, a third laundry appliance 1011 stacked with the single width horizontal module 1030 has been added from the core configuration B1102 of FIG. 75 to form a modified core configuration B 1192.

Additionally, it is within the scope of the invention for the modular laundry system to comprise core configurations other than the core configurations A-R 1100-1134. The core configurations can be other configurations comprising two of the laundry appliances 1010, such as the arrangement shown in FIGS. 73A and 73B, comprising only one of the laundry appliances 1010, or comprising more than two of the laundry appliances 1010. An example of a core configuration comprising one of the laundry appliances 1010 is shown schematically in FIG. 115. FIG. 115 illustrates a core configuration S 1136 comprising one of the laundry appliances 1010 and the single height vertical module 1050 horizontally arranged and the intermediate width horizontal module 2060 stacked with the laundry appliance 10 and the single height vertical module 50. FIG. 50 schematically illustrates an example of a core configuration have more than two laundry appliances. A core configuration T 1138 comprises three of the laundry appliances 1010, the first, second, and third laundry appliances 1018, 1019, 1011, horizontally arranged and the greater than double width horizontal module 2070 stacked with the three laundry appliances 1010. Alternatively, at least one or both of the second and third laundry appliances 1019, 1011 can be replaced with the single height vertical module 1050 or the single height cabinet module 1070. Additionally, the greater than double width horizontal module 2070 can be as wide as the collective width of the three laundry appliances 1010, as shown in FIG. 116, or less wide than the collective width.

In the above description of the modules 1020, it was stated that it is within the scope of the invention to add height to the modules 1020 with a base or pedestal so that the modules 1020 conform to the respective height requirements. It is also within the scope of the invention to add a base or pedestal below or above the single height vertical module 1050 to convert the single height vertical module 1050 to the intermediate height vertical module 1060 or the double height vertical module or below or above the single height cabinet module 1070 to convert the single height cabinet module 1070 to the intermediate height cabinet module 1080 or the double height cabinet module 1090. For example, a customized configuration T 1178, which is illustrated schematically in FIG. 117, can be constructed from the core configuration A 1100 of FIG. 74A by adding the single height vertical module 1050 and supporting the single height vertical module 1050 with a base 1180 to raise the height of the single height vertical module 1050 and effectively convert the single height vertical module 1050 to the intermediate height vertical module 1060.

While the invention has been specifically described in connection with certain specific embodiments thereof, it is to be understood that this is by way of illustration and not of limitation, and the scope of the appended claims should be construed as broadly as the prior art will permit.

What is claimed is:

1. A horizontal laundry module supporting a washing machine in an elevated position, the horizontal laundry module comprising:

a cabinet capable of supporting a washing machine thereupon and having an open face, the cabinet having a width and a height which is less than the width and less than a standard washing machine height;

a drawer slidably mounted to the cabinet for movement between an opened and closed position relative to the open face;

an imperforate tub provided within the drawer; and a wash chamber provided within the imperforate tub.

2. The horizontal laundry module according to claim 1 wherein the width is approximately equal to a standard washing machine width.

3. The horizontal laundry module according to claim 1 wherein the height of the cabinet is less than half the standard washing machine height.

4. The horizontal laundry module according to claim 1 wherein the cabinet has a depth that is approximately equal to a standard washing machine depth.

5. The horizontal laundry module according to claim 1 and further comprising a control panel for the selection of a wash cycle.

6. The horizontal laundry module according to claim 5 wherein the control panel is mounted on the drawer.

7. The horizontal laundry module according to claim 6 wherein the control panel is accessible when the drawer is in the opened or closed position.

8. The horizontal laundry module according to claim 1 and further comprising a wash basket supported by the drawer and defining the wash chamber.

9. The horizontal laundry module according to claim 8 wherein the wash basket is rotatably mounted within the imperforate tub.

10. The horizontal laundry module according to claim 8 wherein the imperforate tub defines an upwardly-facing open top.

11. The horizontal laundry module according to claim 1 wherein the wash chamber is inaccessible in the closed position and accessible in the opened position.

12. The horizontal laundry module according to claim 11 wherein the drawer comprises an open top.

13. The horizontal laundry module according to claim 1 and further comprising a detergent dispenser.

14. The horizontal laundry module according to claim 13 wherein the detergent dispenser is supported by the drawer.

15. The horizontal laundry module according to claim 1 wherein the module is a stand-alone unit that does not require physical connection to a washing machine for operation.

16. The horizontal laundry module according to claim 1 wherein the module is configured to be coupled to a washing machine as a requirement for operation of the module.

17. The horizontal laundry module according to claim 1 wherein the module is configured to be coupled to a washing machine to support operation of the washing machine.

18. The horizontal laundry module according to claim 1 wherein the module has a lower capacity for fabric items than a washing machine the cabinet is capable of supporting.

19. The horizontal laundry module according to claim 1 wherein the module comprises a delicate wash cycle.

20. The horizontal laundry module according to claim 1 wherein the height of the cabinet is about 15.5 inches.

21. The horizontal laundry module according to claim 1 wherein the width of the cabinet is about 27 inches.

22. The horizontal laundry module according to claim 1 wherein the horizontal laundry module can be controlled remotely.

23. The horizontal laundry module according to claim 1 further comprising vibration dampening or isolation pads for positioning between the horizontal laundry module and a washing machine the cabinet is capable of supporting.

24. The horizontal laundry module according to claim 23 wherein the vibration dampening or isolation pads are made of rubber.

25. The horizontal laundry module according to claim 1 wherein the horizontal laundry module is a first horizontal laundry module adapted to be part of a modular laundry system that includes:

a front-loading washing machine vertically stacked above the horizontal laundry module;

a front-loading dryer; and a second horizontal laundry module providing a drying function and having a width, a height which is less than the width and less than a height of the dryer, and horizontally arranged relative to the first horizontal laundry module;

wherein the dryer is vertically stacked above the second horizontal laundry module.

26. The horizontal laundry module of claim 25, wherein the second horizontal laundry module providing a drying function comprises:

a cabinet having an open face; and a drawer mounted to the cabinet and defining an open-top drying chamber.

* * * * *